US008602842B2

(12) United States Patent
Duescher

(10) Patent No.: US 8,602,842 B2
(45) Date of Patent: Dec. 10, 2013

(54) THREE-POINT FIXED-SPINDLE FLOATING-PLATEN ABRASIVE SYSTEM

(76) Inventor: Wayne O. Duescher, Roseville, MN (US)

( * ) Notice: Subject to any disclaimer, the term of this patent is extended or adjusted under 35 U.S.C. 154(b) by 745 days.

(21) Appl. No.: 12/799,841

(22) Filed: May 3, 2010

(65) Prior Publication Data

US 2011/0223836 A1 Sep. 15, 2011

Related U.S. Application Data

(63) Continuation-in-part of application No. 12/661,212, filed on Mar. 12, 2010.

(51) Int. Cl.
*B24B 7/22* (2006.01)
*B24B 53/00* (2006.01)

(52) U.S. Cl.
USPC ..... 451/11; 451/5; 451/288

(58) Field of Classification Search
USPC ..... 451/5, 11, 28, 36, 37, 41, 59, 64, 259, 451/260, 270, 271, 280, 283, 285, 288, 287, 451/443, 444, 56
See application file for complete search history.

(56) References Cited

U.S. PATENT DOCUMENTS

| | | | |
|---|---|---|---|
| 1,989,074 | A | 1/1935 | Bullard |
| 2,410,752 | A | 11/1946 | Sells et al. |
| 2,696,067 | A | 12/1954 | Leach |
| 2,973,605 | A | 3/1961 | Carman et al. |
| 2,979,868 | A | 4/1961 | Emeis |
| 3,342,652 | A | 9/1967 | Reisman et al. |
| 3,475,867 | A | 11/1969 | Walsh |
| 3,662,498 | A | 5/1972 | Caspers |
| 4,104,099 | A | 8/1978 | Scherrer |
| 4,165,584 | A | 8/1979 | Scherrer |
| 4,256,535 | A | 3/1981 | Banks |
| 4,315,383 | A | 2/1982 | Day |
| 4,588,473 | A | 5/1986 | Hisatomi et al. |
| 4,593,495 | A | 6/1986 | Kawakami et al. |
| 4,720,938 | A | 1/1988 | Gosis |
| 4,735,679 | A | 4/1988 | Lasky |
| 4,910,155 | A | 3/1990 | Cote et al. |
| 4,918,870 | A | 4/1990 | Torbert et al. |
| 5,014,468 | A | 5/1991 | Ravipati et al. |
| 5,032,544 | A | 7/1991 | Ito et al. |

(Continued)

OTHER PUBLICATIONS

International Search Report from related International Application No. PCT/US2011/028088 (13 sheets).

*Primary Examiner* — Robert Rose
(74) *Attorney, Agent, or Firm* — Mark A. Litman & Associates, P.A.

(57) ABSTRACT

A method and apparatus for releasably attaching flexible abrasive disks to a flat-surfaced platen that floats in three-point abrading contact with three flat-surfaced rotatable fixed-position workpiece spindles that are mounted on a nominally-flat abrading machine base. The spindle-top flat surfaces are precisely co-planar with each other and approximately co-planar with the machine base horizontal surface. The three spindles are positioned to form a triangle of platen supports where the rotational-centers of each of the spindles are positioned at the center of the annular width of the platen abrading-surface. Flat surfaced workpieces are attached to the spindles and the rotating floating-platen abrasive surface contacts the workpieces to perform single-sided abrading on them. The disk abrasive surfaces can be re-flattened by attaching abrasive disk-type components to the three spindles that are rotated while in abrading contact with the rotating abrasive disk. There is no wear of the abrasive-disk protected platen surface.

20 Claims, 47 Drawing Sheets

(56) References Cited

U.S. PATENT DOCUMENTS

| | | | |
|---|---|---|---|
| 5,137,542 | A | 8/1992 | Buchanan et al. |
| 5,191,738 | A | 3/1993 | Nakazato et al. |
| 5,205,082 | A | 4/1993 | Shendon et al. |
| 5,274,960 | A | 1/1994 | Karlsrud |
| 5,314,513 | A | 5/1994 | Miller et al. |
| 5,364,655 | A | 11/1994 | Nakamura et al. |
| 5,422,316 | A | 6/1995 | Desai et al. |
| 5,454,844 | A | 10/1995 | Hibbard et al. |
| 5,456,627 | A | 10/1995 | Jackson et al. |
| 5,538,460 | A | 7/1996 | Onodera |
| 5,569,062 | A | 10/1996 | Karlsrud |
| 5,643,067 | A | 7/1997 | Katsuoka et al. |
| 5,769,697 | A | 6/1998 | Nishio |
| 5,800,254 | A | 9/1998 | Motley et al. |
| 5,833,519 | A | 11/1998 | Moore |
| 5,840,629 | A | 11/1998 | Carpio |
| 5,857,898 | A | 1/1999 | Hiyama et al. |
| 5,860,847 | A | 1/1999 | Sakurai et al. |
| 5,863,306 | A | 1/1999 | Wei et al. |
| 5,882,245 | A | 3/1999 | Popovich et al. |
| 5,910,041 | A | 6/1999 | Duescher |
| 5,916,009 | A | 6/1999 | Izumi et al. |
| 5,938,506 | A | 8/1999 | Fruitman et al. |
| 5,964,651 | A | 10/1999 | Hose |
| 5,967,882 | A | 10/1999 | Duescher |
| 5,972,792 | A | 10/1999 | Hudson |
| 5,975,997 | A | 11/1999 | Minami |
| 5,981,454 | A | 11/1999 | Small |
| 5,989,104 | A | 11/1999 | Kim et al. |
| 5,993,298 | A | 11/1999 | Duescher |
| 6,001,008 | A | 12/1999 | Fujimori et al. |
| 6,007,407 | A | 12/1999 | Rutherford et al. |
| 6,022,266 | A | 2/2000 | Bullard et al. |
| 6,048,254 | A | 4/2000 | Duescher |
| 6,077,153 | A | 6/2000 | Fujita et al. |
| 6,089,959 | A | 7/2000 | Nagahashi |
| 6,102,777 | A | 8/2000 | Duescher et al. |
| 6,120,352 | A | 9/2000 | Duescher |
| 6,139,428 | A | 10/2000 | Drill et al. |
| 6,149,506 | A | 11/2000 | Duescher |
| 6,165,056 | A | 12/2000 | Hayashi et al. |
| 6,168,506 | B1 | 1/2001 | McJunken |
| 6,217,433 | B1 | 4/2001 | Herrman et al. |
| 6,273,786 | B1 | 8/2001 | Chopra et al. |
| 6,371,838 | B1 | 4/2002 | Holzapfel |
| 6,398,906 | B1 | 6/2002 | Kobayashi et al. |
| 6,425,809 | B1 | 7/2002 | Ichimura |
| 6,439,965 | B1 | 8/2002 | Ichino et al. |
| 6,506,105 | B1 | 1/2003 | Kajiwara et al. |
| 6,520,833 | B1 | 2/2003 | Saldana et al. |
| 6,607,157 | B1 | 8/2003 | Duescher |
| 6,632,127 | B1 | 10/2003 | Zimmer et al. |
| 6,652,764 | B1 | 11/2003 | Blalock |
| 6,702,866 | B2 | 3/2004 | Kamboj |
| 6,752,700 | B2 | 6/2004 | Duescher |
| 6,769,969 | B1 | 8/2004 | Duescher |
| 6,786,810 | B2 | 9/2004 | Muilenberg et al. |
| 6,893,332 | B2 | 5/2005 | Castor |
| 6,896,584 | B2 | 5/2005 | Perlov et al. |
| 6,899,603 | B2 | 5/2005 | Homma et al. |
| 6,935,013 | B1 | 8/2005 | Markevitch et al. |
| 7,001,251 | B2 | 2/2006 | Doan et al. |
| 7,008,303 | B2 | 3/2006 | White et al. |
| 7,014,535 | B2 | 3/2006 | Custer et al. |
| 7,029,380 | B2 | 4/2006 | Horiguchi et al. |
| 7,033,251 | B2 | 4/2006 | Elledge |
| 7,044,838 | B2 | 5/2006 | Maloney et al. |
| 7,125,313 | B2 | 10/2006 | Zelenski et al. |
| 7,144,304 | B2 | 12/2006 | Moore |
| 7,147,541 | B2 | 12/2006 | Nagayama et al. |
| 7,166,016 | B1 | 1/2007 | Chen |
| 7,214,125 | B2 | 5/2007 | Sharples et al. |
| 7,250,368 | B2 | 7/2007 | Kida et al. |
| 7,276,446 | B2 | 10/2007 | Robinson et al. |
| 7,357,699 | B2 | 4/2008 | Togawa et al. |
| 7,364,495 | B2 | 4/2008 | Tominaga et al. |
| 7,367,867 | B2 | 5/2008 | Boller |
| 7,393,790 | B2 | 7/2008 | Britt et al. |
| 7,422,634 | B2 | 9/2008 | Powell et al. |
| 7,446,018 | B2 | 11/2008 | Brogan et al. |
| 7,449,124 | B2 | 11/2008 | Webb et al. |
| 7,456,106 | B2 | 11/2008 | Koyata et al. |
| 7,470,169 | B2 | 12/2008 | Taniguchi et al. |
| 7,491,342 | B2 | 2/2009 | Kamiyama et al. |
| 7,507,148 | B2 | 3/2009 | Kitahashi et al. |
| 7,520,800 | B2 | 4/2009 | Duescher |
| 7,527,722 | B2 | 5/2009 | Sharan |
| 7,582,221 | B2 | 9/2009 | Netsu et al. |
| 7,585,425 | B2 | 9/2009 | Ward |
| 7,588,674 | B2 | 9/2009 | Frodis et al. |
| 7,614,939 | B2 | 11/2009 | Tolles et al. |
| 7,632,434 | B2 | 12/2009 | Duescher |
| 7,635,291 | B2 | 12/2009 | Muldowney |
| 7,648,409 | B1 | 1/2010 | Horiguchi et al. |
| 2005/0118939 | A1 | 6/2005 | Duescher |
| 2008/0182413 | A1 | 7/2008 | Menk et al. |
| 2008/0299875 | A1 | 12/2008 | Duescher |
| 2010/0003904 | A1 | 1/2010 | Duescher |

*Fig. 107*
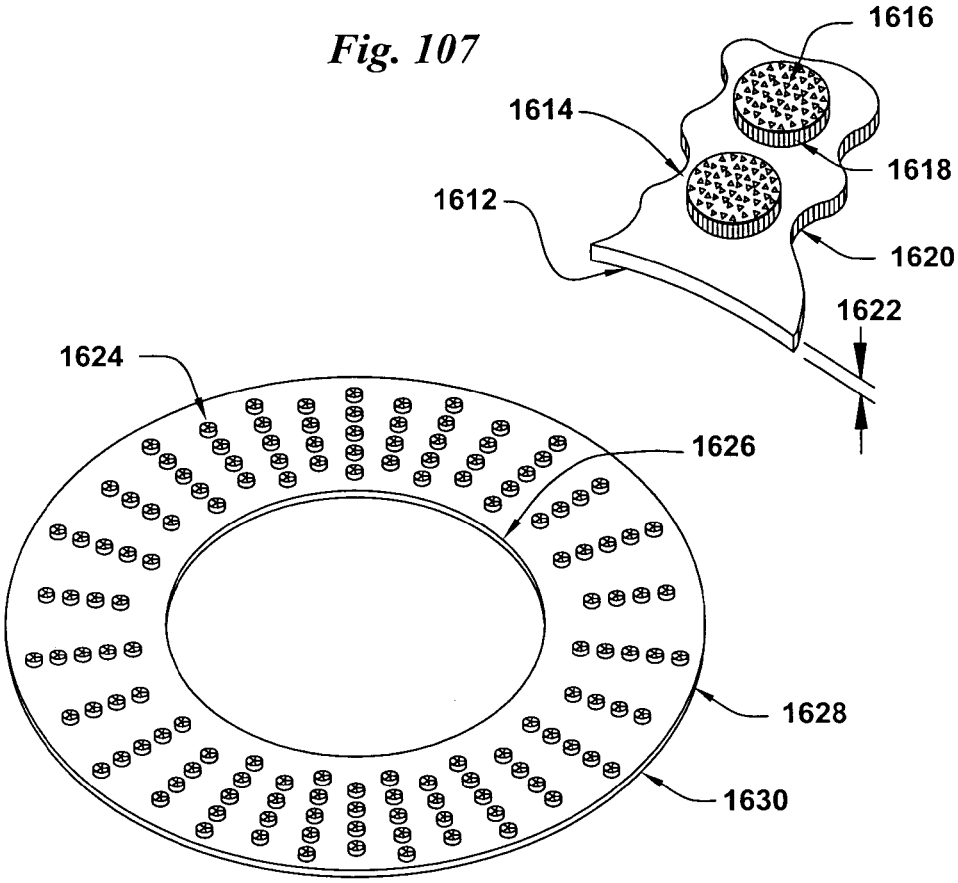
*Fig. 108*
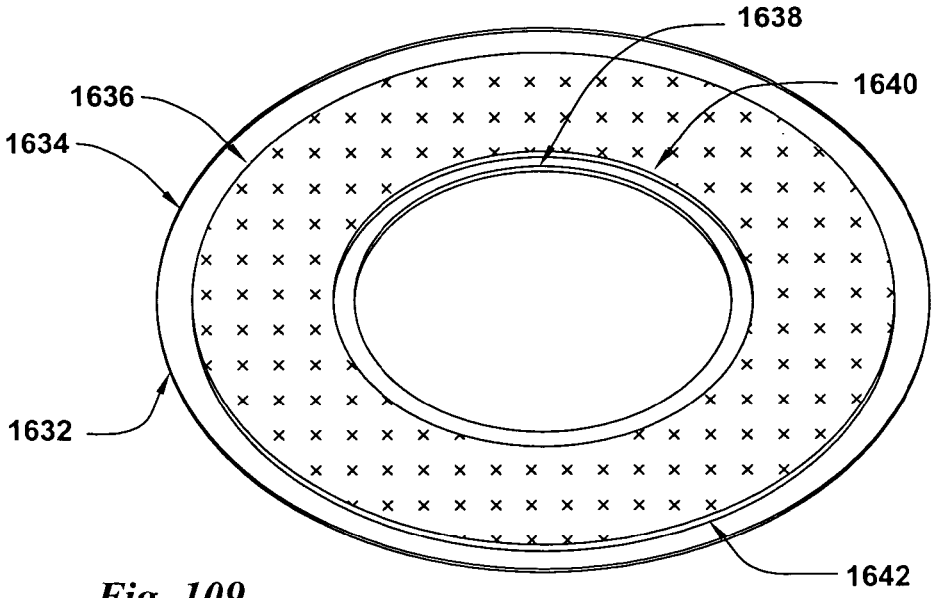
*Fig. 109*

THREE-POINT FIXED-SPINDLE FLOATING-PLATEN ABRASIVE SYSTEM

CROSS REFERENCE TO RELATED APPLICATION

This invention is a continuation-in-part of the U.S. patent application Ser. No. 12/661,212 filed Mar. 12, 2010.

BACKGROUND OF THE INVENTION

Field of the Invention

The present invention relates to the field of abrasive treatment of surfaces such as grinding, polishing and lapping. In particular, the present invention relates to a high speed lapping system that provides simplicity, quality and efficiency to existing lapping technology using multiple floating platens.

Fixed-Spindle-Floating-Platen System

The present invention relates to methods and devices for a single-sided lapping machine that is capable of producing ultra-thin semiconductor wafer workpieces at high abrading speeds. This is done by providing an approximate-flat granite machine base that is used as the primary planar mounting surface datum reference for three rigid flat-surfaced rotatable equal-height workpiece spindles. Flexible abrasive disks having annular bands of fixed-abrasive coated raised islands are attached to a rigid flat-surfaced rotary platen that floats in three-point abrading contact with the three equal-spaced flat-surfaced rotatable workpiece spindles. Water coolant is used with these raised island abrasive disks.

Presently, floating abrasive platens are used in double-sided lapping and double-sided micro-grinding (flat-honing) but the abrading speeds of both of these systems are very low. The upper floating platens used with these systems are positioned in conformal contact with multiple equal-thickness workpieces that are in flat contact with the flat abrading surface of a lower platen. Both the upper and lower abrasive coated platens are typically concentric with each other and they are rotated independent of each other. Often the platens are rotated in opposite directions to minimize the net abrading forces that are applied to the workpieces that are sandwiched between the flat surfaces of the two platens.

In order to compensate for the different abrading speeds that exist at the inner and outer radii of the annular band of abrasive that is on the rotating platens, the workpieces are rotated. The speed of the rotated workpiece reduces the too-fast platen speed at the outer periphery of the platen and increases the too-slow speed at the inner periphery when the platen and the workpiece are both rotated in the same direction. However, if the upper abrasive platen and the lower abrasive platen are rotated in opposite directions, then rotation of the workpieces is favorable to the platen that is rotated in the same direction as the workpiece and unfavorable for the other platen. Here, the speed differential of the rotated workpiece acts against the other platen that is rotated in a direction that is reversed from the workpiece rotation.

Rotation of the workpieces is done with thin gear driven planetary workholder disks that carry the individual workpieces while they are sandwiched between the two platens. Workpieces comprising semiconductor wafers are very thin so the planetary workholders must be even thinner to allow unimpeded abrading contact with both surfaces of the workpieces. The gear teeth on these thin workholder disks that are used to rotate the disks are very fragile, which prevents fast rotation of the workpieces. The resultant slow-rotation workpieces prevent fast abrading speeds of the abrasive platens.

Also, because the workholder disks are fragile, the upper and lower platens are often rotated in opposite directions to minimize the net abrading forces on individual workpieces because a portion of this net abrasive force is applied to the fragile disk-type workholders. It is not practical to abrade very thin workpieces with double-sided platen abrasive systems because the required planetary workholder disks are so fragile.

Multiple workpieces are often slurry lapped using flat-surfaced single-sided platens that are coated with a layer of loose abrasive particles that are in a liquid mixture. Slurry lapping is very slow, and also, very messy.

The platen abrasive surfaces also wear continually during the workpiece abrading action with the result that the platen abrasive surfaces become non-flat. Non-flat platen abrasive surfaces result in non-flat workpiece surfaces. These platen abrasive surfaces must be periodically reconditioned to provide flat workpieces. Conditioning rings are typically placed in abrading contact with the moving abrasive surface to re-establish the planar flatness of the platen annular band of abrasive.

In single-sided lapping, a rigid rotating platen has a coating of abrasive in an annular band on its planar surface. Floating-type workholder spindles hold individual workpieces in flat-surfaced abrading contact with the moving platen abrasive with controlled abrading pressure. The spindles typically have spherical-action devices that rotate the workpieces as they are in abrading contact with the rotating abrasive coated platens.

The fixed-spindle-floating-platen abrading system has many unique features that allow it to provide flat-lapped precision-flat and smoothly-polished thin workpieces at high abrading speeds. Here, the top flat surfaces of the equal-height rotary spindles are in a common plane that is approximately parallel with the granite flat-reference surface. Each of the three rigid spindles is positioned with equal spacing between them to form a triangle of platen spindle-support locations. A rotatable floating platen having a horizontal flat-surfaced annular abrasive surface is positioned above the flat-surfaced spindles that all have horizontal flat surfaces. The rotational-centers of each of the spindles are positioned on the granite so that they are located at the radial center of the annular width of the precision-flat abrading platen surface. Equal-thickness flat-surfaced workpieces are attached to the flat-surfaced tops of each of the spindles. The rigid rotating floating-platen abrasive surface contacts all the workpieces attached to the three rotating spindles to perform single-sided abrading on the exposed surfaces of the workpieces.

The fixed-spindle-floating platen system can be used at high abrading speeds to produce precision-flat and mirror-smooth workpieces at very high production rates. There is no abrasive wear of the platen surface because it is protected by the attached flexible abrasive disks. A minimum of three spindles are used to support the floating platen but more spindles can be added to the three spindles to provide additional workpiece abrading workstations. However, all of the spindle top flat surfaces must be precisely positioned in a common plane.

Fixed-Spindle Floating-Platen System with a Non-Precision-Flat Machine Base

The three-point fixed-spindles can also be attached to the horizontal flat surface of a rigid machine base where the nominally-flat machine base surface is not precisely flat. By precisely aligning all three of the flat-surfaced spindle tops in a common plane, these rotary co-planar spindle tops can be used to perform precision flat lapping or other types of precision abrading. Each of the three workpiece spindles are rigidly mounted to the machine at three spindle mounting legs that form a three-point support of each spindle. These three spindle legs are spaced equal distances around the outer periphery of the stationary rotary-spindle bodies to form a three-point triangle of spindle-support locations. The spindles are rigidly attached to the machine base with threaded fasteners at each of the three spindle legs. Here, the top flat surfaces of the three rigid-body flat-topped spindles are positioned in a common plane by adjusting the elevation heights of each of the three independent three-point support legs that are attached to the periphery of each of the three independent rigid spindle bodies. To precisely align all three spindle top flat surfaces in a common plane, a number of different spindle alignment procedures can be followed. In one spindle alignment procedure, a first of the three spindles is rigidly mounted to the rigid and structurally-stable machine base where the spindle rotatable top portion flat top surface is approximately parallel to the approximately-flat machine base. Height or elevation adjustments are independently made at each of the three spindle legs to allow alignment of the spindle body where the spindle top flat surface is approximately parallel to the machine base top near-flat surface. Shims can be used between each of the three spindle legs and the machine base top surface to achieve this first-spindle non-precision parallel alignment of the spindle top with the machine base top surface.

Then the second of the three-point spindles is aligned with the first spindle by adjusting the height or elevation of each of the three-point spindle legs on the second spindle. As a part of this second-spindle alignment procedure is the rigid attachment of the second-spindle to the flat machine base using the fasteners at each spindle leg. Great care is taken to align the second spindle flat top surface to be precisely co-planar with the flat top surface of the first spindle. Coarse height adjustments are made at each of the second-spindle three-point spindle legs with the use of thin shims between the spindle legs and the machine base surface. Fine height-adjustments are made at each leg by use of a micro-height adjustment technique using spindle legs that can be squeezed horizontally with threaded fasteners to produce extremely small vertical elevation height adjustments that can have height incremental resolutions of only 2 millionths of an inch. Because of the construction of these squeeze-type spindle legs, the height adjustments are structurally stable and can allow a precisely-mounted spindle to be removed from the machine base and then to be re-attached at the same location to re-establish the original co-planar alignment of the second spindle top surface to the first spindle flat top surface.

This precision co-planar alignment of the first and second spindles is completely independent of the localized non-flat defect-type contours of the machine base nominally-flat top horizontal surface. After alignment, the top flat surfaces of the first and the second rotary spindles are precisely co-planar with each other and both the first and second spindles are rigidly attached to the machine base with threaded fasteners. The third of the three-point rotary workpiece spindles is then aligned with the first spindle where its top flat surface is precisely co-planar with the top flat surface of the first spindle. Then the third spindle is then rigidly attached to the machine base with threaded fasteners. All three of the three-point spindles have flat top surfaces that are precisely co-planar with each other. To verify, or improve, this mutual co-planar alignment of the three individual spindles with each other, the co-planar alignment of the second spindle can be measured and adjusted relative to the third spindle. This process of co-planar alignment and co-planar alignment verification can be repeated between different pairs of the three point spindles.

This abrading system can also be used to recondition the surface of the abrasive that is on the platen. This platen annular abrasive surface tends to experience uneven wear across the radial surface of the annular abrasive band after continued abrading contact with the spindle workpieces. When the non-even wear of the abrasive surface becomes excessive and the abrasive can no longer provide precision-flat workpiece surfaces it must be reconditioned to re-establish its planar flatness. Reconditioning the platen abrasive surface can be easily accomplished with this system by attaching equal-thickness abrasive disks to the flat surfaces of the spindles in place of the workpieces. Here, the abrasive surface reconditioning takes place by rotating the spindle abrasive disks while they are in flat-surfaced abrading contact with the rotating platen abrasive annular band.

This fixed-spindle-floating-platen system is particularly suited for flat-lapping large diameter semiconductor wafers. High-value large-sized workpieces such as 12 inch diameter (300 mm) semiconductor wafers can be attached to ultra-precise flat-surfaced air bearing spindles for precision lapping. Commercially available abrading machine components can be easily assembled to construct these lapper machines. Ultra-precise 12 inch diameter air bearing spindles provide flat rotary mounting surfaces for flat workpieces. These spindles provide flatness accuracy of 5 millionths of an inches (or less) during rotation, are very stiff in resisting abrading load deflections and can support loads of 900 lbs. A typical air bearing spindle having a stiffness of 4,000,000 lbs/inch is more resistant to deflections from abrading forces than a spindle having steel roller bearings. The weight of a single 12 inch diameter spindle is typically 130 lbs and the required set of three spindles weighs 390 lbs. Thick-section granite bases that have flat surfaces, structural stiffness and dimensional stability to support these heavy air bearing spindles without distortion are also commercially available. Fluid passageways in the granite bases can allow the circulation of heat transfer fluids that thermally stabilize them to provide long-term dimensional stability of the nominally-flat granite bases. Floating platens having precision-flat planar annular surfaces that are dimensionally stable can also be fabricated or readily purchased.

Use of time-stable nominally-flat lapper machine granite bases that are maintained in a dimensionally stable condition allows the use of the equal-height rigid rotatable workpiece air bearing spindles to provide spindle-top workpiece mounting surfaces that are in a common plane. The multiple workpieces are in abrading contact with a floating rotary platen that also has a precision-flat annular abrading surface. Mounting equal-thickness workpieces on the three spindles provides support for the platen where the platen abrading surface assumes a co-planar location with the common plane of the spindle surfaces. As all the workpieces are simultaneously abraded, they become thinner but retain an equal thickness.

This fixed-spindle-floating-platen system is uniquely capable of providing precision flat lapping of workpieces using rigid lapping machine components at high abrading speeds and high productivity. Because all of the machine components are rigid (including the floating platen), it is required that each abrading component has a precision-flat characteristic. Then, when all of these components are used together, they provide uniform abrading to the surfaces of spindle-mounted workpieces that are simultaneously contacted by a platen planar abrading surface. It is particularly important that all of the individual workpiece surfaces are individually and collectively co-planar with each other. Here, even the raised-island abrasive disks have a uniform precision-thickness over the full annular abrading surface of the disk. This results in both the abrasive surface of the disk and the opposite disk-backing mounting surface being precisely co-planar with each other.

In addition, the flexible raised-island abrasive disks having thin and flexible backings are rigid in a direction that is perpendicular to the disk flat abrading surface. An analogy here is a flexible piece of sheet metal that can be easily flexed out-of-plane but yet provides rigid and stiff load-carrying support for flat-surfaced components that are placed in flat-faced contact with the sheet metal flat surface. Vacuum-attached abrasive disks are flexible so they will conform to the flat surfaces of the platens. The raised-island abrasive disks are constructed from thin but structurally-stiff backing materials and the island structures are also constructed from structurally-stiff construction materials to assure that the abrasive coated island disks are not resilient. The abrasive disks do not distort locally due to abrading forces.

The abrasive disk backing materials are flexible to allow the abrasive disks to conform to the flat abrading surfaces of the platens where the disk can be firmly attached to the platen with vacuum. The disk backings have a continuous and smooth platen-attachment surface that provides an effective seal for the vacuum when the disk is attached to the smooth flat abrading surface of the platen. Abrasive disks can have a continuous backing surface over the full diameter of the disk where the abrasive is coated in an annular band on the disk backing. Also, the abrasive disks can have an annular shape where the disk backing has a open central area at the disk center and the abrasive is coated in an annular shape on the annular backing.

When very thin and flexible abrasive disk backings are used in the construction of large-diameter raised-island abrasive disks, it is possible that these large abrasive disks can be ripped or torn in the event when a sharp-edged workpiece is inadvertently forced at an angle into contact with this somewhat fragile abrasive disk. If the vacuum attachment seal between the disk backing and the platen abrading surface is broken by this disk-cutting action, portions of the ripped disk can lift off the surface of the platen. These extra-thin abrasive disks then can crumple and become wedged between the workpieces and the moving platen surface on high-speed non-floating platen abrading systems. On these open-platen systems, where the platen has a high surface speed, the wedging action of the crumpled disk can quickly apply lifting forces on the workpieces and upon the individual workpiece holder devices that are positioned above the horizontal platen. Because the workpieces are free to travel in a direction that is perpendicular to the platen surface, a gap opening can develop between the workpiece and the platen. Leading-edge portions of the crumpled disk can then enter this gap and the resultant wedge-like event can even increase the workpiece lifting force. Here, the torn abrasive disk that is separated from the platen looses its vacuum attachment bond and the disk no longer rotates with the platen but assumes a stationary-position with the stationary-position workpieces. When that happens, the non-abrasive disk backing skids on the surface of the moving platen. The precision-flat platen abrading surface typically is not affected by these abrasive disk separation events. Abrading system sensors are used to sense the disk separation event and to activate a platen braking system that quickly decelerates the platen to stop its rotation.

When flexible abrasive disks are used with the three-point fixed-spindle floating-platen abrading system, the issue of cutting or tearing the disks is substantially less than with the abrading systems where the workpieces are held in abrading contact with an open-surfaced rotating platen. Any abrasive disk that looses its vacuum attachment with the bottom abrading surface of the platen will tend to fall into the very large open areas that exist between the adjacent three-point workpiece spindles. There is little opportunity for the disks to become wedged between the moving platen and the workpieces, in part, because the workpieces are not free to move vertically away from the platen surface when the workpieces are subjected to forces from a separated abrasive disk. The workpieces are attached to rigidly mounted spindles that do not move away from the surface of the platen when subjected to abrading-event forces. These flat-surfaced workpieces are trapped between the rigid spindle top surfaces and the rigid platen surface where they simply hold the loose abrasive disk at a stationary position while the platen is decelerated to a stop. Because the flat platen surface moves against the smooth non-abrasive surface of the abrasive disk the precision-flat platen abrading surface typically is not affected by these abrasive disk separation events. Abrading system sensors are used to sense the disk separation event and to activate a platen braking system that quickly decelerates the platen to stop its rotation. The sensors also are used to quickly reduce the abrading pressure between the platen and the workpieces.

Also, ripping or tearing of these fragile thin-backing abrasive disks can be easily avoided by simply using increased-thickness backing materials. These thick backings are not vulnerable to tearing when they are subjected to sharp edges of workpieces that are mistakenly directed at angles into the body of the moving abrasive disks. Thick backings can be constructed of polymers or metals or even composite layers of different backing materials. The vacuum provides huge attachment forces that result in the abrasive disk becoming an integral part of the rigid platen structure. The raised-island structures that are attached to the thick and robust backings are ground to have a uniform thickness relative to the backside of the backing before the abrasive coating is applied to the top flat surfaces of the raised island structures. The precision-thickness of the non-coated raised island structures establishes the precision-thickness foundation of the abrasive disks that typically have thin and precision-thickness abrasive coatings. Here, it is as easy to provide thick-backing abrasive disks that have a precision-thickness over the full abrasive surface of the abrasive disks as it is to provide precision-thickness abrasive disks that have thin and fragile backings.

Flexible abrasive disks are attached to the bottom flat annular surfaces of the platens used in the fixed-spindle floating-platen abrading system with vacuum. The vacuum attached abrasive disks that become an integral part of the rigid platen provide rigid abrading surfaces. This system allows disks having different abrasive sizes to be quickly changed. Once an abrasive disk is conformably attached to the platen smooth and flat annular abrading-surface, it will tend to remain attached to the flat platen surface even when the vacuum is interrupted. There is a cohesion-adhesion effect present between the lightweight abrasive disk smooth backing and the smooth platen surface. This abrasive disk cohesion-adhesion effect can be due to multiple sources. Typically there is a very thin water film present on the surface of the platen before a disk is conformable attached. Once the vacuum engages the disk and it becomes an integral part of the platen, the water film then acts as a suction-type disk retention system. This disk attachment effect is so strong that it can even be necessary to peel the disk off the platen surface when the disk is changed. This water-film suction-type attachment technique is often used to attach flat surfaced workpieces such as semiconductor wafers to flat-surfaced rotary spindles for abrading.

Another technique that can be used to separate the disk from the platen is to apply positive air pressure to the platen disk-attachment vacuum port holes. This air pressure will gently break the water-film seal that bonds the abrasive disk to the platen. Here, the loosened abrasive disk will tend to free-fall off the bottom horizontal surface of the platen.

Typically, the platen is allowed to rest on the top surfaces of the spindles when the disk attachment vacuum is turned off for an extended period of time. A stiff flat-plate member having a resilient pad surface can be positioned on top of the three-point spindles before the platen is brought to rest on the spindles. The stiff support plate will provide support of the abrasive disk across the full surface of the disk. Here, the disk will remain in full conformal contact with the platen when the abrading machine is in an at-rest mode with the vacuum shut off.

Also, clip-on abrasive disk support plates can be attached to the platen to retain the abrasive disk in place on the platen. When the abrasive system is restarted, the disk-attachment vacuum is reactivated to bond the disk back onto the platen surface in the same disk-position on the platen as it had before the vacuum was interrupted. Other techniques can be used to enhance the retention of the abrasive disks to the platen. For example, surface-tension enhancement fluids or other cohesion-adhesion agents can be applied to either the abrasive disk backings or the platen attachment surfaces prior to attachment of the disk to the platen. Water-mist sprays, low-tack adhesives sprays, or low-tack films can be applied to the disk backing surfaces. Electro-static charges can also be applied to the disk prior to attachment.

To assure that the flexible abrasive disks are in full conformal contact with the bottom side of large-diameter horizontal platens, the disk can be attached to the platen by "rolling" or progressively lifting it to contact the flat platen abrading surface. Here, one portion of a flexible disk is first brought in contact with the flat platen surface where vacuum engages this contact portion of the disk. Then the remaining portion of the flexible disk is progressively brought into contact with the platen. To concentrate the vacuum attachment capability at the progressive engaging portions of the disks, a thin flexible polymer slider-sheet can be first placed in contact with the platen flat annular surface to seal most of the vacuum attachment port holes that are located in the disk-mounting surface of the platen. As the abrasive disk is "rolled-on" to the platen, the slider-sheet is progressively moved back to expose more vacuum port-holes to the abrasive disk backing. Even very stiff, but flexible, abrasive disks can be installed using this technique. This is a simple and effective procedure of attaching large diameter flexible abrasive disks to the bottom flat annular surfaces of the platens used in the fixed-spindle floating-platen system.

The platen abrasive disks typically have annular bands of fixed-abrasive coated rigid raised-island structures. There is insignificant elastic distortion of the individual raised islands or of the whole thickness of the raised island abrasive disks when they are subjected to typical abrading pressures. These abrasive disks must also be precisely uniform in thickness across the full annular abrading surface of the disk to assure that full-surface abrading takes place over the full flat surface of the workpieces located on the tops of each of the three spindles. The term "precisely" as used herein refers to within ±5 wavelengths planarity and within ±0.01 degrees of perpendicular or parallel, and precisely coplanar means within ±0.01 degrees of parallel and with a standard deviation between planes that does not exceed ±20 microns.

With the fixed-spindle-floating-platen system, there are no resilient or complaint component members n this abrading system that would allow forgiveness of out-of-dimensional-tolerance variations of other of the system components. For example, there is no substantial structural compliance of the platen-mounted abrasive disks to compensate for spindle-to-spindle workpiece surface positional variations. The precision-flat platen abrasive surface must be precisely co-planar with the top exposed surfaces of all three of the rigid-spindle workpieces to provide workpieces that are abraded precisely flat when using these non-resilient abrasive disks. Further, the rigid granite base that the rigid spindles are mounted on does not deflect or elastically distort when the spindles are subjected to typical abrading forces. Likewise, the air bearing workpiece spindles are also extremely stiff and the spindle rotating tops do not experience significant deflection when subjected to the typical abrading forces. The whole fixed-spindle-floating platen system is extremely rigid, but also, has many component surfaces that are precisely co-planar with other of the system component surfaces.

In the present system having flat workpiece surfaces positioned horizontally, there is no vertical movement of the workpiece wafer mounted on one spindle relative to the position of any wafer mounted on any of the other fixed-position rotary workpiece spindles. Here, it is critical that a precision-flat datum reference plane is established on the surfaces of the rotary spindle-tops. When a floating precision-flat platen is brought into abrading face contact with the three spindles, the flat abrading surface of the platen is precisely co-planar with the surfaces of the spindle-tops. Equal-thickness workpieces are attached in flat contact with the flat surfaces of the spindles where the flat abrading surface of the platen contacts the full flat surfaces of the workpieces that are attached to the spindle-tops. Here, the abraded flat surfaces of all three workpieces are also precisely co-planar with the co-planar flat surfaces of the spindle-tops.

During abrading action, both the workpieces and the abrasive platens are rotated simultaneously. Once a floating platen "assumes" a position as it rests conformably upon and is supported by the three spindles, the planar abrasive surface of the platen retains this platen alignment even as the floating platen is rotated. The three-point spindles are located with equal spacing between them circumferentially in alignment with the centerline of the platen annular abrasive. The controlled abrading pressure applied by the abrasive platen to the three individual same-sized and equal-thickness workpieces is evenly distributed to the three workpieces. All three equal-sized workpieces experience the same shared platen-imposed abrading forces and abrading pressures. Semiconductors wafer workpieces can then be lapped where precision-flat and smoothly polished wafer surfaces can be simultaneously produced at all three spindle stations by the fixed-spindle-floating platen abrading system.

Flat-lapped workpieces are typically abraded to a flatness that is 10 to 30, or more, times flatter than the abrading surfaces. This is a surface enhancement magnification process effect where "medium-flat" platen abrasive surfaces can produce "ultra-flat" workpiece surfaces. It is well established that the working surfaces of lapper machines are not provided with flatness equivalent to the flatness of the lapped workpieces. Furthermore, the active abrading lapper machine surfaces are not continuously maintained with the initial machine component flatness during extended abrading operations because they wear during the abrading processes. These platen abrasive surfaces are periodically re-flattened to re-establish their required flatness.

Because the floating-platen and fixed-spindle abrading process is single-sided, very thin workpieces can be attached to the rotatable spindles by vacuum or other attachment means. To provide abrading of the opposite side of the workpiece, it is removed from the spindle, flipped over and abraded with the floating platen. This is a simple two-step procedure. Here, the rotating spindles provide a workpiece surface that remains co-planar with the granite reference surface and the production of workpieces having two opposing non-planar surfaces is avoided. Non-planar workpiece surfaces are often produced by single-sided lapping operations that do not use fixed-position workpiece spindles.

The spindles and the platens can be rotated at very high speeds, particularly with the use of precision-thickness raised-island abrasive disks. These abrading speeds can exceed 10,000 surface feet per minute (SFM). The abrading pressures used are very low because of the extraordinary high material removal rates of superabrasives comprising diamond at high speeds. The abrading pressures are often much less than 1 psi which is a small fraction of the abrading pressures commonly used in abrading. Low abrading pressures result in highly desired low subsurface damage. In addition, low abrading pressures result in lapper machines that have considerably less weight and bulk than conventional abrading machines.

Use of a platen vacuum disk attachment system allows quick set-up changes where different sizes of abrasive particles and different types of abrasive material can be quickly attached to the flat platen surfaces. Also, the use of messy loose-abrasive slurries is avoided by using the fixed-abrasive disks.

A minimum of three evenly-spaced spindles are used to obtain the three-point support of the upper floating platen by contacting the spaced workpieces. However, many more spindles can be used where all of the spindle workpieces are in mutual flat abrading contact with the rotating platen abrasive.

Automated Abrading System

Semiconductor wafers can be easily processed with a fully automated easy-to-operate process that is very practical. Here, individual wafer carriers can be changed on all three spindles with a robotic arm extending through a convenient gap-opening between two adjacent stand-alone wafer spindles.

This three-point fixed-spindle-floating-platen abrading system can also be used for chemical mechanical planarization (CMP) abrading of semiconductor wafers using liquid abrasive slurry mixtures with resilient backed pads attached to the floating platen. These wafers are repetitively abraded on one surface after new semiconductor features are deposited on that surface. This polishing removes undesired surface protuberances from the wafer surface. The system can also be used with CMP-type fixed-abrasive shallow-island abrasive disks that are backed with resilient support pads. These shallow-island abrasives can either be mold-formed on the surface of flexible backings or the shallow-island abrasives can be coated on the backings using gravure-type coating techniques.

Robust and Durable System

The system has the capability to resist large mechanical abrading forces present with abrading processes with unprecedented flatness accuracies and minimum mechanical aberrations. Because the system is comprised of robust components it has a long lifetime with little maintenance even in the harsh abrading environment present with most abrading processes. Air bearing spindles are not prone to failure or degradation and provide a flexible system that is quickly adapted to different polishing processes.

BACKGROUND OF THE INVENTION

Flat lapping of workpiece surfaces to produce precision-flat and mirror smooth polished surfaces at high production rates where the opposing workpiece surfaces are co-planar is required for many high-value parts such as semiconductor wafer and rotary seals. The accuracy of the lapping or abrading process is constantly increased as the workpiece performance, or process requirements, become more demanding. The new workpiece feature tolerances for flatness accuracy, the amount of material removed, the absolute part-thickness and the smoothness of the polish become more progressively more difficult to achieve with existing abrading machines and abrading processes. In addition, it is necessary to reduce the processing costs without sacrificing performance. Also, it is highly desirable to eliminate the use of messy abrasive slurries. Changing the abrading process set-up of most of the present abrading systems to accommodate different sized abrasive particles, different abrasive materials or to match abrasive disk features or the size of the abrasive disks to the workpiece sizes is typically tedious and difficult.

This invention references commonly assigned U.S. Pat. Nos. 5,910,041; 5,967,882; 5,993,298; 6,048,254; 6,102,777; 6,120,352; 6,149,506; 6,607,157; 6,752,700; 6,769,969; 7,632,434 and 7,520,800 and commonly assigned U.S. patent application published numbers 20100003904; 20080299875 and 20050118939 and all contents of which are incorporated herein by reference.

There are many different types of abrading and lapping machines that have evolved over the years. Slurry lapping has been the primary method of providing precision-flat and smoothly polished flat-surfaced workpieces using a liquid mixture of loose abrasive particles that is applied to a flat surfaced rotary platen that is pressed into contact with the rotating workpieces. The platen surface continually wears due to abrading contact with the workpieces and conditioning rings are used periodically or continuously to re-establish the required planar flatness of the platen. Most slurry lapping is single-sided where only the exposed surface of a workpiece is abraded. Double-sided slurry lapping can be done by using two abrading platens that mutually contact both surfaces of the flat workpieces that are sandwiched between the two rotating abrading platens. The upper platen floats to allow conformal contact with the workpieces that are placed in flat contact with the flat surface of the lower platen. Workpieces are rotated with the use of gear-driven planetary workholders where it is required that the workholders geared-disks are thinner than the workpieces. Slurry lapping typically uses low abrading pressure and it is slow and messy. Changing the size of abrasive particles requires that the messy platens have to be thoroughly cleaned before smaller-sized particles are used because a few straggler-type large-sized particles can result in scratches of high-value workpiece surfaces. Abrading processes require that the abrasive sizes be sequentially changed (typically in three steps) to minimize the time required to flatten and polish the surfaces of workpieces.

Micro-grinding (flat-honing) is a double-sided abrading process that uses two abrading platens that mutually contact both surfaces of the flat workpieces that are sandwiched between the two rotating abrading platens. Both the upper and lower platen annular abrading surfaces have a thick layer of fixed-abrasive materials that are bonded to abrasive-wheels, where the abrasive wheels are bolted to the platen surfaces.

The upper platen floats to allow conformal contact with the workpieces that are placed in flat contact with the flat surface of the lower platen. Workpieces are rotated with the use of gear-driven planetary workholders where it is required that the workholders geared-disks are thinner than the workpieces. Micro-grinding is slow and very high abrading pressures are typically used. Changing the abrasive wheels is a time-consuming and complex operation so the abrasive wheels are typically operated for long periods of time before changing. Changing the size of abrasive particles requires that the abrasive wheels have to be changed.

Chemical mechanical planarization (CMP) of workpieces typically use a resilient flat-surfaced pad that is coated with a continuous or periodic flow of liquid slurry that contains loose abrasive particles and specialty chemicals that enhance the abrading characteristics of select workpiece materials. Flat-surfaced workpieces are placed in flat contact with the rotating pads where the workpieces are also typically rotated. The pads often have fiber construction where it has been estimated that only 10% of the individual fiber strands are in abrading contact with the workpiece surface as the workpiece is forced into the surface-depth of the resilient pads. It also has been estimated that 30% of the expensive diamond or other abrasive particles are lost before being utilized for abrading contact with the workpieces. As in slurry lapping, this CMP polishing process is messy. Changing the size of the abrasive particles requires that a new or different pad is used with the new-sized particles. Because the workpieces float on the surface of the resilient pads, the CMP process is a polishing process only. Very small surface protuberances are removed from the flat surfaces of semiconductor wafers but the precision flatness of a wafer can not be established by the CMP process because of the floatation of the wafers on the pad surface.

More recently, fixed-abrasive web material is used for CMP polishing of wafers. The web has shallow-height islands that are attached to a web backing and the abrasive web is incrementally advanced between times of polishing individual wafers held in flat contact with the stationary web. Water containing chemicals is applied to the wafers during the polishing procedure. The abrasive web is typically supported by a semi-rigid polymer surface that is supported by a resilient pad. When the abrasive web is stationary, the wafer is rotated. However, the rotated wafer has a near-zero abrading speed at the rotated wafer center. Because the well-established function of the workpiece material removal rate being directly proportional to the abrading speed, the material removal rate is very high at the outer periphery of the rotating wafer but near-zero at the wafer center. This results in non-uniform abrading of the wafer surface. The fixed-abrasive provides a clean CMP abrading process compared to the messy slurry-pad CMP process.

U.S. Pat. No. 7,614,939 (Tolles et al) describes a CMP polishing machine that uses flexible pads where a conditioner device is used to maintain the abrading characteristic of the pad. Multiple CMP pad stations are used where each station has different sized abrasive particles. U.S. Pat. No. 4,593,495 (Kawakami et al) describes an abrading apparatus that uses planetary workholders. U.S. Pat. No. 4,918,870 (Torbert et al) describes a CMP wafer polishing apparatus where wafers are attached to wafer carriers using vacuum, wax and surface tension using wafer. U.S. Pat. No. 5,205,082 (Shendon et al) describes a CMP wafer polishing apparatus that uses a floating retainer ring. U.S. Pat. No. 6,506,105 (Kajiwara et al) describes a CMP wafer polishing apparatus that uses a CMP with a separate retaining ring and wafer pressure control to minimize over-polishing of wafer peripheral edges. U.S. Pat. No. 6,371,838 (Holzapfel) describes a CMP wafer polishing apparatus that has multiple wafer heads and pad conditioners where the wafers contact a pad attached to a rotating platen. U.S. Pat. No. 6,398,906 (Kobayashi et al) describes a wafer transfer and wafer polishing apparatus. U.S. Pat. No. 7,357,699 (Togawa et al) describes a wafer holding and polishing apparatus and where excessive rounding and polishing of the peripheral edge of wafers occurs. U.S. Pat. No. 7,276,446 (Robinson et al) describes a web-type fixed-abrasive CMP wafer polishing apparatus.

U.S. Pat. No. 6,786,810 (Muilenberg et al) describes a web-type fixed-abrasive CMP article. U.S. Pat. No. 5,014,486 (Ravipati et al) and U.S. Pat. No. 5,863,306 (Wei et al) describe a web-type fixed-abrasive article having shallow-islands of abrasive coated on a web backing using a rotogravure roll to deposit the abrasive islands on the web backing. U.S. Pat. No. 5,314,513 (Milleret al) describes the use of ceria for abrading.

Various abrading machines and abrading processes are described in U.S. Pat. Nos. 1,989,074 (Bullard), 2,410,752 (Sells et al), 2,696,067 (Leach), 2,973,605 (Carman et al), 2,979,868 (Emeis), 3,342,652 (Reisman et al), 3,475,867 (Walsh), 3,662,498 (Caspers), 4,104,099 (Scherrer), 4,165,584 (Scherrer), 4,256,535 (Banks), 4,315,383 (Day), 4,588,473 (Hisatomi et al), 4,720,938 (Gosis), 4,735,679 (Lasky), 4,910,155 (Cote et al), 5,032,544 (Ito et al), 5,137,542 (Buchanan et al), 5,191,738 (Nakazato et al), 5,274,960 (Karlsrud), 5,364,655 (Nakamura et al), 5,422,316 (Desai et al), 5,454,844 (Hibbard et al), 5,456,627 (Jackson et al), 5,538,460 (Onodera), 5,569,062 (Karlsrud), 5,643,067 (Katsuoka et al), 5,769,697 (Nisho), 5,800,254 (Motley et al), 5,833,519 (Moore), 5,840,629 (Carpio), 5,857,898 (Hiyama et al), 5,860,847 (Sakurai et al), 5,882,245 (Popovich et al), 5,916,009 (Izumi et al), 5,938,506 (Fruitman et al), 5,964,651 (Hose), 5,972,792 (Hudson), 5,975,997 (Minami), 5,981,454 (Small), 5,989,104 (Kim et al), 5,916,009 (Izumi et al), 6,007,407 (Rutherford et al), 6,022,266 (Bullard et al), 6,089,959 (Nagahashi), 6,139,428 (Drill et al), 6,165,056 (Hayashi et al), 6,168,506 (McJunken), 6,217,433 (Herrman et al), 6,273,786 (Chopra et al), 6,439,965 (Ichino), 6,520,833 (Saldana et al), 6,632,127 (Zimmer et al), 6,652,764 (Blalock), 6,702,866 (Kamboj), 6,893,332 (Castor), 6,896,584 (Perlov et al), 6,899,603 (Homma et al), 6,935,013 (Markevitch et al), 7,001,251 (Doan et al), 7,008,303 (White et al), 7,014,535 (Custer et al), 7,029,380 (Horiguchi et al), 7,033,251 (Elledge), 7,044,838 (Maloney et al), 7,125,313 (Zelenski et al), 7,144,304 (Moore), 7,147,541 (Nagayama et al), 7,166,016 (Chen), 7,214,125 (Sharples et al), 7,250,368 (Kida et al), 7,364,495 (Tominaga et al), 7,367,867 (Boller), 7,393,790 (Britt et al), 7,422,634 (Powell et al), 7,446,018 (Brogan et al), 7,449,124 (Webb et al), 7,456, 7,527,722 (Sharan), 7,582,221 (Netsu et al), 7,585,425 (Ward), 7,588,674 (Frodis et al), 7,635,291 (Muldowney), 7,648,409 (Horiguchi et al) and in U.S. Patent Application 2008/0182413 (Menk et al).

I. Types of Abrading Contact

The characteristic of workpieces abrasion is highly dependent on the type of contact that is made with an abrasive surface. In one case, the flat (or curved) surface of a rigid platen-type surface is precisely duplicated on a workpiece. This is done by coating the platen with abrasive particles and rubbing the workpiece against the platen. In another case, a rigid moving abrasive surface is guided along a fixed path to abrade the surface of a workpiece. The accuracy of the abrasive guide-rail (or a rotary spindle) determines the accuracy of the abraded workpiece surface. A further case is where workpieces are "floated" in conforming surface-contact with a moving rigid abrasive-coated flat platen. Here, only the high-spot areas of the moving platen contact the workpiece. It is helpful that the abraded surface of the workpiece is typically flatter than the abrading surface of the platen.

For those workpieces requiring ultra-flat surfaces where the amount of material removed in an abrading process is extremely small, it is difficult to provide fixed-path abrading machines having rigid abrasive surfaces that can accomplish this. Out-of-plane variations of the moving abrasive are directly dependent on the variations of the moving abrading machine components. Abrading machines typically are not capable of providing moving abrading surfaces that have variations less than the often-required 1 lightband (0.000011 inches or 11 millionths of an inch) of workpiece flatness. It is much more difficult to create precision-flat and mirror-smooth surfaces on large sized workpieces than small ones.

Most lapping-type of abrading is done on rotary-platen machines that provide smooth continuous abrading motion rather than oscillating-motion machines. However, rotary-motion machines have an inherent flaw in that the abrading speed is high at the outer periphery of the platen and low at the platen center. This change of abrading speed across the surface of the platen results in non-uniform abrading of a workpiece surface. Using annular bands of abrasive on large diameter platens minimizes this problem. However, it is necessary to rotate workpieces while in abrading contact with the platen abrasive to even-out the wear on a workpiece.

Wear-down of the platen abrasives during abrading creates non-flat abrasive surfaces which prevent abrading precision-flat workpiece surfaces. It is necessary to periodically re-flatten the platen abrading surfaces.

For removing small amounts of surface material for workpieces, floatation-type abrading systems are often used. Here, conformal abrading contact provides uniform material removal across the full flat surface of a workpiece. One common-use of floatation-abrading is slurry lapping. Here, a flat platen is surface-coated with a liquid slurry mixture of abrasive particles and a workpiece is held in flat conformal contact with the slurry coated platen. This slurry lapping system can provide workpieces having both precision-flatness across the full workpiece surface and a mirror-smooth polish.

Another abrading system that has "floatation" characteristics is double-sided abrading. Here, equal-thickness workpiece parts are position around the circumference of a lower flat-surfaced abrasive platen. Then another flat-surfaced abrasive platen is placed in conformal contact with the top surface of the distributed workpieces. This upper abrasive platen is allowed to "float" while both abrasive platens are moved relative to the workpieces sandwiched between them.

II. Single-Sided Abrading

Abrading ultra-flat and ultra-smooth workpiece parts requires a sequential series of different abrading techniques. First, rigid-grind techniques are used. Here the, rough-surfaced workpieces are given flat surfaces that are fairly smooth. Then, workpieces are lapped even flatter and smoother. Precision-flat rigid platens are coated with a slurry containing loose abrasive particles are used for lapping. This slurry lapping process can produce workpieces that are much flatter than the platen surfaces. This is a critical achievement because it is not possible to produce and maintain platens that have surfaces that are as desired flatness of the workpieces.

Likewise, it is not possible to provide and maintain lapping machines that rotating workholders that are perfectly perpendicular to a rotary abrasive platen surface. Because of the lack of machine capability, it is not practical to produce workpieces having precisely parallel surfaces using this type of single-sided abrading machines.

III. Double-Sided Abrading

To produce parallel-surfaced workpieces, a different machine technology is used. Here, a large-diameter rigid precision-flat rotating platen is provided. Multiple equal-thickness workpieces are positioned around the circumference of the platen. Then, another large diameter flat-surfaced abrading platen is placed in contact with the top surfaces of the multiple workpieces. Here, the upper platen is allowed to float spherically so its flat surface assumes parallelism with the surface of the bottom platen. Both the upper and bottom platens have equal-diameter abrading surfaces. With this technology, no attempt is made to rigidly position the surface of the upper moving abrasive platen surface precisely perpendicular to the surface of the bottom platen. This co-planar alignment of the two double-sided abrading platens is achieved with ease and simplicity by using the uniform-thickness workpieces as spacers between the two [platens.

Building of complex and expensive rigid-workholder style of machines to abrade precisely co-planar (parallel) workpiece surfaces is avoided by this technique of double-sided abrading. The simple, and less expensive, machines provide an upper platen that floats spherically while rotationally moving in abrading contact with the top surface of the workpieces. Because both workpieces are abraded simultaneously, the workpiece surfaces are precisely co-planar.

IV. CMP Slurry Abrading of Wafers

Floatation-type abrading machines are typically used for abrading workpieces requiring ultra-flat and ultra-smooth workpiece surfaces. For example, high-value semiconductor wafers are constructed from a combination of rigid silicon materials and soft metals. They are often very thin and fragile but have ultra-flat and smooth-polish requirements. Another type of flotation-abrading is used to abrade these wafers after each sequential depositions of material upon the wafer surfaces. This chemical mechanical planarization (CMP) system uses resilient pads that are coated with a liquid slurry mixture containing loose-abrasive particles. Rotating wafers are held in flat abrading contact with the flat moving pad surface. This is considered a "floating" abrading system. Here, the wafers are "plunged" into the surface-depths of the resilient pad where conformal full-surface contact of the wafer is made with the pad surface.

Fixed-abrasive CMP abrading of wafers is also done using thin flexible backings that are coated with shallow-height abrasive islands. These island-backing articles are supported by semi-rigid plates that "float" on a resilient foam pad. The abrasive island backing articles are held stationary while the wafers are rotated while in full-faced contact with the abrasive.

Sequential polishing of semiconductor wafers after each deposition of new materials on the wafer surface requires a completely different abrading technology. The material deposition layers are extremely thin and the wafers are very large in size. It is not possible to construct abrading machines having rigid workholder and rigid abrasive surfaces to remove protrusions (only) from the ultra-thin deposition layers. Instead, a completely different abrading approach is used. First, the wafers are ground or lapped precisely flat. Then, a material layer is deposited on the wafer. A chemical mechanical planarization (CMP) planarization process is used to remove only the unwanted protrusions of this deposited material. Here, the wafer is held face-down, under low pressure, against a non-rigid, abrasive slurry coated resilient foam disk pad. The resilient foam pad provides conformal contact of the pad surface with the flat wafer surface. The pad disk rotates and the workpiece is also rotated to provide abrading speed across the whole surface wafer surface. Loose-abrasive soft ceria particles are mixed in the liquid slurry applied to the pad surface. The pH of the slurry liquid is elevated to soften the surface of the applied wafer deposition material. Abrading the undesired softened protrusions is a very gentile action compared with conventional hard abrasive particle abrading action.

No planarization attempt is made to correct any global non-flat regions of the whole wafer surfaces. Only localized planarization is provided where only individual protrusions are removed.

V. Fixed-Abrasive CMP Wafer Abrading

Fixed-abrasive media is now being used for CMP abrading of wafers. Here, there is no liquid abrasive slurry mess because the abrasive particles are bonded in shallow-height islands on a flexible backing sheet. This fixed abrasive media is in a web-roll form. Sections of the abrasive web are stretched over a semi-rigid flat-surfaced polymer platen. The rigid platen is supported by a resilient foam-type pad. Abrading speed is provided by rotating the wafer while it is in full-face contact with the stationary raised-island abrasive. The abrasive is not moved relative to the wafer. This fixed-abrasive system is different than the abrasive slurry CMP system where relative abrading speed is provided by a moving slurry pad. Water having elevated pH is applied to the abrasive surface.

VI. Raised-Island High Speed Flat Lapping

All of the present precision-flat abrading processes have very slow abrading speeds of about 5 mph. The high speed flat lapping system operates at about 100 mph. Increasing abrading speeds increase the material removal rates. This results in high workpiece production and large cost savings. In addition, those abrading processes that use liquid abrasive slurries are very messy. The fixed-abrasive used in high speed flat lapping eliminates the slurry mess. Another advantage is the quick-change features of the high speed lapper system where abrasive disks can be quickly changed with use of the disk vacuum attachment system. Changing the sized of the abrasive particles on all of the other abrading systems is slow and troublesome. The precision-thickness raised island abrasive disks that are used in high speed flat lapping can also be used for CMP-type abrading, but at lower speeds. These disks can be provided with thick semi-rigid backings that are supported with resilient foam backings.

VII. Abrading Platens

A. Rotary Platens

Rotary platens are used for lapping because it is easy to establish and maintain their moving precision-flat surfaces that support abrasive coatings. The flat abrasive surfaces are replicated on workpieces where non-flat abrasive surfaces result in non-flat workpiece surfaces. Rotary platens also provide the required continuous smooth abrading motion during the lapping operation because they don't reverse direction as does an oscillating system. However, the circular rotary platen annular abrasive bands are curved which means the outer periphery travels faster than the inner periphery. As a result, the material cut-rate is higher at the outside portion of the annular band than the inside. To minimize this radial position cut rate disparity, very large diameter platens are used to accommodate large workpieces.

B. Maintain Abrasive Surface Flatness

To provide precision-flat workpiece surfaces, it is important to maintain the required flatness of annular band of fixed-abrasive coated raised islands during the full abrading life of an abrasive disk. The techniques developed to maintain the abrasive surface flatness are very effective. The primary technique is to use the abraded workpieces themselves to keep the abrasive flat during the lapping process. Here large workpieces (or small workpieces grouped together) are also rotated as they span the radial width of the rotating abrasive band. Another technique uses driven planetary workholders that move workpieces in constant orbital spiral path motions across the abrasive band width. Other techniques include the use of annular abrasive coated conditioning rings. These rings can rotate in stationary positions or be transported by planetary circulation mechanisms. Conditioning rings have been used for years to maintain the flatness of slurry platens that utilize loose abrasive particles. These same types of conditioning rings are also used to periodically re-flatten the fixed-abrasive continuous coated platens used in micro-grinding.

C. No Platen Wear

Unlike slurry lapping, there is no abrasive wear of raised island abrasive disk platens because only the non-abrasive flexible disk backing surface contacts the platen surface. There is no motion of the abrasive disk relative to the platen because the disk is attached to the platen. During lapping, only the top surface of the disk raised island fixed-abrasive has to be kept flat, not the platen surface itself. Here, the precision flatness of the high speed flat lapper system can be completely re-established by simply and quickly changing the abrasive disk. Changing the non-flat fixed abrasive surface of a micro-grinder can not be done quickly because it is a bolted-on integral part of the rotating platen that supports it.

D. Quick-Change Capability

Vacuum is used to quickly attach flexible abrasive disks, having different sized particles, different abrasive materials and different array patterns and styles of raised islands. Each flexible disk conforms to the precision-flat platen surface provide precision-flat planar abrading surfaces. Quick lapping process set-up changes can be made to process a wide variety of workpieces having different materials and shapes with application-selected raised island abrasive disks that are optimized for them individually. Small and medium diameter disks can be stored or shipped flat in layers. Large and very large disks can be rolled and stored or shipped in polymer protective tubes. The abrasive disk quick change capability is especially desirable for laboratory lapping machines but they are also great for prototype lapping and full-scale production lapping machines. This abrasive disk quick-change capability also provides a large advantage over micro-grinding where it is necessary to change-out a worn heavy rigid platen or to replace it with one having different sized particles.

VIII. Hydroplaning of Workpieces

Hydroplaning of workpieces occurs when smooth surfaces (continuous thin-coated abrasive) are in fast-moving contact with a flat surface in the presence of surface water. However, it does not occur when interrupted-surfaces (raised islands) contact a flat wetted workpiece surface. An analogy is the tread lugs on auto tires which are used on rain slicked roads. Tires with lugs grip the road at high speeds while bald smooth-surfaced tires hydroplane.

IX. Maintaining Abrasive Disk Flat Surface

Care is taken during the lapping procedures to maintain the precision flatness of the abrasive surface. This is done by selecting abrasive disks where the full surface of the abrasive is contacted by the workpiece surface. This results in uniform wear-down of the abrasive. Other techniques can also be used to accomplish this. First, a workpiece that is smaller than the radial width of the annular band of abrasive islands can be oscillated radially during the abrading procedure to overlap both the inner and outer edges of the annular abrasive band. This prevents the formation of tangential raised ribs of abrasive inboard and outboard of the wear-track of the workpiece.

Also, stationary-position conditioning rings can be used in flat contact with the moving abrasive. These rings have diameters that are larger than the radial width of the abrasive island annular band. They preferentially remove the undesirable raised abrasive high spot areas or even raised rib-walls of abrasive that extend around the circumference of the annular band of abrasive. The conditioning rings are similar to those used in slurry lapping to continually maintain the flatness of the rotating slurry platen.

Many of the different techniques used here to maintain the flatness of annular band of fixed-abrasive coated raised islands during the abrading life of an abrasive disk are highly developed and in common use in slurry lapping. In slurry lapping, a liquid mixture that contains loose abrasive particles continuously wears recessed circumferential tracks in the rigid metal platen surface. However, unlike slurry lapping, there is no abrasive wear of the high speed flat lapper platens because only the flexible disk backing contacts the platen surface. Here, the precision flatness of the high speed flat lapper system is re-established by simply changing the abrasive disk.

Another method of maintaining the planar flatness of both the upper and lower abrasive platens used in double-sided lapping is to translate the upper platen radially relative to the lower platen during the recondition process. Instead of the upper and lower platens being held in a concentric position during the flatness reconditioning process, the upper platen is moved to where they are not concentric. The amount of radial motion required is limited because the radial width of the annular band of abrasive is small relative to the platen diameters. Radial off-setting of the platens takes place but the floating upper platen is still allowed to maintain its flat conformal contact with the lower platen surface. Abrading mutually takes place on both abrasive platen surfaces as both the platens are rotated. This platen surface abrading action allows abrasive from one platen to travel cross-width relative to the abrasive on the opposing platen.

Off-set abrading action prevents tangential out-of-plane faults on one platen abrasive surface being transferred to the abrading surface of the opposite platen when the two platen surfaces are reconditioned while they are concentric. The upper platen off-set can be stationary or the upper platen can be oscillated relative to the lower platen during the reconditioning event.

Because the upper platen uses a spherical bearing that allows the platen to float, the platen holding mechanism can be a simple pivot arm device. The platen spherical-action bearing provides radial support for the platen during rotation so the platen retains its balance even when it is operated at great speeds. Conformal flat contact of the two platens prevents wobble of the upper platen as it is rotated. It is not necessary that the pivot arm position the upper platen in a precision concentric alignment with the lower platen during a double-sided lapping operation.

X. Raised Island Disks

The reason that this lapping system can be operated at such high speeds is due to the use of precision-thickness abrasive coated raised island disks. Moving abrasive disks are surface cooled with water to prevent overheating of both the workpiece and the abrasive particles. Raised islands prevent hydroplaning of the stationary workpieces that are in flat conformal contact with water wetted abrasive that moves at very high speeds. Abrading speeds are often in excess of 100 mph. Hydroplaning occurs with conventional non-island continuous-coated lapping film disks where a high pressure water film is developed in the gap between the flat workpiece and the flat abrasive surfaces.

During hydroplaning, the workpiece is pushed up away from the abrasive by the high pressure water and also, the workpiece is tilted. These cause undesirable non-flat workpiece surfaces. The non-flat workpieces are typically polished smooth because of the small size of the abrasive particles. However, flat-lapped workpieces require surfaces that are both precision-flat and smoothly polished.

The islands have an analogy in the tread lugs on auto tires which are used on rain slicked roads. Tires with lugs grip the road at high speeds while bald tires hydroplane. Conventional continuous-coated lapping film disks are analogous to the bald tires.

Raised islands also reduce "stiction" forces that tend to bond a flat surfaced workpiece to a water wetted flat-surfaced abrasive surface. High stiction forces require that large forces are applied to a workpiece when the contacting abrasive moves at great speeds relative to the stationary workpiece. These stiction forces tend to tilt the workpiece, resulting in non-flat workpiece surfaces. A direct analogy is the large attachment forces that exist between two water-wetted flat plates that are in conformal contact with each other. It is difficult to slide one plate relative to the other. Also, it is difficult to "pry" one plate away from the other. Raised island have recessed channel passageways between the island structures. The continuous film of coolant water that is attached to the workpiece is broken up by these island passageways. Breaking up the continuous water film substantially reduces the stiction.

XI. Precision Thickness Disks

Another reason that this lapping system can be operated at such high speeds is due to the use of precision-thickness abrasive coated raised island disks. These disks have an array of raised islands arranged in an annular band on a disk backing. To be successfully used for high speed lapping, the overall thickness of the abrasive disks, measured from the top surface of the exposed abrasive to the bottom mounting surface of the disk backing must be uniform across the full disk-abrasive surface with a standard deviation in thickness of less than 0.0001 inches. The top flat surfaces of the islands are coated with a very thin coating of abrasive. The abrasive coating consists of a monolayer of 0.002 inch beads that typically contain very small 3 micron (0.0001 inch) or submicron diamond abrasive particles. Raised island abrasive disks are attached with vacuum to ultra-flat platens that rotate at very high abrading surface speeds, often in excess of 100 mph.

The abrasive disks have to be of a uniform thickness over the full abrading surface of the disk for three primary reasons. The first reason is to present all of the disk abrasive in flat abrading contact with the flat workpiece surface. This is necessary to provide uniform abrading action over the full surface of the workpiece. If only localized "high spots" abrasive surfaces contact a workpiece, undesirable tracks or gouges will be abraded into the workpiece surface. The second reason is to allow all of the expensive diamond abrasive particles contained in the beads to be fully utilized. Again if only localized "high spots" abrasive surfaces contact a workpiece, those abrasive particles located in "low spots" will not contact the workpiece surface. Those abrasive beads that do not have abrading contact with a workpiece will not be utilized. Because the typical flatness of a lapped workpiece are measured in millionths of an inch, the allowable thickness variation of an raised island abrasive disk to provide uniform abrasive contact must also have extra-ordinary accuracy.

The third reason is to prevent fast moving uneven "high spot" abrasive surfaces from providing vibration excitation of the workpiece that "bump" the workpiece up and away from contact with the flat abrasive surface. Because the abrasive disks rotate at such high speeds and the workpieces are lightweight, these moving bumps tend to repetitively drive the workpiece up after which it falls down again with only occasional contact with the moving abrasive. The result is uneven wear of the workpiece surface.

All three of these reasons are unique to high speed flat lapping. The abrading problems, and solutions described here were progressively originated while developing this total lapping system. They were not known or addressed by others who had developed raised island abrasive disks. Because of that, their disks can not be used for high speed flat lapping.

XII. Abrading Pressure

Abrading pressures used are typically a small fraction of that used in traditional abrading processes. This is because of the extraordinary cutting rates of the diamond abrasive at the very high abrading speeds. Often abrading pressures of less than 0.2 psi can be used in high speed flat lapping. These low pressures have a very beneficial effect as they result in very small amounts of subsurface damage of workpiece materials that is typically caused by the abrasive material.

XIII. Annular Band of Abrasive

The raised abrasive islands are located only in an annular band that is positioned at the outer periphery of the disk. Problems associated with the uneven wear-down of abrasives located at the inner radius of a disk are minimized. Also, the uneven cutting rates of abrasives across the abrasive surface due to low abrading speeds at the innermost disk are minimized. Equalized cutting rates across the radial width of the annular band occur because the localized abrading speeds at the inner and outer radii of the annular abrasive band are equalized.

The abrasive islands are constructed in annular bands on a flexible backing. The disks are not produced from continuous abrasive coated webs is not used because the presence of abrasive material at the innermost locations on a disk are harmful to high speed flat lapping. In addition, there are no economic losses associated with the lack of utilization of expensive diamond particles located at the undesirable innermost radii of an abrasive disk.

XIV. Initial Platen Flatness

The best flatness that is practical to achieve for a new (or reconditioned) slurry platen having a medium platen diameter is about 0.0001 inches. It is even more difficult to achieve this flatness for large diameter platens. These are platen flatness accuracies that are achieved immediately after a platen is initially flattened. This process is usually done with great care and requires great skill and effort. To better appreciate the small size of this 0.0001 inch allowable platen variation, a human hair has a diameter of about 0.004 inches and a sheet of copier paper is also about 0.004 inches thick. Attaining a flatness variation of 0.0001 inches is difficult for a medium 12 inch diameter platen, more difficult for a large 6 foot platen and extremely difficult for huge platens that exceed 30 feet in diameter.

The vertical distance that a typical outer periphery deviates from the platen planar surface far exceeds the size of a sub-micron abrasive particle. To appreciate the relative difference between platen flatness deviation dimensions and the abrasive particle sizes, a comparison is made here. Typically a new (or reconditioned) platen is flattened to within 0.0001 inches total variation of the platen plane. This is roughly equivalent to the size of a 3 micron abrasive particle. It is also approximately equal to 10 helium lightbands of flatness. These dimensions are so small that optical refraction devices are used to measure flatness variations in lightbands. It is difficult to accurately make these small measurements using conventional mechanical measuring devices. The out-of-plane platen flatness is even worse when compared to sub-micron sized abrasive particles. For instance, a typical 0.3 micron particle is only one tenth the size of a 3 micron particle. Even the typical non-worn platen flatness variations are grossly larger than the size of the sub-micron particles that are required to produce mirror-smooth polishes.

XV. Continual Wear of Platen Surface

Even though a platen can initially have a precision-flat planar surface, this surface is constantly subjected to uneven wear. The platen uneven wear is caused primarily by the variation of the abrading speeds across the radial surface of the rotating platen. Abrading speeds are higher at the outer periphery of a circular rotating platen than they are at the inner radial location due to the greater circumference at the outer periphery. Higher abrading speeds mean higher wear. This results in continual higher wear of the platen at the outer periphery. The worn outer periphery area then develops an annular band that is lower than the plane of the overall platen surface. This out-of-plane platen wear is caused primarily by the loose abrasive particles, not the imbedded particles.

XVI. Platen Wear Effect on Workpiece

As a platen is subjected to uneven wear only the high-spot areas of a rotating platen are in abrading contact with a flat workpiece surface. More uneven platen wear means that uneven workpiece material removal becomes more pronounced.

XVII. Conditioning Rings

In addition, a conditioning ring can make flat abrading contact with the annular abrasive band to periodically dress the full radial and tangential surface of the abrasive band into a precision plane. These conditioning rings are the same as used for slurry lapping. For slurry lapping, they prevent abrading an annular groove in the rotating platen surface. For high speed raised island disks, they prevent abrading an annular groove in the planar abrasive surface.

XVIII. Raised Island Disk Features

A. Precision Thickness Abrasive Disks

The abrasive disks that are used to produce a flat lapped workpiece generally are used in sets of three. The first disk uses a coarse abrasive to initially flatten a rough surfaced workpiece. The second disk uses a medium abrasive to develop a smooth surface while retaining the flatness. The third disk has very small abrasive particles to generate the polished surface, again while retaining the surface flatness. The abrasive disks are used sequentially on the lapper machine and the sequence is repeated until the abrasive disks are worn out. Typical disks have very long lives because of the long life of the abrasive beads that are filled with diamond particles.

Because the flatness of a workpiece is directly related to the flatness of the abrasive disk, it is critical that new disks have a precision thickness across the full surface of the disk. Each disk must be manufactured with a uniform thickness across the surface of the abrasive islands that typically has a thickness variation that is less than 0.0001 inches to assure that the disk can be used satisfactorily to produce flat lapped workpiece parts. This disk thickness accuracy is required for the high speed abrasive disks used in this operation and is not available with traditional raised island abrasive disks.

One simple method to manufacture raised island abrasive disks that have the required disk thickness is to produce polymer disk backings that have annular bands patterns of raised island structures attached to the backing. Then the island top surfaces are ground to have the same precision height from the backside of the backing. A mixture of abrasive beads, a solvent and an adhesive provides a mixture that has a uniform distribution of the beads in the adhesive mixture. This mixture is applied to the top flat surface of the islands to form a monolayer of abrasive beads. After partial drying of the adhesive which tends to "skin-over", the tops of the individual beads can be pressed into a common plane that is parallel to the backside of the disk backing. This assures that all the individual abrasive beads are utilized in the abrading procedures. Also, the abrasive disk now has a precision thickness across the whole abrasive surface of the abrasive. The nominal thickness of the abrasive disk is relatively unimportant as a a workpiece is simply lowered to contact the abrasive. It is primarily the precision thickness control of the disk that is important.

It is desirable that the inner diameter of the annular abrasive band is greater than approximately 50% of the outer diameter of the annular band to equalize the abrading surface speeds across the radial width of the band. Each high speed abrasive disk has an annular band of abrasive coated raised islands to provide abrading speeds that are approximately constant across the radial width of the annular abrasive. Typically, the width of the workpiece is approximately equal to the radial width of the annular abrasive band to assure that the abrasive is worn down evenly during the abrading process. When large workpieces are abraded, then the annular width of the abrasive disk has to be equally large.

The abrasive disks are flexible to conform to the flat surface of a rotary platen. The disk backing is typically made from a polymer sheet having a thickness of less than 0.005 inches. The bottom mounting surface of the backing is smooth and continuous to provide a vacuum seal when the disk is mounted to a flat platen. It is preferred that the disks are used on flat surfaced rotary platens.

B. Thickness Related to Disk Diameter

Small diameter abrasive disks having low-height raised islands can be moderately thin and use polymer backings. Large diameter disks require thicker backings for abrading durability and for handling and storage. Thick, but flexible disks are easier to attach to large diameter platens than are thin disks.

C. Thickness Related to Island Heights

Thicker backings are required for disks having raised island structures that protrude substantially from the top surface of the backing but have small footprints. Abrading forces apply tipping torques to these tall islands. Thick backings are useful in resisting these torque forces. Also, composite laminated backings are used to provide structural support to these small-surface area (but tall) islands. Increasing the backing thickness and the island height both increase the overall abrasive disk thickness.

D. Heavy-Duty Abrasive Disks

The laminated heavy-duty disks that have raised islands coated with thick layers of abrasive material are thicker than the disks that only have monolayers of abrasive beads. The laminated backings can be constructed of multiple layers of different materials including polymers, metal and fiber mats. These backings can be quite thick. Also, the individual abrasive coated island structures can be substantial in height. The thickness of the disks measured from the island top surfaces to the bottom of the backing is precisely controlled over the whole annular abrasive band.

E. Abrasive Disk Uniform Wear-Down

It is also critical that the abrasive disk is worn-down uniformly across the abrasive surface to maintain the flatness of the disk over its full abrading life. When an abrasive disk wears down uniformly across that full annular area the precision thickness of the disk is maintained. This uniform wear-down of the abrasive is accomplished by matching the width of the disk annular radial width to the flat cross sectional size of the workpiece. Here the full annular width of the abrasive disk is contacted by the workpiece during an abrading operation to assure that abrasive experiences uniform wear.

XIX. Size of Island Disks

A. Typical Disk Size

The disks typically have a 12 inch diameter when small sized workpieces are lapped. The raised island abrasive is located in an annular band where the radial width of the annular band is approximately equal to the diameter (or size) of a workpiece. Large diameter abrasive disks are required for large diameter workpieces. For example, a 300 mm (12 inch) diameter semiconductor workpiece requires an abrasive disk that exceeds 48 inches or 4 feet to provide an annular abrasive band that is 12 inches wide. Having the abrasive disk central 24 inch diameter free of abrasive assures that the abrading surface speed of the abrasive at the inner diameter of the annular band is not substantially different than the abrading surface speed at the outer diameter. The closer the outer and inner diameters of the annular band are to each other, the rotational speed of the workpiece required to even-out the abrading speed across the abrasive annular band is reduced. It is desired to minimize the rotational speed of the workpieces to minimize balancing problems. Un-balanced workpieces rotating at great seeds can cause wobbling which results in non-flat lapped surfaces. It is practical to balance the workpieces which allows them to be rotated at high speeds without wobbling.

Some abrasive disks can be huge. For instance 144 inch (12 feet) diameter disks are the size of a small room. These disks are used to flat lap 300 mm (12 inch) diameter semiconductors.

XX. Heavy Duty Raised Island Disks

A. Disks Replace Micro-Grinding Wheels

Abrasive systems using heavy-duty versions of flexible raised-island abrasive disks can be used to replace the micro-grinding (flat-honing) systems that use rigid metal abrasive-wheels. These heavy-duty flexible abrasive disks are used for aggressive workpiece material removal and for long-life abrading usage. The flexible disks have flat-surfaced raised-islands. Each island has thick layers of abrasive-bead material which allows long term usage of the disk before the disk abrasive wears out. Flexible heavy-duty disks can also have abrasive pellet islands that are attached to durable disk backings. The abrasive coated raised-islands are positioned in array patterns that form annular bands of abrasive around the circumference of the disks.

Quick changing of these heavy-duty disks allows fast set-up changes to be made to the abrading system. Vacuum is used to quickly attach these flexible raised-island disks to rigid flat-surfaced platens. Here, utilization of a wide range of abrasive particle sizes and abrasive particle materials (including diamond, CBN and aluminum oxide) can be made with ease. Rigid micro-grinding abrasive-wheels can not be quickly changed without great difficulty. In addition, the flexible heavy-duty disks are lightweight and easy to handle compared to the massive flat-surfaced heavy metal abrasive-wheels used in micro-grinding.

When changing a micro-grinder abrasive-wheel, localized abrasive surface distortions can occur when the abrasive-wheels are bolted on to platens. These surface distortions originate at the individual mounting-bolt areas and are caused by tightening the mounting bolts. Undesired planar-flatness distortions of only 0.0001 inches can affect the performance of an abrading surface when flat-lapping workpieces. The vacuum hold-down forces of the flexible heavy-duty raised-island disks are spread uniformly across the whole flat surface of the platen and these forces do not distort the platen surface.

Advantages of using these flexible heavy-duty disks include quick-change set-ups, high abrading speeds, low abrading pressures, high productivity, low workpiece polishing costs, great water cooling action, precision-flat and mirror-smooth workpieces (due to the very small particles in the abrasive beads). Because high abrading speeds are used with these heavy-duty raised island disks, the abrading contact forces are just a fraction of those used in micro-grinding. Instead of having "brute-force" workpiece material removal by slow-speed micro-grinding, the high-speed disks provide "delicate-force" abrading contact but also, high material removal rates. These lesser abrading forces result in smaller forces on the island structures. These smaller abrading forces allows flexible (but durable) backings to be used in place of the rigid metal abrasive-wheels used in the micro-grinding. Also, smaller abrading forces result in less subsurface damage of brittle workpieces.

B. Thick Abrasive Layers on Islands

The thick abrasive layers on the island flat top surfaces can be produced by a number of different methods. First, small diameter beads can be mixed with an adhesive and coated on the island tops where many layers of the small beads are stacked on top of each other. Second, very large sized abrasive beads can be coated in monolayers on the island tops. Third, vitrified abrasive island pellets can be adhesively bonded o to a flexible backing. The erodibility of these stacked ceramic abrasive beads is similar to the erodibility of the thick layers of abrasive particles contained in the vitrified abrasive pellets.

C. Abrasive Pellets Attached to Backings

Fused or vitrified flat-surfaced composite abrasive island pellets can be strongly bonded with adhesive to a flexible backing to produce flexible heavy-duty abrasive raised island disks. Open recessed-passageways are provided between each of the pellet island structures. These passageways provide channels for excess coolant water which prevents hydroplaning of the workpieces when the disks are rotated at high abrading speeds. Even though the individual vitrified abrasive pellets are rigid, the backing material located in the recessed areas between the individual island structures is flexible. Because the inter-island backing is flexible, the overall abrasive disk is flexible. Here, the flexible island disks will conform to the flat planar surface of rotary platens, which allows the disks to be robustly attached to the platens with vacuum.

To provide heavy-duty abrasive raised-island pellet disks having a planar abrasive surface that is precisely co-planar with the bottom mounting surface of the backing, special and simple production steps can be taken. First, if the top abrasive surfaces of the pellets are not sealed adequately to hold a vacuum, an adhesive tape can be applied to the top flat surface of each of the individual pellets. Second, the tape-covered pellet islands can be temporarily attached to the flat surface of a first precision-flat platen by vacuum. Individual pellet islands are positioned to have gaps between adjacent islands. They are also arranged to form annular abrasive bands on the platen. Third, a flexible backing can be attached to another precision-flat platen with vacuum. Fourth, an adhesive is applied to the bottom of the exposed surface of the individual pellet bases. Fifth, the first platen holding the pellets is positioned with gap spacers that provide a precision fixed distance from the first platen to the platen holding the backing. As the first pellet platen is lowered to rest on the spacers, the pellet-base adhesive contacts the backing surface. When, the adhesive solidifies, the first platen is then separated from the pellets by interrupting the vacuum, leaving the abrasive pellets attached to the backing with adhesive.

The top flat surface of all of the individual abrasive pellets is now precisely co-planar to the bottom mounting surface of the abrasive disk backing. The adhesive tape (if used) is removed from the pellet island surfaces to expose the pellet abrasive particles. The pellet-type heavy-duty raised-island abrasive disks produced here can be used interchangeably for high speed flat lapping. This is because the disk abrasive surfaces are precisely co-planar with the disk-backing platen-mounting surface. These heavy-duty raised-island abrasive disks have precision thicknesses with very small thickness variations across the whole annular abrading surface of the disk. The absolute thickness of the disks does not have to be constant as just the thickness uniformity is important for high-speed abrading.

D. Vitrified Abrasive Pellet Manufacturing

Both abrasive beads and vitrified pellets provide a porous erodible ceramic support for individual abrasive particles. The abrasive particles are mixed with metal oxide (ceramic precursor) particles and formed into abrasive shapes. Abrasive beads have spherical shapes. Abrasive pellets have flat surfaces with a variety of cross-sectional body shapes. Both the abrasive beads and the abrasive pellets are erodible. When the ceramic matrix material supporting the individual abrasive particles erodes away, worn particles are released and new sharp abrasive particles become exposed to continue the abrading action.

Both the abrasive beads and the vitrified abrasive pellets are processed in high temperature furnaces to convert the metal oxide into a ceramic. Other materials such as metals can also be used along with the metal oxides to produce the abrasive pellets. Modest furnace temperatures are used with the beads to provide a porous erodible ceramic matrix that rigidly supports individual abrasive particles. For vitrified pellet shapes, high furnace temperatures are used to melt the ceramic to form it into a solid glassy state (vitrified) upon cooling. In the pellets, individual abrasive particles are bonded together with strings of the melted and glassy ceramic material. The combination of the ceramic and abrasive particles form the vitrified abrasive pellets.

Because diamond particles break down thermally at high furnace temperatures in the presence of oxygen, the bead furnace temperatures are kept below 500° C. It is necessary to far exceed 500° C. to vitrify (melt or fuse) the ceramic when forming the abrasive pellets. To protect the diamond (pure carbon) particles from reacting with the oxygen and thermally degrading it at these high temperatures, special steps have to be taken. One alternative is to operate the furnace with an inert (non-oxygen) atmosphere, typically with the use of an enclosed retort furnace. This adds to the production expense and increases the complexity of the furnace operation. Another alternative is to plate a thin metal coating layer on the exterior surface of the individual diamond abrasive particles. This metal plating acts as a barrier that prevents high temperature ambient oxygen in the furnace from reacting with the diamond material. This step also adds to the complexity and expense of producing abrasive pellets. The pellets can be constructed with thick layers of fused or vitrified abrasive particles that are attached to inert ceramic island-base materials. These composite abrasive pellets are bonded to the thick and strong but flexible disk backings.

E. Abrasive Disks Less Expensive than Abrasive Wheels

Flexible heavy-duty abrasive disks are much less expensive to produce than heavy micro-grinding flat surfaced rigid metal abrasive coated wheels.

A wide variety of these heavy-duty disks can be stocked by those performing lapping instead of having a large investment in single expensive abrasive-wheels that often are not changed for months of operation. Having the economic freedom to quickly change the type of abrasive or abrasive particles sizes is a huge advantage for those companies that provide lapping services to a wide range of customers.

F. Quick-Change Heavy-Duty Disks

The heavy-duty flexible disks are light weight and easy to handle for quick attachment to the flat platens. Even though the disks have high raised islands and thick backings, the disks are flexible. They also have a continuous and smooth surfaced backing. The flexible and smooth-backside abrasive disks can be quickly attached to flat-surfaced platens with the use of vacuum. The vacuum provides huge attachment forces that "structurally" bond the flexible abrasive disks to the rigid metal platens. These vacuum disk hold-down forces allow the flexible heavy-duty abrasive disks to become an integral part of the rigid platens. Because the disk backings are relatively thin and the islands are rigid, there is very little compressibility of the raised island abrasive disks. The top flat-abrasive surface of the precision-thickness disks automatically becomes co-planar with the precision flat rigid platen surface. Each time an abrasive disk is mounted on the platen, a precision-flat abrading surface is provided for contact with flat-surfaced workpieces.

Because the flexible abrasive disks protect the platen flat disk mounting surface from wear, the precision flat platen surfaces remain flat over long periods of time, even as the abrasive disk surfaces experience wear. The abrasive surface flatness of a disk abrading surface can be quickly reestablished simply by removing a defective disk and replacing it with a new (or previously used) flat-surfaced abrasive disk.

To assure that disks "remember" their abrasive surface planar flatness relative to a given platen, the disks can be marked on the outer periphery. This alignment disk-mark can be registered (aligned) with a corresponding permanent registration mark located on the outer periphery of the platen. The abrasive disk registration marks can be added at the initial installation of the disk on a platen or the disk marks can be incorporated as a feature on new disks. Positioning disks concentric with a platen is easy to accomplish visually because both the disks and the platens typically have the same diameters. Alignment of the disk and platen marks is also easy to accomplish by rotating the disk tangentially by hand prior to application of the disk hold-down vacuum. In this way, any out-of-plane defects of the platen surface are automatically compensated for, after a given disk is dressed-flat on that specific platen surface.

G. Avoid Platen Distortions

It is necessary to attach the heavy and rigid micro-grinding abrasive wheels to platens with threaded fastener bolts. When these bolts are tightened, distortion of the abrasive-wheel is unavoidable in the bolt-hole locations. These rigid-wheel bolt-hole distortions can spread structurally to the planar surface of the wheel abrasive. For high speed abrading, it is critical that the surface of the abrasive have a radial flatness variation of less than 0.0005 inches and a circumferential flatness variation of approximately 0.0005 inches, depending on the diameter of the platen and the platen rotational speed. Otherwise, the non-flat abrasive traveling at more than 10,000 SFM (100 mph) will only contact the workpieces at the abrasive "high-spot" areas. This non-flat abrading contact is highly undesirable. A reverse-analogy here is an auto traveling at high speeds over a washboard road (high-spot abrasive areas). The auto will be "floated-upward" by the continual excitation of the periodic bumps of the washboard road surface. Controlled stability of the auto is lost until the auto reaches a smooth road surface. It is preferred that the platen has a radial flatness of standard deviation of less than 0.0002 inches and a circumferential flatness variation standard deviation of slightly greater than 0.0002 inches. It is more preferred that both the radial and circumferential flatness standard deviation is less than 0.0001 inches The micro-grinding non-flat abrasive surfaces have to be abrasively conditioned after an abrasive-wheel is changed. This conditioning removes the high spots from the wheel abrasive surface. When the abrasive wheels are changed on a micro-grinding system, it is a long and laborious procedure. Thee rigid wheels are heavy and difficult to handle manually.

Great care has to be exercised in tightening the wheel hold-down bolts so that the whole wheel body is joined to the platen body without distortion to the wheel body. This procedure is analogous to the careful bolt-tightening pattern procedures required for attaching the valve-head to the block of an automotive engine without distorting the head.

Part of the motivation to provide such thick abrasive layers on the abrasive wheels is the great difficulties present in changing the rigid abrasive wheels. None of these abrasive surface distortion concerns are present when a new flexible heavy-duty abrasive disk is attached to the surface of a flat platen. Here, the lightweight disk is simply laid by hand on the surface of the platen and vacuum is applied. The disk-attachment hold-down vacuum immediately bonds the disk to the rigid and precision-flat platen surface. The flexible disk becomes an integral part of the rigid and strong platen.

Because the vacuum attachment forces act uniformly across the full surface of the disk there are no localized distortion applied either to the platen or to the disks. This allows the heavy-duty flexible abrasive disks to be mounted repetitively on the platens. Each time a flexible disk is remounted on a platen, the abrasive regains its original precision planar abrasive surface that was already established with earlier use on the same platen. First-time conditioning-use of a raised island disk compensates for any out-of-plane flatness variations on the platen surface. These re-mounted disks can be used immediately to successfully abrade workpieces at the desired high abrading speeds.

H. Reduced Subsurface Damage

The small abrading forces used in high-speed abrading with the heavy-duty flexible disks results in less subsurface damage of brittle workpieces than occurs with the high abrading force micro-grinding systems.

I. Heavy-Duty Disk Platens

The platens used with these heavy-duty raised island abrasive disks have a structurally and dimensionally stable construction so they remain precisely flat over long periods of time.

XXI. Workpiece Cooling with Islands

A. Coolant Used to Avoid Thermal Cracks

Sufficient water is applied to the workpiece and abrasive to provide surface cooling under the whole flat surface of the lapped workpiece. This water is used to remove the friction heat that was generated by the abrading action of the moving island abrasive. This friction heat can damage both the workpiece and the individual diamond abrasive particles. It is desirable to quickly remove the heat from a localized workpiece abraded area before it has a chance to "soak" into the depths of the workpiece. If a localized area of a workpiece is heated, the thermal expansion of the heated area tends to cause thermal stresses in the workpiece material. Ceramic materials are particularly susceptible to the thermal stress which can cause undesirable localized stress cracks.

B. Islands Carry and Spread Coolant Water

Water that is applied to the leading edge of a workpiece minimizes the coolant water velocity as it travels along with the high speed abrasive. This "stationary" water tends not to be driven into the wedge areas of the leading edge of the workpiece. Water that is applied to a continuous-coated abrasive surface upstream of the leading edge and moves at high speeds is driven into these wedges and causes hydroplaning or lifting of the workpiece.

Raised islands that contact the "stationary" bead of coolant water at the workpiece leading edge tends to "chew-off" a portion of water and push this portion along the flat workpiece abraded surface. The water clings to the flat abraded side of the workpiece rather than falling away from the surface. This clinging is due to surface tension and other liquid adhesion forces. Also, the curved or angled leading edge of the island "snowplows" the water portion off to the island-travel pathway sides as the island travels under the workpiece. The snowplowed water wakes wet the surface of the workpiece that had been abraded by a previous island that had preceded it on an adjacent travel-pathway. In this way, the coolant water is constantly spread or washed across the surface of the abraded workpiece surface by the island structures. Because the islands travel at such high speeds, the water coolant effects take place immediately after the friction heat was generated on the workpiece surface by a preceding abrasive island.

In addition, the coolant water has special heat transfer characteristics for cooling the cutting tips of diamond abrasive particles that can be heated to very temperatures by this friction heating. When the diamond cutting edges are heated to more than 212 F, the diamond edge-contacting coolant water vaporizes and provides huge cooling to the diamond due to the localized vaporization of the water. The high associated coefficients of heat transfer with this water-boiling effect maintains the diamond edge temperatures to much less than that which will degrade the sharp cutting edges of the individual diamond particles. Any steam produced is routed to the recessed channels between the raised islands which prevents the steam from lifting the workpiece away from the flat abrasive surface.

Double-Sided Floating Platen Systems

Double-sided slurry or micro-grinding (flat-honing) systems also use the approach where the upper floating platens contact equal-thickness workpieces. However, the workpieces are not independently supported by multiple rigid fixed-position spindle surfaces that are co-planar. Rather, both the floating double-sided upper platen and the rigid-supported lower abrasive platen are independently rotated with equal-thickness workpieces sandwiched between the two platens. Multiple flat-surfaced workpieces are spaced around the annular circumference of the lower platen and they are held in abrading contact with the lower platen abrading by the upper abrasive platen. Both opposed surfaces of the workpieces are simultaneously abraded by the concentric rotation of both the upper and lower platens. Workpieces are rotated during the abrading action to provide uniform wear on the workpiece surfaces even though the abrading speeds, and the corresponding workpiece material removal rates, are different at the inner and outer radii of the platen annular abrasive bands.

Both the upper and lower platen abrasive surfaces are continuously worn into non-planar conditions by abrading contact with the abraded workpieces sandwiched between them. In double-sided floating-platen abrading, the workpieces are held by gear-driven planetary workholder carrier disks that rotate the workpieces during the abrading action. These carrier disks must be thinner than the workpiece to avoid abrading contact of the carriers with the abrasive on both platens. Abrading forces are applied to these thin carriers by the rotating platen abrasive surfaces and portions of these abrading forces are also applied to the planetary carrier drive gears. These thin and fragile workpiece carriers, that are also sandwiched between the platens, can not be driven at high speeds by the carrier disk drive gears. Because of limitations of the workpiece carrier system, both double-sided slurry lapping and micro-grinding (flat-honing) systems operate at low abrading speeds. Double-sided slurry lapping typically has low abrading pressures but double-sided micro-grinding (flat honing) utilizes very high abrading pressures. The workpiece abrading pressures are applied by the upper platen. Because the workpiece abrading pressures of the double-sided micro-grinding (flat honing) system utilizes very high abrading pressures, the upper and lower platens must be strong enough to resists these pressures without distorting the platen planar abrading surfaces. As a result, these platens are typically very heavy in order to provide the required structurally stiff platen abrasive surfaces. Use of very heavy upper platens results in difficulty in accurately controlling the low workpiece abrading pressures desired for high speed flat-lapping.

CMP-Type Floating Spindle Systems

Some CMP abrading systems use multiple workpiece spindles that are attached to a common frame that is suspended above a flat-surfaced rotating platen. The platen is covered with a resilient abrasive pad. Wafers are attached to the individual spindles and then the frame is lowered to bring all of the individual spindle-rotated wafers into abrading contact with the pad as the pad is rotated by the platen. The dimensional amount that each wafer is plunged into the surface of the thin liquid abrasive slurry-coated resilient pad is not precisely controlled. Instead, the abrading force that the individual wafers are pressed into the pad is typically controlled by the mechanisms that apply forces to the individual spindles. Penetration of the flat-surfaced wafer body into the pad surfaces also varies by the localized stiffness of the resilient pad. This pad stiffness changes during the CMP process as the abrasive slurry builds up a crusty solidified deposit coating on the pad. This crusty surface is broken up periodically by use of an abrasive-particle coated conditioning ring that is held in force contact with the moving pad.

There is no critical precision static or dynamic machine component co-planar surface requirement present for these CMP platens because the floating individual wafers are forced into the surface-depths of the resilient abrasive pad as the pad is rotated. Likewise, there is no critical requirement for the alignment of the flat abraded-surfaces of each of the individual spindle-mounted wafer to be located precisely in a common plane. This lack of co-planar alignment criteria occurs partially because of the wide positional tolerance of the wafer spindles allowed by penetration of the wafer surface into the surface-depth of the pad. Further, there is no requirement that the surfaces of the individual wafers be precisely co-planar with the flat surface of the rotating platen, again partially because of the wide wafer surface positional tolerance allowed by penetration of the wafer surface into the surface-depth of the pad. These co-planar spindle surface alignments are not necessary because each of the spindles is independently moved along its rotation axis. By simply controlling the applied abrading pressure at each workpiece spindle, the spindles are allowed to move freely along their rotation axes to provide the desired abrading pressure, independent of the movement of the other adjacent workpiece spindles.

There is a distinct difference in the technologies used by the floating-spindle CMP abrading system and the fixed-spindle floating-platen abrading system. The CMP abrading system is a distributed-spindle pressure-controlled axial-motion workpiece spindle system. It is not a rigid non-movement workpiece spindle system like the fixed-spindle-floating platen abrading system. This CMP abrading system can not perform the precision workpiece abrading functions that the fixed-spindle-floating platen abrading system can because the CMP system does not have the precision fixed-position rigid planar surface abrading system. CMP abrading consists only of removing a layer of material from an already-flat workpiece surface by polishing action. It does not establish a planar flat surface on a workpiece. Rather, it just provides a surface-polishing action. However, the fixed-spindle-floating platen abrading system can establish a planar flat surface on a workpiece even if the workpiece has a non-flat surface when the abrading action is initiated. Both systems use rigid platens. The CMP platen is rigid but the flat abrasive pad that is attached to the rigid platen is resilient. The CMP workpieces are not in abrading contact with a rigid abrasive surface; the workpieces are in abrading contact with a resilient pad abrasive surface.

Slurry Lapping

Conventional liquid abrasive slurry can also be used with this fixed-spindle floating-platen abrading system by attaching a disposable flat-surfaced metal, or non-metal, plate to the rigid platen surface and applying a coating of a liquid loose-abrasive slurry to the exposed flat surface of the plate. The platen slurry plate can be periodically re-conditioned by attaching equal-thickness abrasive disks to the rotating workpiece spindles and holding the rotating platen in abrading contact with the spindle abrasive disks. Here again, the primary planar reference surface even for the platen is the granite surface planar surface.

There are still many improvements in this area of technology that can be made according to practices and enabling apparatus, systems and methods described herein. All references cited in this specification are incorporated by reference in their entirety.

SUMMARY OF THE INVENTION

The presently disclosed technology includes a fixed-spindle, floating-platen system which is a new configuration of a single-sided lapping machine system. This system is capable of producing ultra-flat thin semiconductor wafer workpieces at high abrading speeds. This can be done by providing a dimensionally-stable, rigid (e.g., synthetic, composite or granite) machine base that the three-point rigid fixed-position workpiece spindles are mounted on. Flexible abrasive disks having annular bands of abrasive-coated raised islands may be attached to a rigid flat-surfaced rotary platen that floats in three-point abrading contact with the three equal-spaced flat-surfaced rotatable workpiece spindles. Use of a platen vacuum disk attachment system allows quick set-up changes where different sizes of abrasive particles and different types of abrasive material can be quickly attached to the flat platen surfaces.

Water coolant is preferably used with these raised island abrasive disks, which allows them to be used at very high abrading speeds, often in excess of 10,000 SFM. The coolant water can be applied directly to the top surfaces of the workpieces or the coolant water can be applied through aperture holes at the center of the abrasive disk or through aperture holes at other locations on the abrasive disk. The applied coolant water results in abrading debris being continually flushed from the abraded surface of the workpieces. Here, when the water-carried debris falls off the spindle top surfaces it is not carried along by the platen to contaminate and scratch the adjacent high-value workpieces, a process condition that occurs in double-sided abrading.

The fixed-spindle-floating-platen system is easy to use, is flexible for abrasive selection set-ups, handles a wide range of types of abrading, is a clean process, produces ultra-flat and ultra-smooth finishes, handles thin workpieces, can be fully automated for changing workpieces and can be fully automated for changing abrasive disks to provide quick-changes of types and sizes of abrasive particles. The different types of abrading range from high-speed water-cooled flat-lapping to liquid slurry lapping, CMP polishing with liquid slurries and resilient pads, fixed-abrasive CMP polishing, and abrading with thick layers of abrasive pellets attached to thick disk backings. This system provides new wide range of abrading capabilities that can not be achieved by other conventional abrading systems.

This fixed-spindle, floating-platen system is particularly suited for precision flat-lapping or surface polishing large diameter semiconductor wafers. High-value large-sized workpieces such as at least 10-inch (250 mm) and at least 12 inch diameter (300 mm) semiconductor wafers can be attached to ultra-precise flat-surfaced 12 inch diameter air bearing spindles for precision lapping.

In these systems, the lower platen of a double-sided platen abrading system having workpieces sandwiched between a floating upper platen and a lower rigidly mounted platen is replaced with a three-point fixed-spindle upper floating platen support system. Instead of the upper floating platen being conformably supported by equal-thickness flat workpieces that are supported by flat-surfaced contact with the flat surface of the lower platen, the upper floating platen is supported by contacting equal-thickness flat workpieces that are supported by flat-surfaced contact with the flat surfaces of the three rigidly mounted rotatable spindles. The equally-spaced workpiece spindles provide stable support for the floating upper platen. This new floating platen abrading system is a single-sided abrading system as compared to the double-sided floating platen abrading system. Only the top surfaces of the workpieces are abraded as compared to both sides of workpieces being abraded simultaneously with the double-sided abrading system. The single-sided fixed-spindle-floating-platen system can abrade thin workpieces and produce ultra-flat abraded surfaces that are superior in flatness produced by conventional double-sided abrading. This flatness performance advantage occurs because the individual workpieces are supported by the precision-flat surfaces of the air bearing spindles rather than by the worn-down abrading surfaces of the bottom platen in a double-sided abrading system.

The systems of supporting the floating upper platen with the three-point rigid mounted precision-flat air bearing spindles provide a floating platen support system that is has a planar flatness that is equivalent to or flatter than that provided by a conventional rigid mounted lower platen. The air bearing spindles used here have precision flat surfaces that provide surface variations that are often more than one order of magnitude flatter than conventional abrading platen surfaces, even when the spindles are rotated at large speeds. Most conventional platen abrasive surfaces have original-condition flatness tolerances of 0.0001 inches (100 millionths) that typically wear down into a non-flat condition during abrading operations to approximately 0.0006 inches before they are reconditioned to re-establish the original flatness variation of 0.0001 inches. By comparison, the typical flatness of a precision air bearing spindle is less than 5 millionths of an inch. The air bearings have large 12 inch diameter flat surfaces and are able to supportl2 inch (300 mm) diameter workpieces comprising semiconductor wafers with little spindle-top deflections due to abrading forces. The spindle stiffness of air bearings often exceeds the stiffness of roller bearing spindles. Workpieces are typically attached to equal-thickness carrier plates that are lapped precisely flat where both of the carrier plate flat surfaces are precisely parallel to each other. These precision carriers provide assurance that the independent workpieces that are mounted on the three spindles have workpiece surfaces that are precisely co-planar with each other.

The top flat surfaces of the equal-height spindles must be co-planar with each other. Each of the three rigid spindles is positioned with equal spacing between them to form a triangle of platen spindle-support locations. The rotational-centers of each of the spindles are positioned on the granite so that they are located at the radial center of the annular width of the precision-flat abrading platen surface. Equal-thickness flat-surfaced workpieces are attached to the flat-surfaced tops of each of the spindles. The rigid rotating floating-platen abrasive surface contacts all three rotating workpieces to perform single-sided abrading on the exposed surfaces of the workpieces. The fixed-spindle-floating platen system can be used at high abrading speeds to produce precision-flat and mirror-smooth workpieces at very high production rates. There is no abrasive wear of the platen surface because it is protected by the attached flexible abrasive disks.

The multiple workpieces are in abrading contact with a floating rotary platen that also has a precision-flat annular abrading surface. Mounting equal-thickness workpieces on the three spindles provides support for the platen where the platen abrading surface assumes a co-planar location with the common plane of the spindle surfaces. As all the workpieces are simultaneously abraded, they become thinner but retain an equal thickness.

This fixed-spindle-floating-platen system is uniquely capable of providing precision flat lapping of workpieces using rigid lapping machine components at high abrading speeds and high productivity. Because all of the machine components are rigid (including the floating platen), it is required that each component has a precision-flat characteristic. Then, when all of these components are used together, they provide uniform abrading to the surfaces of spindle-mounted workpieces that are simultaneously contacted by a platen planar abrading surface. It is particularly important that all of the individual workpiece surfaces active in the abrading operation are individually and collectively co-planar with each other. Here, even the raised-island abrasive disks have a uniform precision-thickness over the full annular abrading surface of the disk. This results in both the abrasive surface of the disk and the opposite disk-backing mounting surface being precisely co-planar with each other. In addition, the flexible raised-island abrasive disks having thin and flexible backings are rigid in a direction that is perpendicular to the disk flat abrading surface. An analogy here is a flexible piece of sheet metal that can be easily flexed out-of-plane but yet provides rigid and stiff load-carrying support for flat-surfaced components that are placed in flat-faced contact with the sheet metal flat surface. Vacuum-attached abrasive disks are flexible so they will conform to the flat surfaces of the platens. The raised-island abrasive disks are constructed from thin but structurally-stiff backing materials and the island structures are also constructed from structurally-stiff construction materials to assure that the abrasive coated island disks are not resilient. The abrasive disks do not distort locally due to abrading forces.

The platen abrasive disks typically have annular bands of fixed-abrasive coated rigid raised-island structures. There is insignificant elastic distortion of the individual raised islands or of the whole thickness of the raised island abrasive disks when they are subjected to typical abrading pressures. These abrasive disks must also be precisely uniform in thickness across the full annular abrading surface of the disk to assure that full-surface abrading takes place over the full flat surface of the workpieces located on the tops of each of the three spindles.

There are no resilient or complaint component members n this abrading system that would allow forgiveness of out-of-dimensional-tolerance variations of other of the system components. For example, there is no substantial structural compliance of the platen-mounted abrasive disks to compensate for spindle-to-spindle workpiece surface positional variations. The precision-flat platen abrasive surface must be precisely co-planar with the top exposed surfaces of all three of the rigid-spindle workpieces to provide workpieces that are abraded precisely flat when using these non-resilient abrasive disks. Further, the rigid granite base that the rigid spindles are mounted on does not deflect or elastically distort when the spindles are subjected to typical abrading forces. Likewise, the air bearing workpiece spindles are also extremely stiff and the spindle rotating tops do not experience significant deflection when subjected to the typical abrading forces. The whole fixed-spindle-floating platen system is extremely rigid, but also, has many component surfaces that are precisely co-planar with other of the system component surfaces.

In the present system having flat workpiece surfaces positioned horizontally, there is no vertical movement of the workpiece wafer mounted on one spindle relative to the position of any wafer mounted on any of the other fixed-position rotary workpiece spindles.

During abrading action, both the workpieces and the abrasive platens are rotated simultaneously. Once a floating platen "assumes" a position as it rests conformably upon and is supported by the three spindles, the planar abrasive surface of the platen retains this platen alignment even as the floating platen is rotated. The three-point spindles are located with equal spacing between them circumferentially in alignment with the centerline of the platen annular abrasive. The controlled abrading pressure applied by the abrasive platen to the three individual same-sized and equal-thickness workpieces is evenly distributed to the three workpieces. All three equal-sized workpieces experience the same shared platen-imposed abrading forces and abrading pressures. Semiconductors wafer workpieces can then be lapped where precision-flat and smoothly polished wafer surfaces can be simultaneously produced at all three spindle stations by the fixed-spindle-floating platen abrading system.

Very thin workpieces can be attached to the rotatable spindles by vacuum or other attachment means. To provide abrading of the opposite side of the workpiece, it is removed from the spindle, flipped over and abraded with the floating platen. This is a simple two-step procedure. Here, the rotating spindles provide a workpiece surface that remains co-planar with the granite reference surface and the production of workpieces having two opposing non-planar surfaces is avoided. Non-planar workpiece surfaces are often produced by single-sided lapping operations that do not use fixed-position workpiece spindles.

A minimum of three evenly-spaced spindles are used to obtain the three-point support of the upper floating platen by contacting the spaced workpieces. However, many more spindles can be used where all of the spindle workpieces are in mutual flat abrading contact with the rotating platen abrasive.

This three-point fixed-spindle-floating-platen abrading system can also be used for chemical mechanical planarization (CMP) abrading of semiconductor wafers using liquid abrasive slurry mixtures with resilient backed pads attached to the floating platen. These wafers are repetitively abraded on one surface after new semiconductor features are deposited on that surface. This polishing removes undesired surface protuberances from the wafer surface. The system can also be used with CMP-type fixed-abrasive shallow-island abrasive disks that are backed with resilient support pads. These shallow-island abrasives can either be mold-formed on the surface of flexible backings or the shallow-island abrasive disks can be coated or printed on disk backings comprising gravure, off-set, flexo-graphic using flexible polymer printing plates having raised-island printing features, or other printing or coating techniques. The abrasive material typically used for the CMP disks comprises ceria which can be applied as a slurry mixture of ceria particles mixed with an adhesive binder or it can be spherical beads of ceria that are deposited on adhesive coated island features on a backing or deposited island features of ceria abrasive beads in a slurry mixture of adhesive.

This system can also provide slurry lapping by attaching a disposable flat-surfaced metal, or non-metal, plate to the rigid platen surface and applying a coating of a liquid loose-abrasive slurry to the exposed flat surface of the plate. The platen slurry plate can be periodically re-conditioned by attaching equal-thickness abrasive disks to the rotating workpiece spindles and holding the rotating platen in abrading contact with the spindle abrasive disks. Here again, the primary planar reference surface even for the platen is the granite surface planar surface.

The system can also be used to recondition the surface of the abrasive that is on the platen. This platen annular abrasive surface tends to experience uneven wear across the radial surface of the annular abrasive band after continued abrading contact with the spindle workpieces. When the non-even wear of the abrasive surface becomes excessive and the abrasive can no longer provide precision-flat workpiece surfaces it must be reconditioned to re-establish its planar flatness. Reconditioning the platen abrasive surface can be easily accomplished with this system by attaching equal-thickness abrasive disks to the flat surfaces of the spindles in place of the workpieces. Here, the abrasive surface reconditioning takes place by rotating the spindle abrasive disks while they are in flat-surfaced abrading contact with the rotating platen abrasive annular band.

Workpieces comprising semiconductor wafers can be easily processed with a fully automated easy-to-operate process that is very practical. Here, individual wafer carriers can be changed on all three spindles with a robotic arm extending through a convenient gap-opening between two adjacent stand-alone wafer spindles.

The system has the capability to resist large mechanical abrading forces present with abrading processes with unprecedented flatness accuracies and minimum mechanical aberrations. Because the system is comprised of robust components it has a long lifetime with little maintenance even in the harsh abrading environment present with most abrading processes. Air bearing spindles are not prone to failure or degradation and provide a flexible system that is quickly adapted to different polishing processes.

There is no wear of the platen surface because the abrasive is not in abrading contact with the platen. Each time an abrasive disk is attached to a platen, the non-worn platen provides the same precision-flat planar reference surface for the new or changed disk.

BRIEF DESCRIPTION OF THE DRAWINGS

FIG. 107 is an isometric view of fixed-abrasive raised islands on an annular abrasive disk.

FIG. 108 is an isometric view of a fixed-abrasive coated raised island annular abrasive disk.

FIG. 109 is an isometric view of a solid-layer fixed-abrasive annular disk.

FIG. 119 is a cross section view of co-planar spindles mounted on a angled machine base.

FIG. 120 is a cross section view of a floating platen and spindles on a angled machine base.

FIG. 121 is a cross section view of a floating platen and spindles on a angled machine base.

FIG. 122 is a top view of an arc segment of a platen abrading surface.

FIG. 123 is a cross section view of a non-planar platen surface.

FIG. 124 is a cross section view of a segment of a non-planar platen surface.

FIG. 125 is a cross section view of a non-flat radial segment of a platen surface.

FIG. 126 is a top view of a non-flat radial segment of a platen surface.

DETAILED DESCRIPTION OF THE INVENTION

Figure 1:
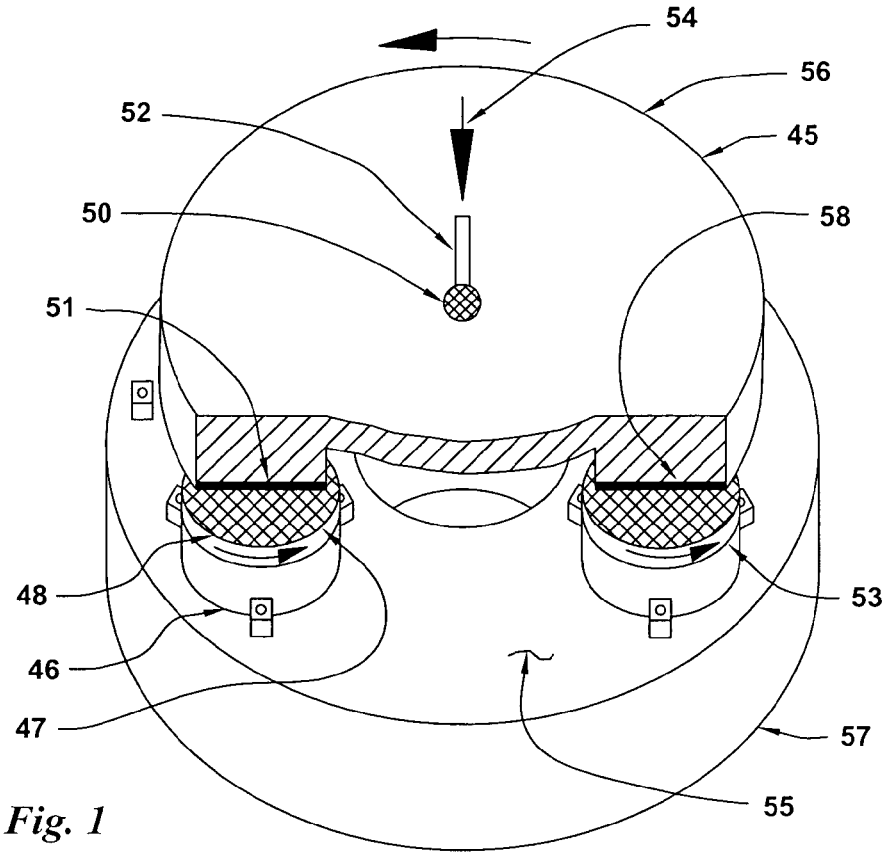
FIG. 1 is an isometric view of three-point spindles supporting a floating abrasive platen.

FIG. 1 is an isometric view of an abrading system 45 having three-point fixed-position rotating workpiece spindles supporting a floating rotating abrasive platen. Three evenly-spaced rotatable spindles 46 (one not shown) having rotating tops 53 that have attached workpieces 48 support a floating abrasive platen 56. The platen 56 has a vacuum, or other, abrasive disk attachment device (not shown) that is used to attach an annular abrasive disk 58 to the precision-flat platen 56 abrasive-disk mounting surface 51. The abrasive disk 58 is in flat abrasive surface contact with all three of the workpieces 48. The rotating floating platen 56 is driven through a spherical-action universal joint type of device 50 having a platen drive shaft 52 to which is applied an abrasive contact force 54 to control the abrading pressure applied to the workpieces 48. The equal-height workpiece rotary spindles 46 are mounted on a granite base 57 that has a approximate-flat surface 55. The three workpiece spindles 46 have precise equal-heights which results in the top surfaces of the three spindles 46 to be co-planar and results in the co-planar surfaces of all of the flat-surfaced rotating workpiece spindles 46 to be approximately co-planar with the approximate-flat surface 55 of the granite base 57. The equal-height workpiece spindles 46 can be interchanged or a new workpiece spindle 46 can be changed with an existing spindle 46 where the flat surfaces of the spindles 46 are in the same plane and are co-planar with the approximate-flat surface 55 of the granite base 57. Here, the equal-thickness workpieces 48 are in the same plane and are abraded uniformly across each workpiece 48 surface by the platen 56 precision-flat planar abrasive disk 58 abrading surface. The planar abrading surface 51 of the floating platen 56 is approximately co-planar with the approximate-flat surface 55 of the granite base 57.

The spindle 46 rotating surfaces tops 53 can driven by different techniques comprising spindle 46 internal spindle shafts (not shown), external spindle 46 flexible drive belts (not shown), drive-wires (not shown) and spindle 46 internal drive motors (not shown). The spindle 46 tops 53 can be driven independently in both rotation directions and at a wide range of rotation speeds including very high speeds. Typically the spindles 46 are air bearing spindles that provide precision flat surfaces, equal heights, are very stiff, to maintain high rigidity against abrading forces, have very low friction and can operate at very high rotational speeds.

Abrasive disks (not shown) can be attached to the spindle 46 tops 53 to abrade the platen 56 flat surface 51 by rotating the spindle tops 53 while the platen 56 flat surface 51 is positioned in abrading contact with the spindle abrasive disks that are rotated in selected directions and at selected rotational speeds when the platen 56 is rotated at selected speeds and selected rotation direction when applying a selected abrading force 54. The top surfaces 47 of the individual three-point spindle 46 rotating tops 53 can also be abraded by the platen 56 planar abrasive disk 58 by placing the platen 56 and the abrasive disk 58 in flat conformal contact with the spindle-tops 53 flat surfaces 47 of the workpiece spindles 46 as both the platen 56 and the spindle tops 53 are rotated in selected directions when an abrading pressure force 54 is applied. The top surfaces 47 of the spindles 46 abraded by the platen 56 results in all of the spindle 46 top surfaces 47 being in a common plane.

The granite base 57 is known to provide a time-stable nominally-flat surface 55 to which the precision-flat three-point spindles 46 can be mounted. The unique capability provided by this abrading system 45 is that the primary datum-reference is the fixed-position co-planar spindle-tops 53 flat surfaces 47. When the abrading system is initially assembled it can provide extremely flat abrading workpiece 48 spindle 46 top 53 mounting surfaces and extremely flat platen 56 abrading surfaces 51. The extreme flatness accuracy of the abrading system 45 provides the capability of abrading ultra-thin and large-diameter and high-value workpieces 48, such as semiconductor wafers, at very high abrading speeds with a fully automated workpiece 48 robotic device (not shown). In addition, the system 45 can provide unprecedented system 45 component flatness and workpiece abrading accuracy by using the system 45 components to "abrasively dress" other of these same-machine system 45 critical components such as the spindle tops 53 and the platen 56 planar-surface 51. These spindle top 53 and the platen 56 planar surface 51 component dressing actions can be alternatively repeated on each other to progressively bring the system 45 critical components comprising the spindle tops 53 and the platen 56 planar-surface 51 into a higher state of operational flatness perfection than existed when the system 45 was initially assembled. This system 45 self-dressing process is simple, easy to do and can be done as often as desired to reestablish the precision flatness of the system 45 component or to improve their flatness for specific abrading operations.

This single-sided abrading system 45 self-enhancement surface-flattening process is unique among conventional floating-platen abrasive systems. Other abrading systems use floating platens but these systems are double-sided abrading systems. These other systems comprise slurry lapping and micro-grinding (flat-honing) that have rigid bearing-supported rotated lower abrasive coated platens that have equal-thickness flat-surfaced workpieces in flat contact with the annular abrasive surfaces of the lower platens. The floating upper platen annular abrasive surface is in abrading contact with these multiple workpieces where these multiple workpieces support the upper floating platen as it is rotated. The result is that the floating platens of these other floating platen systems are supported by a single-item moving-reference device, the rotating lower platen.

Large diameter rotating lower platens that are typically used for double-sided slurry lapping and micro-grinding (flat-honing) have substantial abrasive-surface out-of-plane variations. These undesired abrading surface variations are due to many causes comprising: relatively compliant (non-stiff) platen support bearings that transmit or magnify bearing dimension variations to the outboard tangential abrading surfaces of the lower platen abrasive surface; radial and tangential out-of-plane variations in the large platen surface; time-dependent platen material creep distortions; abrading machine operating-temperature variations that result in expansion or shrinkage distortion of the lower platen surface; and the constant wear-down of the lower platen abrading surface by abrading contact with the workpieces that are in moving abrading contact with the lower platen abrasive surface. The single-sided abrading system 45 is completely different than the double-sided system (not-shown).

The floating platen 56 system 45 performance is based on supporting a floating abrasive platen 56 on the top surfaces 47 of three-point spaced fixed-position rotary workpiece spindles 46 that are mounted on a stable machine base 57 flat surface 55 where the top surfaces 47 of the spindles 46 are precisely located in a common plane and where the top surfaces 47 of the spindles 46 are approximately co-planar with the approximate-flat surface 55 of a rigid fixed-position granite, or other material, base 57. The three-point support is required to provide a stable support for the floating platen 56 as rigid components, in general, only contact each other at three points.

This three-point workpiece spindle abrading system 45 can also be used for abrasive slurry lapping (not shown), for micro-grinding (flat-honing) (not shown) and also for chemical mechanical planarization (CMP) (not shown) abrading to provide ultra-flat abraded workpieces 48.

Figure 2:
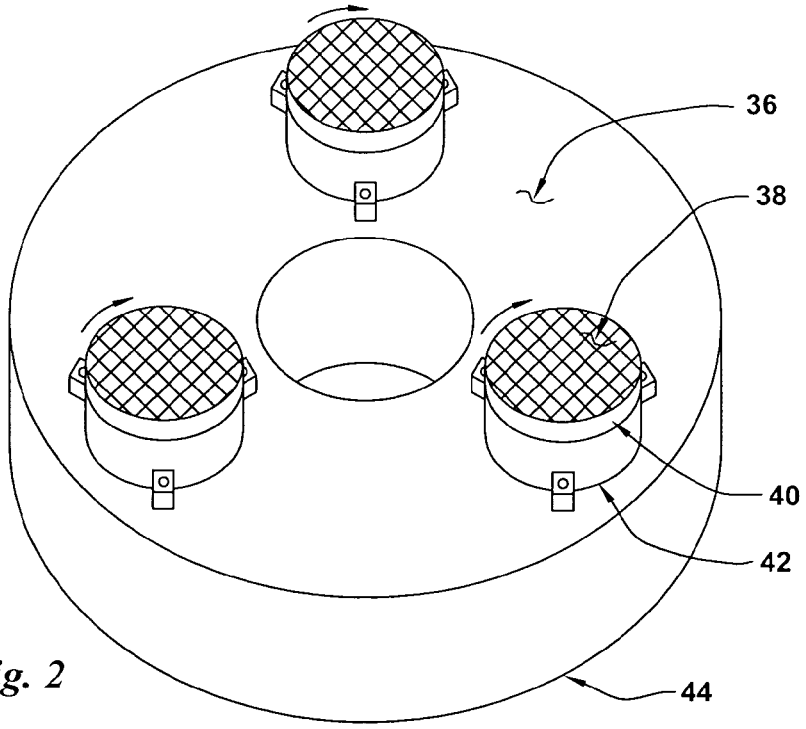
FIG. 2 is an isometric view of three-point fixed-position spindles mounted on a granite base.

FIG. 2 is an isometric view of three-point fixed-position spindles mounted on a granite base. A granite base 44 has an approximate-flat top surface 36 that supports three attached workpiece spindles 42 that have rotatable driven tops 40 where flat-surfaced workpieces 38 are attached to the flat-surfaced spindle tops 40.

Figure 3:
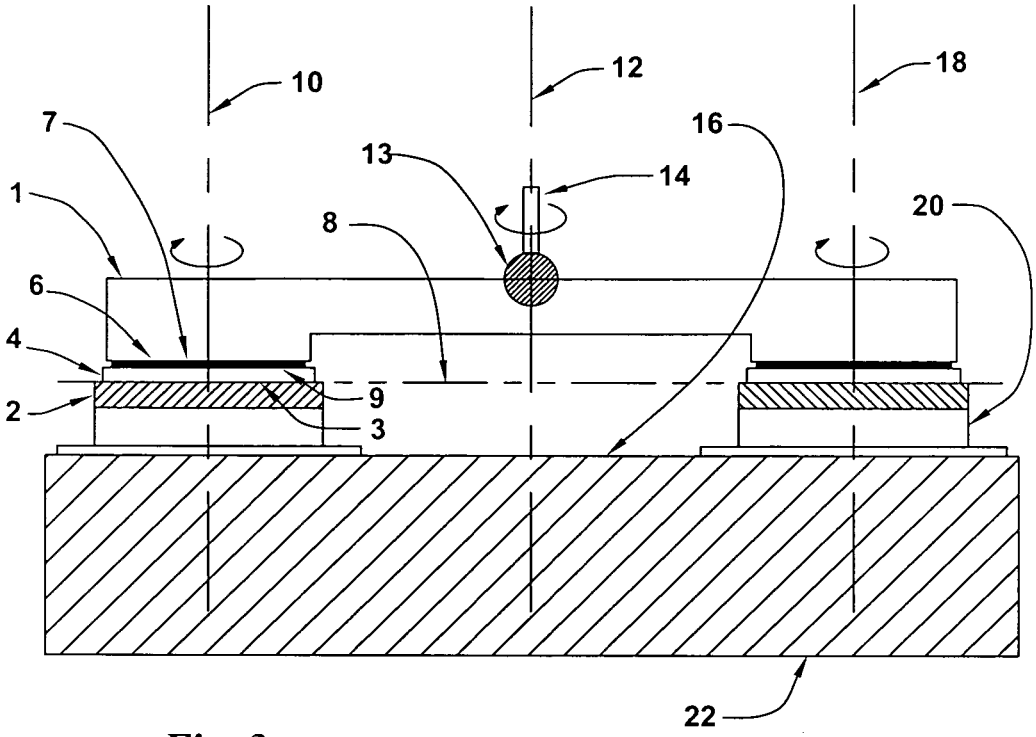
FIG. 3 is a cross section view of three-point spindles supporting a floating abrasive platen.

FIG. 3 is a cross section view of three-point fixed-position spindles supporting a rotating floating abrasive platen. A floating circular platen 1 has a spherical-action rotating drive mechanism 13 having a drive shaft 14 where the platen 1 rotates about an axis 12. Three workpiece spindles 20 (one not shown) having rotatable spindle tops 2 that have flat top surfaces 3 are mounted to the top nominally-flat surface 16 of a machine base 22 that is constructed from granite, epoxy-granite, metal or composite or other materials. The flat top surfaces of the spindle tops 2 are all in a common plane 8 where the spindle plane 8 is approximately co-planar with the top flat surface 16 of the machine base 22. Equal-thickness flat-surfaced workpieces 4 are attached to the spindle top 2 flat surfaces 3 by a vacuum, or other, disk attachment device where the top surfaces of the three workpieces 4 are mutually contacted by the abrading surface 9 of an annular abrasive disk 6 that is attached to the platen 1. The platen 1 disk attachment surface 7 is precisely flat and the precision-thickness abrasive disk 6 annular abrasive surface 9 is precisely co-planar with the platen 1 disk attachment surface 7. The annular abrasive surface 9 is precisely co-planar with the flat top surfaces of each of the three independent spindle top 2 flat surfaces 3 and also, co-planar with the spindle plane 8. The floating platen 1 is supported by the three equally-spaced spindles 20 where the flat disk attachment surface 7 of the platen 1 is approximately co-planar with the top surface 16 of the machine base 22. The three equally-spaced spindles 20 of the three-point set of spindles 20 provide stable support to the floating platen 1. The spherical platen 1 drive mechanism 13 restrains the platen 1 in a circular platen 1 radial direction. The spindle tops 2 are driven (not shown) in either clockwise or counterclockwise directions with rotation axes 10 and 18 while the rotating platen 1 is also driven. Typically, the spindle tops 2 are driven in the same rotation direction as the platen 1. The workpiece spindle 20 tops 2 can be rotationally driven by motors (not shown) that are an integral part of the spindles 20 or the tops 2 can be driven by internal spindle shafts (not shown) that extend through the bottom mounting surface of the spindles 20 and into or through the granite machine base 22 or the spindles 20 can be driven by external drive belts (not shown).

Figure 4:
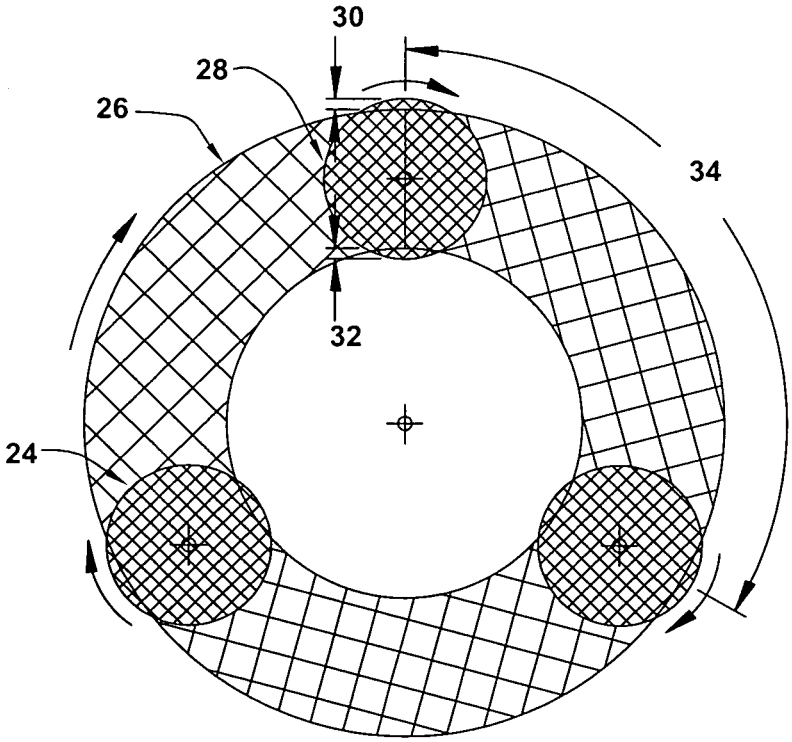
FIG. 4 is a top view of three-point fixed-spindles supporting a floating abrasive platen.

FIG. 4 is a top view of three-point fixed-spindles supporting a floating abrasive platen. Workpieces 28 are attached to three rotatable spindles 24 where the workpieces 28 are in abrading contact with an annular band of abrasive 26 where the workpieces 28 overhang the outer periphery of the abrasive 26 by a distance 30 and overhang the inner periphery of the abrasive 26 by a distance 32. Each of the three spindles 24 are shown separated by an angle 34 of approximately 120 degrees to provide three-point support of the rotating platen (not shown) having an annular band of abrasive 26.

Figure 5:
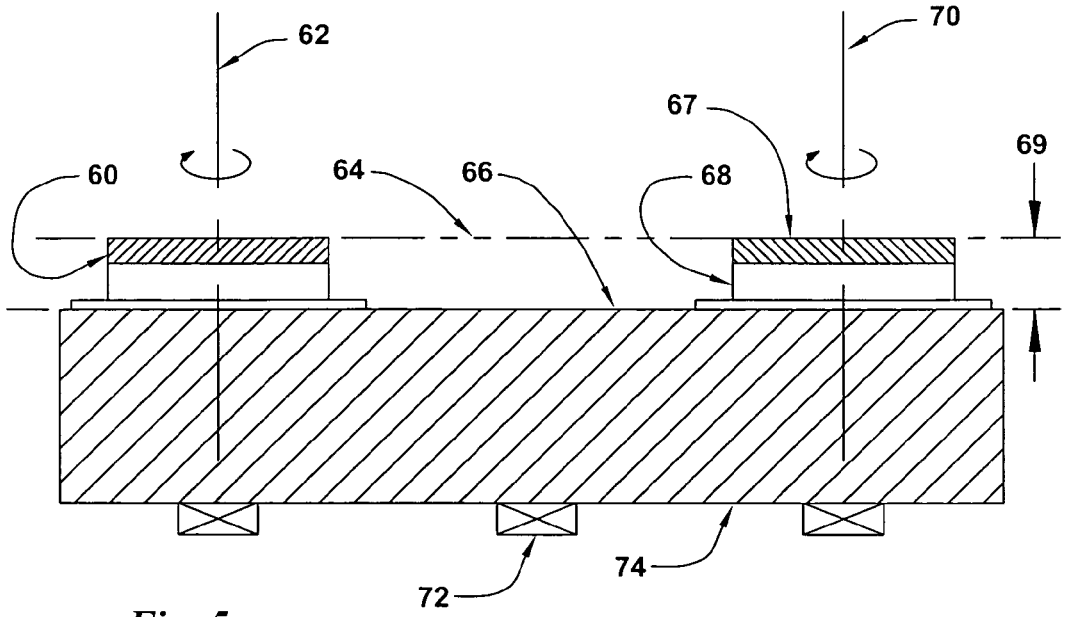
FIG. 5 is a cross section view of three-point spindles mounted on a machine base.

FIG. 5 is a cross section view of three-point spindles mounted on a machine base. Rotary spindles 68 are mounted to the top flat surface 66 of a granite, or other material, machine base 74 that is supported at three points by base supports 72. Only two of the set of three spindles 68 are shown. Each of the spindles 68 has rotary tops 60. The flatness of the base 74 surface 66 is established when the base 74 is manufactured with the same three-point base supports 72 which allows the flatness of the surface 66 to be retained when the base 74 is later mounted in an abrading machine (not shown) frame using these same base supports 72. Equal thickness 69 spindles 68 have rotary flat-surfaced tops 67 that all are in a common plane 64 that is approximately co-planar with the base 74 top surface 66. The spindles 68 have axes of rotation 62 and 70.

Figure 6:
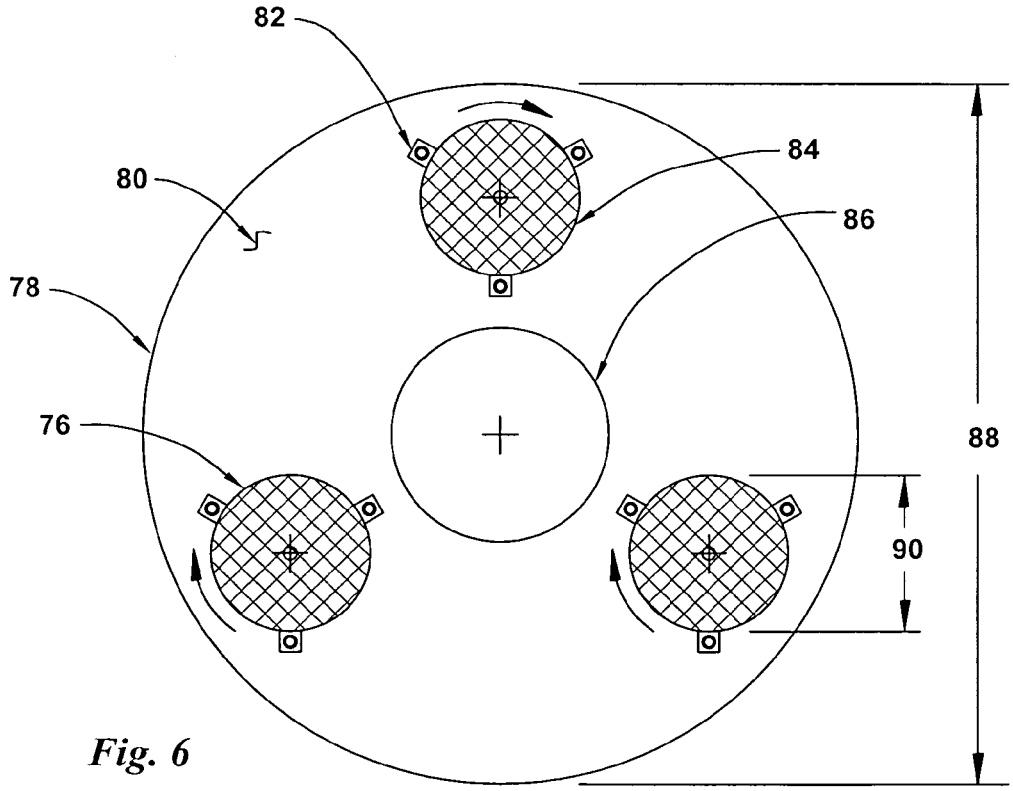
FIG. 6 is a top view of three-point fixed-position spindles mounted on a machine base.

FIG. 6 is a top view of equally-spaced three-point fixed-position spindles mounted on a machine base. Rotary spindles 76 having rotary tops 84 are mounted on a granite machine base 78 having an approximate-flat surface 80. Each of the three equally-spaced spindles 76 has equally-spaced three-point mounting legs 82 that are attached with mechanical fasteners (not shown) to the machine base 78. The three-point mounting legs 82 allow the spindle 76 flat surfaces 84 to be aligned in a common plane that is approximately co-planar with the base 78 flat surface 80. The spindles 76 have a spindle diameter 90 that is typically 12 inches (300 mm) in diameter and the granite machine base 78 has a typical diameter 88 of 48 inches (122 cm). The spindles 76 shown here have three mounting legs 82 to demonstrate a method of precisely aligning the flat top surfaces of the spindles tops 84 to be approximately co-planar with the granite base 78 surface 80. The top surfaces of commercially available air bearing spindles are typically co-planar with the bottom mounting surfaces of the spindles 76. The uniformity of the spindles 76 allows spindles 76 to be replaced with new or different spindles 76 when desired. Air bearing spindles are preferred because of the precision flatness of the spindle surfaces at all abrading speeds. Commercial 12 inch (300 mm) diameter air bearing spindles, weighing approximately 85 lbs, are available from the Nelson Air Corp, Milford, N.H.

Figure 7:
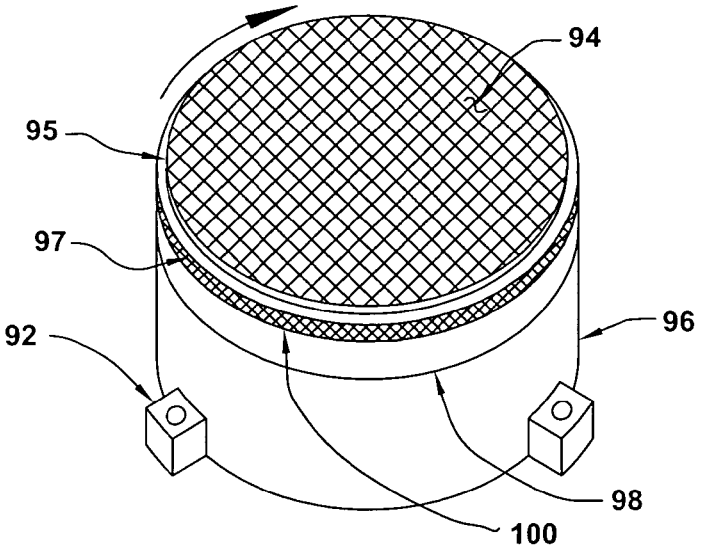
FIG. 7 is an isometric view of a workpiece spindle having three-point mounting legs.

FIG. 7 is an isometric view of a workpiece spindle having three-point mounting legs. The workpiece rotary spindle 96 has a rotary top 98 that has a precision-flat surface 100 to which is attached a precision-flat vacuum chuck device 97 that has co-planar opposed flat surfaces. A flat-surfaced workpiece 95 has an exposed flat surface 94 that is abraded by an abrasive coated platen (not shown). The workpiece spindle 96 is three-point supported by spindle legs 92. The workpiece 95 shown here has a diameter of 12 inches and is supported by a spindle 96 having a 12 inch diameter and a rotary top 98 top flat surface 100 that has a diameter of 12 inches.

Figure 8:
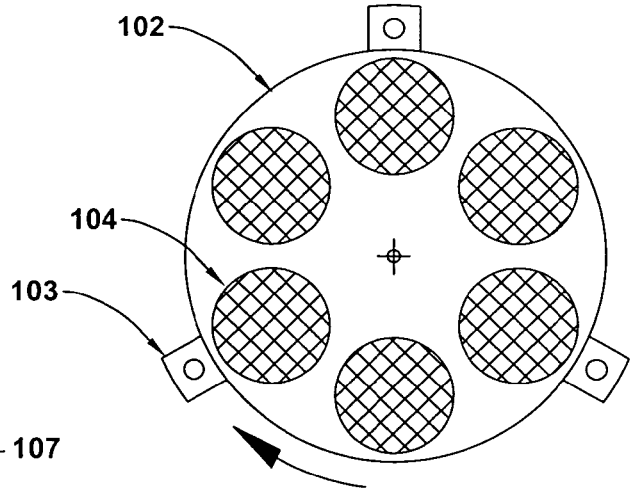
FIG. 8 is a top view of a workpiece spindle having multiple circular workpieces.
Figure 9:
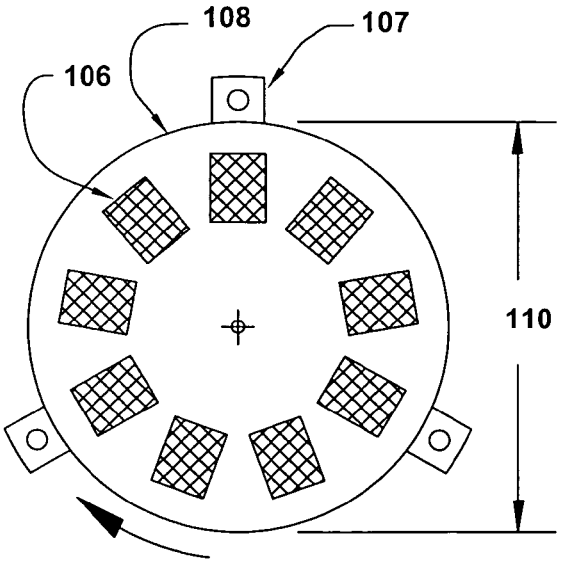
FIG. 9 is a top view of a workpiece spindle having multiple rectangular workpieces.

FIG. 8 is a top view of a workpiece spindle having multiple circular workpieces. A workpiece rotary spindle 102 having three-point support legs 103 where the spindle 102 supports small circular flat-surfaced workpieces 104 that are abraded by an abrasive coated platen (not shown). FIG. 9 is a top view of a workpiece spindle having multiple rectangular workpieces. A workpiece rotary spindle 108 having three-point support legs 107 where the spindle 108 supports small circular flat-surfaced workpieces 106 that are abraded by an abrasive coated platen (not shown).

Figure 10:
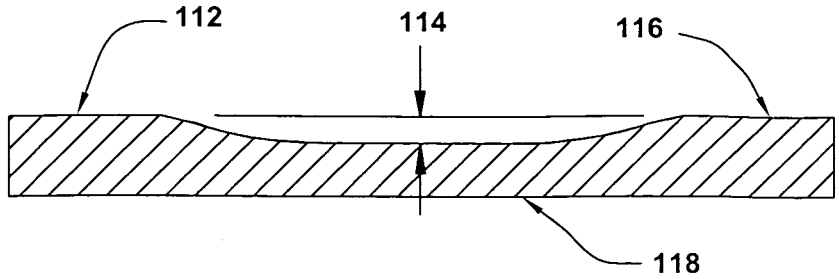
Fig. 10 Prior art
FIG. 10 is a cross section view of a flat workpiece with a concave non-flat surface.
Figure 11:
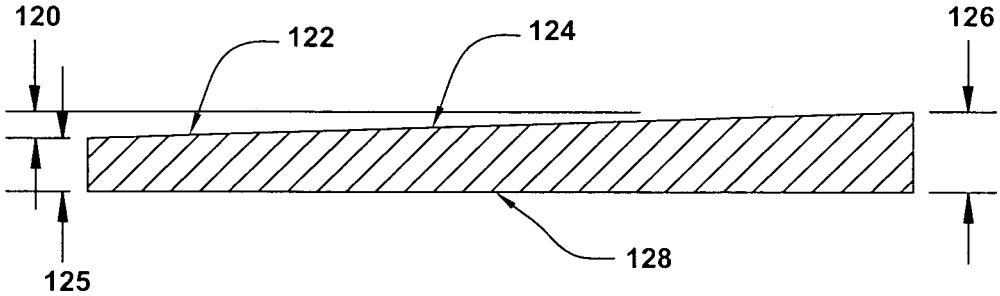
Fig. 11 Prior art
FIG. 11 is a cross section view of a flat workpiece with an angled non-flat surface.
Figure 12:
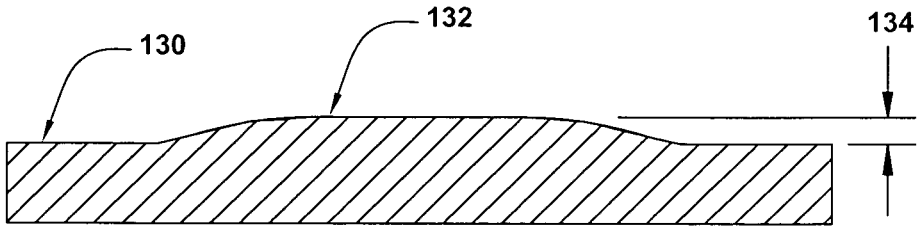
Fig. 12 Prior art
FIG. 12 is a cross section view of a flat workpiece with a raised non-flat surface.

FIG. 10, FIG. 11 and FIG. 12 are cross sectional views of the out-of-plane rigid platen abrading surface defects that occur during workpiece abrading on the annular abrasive bands of prior art slurry lapping, micro-grinding (flat-honing) and high-speed flat lapping abrading processes. Slurry flat lapping uses loose-abrasive particles in a liquid slurry mixture that is coated on a rigid flat platen. Micro-grinding (flat-honing) use fixed-abrasive attached to a flat-surfaced rigid abrasive wheel. High-speed flat lapping uses fixed-abrasive particles attached to flexible abrasive disks that are attached to a flat-surfaced rigid platen.

Figure 13:
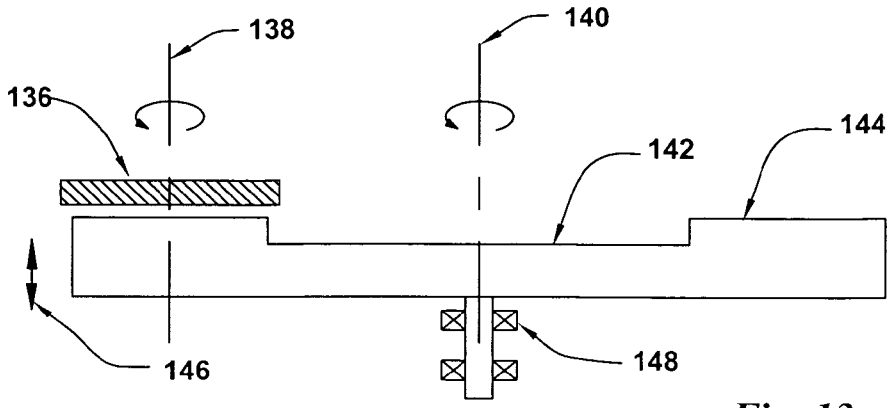
Fig. 13 Prior Art
FIG. 13 is a cross section view of a flat workpiece abraded by a single-sided rotary platen.
Figure 14:
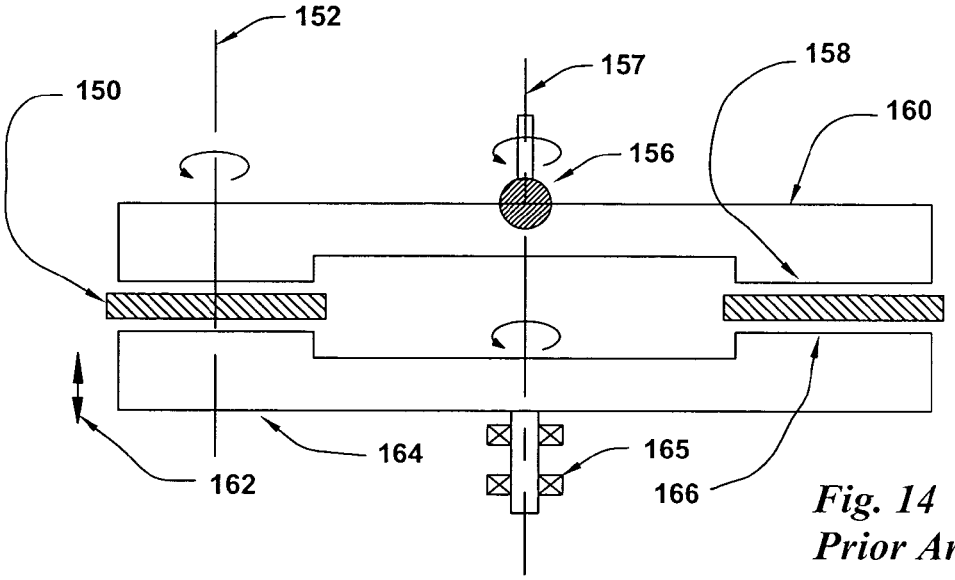
Fig. 14 Prior Art
FIG. 14 is a cross section view of a flat workpiece abraded by double-sided rotary platens.
Figure 15:
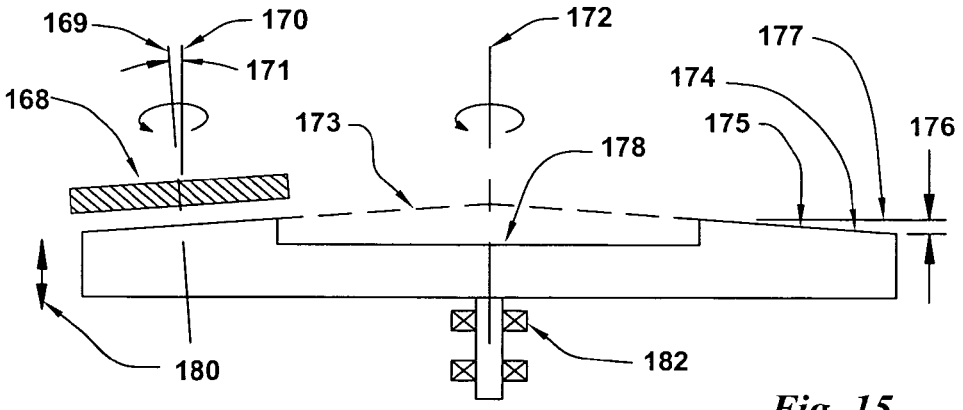
Fig. 15 Prior Art
FIG. 15 is a cross section view of a flat workpiece abraded by an angled single-sided platen.

FIG. 13, FIG. 14 and FIG. 15 are cross sectional views of prior art single-sided and double-sided slurry lapping, micro-grinding (flat-honing) and high-speed flat lapping abrading processes. They show the abrading relationship between flat-surfaced workpieces and flat-surfaced abrasive platens when using planar-flat platens and a defective platen having an angled platen surface.

Figure 16:
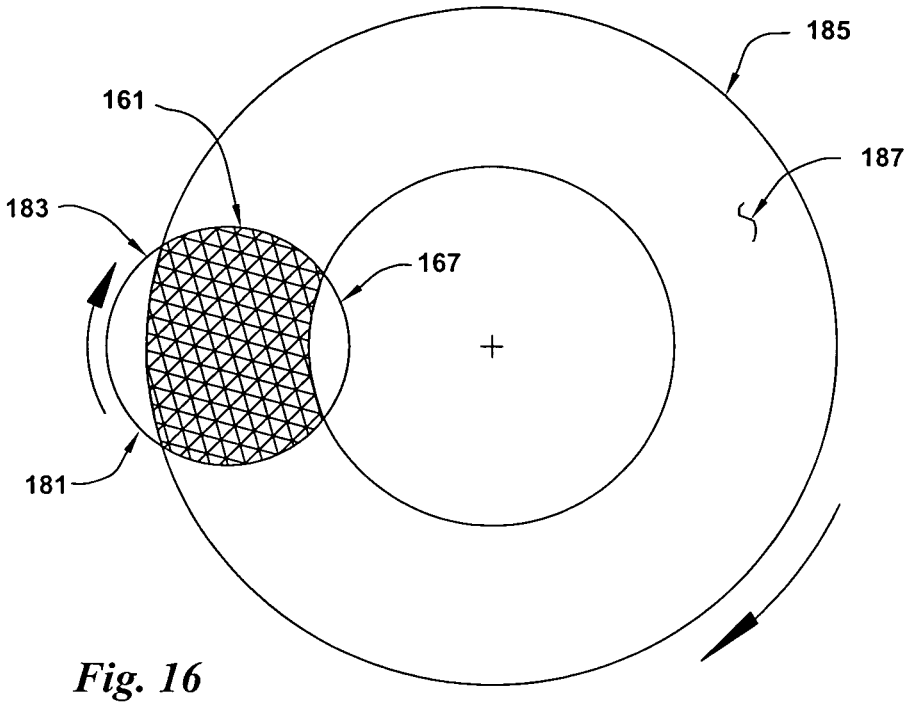
Fig. 16 Prior Art
FIG. 16 is a top view of workpiece on a flat-surfaced platen with an annular abrasive band.
Figure 17:
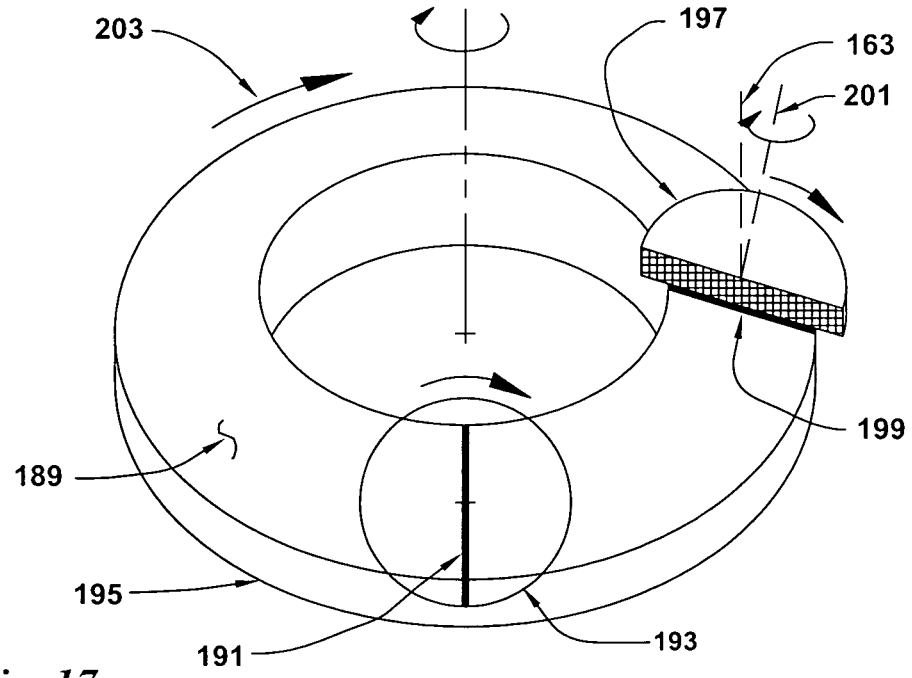
Fig. 17 Prior Art
FIG. 17 is an isometric view of a workpiece on a cone-shaped platen abrasive surface.

FIGS. 16 and 17 are views of prior art flat surfaced workpieces being single-sided abraded by a desired planar-flat annular band of abrasive and a defective angled band of abrasive. The width of the annular abrasive is less than the size of the workpiece. Both the workpieces and the platen rotate is the same direction. This is the abrading process used in slurry lapping, micro-grinding (flat-honing) and high-speed flat lapping abrading processes.

Figure 18:
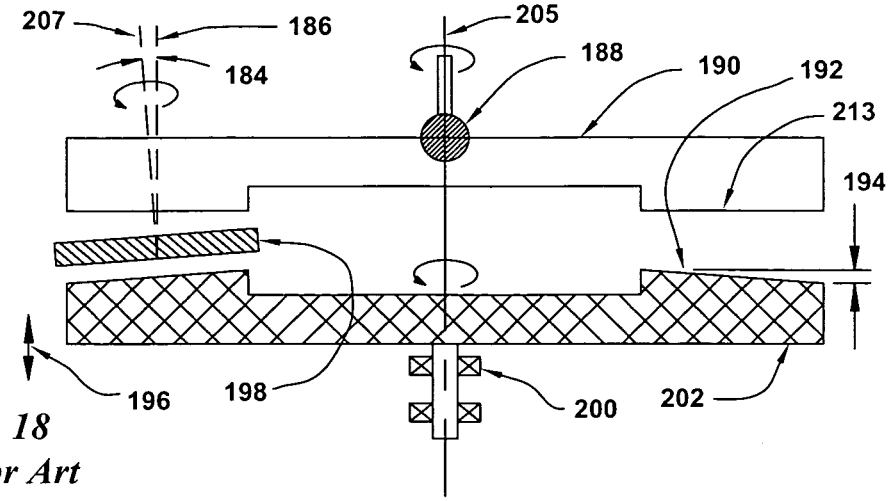
Fig. 18 Prior Art
FIG. 18 is a cross section view of a workpiece abraded by an angled double-sided platen.
Figure 19:
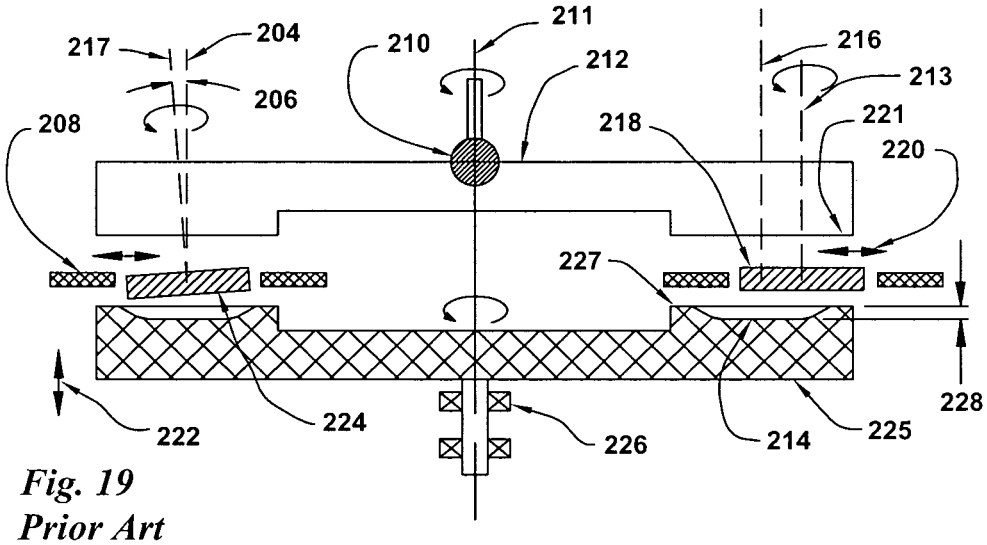
Fig. 19 Prior Art
FIG. 19 is a cross section view of a workpieces held by planetary workholders.
Figure 20:
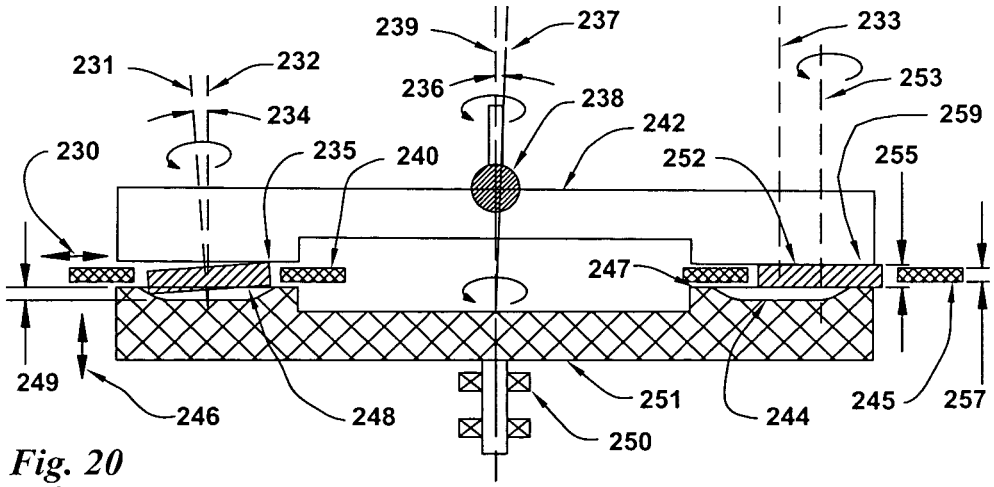
Fig. 20 Prior Art
FIG. 20 is a cross section view of a flat workpiece with a depressed double-sided platen.

FIG. 18, FIG. 19 and FIG. 20 are cross sectional views of prior art flat-surfaced workpieces that are double-sided abraded on both opposed workpiece surfaces by slurry lapping, micro-grinding (flat-honing) and high-speed raised-island flat lapping abrading processes. Planetary workholders rotate and translate the workpieces between the platens relative to the platen abrasive surfaces to provide uniform abrading of the workpiece surfaces. Each of the flat abrasive surfaces on the lower platens is defective due to abrasive surface wear from the workpieces. No wear is shown on the flat upper platen surfaces in these figures to focus attention on the abrading action influences of the defective non-planar platen abrasive surfaces on individual workpieces.

The wear that occurs on the lower platen abrasive surface also occurs on the upper platen abrasive surfaces. However, the wear on the upper platen is typically not a mirror-image of the lower platen because the upper and lower platens are often rotated in opposite directions while the planetary workholders are rotated in one direction. Using opposed platen rotation directions provide a net abrading force on the workpiece of near-zero. This is highly desirable because the same low resultant workpiece net abrading force, which is also applied to the rotary planetary workholder, is very low. Thin workpieces require thinner workholder disks that are fragile, especially at the workholder periphery that is driven by gears or pin-gears. The high abrading forces applied to workpieces by double-sided micro-grinding (flat-honing) can easily damage the thin workholder disks. Damage of the workholder planetary disks is not as much an issue with slurry lapping and high-speed raised-island lapping because the abrading forces applied to the workpieces by these abrading systems are much lower than the abrading forces used in micro-grinding (flat-honing) system.

Rotation of the workholder in the same direction as one of the platens minimizes the non-planar wear of that platen annular abrasive surface but this same direction of workholder rotation makes non-planar wear of the other opposed-direction platen annular abrasive surface worse. This undesirable uneven difference in wear of the upper and lower platens occurs because the differential abrading speed that exist across the radial surface of the rotating platens. Here, the localized abrading speed of the annular platen increases with an increase of the radial location on the platen where low abrading speeds exist at the inner radius of the annular platen and high abrading speeds exist at the outer periphery of the platen. Rotation of the workpieces in the same rotation direction as one platen helps reduce the net abrading speed at that platen outer periphery and increase the net abrading speed at the inner radius of that platen annular abrading surface. The workpieces are rotated fast enough to even-out the speed differential across the radial surface of the platen annular surface for this specific platen. When the other platen is rotated in an opposite direction to the workpiece rotation direction, the net abrading speed at the outer periphery of the platen is made worse by adding the speed of the workpiece to the too-high speed of the platen. Likewise the net abrading speed at the inner radius of the platen is also made worse because the already too-slow platen abrading speed at that location is reduced even further by the workpiece that rotates in the same direction as the platen. Typically the workpieces are rotated at a rotational speed that is 10% of the rotational speed of the platen.

FIG. 10 is a prior art cross section view of a flat workpiece with a concave non-flat surface. A workpiece 112 having a flat top surface 116 has a non-flat concave depression having a non-flat depression depth 114. The top flat surface 116 of the workpiece 112 is co-planar with the bottom mounting surface 118 of the workpiece 112. FIG. 11 is a prior art cross section view of a flat workpiece with an angled non-flat surface. A workpiece 122 has a non-flat angled surface 124. One end of the workpiece 122 has a thickness 125 and a non-flat error distance 120 while the opposed end has a thickness 126. The angled surface 124 is not co-planar with the workpiece 122 flat bottom mounting surface 128. FIG. 12 is a prior art cross section view of a flat workpiece with a raised non-flat surface. A workpiece 130 has a non-flat raised portion 132 having a non-flat raised height 134.

FIG. 13 is a prior art cross section view of a flat workpiece abraded by a single-sided rotary platen. A rotary flat-surfaced platen 142 having an annular abrasive surface 144 (no abrasive shown) is shown with a flat-surfaced workpiece 136 that is rotated about a workpiece axis 138 while the platen 142 is rotated about a platen axis 140. The platen 142 is shown mounted with platen spindle bearings 148. The platen 142 experiences out-of-plane annular abrasive surface 144 elevation excursions 146 due to imperfections of the platen spindle bearings 148 and due to platen 142 surface flatness variations. The workpiece 136 is subjected to the dynamic platen 142 variation excursions 146 as the platen 142 is rotated about the platen axis 140. At low platen 142 rotation speeds, the workpiece 136 "travels" up and down with the platen 142 dynamic excursions 146 but at high platen 142 speeds the mass inertia of the workpiece 136 prevents the workpiece 136 from "following" the up-and-down excursions of the platen 142 as the platen 142 rotates. At very high speeds the platen 142 abrading surface only contacts the workpiece 136 surface at the platen 142 surface-excursion high spots which results in undesirable non-uniform abrading action across the surface of the workpiece 138.

FIG. 14 is a prior art cross section view of a flat workpiece abraded by double-sided rotary platens. Two rotary flat-surfaced platens 160 and 164 having annular abrasive surfaces 158 and 166 (no abrasive shown) are shown with flat-surfaced workpieces 150 sandwiched between the platens 160 and 164. Both opposed flat surfaces of the workpieces 150 are abraded simultaneously during the double-sided abrading action. The workpieces 150 are rotated about the workpiece axes 152 while the platens 160 and 164 are rotated about a platen axis 157. The floating upper platen 160 and the rigid lower platen 164 rotate concentrically with each other about the common rotation axis 157. The lower platen 164 is shown mounted with platen spindle bearings 165 but the upper platen 160 "floats" where the annular abrading surface 158 of the upper platen 160 is supported by the upper surfaces of the equal-thickness workpieces 150 which are supported by the "rigid" lower platen 164 annular-abrasive surface 166. The upper platen 160 is positioned by a spherical bearing 156 device that maintains concentric alignment of the upper platen 160 with the lower platen 164 and the spherical device 156 also drives the platen 160 rotationally. The lower platen 164 experiences out-of-plane annular abrasive surface 166 elevation excursions 162 due to imperfections of the platen spindle bearings 165 and due to platen 164 surface flatness variations. The workpieces 150 are subjected to the dynamic lower platen 164 flatness variation annular abrasive surface 166 excursions 162 as the platen 164 is rotated about the platen axis 157. At low platen 164 rotation speeds, the workpieces 150 "travel" up and down with the platen 164 dynamic excursions 162 but at high platen 164 speeds the mass inertia of the workpieces 150 prevents the workpieces 150 from "following" the up-and-down excursions (hills and valleys) of the platen 164 annular abrasive surface 166 as the platen 164 rotates. At very high speeds the platen 164 abrading surface 166 only contacts the workpieces 150 surfaces at the platen 164 surface-excursion high spots which results in undesirable non-uniform abrading action across the bottom surfaces of the workpieces 150.

FIG. 15 is a prior art cross section view of a flat workpiece abraded by an angled single-sided platen. A rotary flat-surfaced platen 178 having an annular abrasive surface 174 (no abrasive shown) is shown with a flat-surfaced workpiece 168 that is rotated about an angled workpiece axis 169 that is misaligned by an angle 171 with a vertical workpiece 168 rotation axis 170 while the platen 178 is rotated about a platen axis 172. The platen 178 has an annular abrasive surface 175 that is angled from a true platen 178 abrading surface plane 177 where the annular abrasive surface 174 has an angled out-of-plane flatness distance 176. The angled annular abrasive surface 174 forms a shallow cone-shaped 173 abrasive surface. The platen 178 is shown mounted with platen spindle bearings 182. The platen 178 experiences out-of-plane abrasive surface 174 elevation excursions 180 due to imperfections of the platen spindle bearings 182 and due to platen 178 surface flatness variations. The workpiece 168 is subjected to the dynamic platen 178 variation excursions 180 as the platen 178 is rotated about the platen axis 172. At low platen 178 rotation speeds, the workpiece 168 "travels" up and down with the platen 178 dynamic excursions 180 but at high platen 178 speeds the mass inertia of the workpiece 168 prevents the workpiece 168 from "following" the up-and-down excursions of the platen 178 annular abrasive surface 175 as the platen 178 rotates. At very high speeds the platen 178 abrading surface only contacts the workpiece 168 surface at the platen 178 surface-excursion high spots which results in undesirable non-uniform abrading action across the surface of the workpiece 168.

FIG. 16 is a prior art top view of workpiece on a flat-surfaced rotating platen with an annular abrasive band. A platen 185 having a precision flat planar annular abrading surface 187 is in flat abrading contact with a rotating flat workpiece 183 where the workpiece 183 has a substantial abrading surface portion 161 that is in abrading contact with the flat abrading surface 187. All of the flat workpiece 183 flat surface is in abrading contact with the flat abrading surface 187 except for the outer periphery portions 181 and 167 of the workpiece 183 that overhang the annular abrading surface 187. FIG. 17 is a prior art isometric view of a workpiece in abrading contact with a cone-shaped platen abrasive surface. A platen 195 has an angled cone-shaped annular abrading surface 189 that is in abrading contact with workpieces 193 and 197. The platen 195 has a direction of rotation 203 that is in the same direction of rotation as the workpiece 197 and the workpiece 193. The workpiece 197 has an angled rotation axis 201 that tilts away from a vertical axis 163 due to the non-planar angle of the cone-shaped annular abrasive band 189. Because the platen 195 has a cone-shaped annular abrasive band 189 the rigid flat-surfaced workpieces 193 and 197 have only abrading-line contacts 199 and 191. The workpiece 193 is shown as a see-through top view to indicate the location of the abrasive contact-line 191. The workpiece 197 is shown as a half-cutaway to indicate the location of the abrading-line contact 199. Abrading line-contact with precision flat workpieces is highly undesirable because abrading action is concentrated exclusively only on a line-portion of the workpiece rather than uniformly across the near-full flat surface of the workpieces 193, 197.

FIG. 18 is a cross section view of a prior art workpiece abraded by an angled double-sided platen. Two rotary flat-surfaced platens 190 and 202 have annular abrasive surfaces 213 and 192. No abrasive is shown on the upper platen 190. A large-sized flat-surfaced workpiece 198 is sandwiched between the platens 190 and 202. The lower platen 202 is shown with a localized, or full annular cone-shaped, angled non-planar annular abrasive surface 192 which has an out-of-plane flatness variation 194. Both opposed flat surfaces of the workpieces 198 (only one is shown) are abraded simultaneously during the double-sided abrading action. The workpiece 198 is rotated about the workpiece axis 207 that is angled 184 with a vertical axis 186 while the platens 190 and 202 are rotated about a common platen axis 205. The floating upper platen 190 and the rigid lower platen 202 rotate concentrically with each other about the common rotation axis 205. The lower platen 202 is shown mounted with platen spindle bearings 200 but the upper platen 190 "floats" where the annular abrading surface 213 of the upper platen 190 is supported by the upper surfaces of the equal-thickness workpieces 198 which are supported by the "rigid" lower platen 202 annular-abrasive surface 192. The upper platen 190 is positioned by a spherical bearing 188 device that maintains concentric alignment of the upper platen 190 with the lower platen 202 and the spherical bearing device 188 also drives the platen 190 rotationally. The lower platen 202 experiences out-of-plane annular abrasive surface 192 elevation excursions 196 due to imperfections of the platen 202 spindle bearings 200 and due to platen 202 abrasive surface 192 flatness variations. The workpieces 198 are subjected to the dynamic lower platen 202 flatness variation annular abrasive surface 192 excursions 196 as the platen 202 is rotated about the platen axis 205. At low platen 202 rotation speeds, the workpieces 198 "travel" up and down with the platen 202 dynamic excursions 196 but at high platen 202 speeds the mass inertia of the workpieces 198 prevents the workpieces 198 from "following" the up-and-down excursions (hills and valleys) of the platen 202 annular abrasive surface 192 as the platen 202 rotates. At very high speeds the platen 202 abrading surface 192 only contacts the workpieces 198 surfaces at the platen 202 abrasive surface 192 excursion high spots which results in undesirable non-uniform abrading action across the bottom surfaces of the workpieces 198.

FIG. 19 is a cross section view of prior art small workpieces abraded by a depressed-area double-sided platen system where the small workpieces are moved radially across the platen by a planetary workholder disk. Two rotary flat-surfaced platens 212 and 225 have annular abrasive surfaces 221 and 227. No abrasive particles are shown on the upper platen 212 or the lower platen 225. Flat-surfaced small-sized workpieces 224 and 218 are sandwiched between the platens 212 and 225 and are held by planetary workholder disks 208 that move the workpieces 224 and 218 radially relative to the platens 212 and 225 through an excursion distance 220. The lower platen 225 is shown with a localized, or full annular trough-shaped, depressed non-planar annular abrasive surface 214 which has an out-of-plane flatness variation 228. Both opposed flat surfaces of the workpieces 224 and 218 are abraded simultaneously during the double-sided abrading action. The workpiece 224 is shown tipped down into the depressed area 214 as it is moved radially through the excursion distance 220 by the workholder 208 and the workpiece 224 is also rotated about the workholder 208 vertical rotational axes 204. The workholder 208 is rotationally driven. The floating upper platen 212 and the rigid lower platen 225 rotate concentrically with each other about the common rotation axis 211.

The small-sized workpieces 218 and 224 that is tipped into the recessed area 214 has a resultant tilted rotational axis 217 and has an angle 206 with the workholder 208 vertical rotation axis 204. The small-sized workpiece 218 is shown retaining its flat position (non-tipped) as it is moved radially by the planetary workholder 208 to an outer periphery flat ledge area of the abrading surface 227 where the workpiece 218 is rotated about a vertical workholder 208 rotation axis 216 that is offset from the center axis 213 of the workpiece 218. Because the workpieces 218 and 224 are small-sized multiple workpieces they are carried by a single workholder disk 208 that rotates about workholder axes 204 and 216.

The individual workpiece 218 shown here is translated 208 to the outer peripheries of the platens 212 and 225 as the workholder disk 208 is rotated. This radial translation 208 of the workpiece 218 results in the vertical workholder 208 rotation axis 216 becoming offset from the center axis 213 of the workpiece 218.

The lower platen 225 is shown mounted with platen spindle bearings 226 but the upper platen 212 "floats" where the annular abrading surface 221 of the upper platen 212 is supported (not shown) by the upper surfaces of the equal-thickness workpieces 224 and 218 which are supported (not shown) by the "rigid" lower platen 225 annular-abrasive surface 227. The upper platen 212 is positioned by a spherical bearing 210 device that maintains concentric alignment of the upper platen 212 with the lower platen 225 and the spherical bearing device 210 also drives the platen 212 rotationally. The lower platen 225 experiences out-of-plane annular abrasive surface 227 elevation excursions 222 due to imperfections of the platen 225 spindle bearings 226 and due to platen 225 abrasive surface 227 flatness variations. The workpieces 224 and 218 are subjected to the dynamic lower platen 225 flatness variation annular abrasive surface 227 excursions 222 as the platen 225 is rotated about the platen axis 211. At low platen 225 rotation speeds, the workpieces 224 and 218 "travel" up and down with the platen 225 dynamic excursions 222 but at high platen 225 speeds the mass inertia of the workpieces 224 and 218 prevents the workpieces 224 and 218 from "following" the up-and-down excursions (hills and valleys) of the platen 225 annular abrasive surface 227 as the platen 225 rotates. At very high speeds the platen 225 abrading surface 227 only contacts the workpieces 224 and 218 surfaces at the platen 225 abrasive surface 227 excursion high spots which results in undesirable non-uniform abrading action across the bottom surfaces of the workpieces 224 and 218.

FIG. 20 is a cross section view of prior art small workpieces abraded simultaneously on both surfaces by a depressed-area double-sided platen system where the small workpieces are moved radially across the platen by a planetary workholder disk. Two rotary flat-surfaced platens 242 and 251 have annular abrasive surfaces 259 and 247. No abrasive particles are shown on the upper platen 242 or the lower platen 251. Flat-surfaced small-sized workpieces 248 and 252 are sandwiched between the platens 242 and 251 and are held by planetary workholder disks 240 and 245 that move the workpieces 248 and 252 radially relative to the platens 242 and 251 through an excursion distance 230. The lower platen 251 is shown with a localized, or full annular trough-shaped, depressed non-planar annular abrasive surface 244 which has an out-of-plane flatness variation 249. Both opposed flat surfaces of the workpieces 248 and 252 are abraded simultaneously during the double-sided abrading action. The small-sized workpiece 248 is shown tipped into the depressed area 244 as it is moved radially through the excursion distance 230 by the planetary workholder 240 and the workpiece 248 is also rotated about the workholder 240 rotational vertical axis 232. The workholders 240 and 245 are rotationally driven.

The floating upper platen 242 and the rigid lower platen 251 rotate concentrically with each other about the common rotation axis 237.

The small-sized workpiece 248 that is tipped into the recessed area 244 has a resultant tilted rotational axis 231 and has an angle 234 with the workholder 240 vertical rotation axis 232. The small-sized workpiece 252 is shown retaining its flat position (non-tipped) as it is moved radially by the planetary workholder 245 to an outer periphery flat ledge area of the abrading surface 247 where the workpiece 252 is rotated about a vertical workholder 245 rotation axis 233 that is offset from the center axis 253 of the workpiece 252. Because the workpieces 248 and 252 are small-sized multiple workpieces 248 and 252 they are carried by a single workholder disk 245 that rotates about a workholder axis 233. The individual workpiece 252 shown here is translated 230 to the outer peripheries of the platens 242 and 251 as the workholder disk 245 is rotated. This radial translation 230 of the workpiece 252 results in the vertical workholder 245 rotation axis 233 becoming offset from the center axis 253 of the workpiece 245.

The workpieces 248 and 252 have a thickness 255 while the workholder disks 240 and 245 have a thickness 257 that is less than the workpieces 248 and 252 to assure that the workholders disks 240 and 245 are not in abrading-pressure-contact with the flat-surfaced platens 242 and 251 annular abrasive surfaces 252 and 247. When very thin semiconductor, or other, workpieces 248 and 252 having a thickness 255 that is only 0.010 inches, or less, thick, then the workholder disks 240 and 245 must have a thickness that is less than 0.010 inches. These very thin workholder disks 240 and 245 are very fragile and are susceptible to damage as they are gear or pin-gear driven (not shown) at both the inner and outer peripheries of the platens 242 and 251. These thin workholder disks 240 and 245 can not be rotated at high rotational speeds because they too fragile to be driven at high speeds by the rotational drive gears or drive pins. Also, these thin workholder disks 240 and 245 can not withstand large abrading forces imposed on them by applying large abrading forces to the workpieces 248 and 252 by the abrading surfaces 245 and 247.

The lower platen 251 is shown mounted with platen spindle bearings 250 but the upper platen 242 "floats" where the annular abrading surface 245 of the upper platen 242 is supported by the upper surfaces of the equal-thickness rigid workpieces 248 and 252 which are supported by the "rigid" lower platen 251 annular-abrasive surface 247. The floating upper platen 242 rotates about a tilted axis 239 that has an angle 236 with a vertical axis 237 because the platen 251 supporting workpiece 248 moves downward into the recessed area hole 244. Here the workpiece 248 has an undesirable "point" abrading contact 235 with the upper platen 242 annular abrading surface 245. The rigid lower platen 251 rotates about the vertical rotation axis 237. The upper platen 242 is positioned by a spherical bearing device 238 that maintains concentric alignment of the upper platen 242 with the lower platen 251 and the spherical device 238 also drives the platen 242 rotationally. The lower platen 251 experiences out-of-plane annular abrasive surface 247 elevation excursions 246 due to imperfections of the platen 251 spindle bearings 250 and due to platen 251 abrasive surface 247 flatness variations. The workpieces 248 and 252 are subjected to the dynamic lower platen 251 flatness variation annular abrasive surface 247 excursions 246 as the platen 251 is rotated about the platen axis 237. At low platen 251 rotation speeds, the workpieces 248 and 252 "travel" up and down with the platen 251 dynamic excursions 246 but at high platen 251 speeds the mass inertia of the workpieces 248 and 252 prevents the workpieces 248 and 252 from "following" the up-and-down excursions (hills and valleys) of the platen 251 annular abrasive surface 247 as the platen 251 rotates. At very high speeds the platen 251 abrading surface 247 only contacts the workpieces 248 and 252 surfaces at the platen 251 abrasive surface 247 excursion high spots which results in undesirable non-uniform abrading action across the bottom surfaces of the workpieces 248 and 252.

Figure 21:
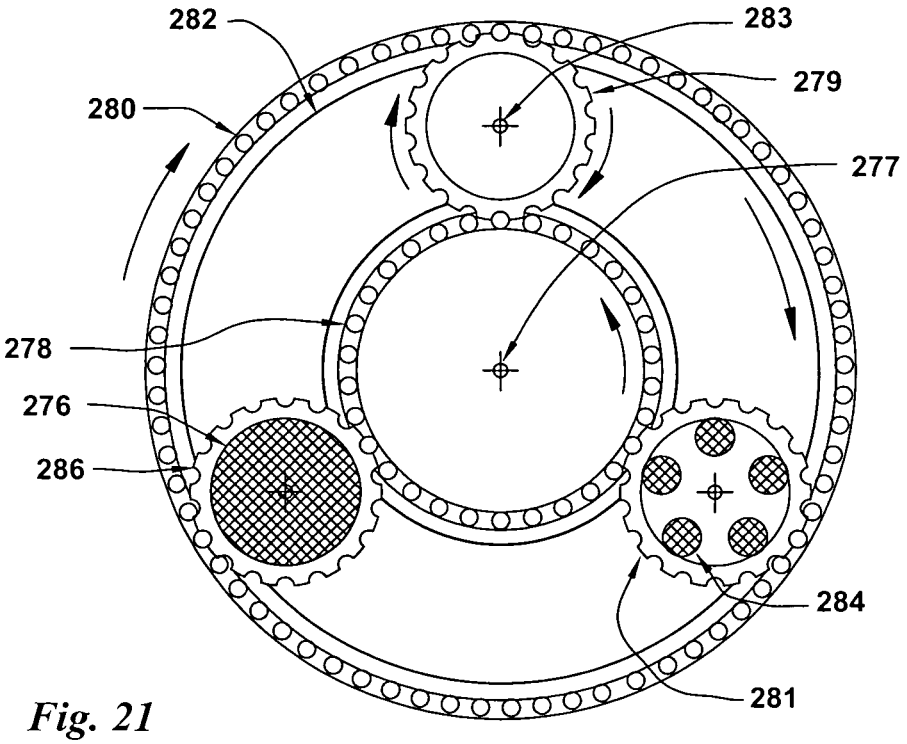
Fig. 21 Prior Art
FIG. 21 is a top view of workpieces and planetary workholders on an abrasive platen.

FIG. 21 is a top view of prior art pin-gear driven planetary workholders and workpieces on an abrasive platen. A rotating annular abrasive coated platen 282 and three planetary workholder disks, 279, 281 and 286 that are driven by a platen 282 outer periphery pin-gear 280 and a platen 282 inner periphery pin-gear 278 are shown. Typically the outer periphery pin-gear 280 and the inner periphery pin-gear 278 are driven in opposite directions where the three planetary workholder disks 279, 281 and 286 rotate about a workholder rotation axis 283 but maintain a stationary position relative to the platen 282 rotation axis 277 or they slowly rotate about the platen 282 rotation axis 277 as the platen 282 rotates about the platen rotation axis 277. The outer pin-gears 280 and the inner pin-gears 278 rotate independently in either rotation direction and at different rotation speeds to provide different rotation speeds of the workholder disks 279, 281 and 286 about the workholder rotation axes 283 and also to provide different rotation directions and speeds of the workholders disks 279, 281 and 286 about the platen 282 rotation axis 277. A single individual large-diameter flat-surfaced workpiece 276 is positioned inside the rotating workholder 286 and multiple small-diameter flat-surfaced workpieces 284 are positioned inside the rotating workholder 281. The workholder 279 does not contain a workpiece.

Figure 22:
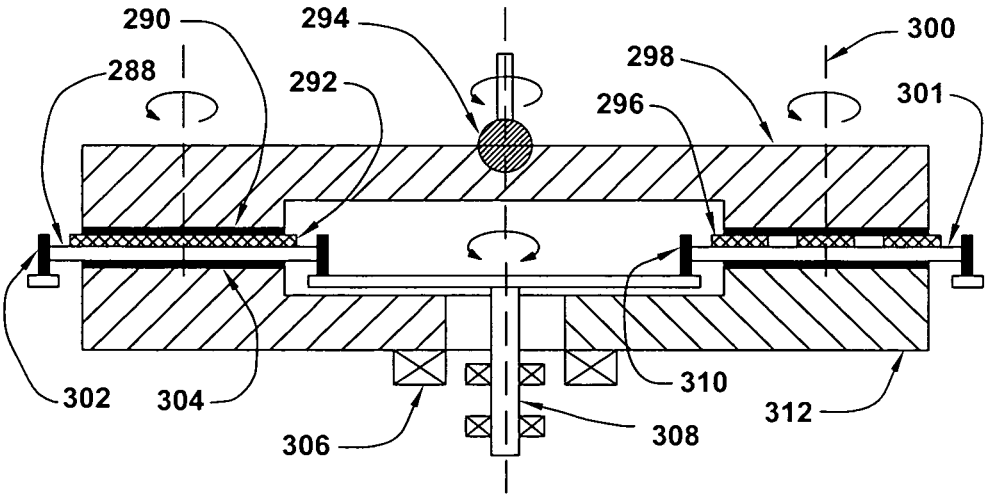
Fig. 22 Prior Art
FIG. 22 is a cross section view of planetary workholders and a double-sided abrasive platen.

FIG. 22 is a cross section view of prior art planetary workholders, workpieces and a double-sided abrasive platen. The abrading surface 290 of a rotating upper floating platen 298 and the abrading surface 304 of a rotating lower rigid platen 312 are in abrading contact with flat-surfaced workpieces 292 and 296. A planetary workholder 288 contains a single large-sized workpiece 292 and the planetary workholder 301 contains multiple small-sized workpieces 296. The planetary flat-surfaced workholder disks 288 and 301 rotate about a workholder axis 300 and the workholder disks 288 and 301 are driven by outer periphery pin-gears 302 and inner periphery pin-gears 310. The inner periphery pin-gears 310 are mounted on a rotary drive spindle that has a spindle shaft 308. The rigid-mounted lower platen 312 is supported by platen bearings 306. The floating upper spindle 298 is driven by a spherical rotation device 294 that allows the platen 298 to be conformably supported by the equal-thickness workpieces 292 and 296 that are supported by the lower rigid platen 312.

Figure 23:
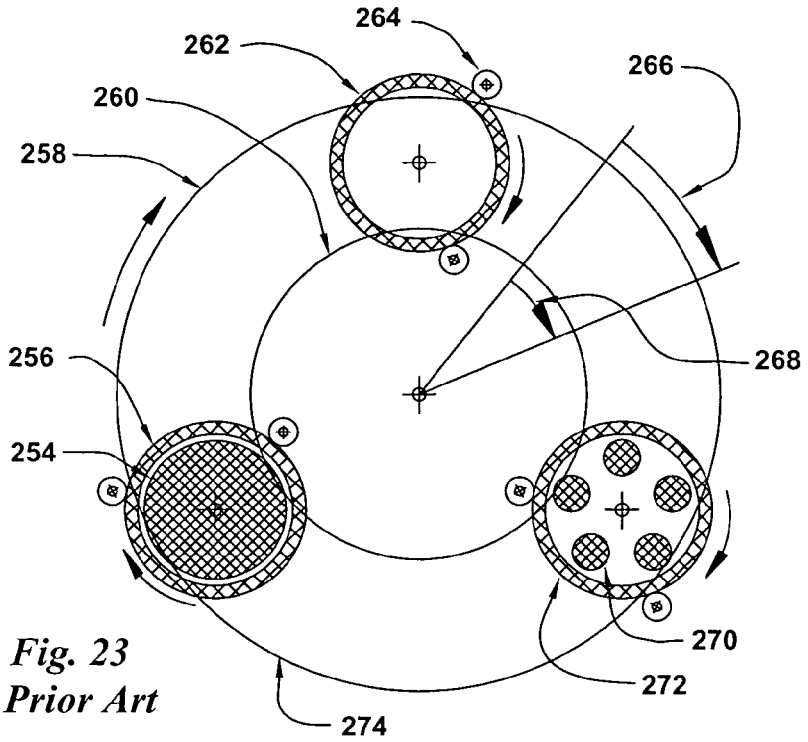
Fig. 23 Prior Art
FIG. 23 is a top view of workpieces and conditioner rings on an abrasive platen.

FIG. 23 is a top view of prior art workpieces and platen surface conditioner rings on an abrasive platen. A rotating annular abrasive coated platen 258 having an outer periphery 274 and an inner periphery 260 has abrasive-surfaced annular-shaped conditioning rings 256, 262 and 272. A single individual large diameter flat-surfaced workpiece 254 is positioned inside the rotating annular conditioning ring 256 and multiple small-diameter flat-surfaced workpieces 270 are positioned inside the rotating annular conditioning ring 272. The conditioning ring 262 does not contain a workpiece. The rotating conditioning rings 256, 262 and 272 are held in position relative to the rotating platen 258 by sets of two support bearings 264 where the conditioning rings 256, 262 and 272 are rotated by the differential abrading speeds at the outer periphery 274 and an inner periphery 260 of the rotating platen 258. The platen 258 has a large abrading speed 266 at the outer periphery 274 which is greater than the small abrading speed 268 at the inner periphery 260. The speed differential between the large abrading speed 266 and the small abrading speed 268 rotates the conditioning rings 256, 262 and 272 in the same rotation direction as the platen 258.

Figure 24:
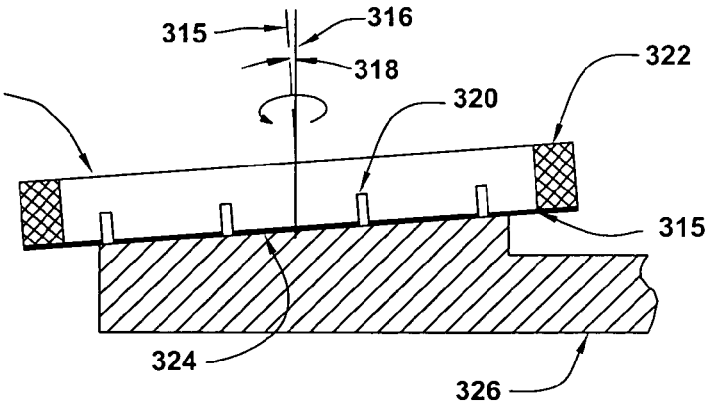
Fig. 24 Prior Art
FIG. 24 is a cross section view of a planetary workholder and an angled abrasive platen.

FIG. 24 is a cross section view of a prior art planetary workholder and a single-sided abrasive platen having an angled annular abrasive surface. A platen 326 has an undesired angled annular abrasive surface 324 that is in abrading contact with an abrasive 315 coated conditioning ring 314 that has an annular outer conditioning portion 322. The conditioning ring 314 that is in conformal contact with the platen 326 angled abrading surface 324 rotates about an angled axis 315 that has an angle 318 with a vertical axis 316. The conditioning ring 314 has slots 320 that allow abrasive slurry (not shown) and abrasive debris (not shown) to pass from the interior of the annular conditioning ring 314 to the exterior during the platen 326 conditioning process which removes the platen 326 angled surface 324 to develop a planar annular abrading surface on the platen 326.

Figure 25:
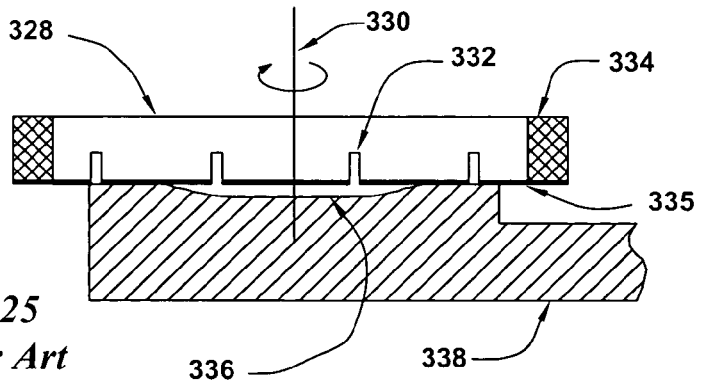
Fig. 25 Prior Art
FIG. 25 is a cross section view of a planetary workholder and a depressed abrasive platen.

FIG. 25 is a cross section view of a prior art planetary workholder and a single-sided abrasive platen having a depressed annular abrasive surface. A platen 338 has an undesired depressed annular abrasive surface 336 that is in abrading contact with an abrasive 335 coated conditioning ring 328 that has an annular outer conditioning portion 334. The conditioning ring 328 that is in conformal contact with the platen 338 depressed abrading surface 336 rotates about an axis 330. The conditioning ring 328 has slots 332 that allow abrasive slurry (not shown) and abrasive debris (not shown) to pass from the interior of the annular conditioning ring 328 to the exterior during the platen 338 conditioning process which removes the platen 338 recessed surface 336 to develop a planar annular abrading surface on the platen 338.

Figure 26:
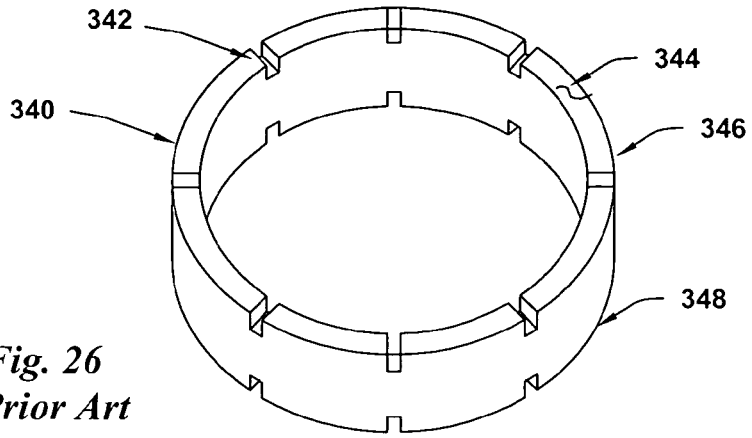
Fig. 26 Prior Art
FIG. 26 is an isometric view of a platen double-sided conditioning ring.

FIG. 26 is an isometric view of a prior art platen double-sided conditioning ring used to re-condition or re-flatten the flat abrading surfaces of both the upper and lower platens of a double-sided abrading system. The annular conditioning ring 340 has abrasive slurry or abrasive debris slots 242 where the annular ring 340 has an abrasive 344 coated upper surface 346 and an abrasive 344 coated lower surface 348.

Figure 27:
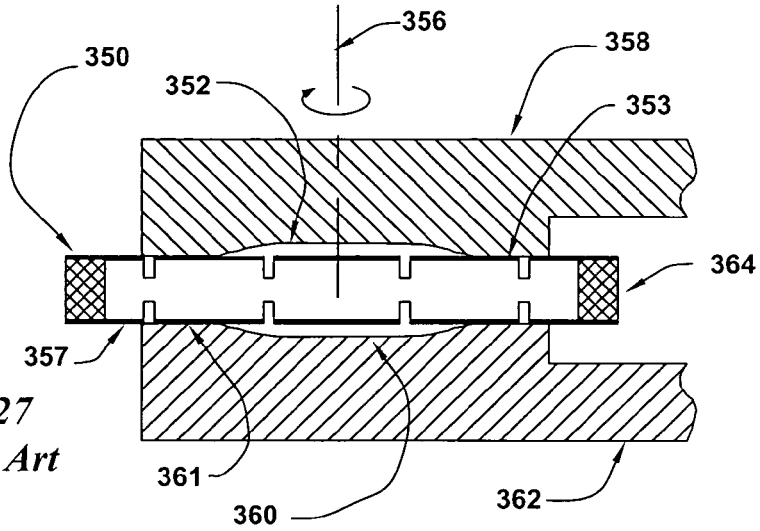
Fig. 27 Prior Art
FIG. 27 is a cross section view of a double-sided conditioning ring a depressed platen.

FIG. 27 is a cross section view of a prior art double-sided conditioning ring that has a depressed platen abrading surface. The upper platen 358 has a depressed area 352 and the lower platen 362 has a depressed area 360. The annular conditioning ring 364 that rotates about an axis 356 has an abrasive surface 350 that contacts the abrading surface 353 of the upper platen 358 and has an abrasive surface 357 that contacts the abrading surface 361 of the lower plate 362.

Figure 28:
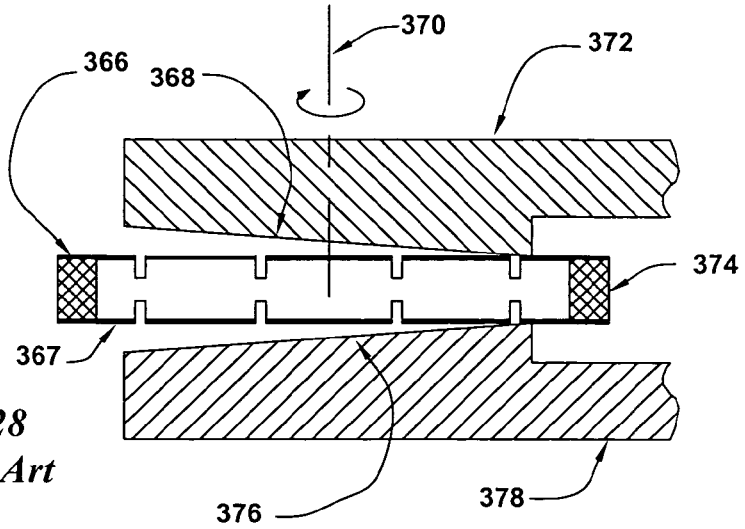
Fig. 28 Prior Art
FIG. 28 is a cross section view of a double-sided conditioning ring an angled platen.

FIG. 28 is a cross section view of a prior art double-sided conditioning ring that has an angled platen abrading surface. The upper platen 372 has an angled abrasive area 368 and the lower platen 378 has an angled abrasive area 376. The annular conditioning ring 374 that rotates about an axis 370 has an abrasive surface 366 that contacts the abrading surface 368 of the upper platen 372 and has an abrasive surface 367 that contacts the abrading surface 376 of the lower plate 378.

Figure 29:
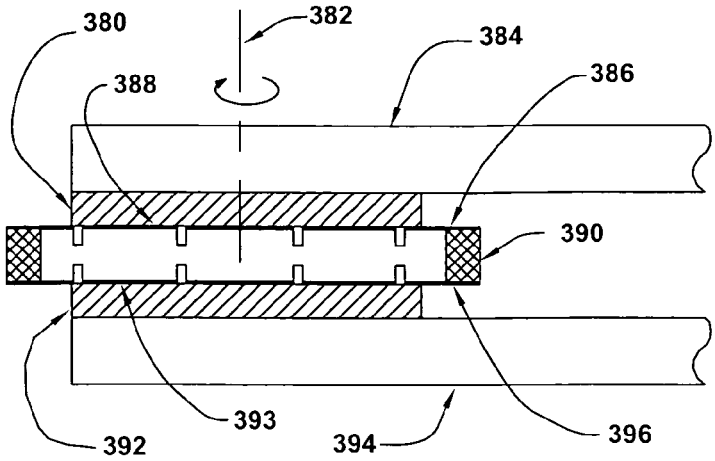
Fig. 29 Prior Art
FIG. 29 is a cross section view of double-sided conditioning of a flat solid abrasive.

FIG. 29 is a cross section view of double-sided conditioning of a flat solid abrasive. The upper rotating platen 384 has a solid abrasive layer 380 that has a flat-surfaced area 388 and the lower rotating platen 394 has a solid abrasive layer 392 that has a flat-surfaced area 393. The annular conditioning ring 390 that rotates about an axis 382 has an abrasive surface 386 that contacts the abrading surface 388 of the upper platen 384 and has an abrasive surface 396 that contacts the abrading surface 393 of the lower platen 394.

Figure 30:
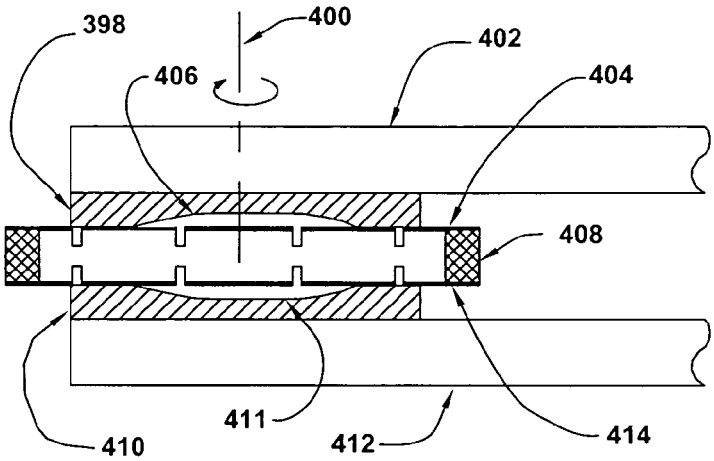
Fig. 30 Prior Art
FIG. 30 is a cross section view of double-sided conditioning of depressed solid abrasive.

FIG. 30 is a cross section view of double-sided conditioning of depressed solid abrasive. The upper rotating platen 402 has a solid abrasive layer 398 that has a depressed area 406 and the lower rotating platen 412 has a solid abrasive layer 410 that has a depressed area 411. The annular conditioning ring 408 that rotates about an axis 400 has an abrasive surface 404 that contacts the abrading layer 398 of the upper platen 402 and has an abrasive surface 414 that contacts the abrading layer 410 of the lower platen 412.

Figure 31:
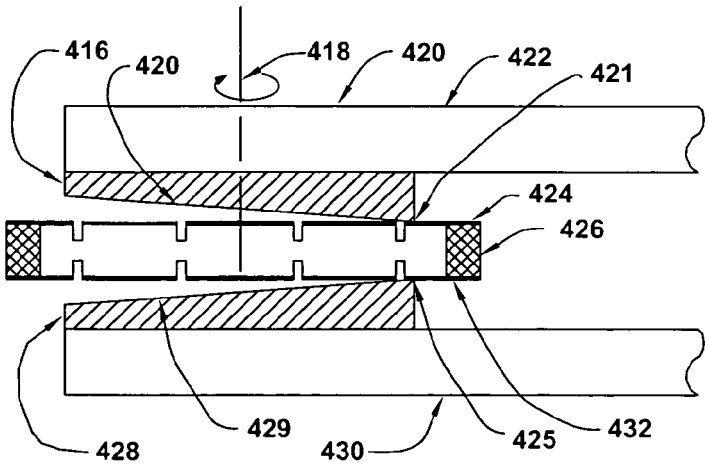
Fig. 31 Prior Art
FIG. 31 is a cross section view of double-sided conditioning of an angled solid abrasive.

FIG. 31 is a cross section view of double-sided conditioning of an angled solid abrasive. The upper rotating platen 422 has a solid abrasive layer 416 that has an angled area 420 and the lower rotating platen 430 has a solid abrasive layer 428 that has an angled area 429. The annular conditioning ring 426 that rotates about an axis 418 has an abrasive surface 424 that contacts the abrasive layer 416 angled portion 420 of the upper platen 422 at a single line 421 and has an abrasive surface 432 that contacts the abrasive layer 428 angled portion 429 of the lower platen 430 at a single line 425.

Figure 32:
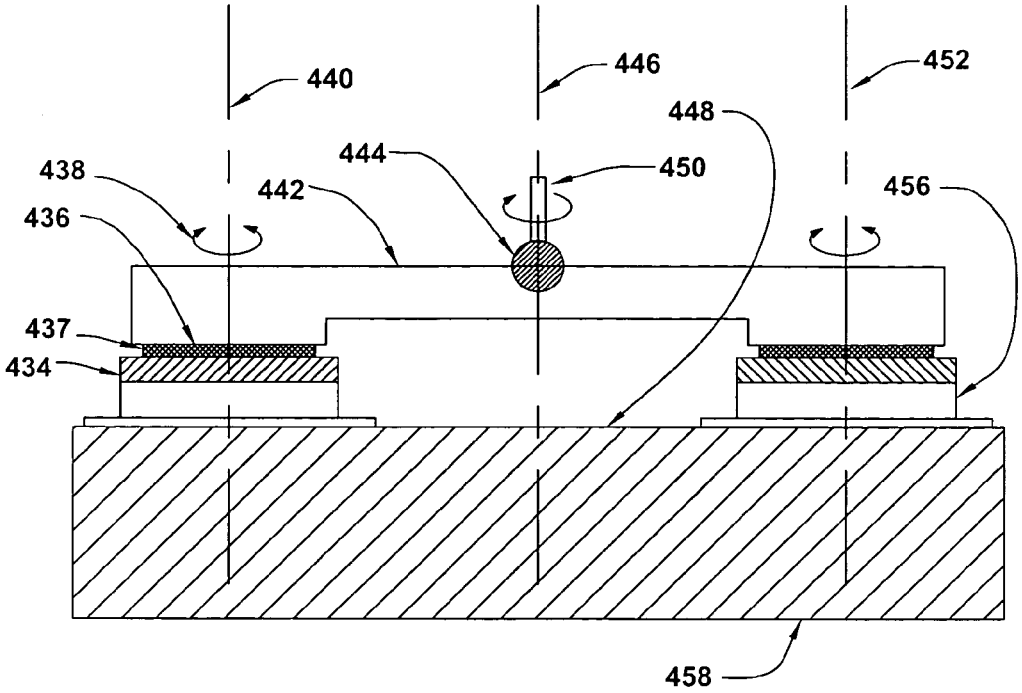
FIG. 32 is a cross section view of three-point spindles and a floating solid-abrasive platen.

FIG. 32 is a cross section view of three-point spindles and a floating solid-abrasive platen. A floating circular platen 442 has a spherical-action rotating drive mechanism 444 having a drive shaft 450 where the platen 442 rotates about an axis 446. Three workpiece spindles 456 (one not shown) having rotatable spindle tops 434 are mounted to the top approximate-flat surface 448 of a machine base 458 that is constructed from granite, metal or composite or other materials. The flat top surfaces of the spindle 456 tops 434 are all in a common plane that is approximately co-planar with the top flat surface 448 of the machine base 458. The floating platen 442 is three-point supported by the three equally-spaced spindles 456 where the thick solid abrasive layer 437 that is attached to the flat planar annular surface of the platen 442 is shown in flat contact with the top flat surfaces of the fixed-position spindle 456 rotating tops 434. The spindle tops 434 rotate 438 about a spindle axis 440.

Figure 33:
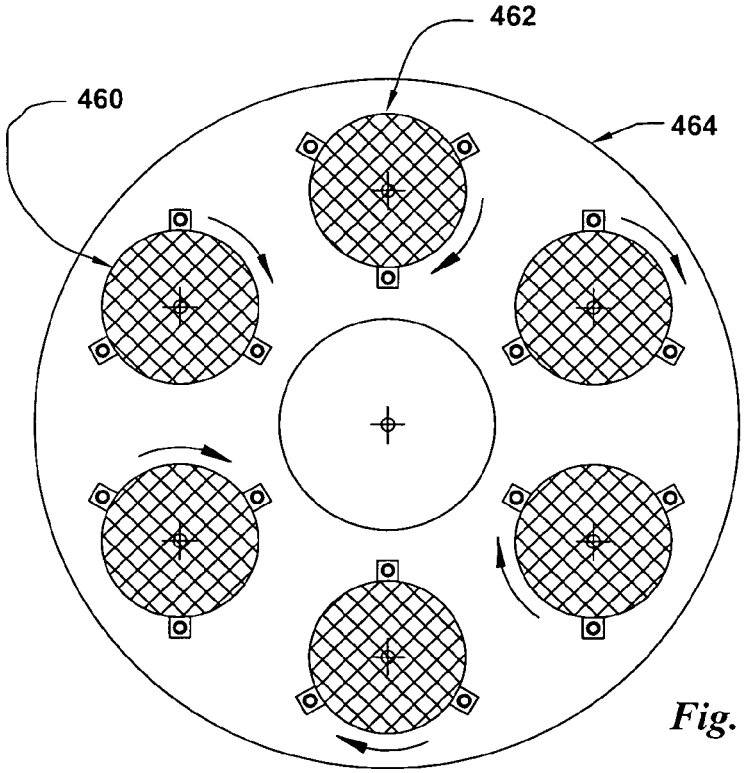
FIG. 33 is a top view of multiple fixed-spindles that support a floating abrasive platen.

FIG. 33 is a top view of multiple fixed-spindles that support a floating abrasive platen. A flat-surfaced granite base 464 supports multiple fixed-position air bearing spindles 460 that have rotating flat-surfaced tops 462. The multiple spindles 460 support a floating abrasive platen (not shown) flat abrading surface on the multiple spindle top 462 flat surfaces that are all co-planar.

Figure 34:
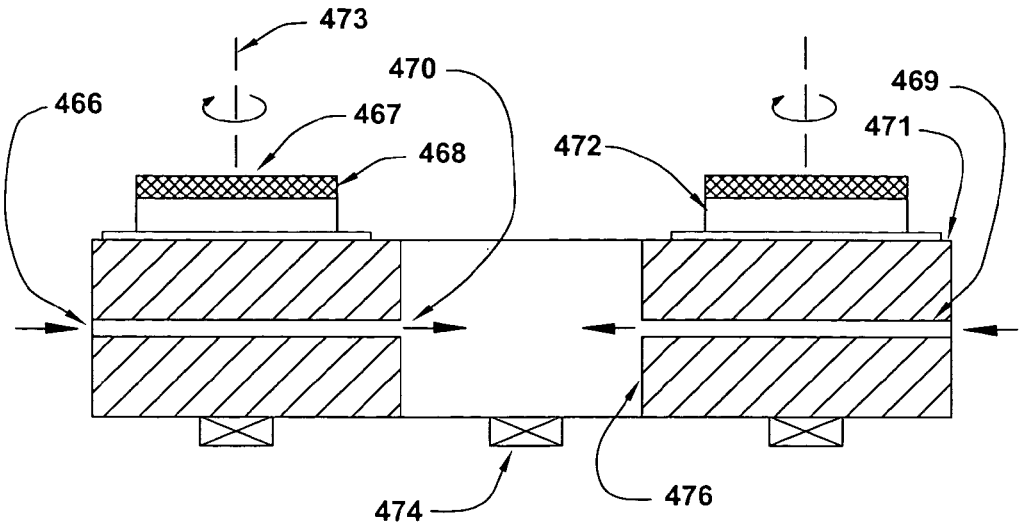
FIG. 34 is a cross section view of three-point spindles on a fluid passageway granite base.

FIG. 34 is a cross section view of three-point spindles on a fluid passageway granite base. Rotary spindles 472 are mounted to the top flat surface of a granite, or other material, machine base 476 that is supported at three points by base supports 474. Only two of the set of three spindles 472 are shown. Each of the spindles 472 has rotary tops 468. The flatness of the base 476 top surface 471 is established when the base 476 is manufactured with the same three-point base supports 474 which allows the flatness of the surface 471 of the base 476 to be retained when the base 476 is later mounted in an abrading machine (not shown) frame using these same base supports 474. Equal thickness spindles 472 have rotary tops 468 that have flat surfaces 467 where the flat surfaces 467 are in a common plane that is approximately co-planar with the base 476 top surface 471. The spindles 472 have axes of rotation 473. The granite base 476 has internal fluid passageways 469 that have a fluid entrance 466 and a fluid exit 470. The granite base 476 fluid passageways 469 maintain the temperature of the granite base 476 at a uniform temperature which prevents localized thermal expansions or thermal contractions of portions of the granite base 476 from distorting the flatness of the granite base 476 mounting surface 471 due to ambient temperature changes or machine component or machine operation induced granite base 476 temperature changes.

Figure 35:
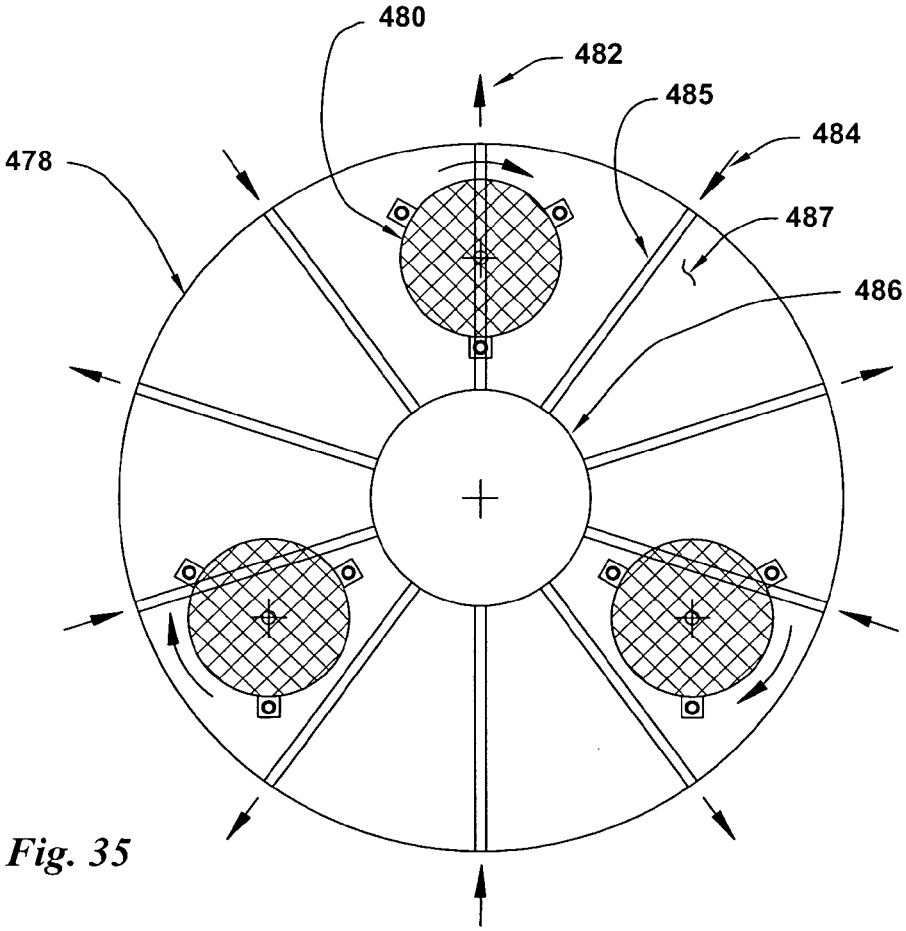
FIG. 35 is a top view of three-point spindles on a fluid passageway granite base.

FIG. 35 is a top view of equally-spaced three-point fixed-position spindles mounted on a granite machine base that has internal fluid passageways. Rotary spindles 480 are mounted on a granite machine base 478 having an approximately-flat surface 487 surface 487. Each of the three equally-spaced spindles 480 has equally-spaced three-point mounting legs that are attached with mechanical fasteners (not shown) to the machine base 478 surface 487. The annular shaped granite base 478 has an inner periphery 486 that provides a circular open area that allows interconnection of internal fluid passageways 485 that have a fluid entrance 484 and a fluid exit 482. The granite base 476 fluid passageways 485 maintain the temperature of the granite base 478 at a uniform temperature which prevents localized thermal expansions or thermal contractions of portions of the granite base 478 from distorting the flatness of the granite base 478 mounting surface 487 due to ambient temperature changes or machine component or machine operation induced granite base 478 temperature changes.

Figure 36:
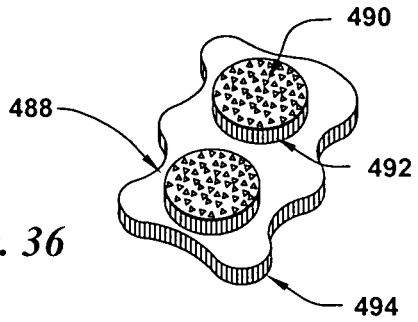
FIG. 36 is an isometric view of fixed-abrasive coated raised islands on an abrasive disk.

FIG. 36 is an isometric view of fixed-abrasive coated raised islands on an abrasive disk. Abrasive particle 490 coated raised islands 492 are attached to an abrasive disk 488 backing 494.

Figure 37:
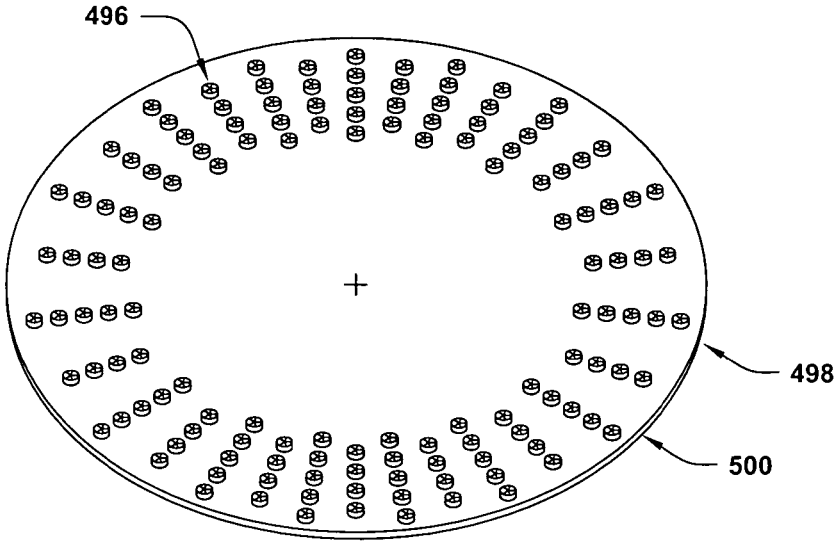
FIG. 37 is an isometric view of a fixed-abrasive coated raised island abrasive disk.

FIG. 37 is an isometric view of a flexible fixed-abrasive coated raised island abrasive disk. Abrasive particle coated raised islands 496 are attached to an abrasive disk 500 backing 498.

Figure 38:
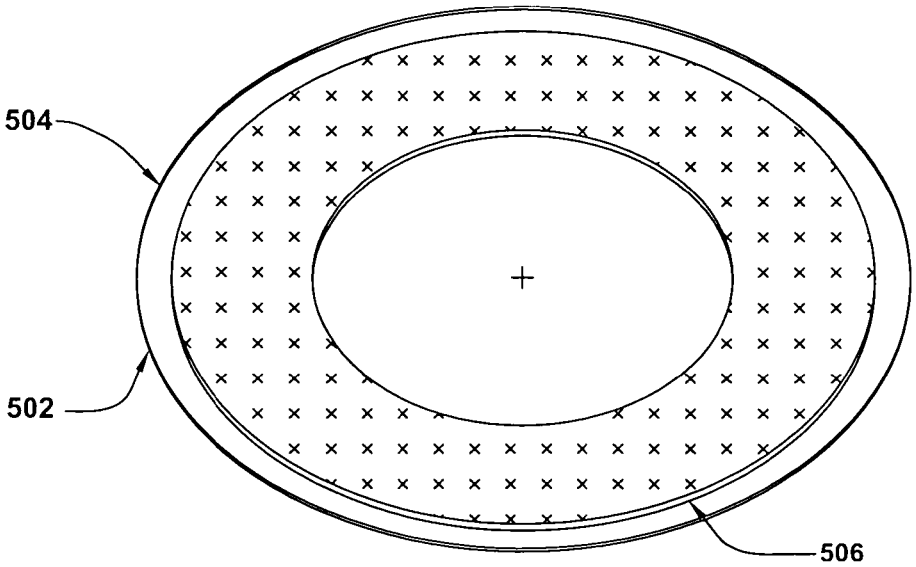
FIG. 38 is an isometric view of a solid-layer fixed-abrasive disk.

FIG. 38 is an isometric view of a flexible fixed-abrasive coated abrasive disk having a thick layer of solid abrasive material attached to the abrasive disk backing. A continuous flat-surfaced annular band of a thick layer of solid abrasive material 506 is attached to the flexible backing 502 of an abrasive disk 504 that can be attached with vacuum r by other mechanical attachment devices (not shown) to a flat-surfaced rotary platen (not shown).

Figure 39:
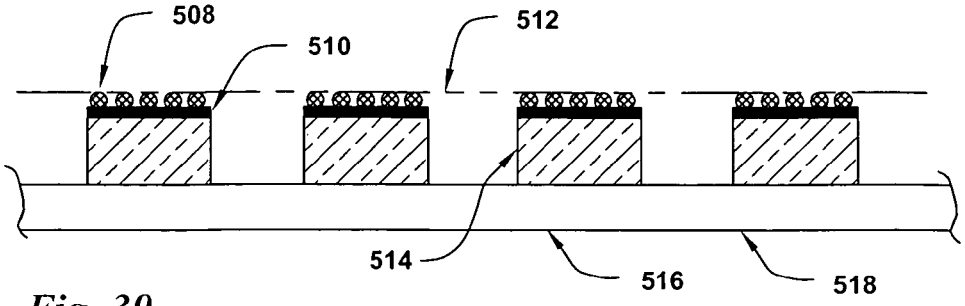
FIG. 39 is a cross section view of abrasive beads coated on raised island islands.

FIG. 39 is a cross section view of abrasive beads coated on raised island islands. Abrasive beads 508 are attached with a layer of adhesive 510 to raised islands 514 that are attached to an abrasive disk 516 flexible backing 518. The top surfaces of the beads 508 that are attached to all the islands 514 are precisely located in a common plane 512 to provide uniform workpiece (not shown) abrading when the disk 516 is attached to a rotating platen (not shown). The raised islands 514 prevent hydroplaning of the workpieces when the abrasive disk 516 is operated at very high abrading speeds in the presence of workpiece coolant water.

Figure 40:
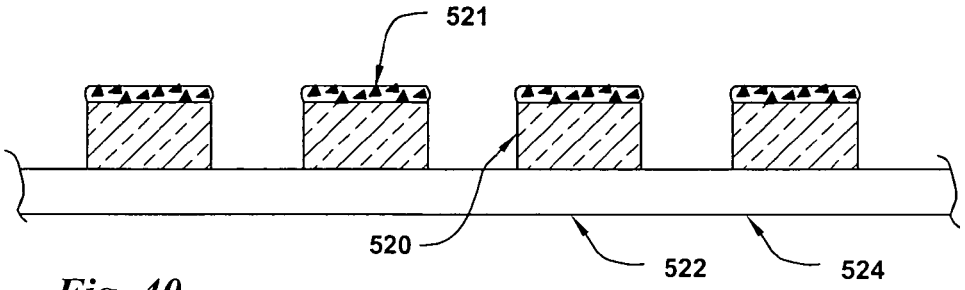
FIG. 40 is a cross section view of abrasive slurry coated on raised island islands.

FIG. 40 is a cross section view of abrasive slurry coated on raised island islands. Abrasive slurry coating 521 containing abrasive particles in an adhesive binder is coated as a layer on to the top surfaces of raised islands 520 that are attached to an abrasive disk 524 flexible backing 522.

Figure 41:
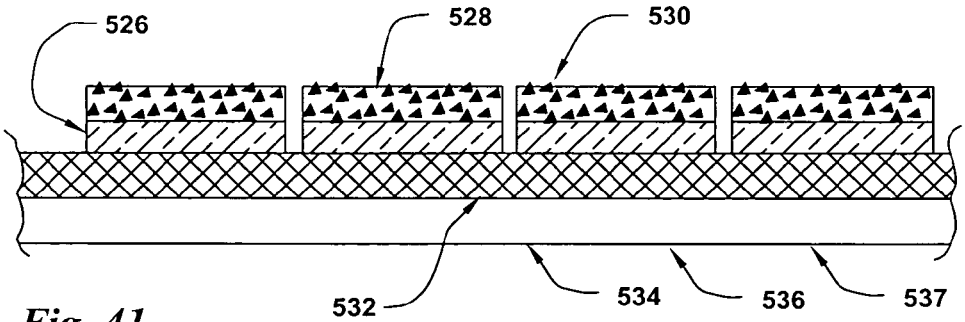
FIG. 41 is a cross section view of thick layers of abrasive coated on raised island islands.

FIG. 41 is a cross section view of thick layers of abrasive coated on raised island islands. A thick layer of solid abrasive material 528 is attached to rigid raised island structures 526 that are attached to a thick, strong and durable flexible backing 532 that is attached to a flexible backing 534 that has a smooth surface 536 that allows the thick abrasive disk 537 to be conformably attached to a flat-surfaced platen (not shown) with vacuum.

Figure 42:
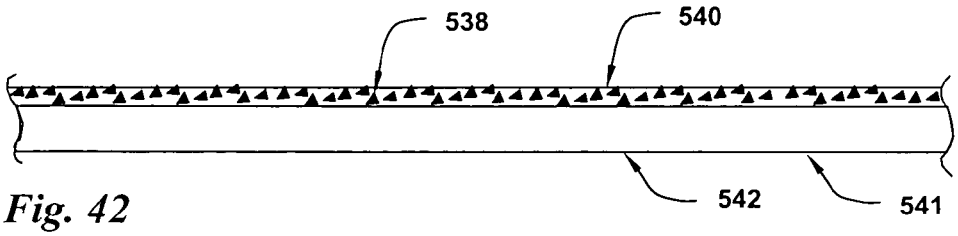
FIG. 42 is a cross section view of a continuous layer of abrasive coated on a disk backing.

FIG. 42 is a cross section view of a continuous layer of abrasive coated on a disk backing. Abrasive slurry coating 540 containing abrasive particles 538 in an adhesive binder is continuous-coated as a layer on to the top surfaces of a backing 542 for an abrasive disk 541.

Figure 43:
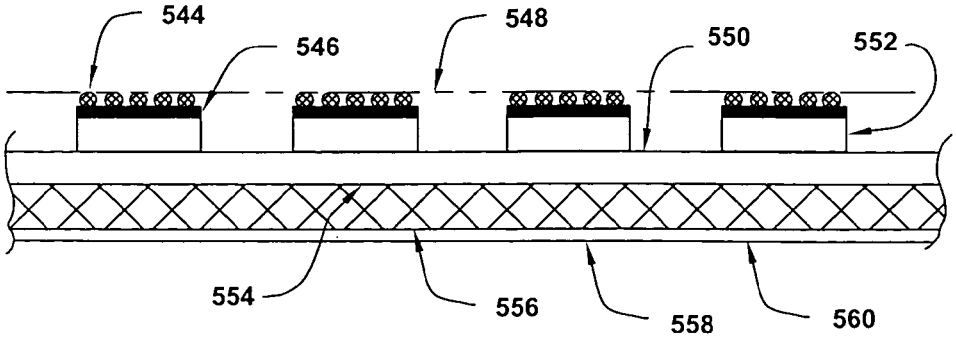
FIG. 43 is a cross section view of abrasive bead raised islands on a foam-backed disk.

FIG. 43 is a cross section view of abrasive bead raised islands on a foam-backed disk. Abrasive beads 544 are attached with a layer of adhesive 546 to raised islands 522 that are attached to an abrasive disk 560 flexible backing 550. A foam backing 556 is attached to the bottom surface 554 of the flexible backing 550. A smooth surfaced backing 558 is attached to the foam backing 556 to allow the abrasive disk 560 to be attached to the flat surface of a platen (not shown).

Figure 44:
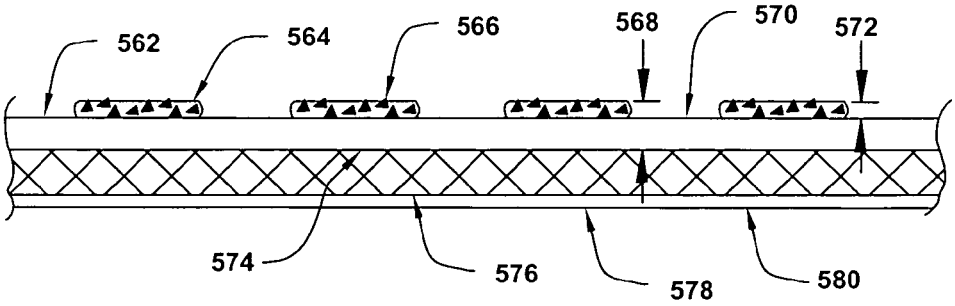
FIG. 44 is a cross section view of shallow-height abrasive raised islands on foam disk.

FIG. 44 is a cross section view of CMP-type shallow-height abrasive raised islands on foam disk. Shallow-height abrasive islands 564 are attached a flexible backing 570. A foam backing 576 is attached to the bottom surface 574 of the flexible backing 570. A smooth surfaced backing 578 is attached to the foam backing 576 to allow the abrasive disk 580 to be attached to the flat surface of a platen (not shown). The top surfaces 566 of the shallow abrasive islands 564 are precisely equal in thickness 568 from the bottom side 574 of the flexible backing 570 to assure uniform abrading of the abrasive disk 580. Each of the shallow raised islands 564 have a height 572 measured from the top surface of the backing 570 that is only approximately 0.001 inch high. The shallow raised islands 564 can be molded on to the top surfaced of the backing 570 or the islands 564 can be coated on the top surface of the backing 570 by a gravure coating process.

Figure 45:
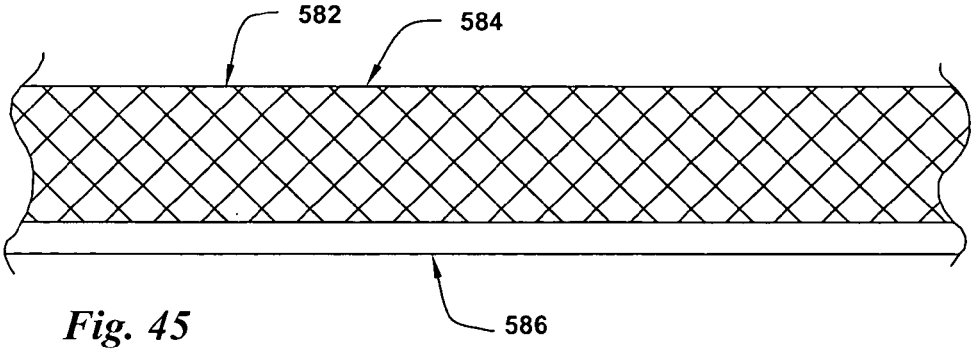
FIG. 45 is a cross section view of a CMP resilient foam pad attached to a disk backing.

FIG. 45 is a cross section view of a CMP resilient foam pad attached to a disk backing. A CMP-type abrasive disk 582 has a resilient foam pad 584 attached to a polymer or metal flexible backing 586 that allows the abrasive disk 582 to be attached to the flat surface of a rotating platen (not shown). A liquid mixture containing loose abrasive particles can be applied to the pad abrasive disk 582 as the disk 582 is rotated while in abrading contact with one or more workpieces (not shown) that are attached to fixed-position workpiece rotating spindles (not shown).

Figure 46:
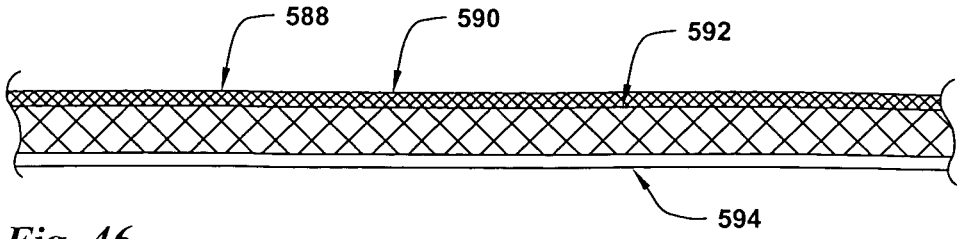
FIG. 46 is a cross section view of a CMP resilient foam pad with a top surface nap layer.

FIG. 46 is a cross section view of a CMP resilient foam pad with a top surface nap layer. A flexible abrasive disk pad 588 has an attached top nap layer 590 that is attached to a base layer 592 that is attached to a smooth-surfaced backing layer 594. The base layer 592 comprises a resilient foam material or a semi-rigid polymer material or a fiber material. The use of the backing layer 594 is optional as it provides a sealed surface to the disk pad 588 that allows the disk 588 to be attached to a rotary platen (not shown) by a vacuum disk attachment system. A liquid slurry (not shown) containing lose abrasive particles is applied to the nap layer 590 that is flat abrading contact with workpieces (not shown).

Figure 47:
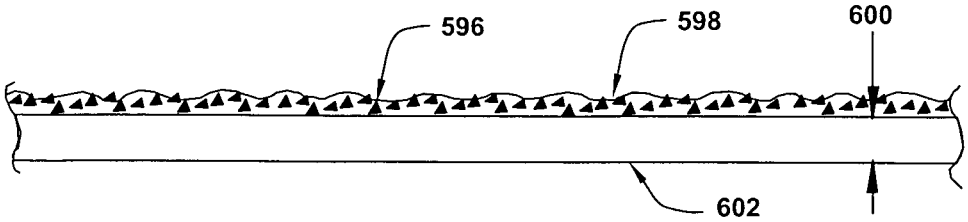
FIG. 47 is a cross section view of a flat disk covered with an abrasive slurry layer.

FIG. 47 is a cross section view of a flat disk covered with an abrasive slurry layer. A flexible metal abrasive slurry disk 602 is shown coated with a liquid slurry mixture 598 containing lose abrasive particles 596. The disk 602 has a precision-thickness 600 over its full annular abrading surface and also has a smooth mounting surface that provides a sealed surface that allows the disk 602 to be attached to a rotary platen (not shown) by a vacuum disk attachment system.

Figure 48:
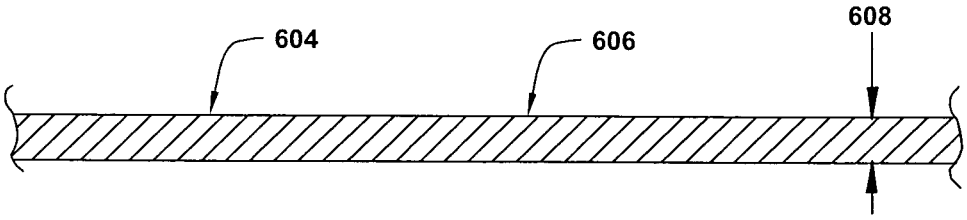
FIG. 48 is a cross section view of a flat disk cover used for abrasive slurry.

FIG. 48 is a cross section view of a flat disk cover used for abrasive slurry. A flexible metal abrasive slurry disk 604 is shown without a liquid slurry mixture. The disk 604 has a precision-thickness 608 over its full annular abrading surface and the disk 604 has a precision-flat abrading surface 606 over its full annular abrading surface. The disk 604 has a smooth mounting surface that provides a sealed surface that allows the disk 604 to be attached to a rotary platen (not shown) by a vacuum disk attachment system.

Figure 49:
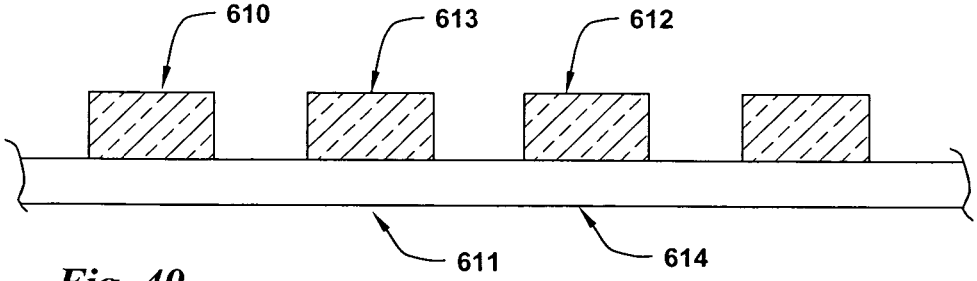
FIG. 49 is a cross section view of raised island structures attached to a backing disk.

FIG. 49 is a cross section view of raised island structures attached to a backing disk. Raised island structures 610 have island flat top surfaces 613 that are co-planar with each other and that are also co-planar with the backing 614 bottom mount surface 611. The island structures 610 that are attached to an abrasive disk 612 flexible backing 614 do not have an abrasive coating. These flexible disks 612 can be attached at the backing surface 611 to a platen (not shown) for abrading with a liquid abrasive slurry (not shown).

Figure 50:
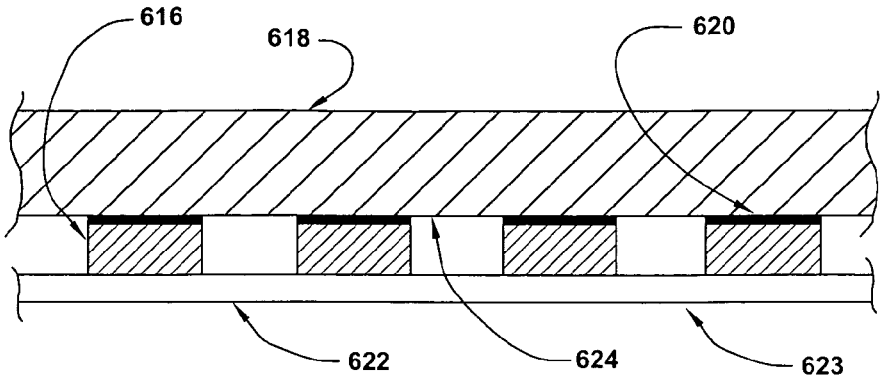
FIG. 50 is a cross section view of raised islands in abrading contact with a flat workpiece.

FIG. 50 is a cross section view of raised islands in abrading contact with a flat workpiece. An abrasive disk 622 having a flexible backing 623 is attached to a flat-surfaced platen (not shown) where the raised islands 616 that are coated with an abrasive 620 is in full-faced flat abrading contact with a flat-surfaced workpiece 618.

Figure 51:
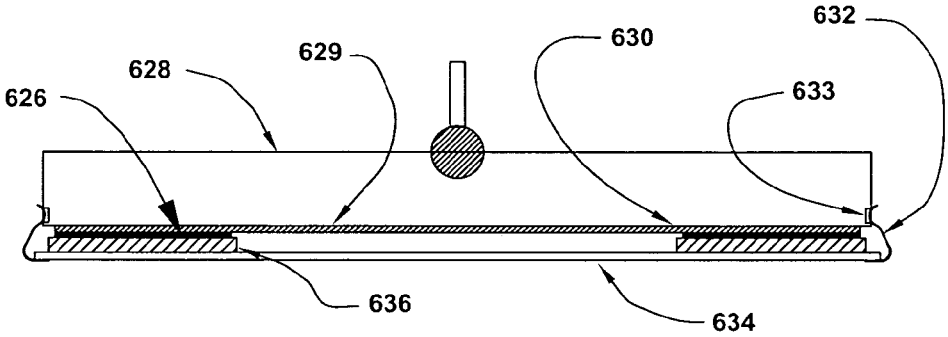
FIG. 51 is a cross section view of an abrading disk held to a platen with a disk holder plate.

FIG. 51 is a cross section view of an abrading disk held to a platen with a disk holder plate. An abrasive disk 629 having an annular layer of abrasive 626 is held in conformal flat surface contact with the disk-mounting surface 630 of an upper platen 628 by a disk holder 634. The disk holder plate 634 has a resilient layer 636 that is attached to the holder plate 634. Disk holder 634 spring clips 632 provide attachment of the holder 634 and the abrasive disk 629 to the upper platen 628 by snapping the spring clips 632 into platen 628 spring clip 632 grooves 633 when vacuum to the disk attachment device (not shown) is interrupted. This holder plate 634 allows the disk 629 to be in conformal flat-surface contact with the platen 628 surface 630 until vacuum is restored to attach the disk 629 to the platen 628 after which, the disk holder is removed. This disk holder device is used to provide conformal attachment of the disk 629 to the platen 628 when the abrading machine is deactivated for periods of time. Upon activation of the vacuum, the disk 629 is in place to provide a vacuum seal for re-developing the vacuum flexible disk 629 attachment that allows the abrasive disk 629 to be re-used a for abrading action.

Figure 52:
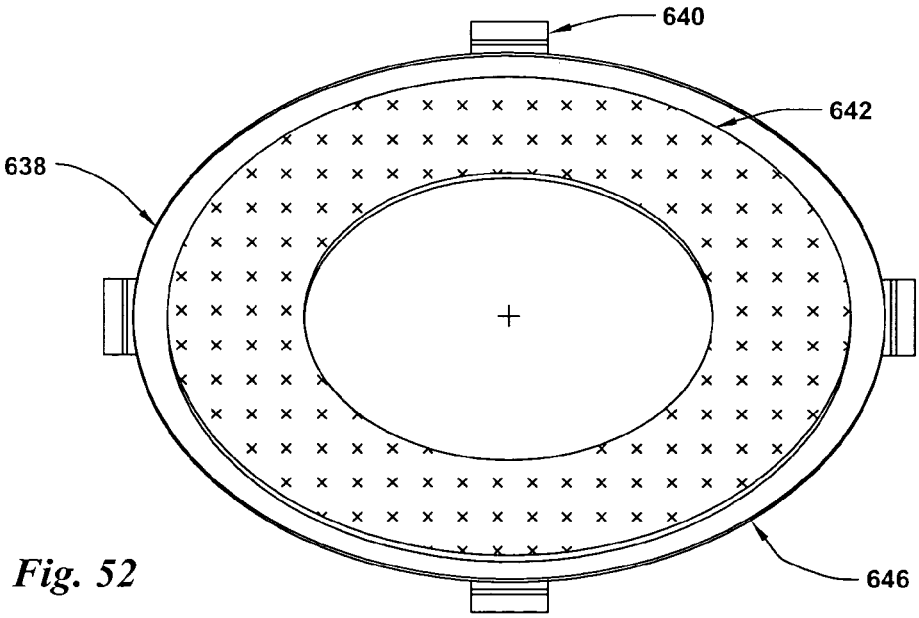
FIG. 52 is an isometric view of a temporary foam-covered abrasive disk holder plate.

FIG. 52 is an isometric view of a temporary foam-covered abrasive disk holder plate. Flexible abrasive particle coated disks (not shown) can be held in place conformably with the flat surface of an upper platen (not shown) when the platen abrasive disk vacuum attachment system that attaches the abrasive disks to the flat surface of the platen is not operating. A flat-surfaced abrasive disk holder 646 has an abrasive disk-contacting flat-surfaced foam layer 642 that is attached to the holder 646 plate 638. The disk holder 646 can be installed by snapping the holder 646 retaining flexible springs 640 into place into grooves (not shown) in the upper platen. The disk holder 646 can be easily removed from the platen by flexing the holder 646 retaining springs 640 to release the holder 646 from the platen. The disk holders can be used for the upper floating abrasive platens used for both the fixed-spindle-floating-platen system (not shown) and also for a double-sided abrading system that has a floating upper platen with a vacuum-attached flexible abrasive disk.

Figure 53:
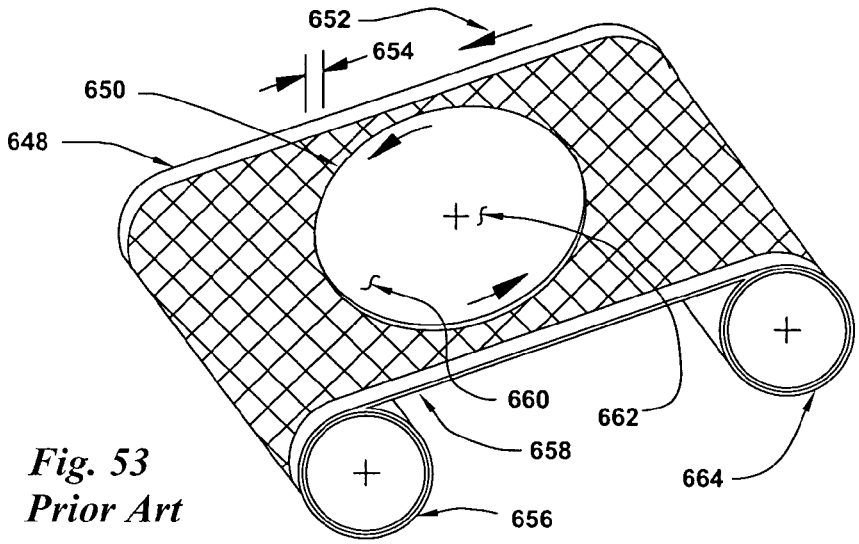
Fig. 53 Prior Art
FIG. 53 is an isometric view of a workpiece on a fixed-abrasive CMP web polisher.

FIG. 53 is an isometric view of a workpiece on a fixed-abrasive CMP web polisher. A fixed-abrasive CMP-type web polisher 648 has a flat mid-section and it has a web winder roll 656 and a web unwind roll 664 that advances the shallow-island fixed-abrasive flexible web 658. The web 658 is stationary during the flat workpiece 650 polishing action and the web 658 advances forward an incremental distance 654 in the direction 652 when a new workpiece 650 is polished. The workpiece 650 rotates with a high abrading speed at the outer periphery area 660 of the workpiece 650 and with a near-zero workpiece abrading sped at the inner portion area 662 of workpiece 650. Because the abrasive web 658 is not attached to the flat web 658 support plate (not shown) under the web 658, the abrasive web 658 can be wrinkled by the rubbing action of the rotating workpiece 650.

Figure 54:
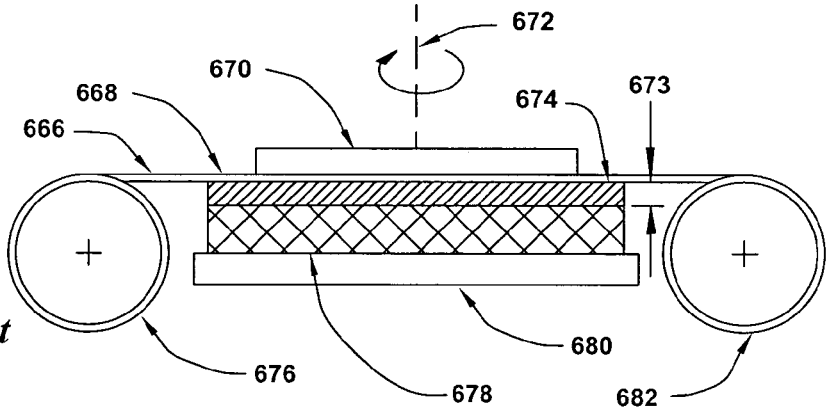
Fig. 54 Prior Art
FIG. 54 is a cross section view of a workpiece on a fixed-abrasive CMP web polisher.

FIG. 54 is a cross section view of a workpiece on a fixed-abrasive CMP web polisher. A fixed-abrasive CMP-type web polisher 666 has a flat mid-section and it has a web winder roll 676 and a web unwind roll 682 that advances the shallow-island fixed-abrasive flexible web 668. The web 668 is stationary during the flat workpiece 670 polishing action and the workpiece 670 rotates about an axis 672 while the web 668 is stationary. The web 668 is supported by a rigid, or semi-rigid, polymer, or other material, flat-surfaced stationary plate 674. The stationary web support plate 674 has a dimensional thickness 673 that determines the stiffness of the web support platen 674. The support plate 674 is attached to a resilient support base 678 that is supported by a rigid web polisher base 680. The resilient support base 678 allows the web support plate 674 to tilt or to deform locally to provide flat-surface abrading contact with the rotating flat-surfaced workpiece 670. Typically the resilient support base 678 material has reduced-elastic deformation characteristics where some time is required before the material is restored to its original position after it was deformed by a high-spot area of a contacting moving workpiece 670. Here, the support base 678 material experiences a time delay in that it does not respond quickly to provide full abrading pressure contact to a low-spot area of the moving workpiece 670 that follows the high-spot area, especially if the workpiece 670 is rotated at high speeds. The workpiece 670 is typically a thin semiconductor wafer that is exceedingly flat. However, the flat top surface of the web support base 674 that is in direct contact with the abrasive web 668 typically does not have a flatness accuracy that is comparable with the flatness of the semiconductor workpieces 670. Also, the fixed-abrasive shallow-island web 668 has web thickness variations because the web 668 abrasive surface is worn-down progressively as it advances incrementally with the introduction of new wafers. Because the abrasive web is constructed from a thin polymer web material and the shallow islands have such small heights, this web 668 has a high stiffness in the direction perpendicular to the flat surface of the web 668. Here, the high-spot non-planar imperfection areas of the web support plate 674 are directly translated to the localized web 668 abrasive contact with the flat surface of the wafer workpiece 670. Intentional out-of-plane flexing of the thin wafer workpieces 670 can increase the sizes of the localized mutual abrading contact areas between portions of the wafer workpiece 670 and the abrasive web 668. However, most wafer-type workpieces 670 are typically mounted on rigid flat-surfaced carriers (not shown) that do not provide out-of-plane flexing of the workpiece 670 to match surface variations of the supporting plate 674. The workpiece 670 has a rotation axis 672 and the abrading speed at the portion of the workpiece 670 near the workpiece 670 rotation axis is near-zero and the abrading speed near the outer periphery of the rotating workpiece 670 is maximum. The CMP-type abrading speed varies proportionally across the radial portion of the workpiece 670. Because the abrasive web 668 is stationary, the abrasive web 668 does not contribute any abrading speed to any portion of the abraded surface of the flat-surfaced rotated workpieces 670.

Figure 55:
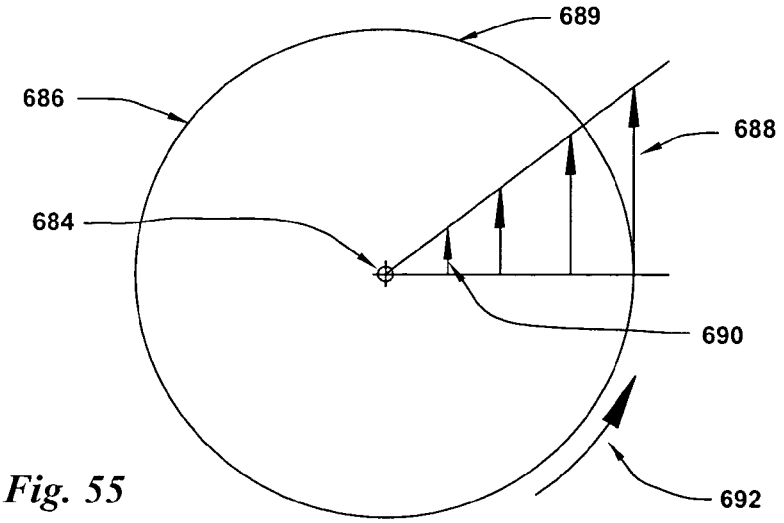
FIG. 55 is a top view of a rotating workpiece on a fixed-abrasive CMP web polisher.
Figure 56:
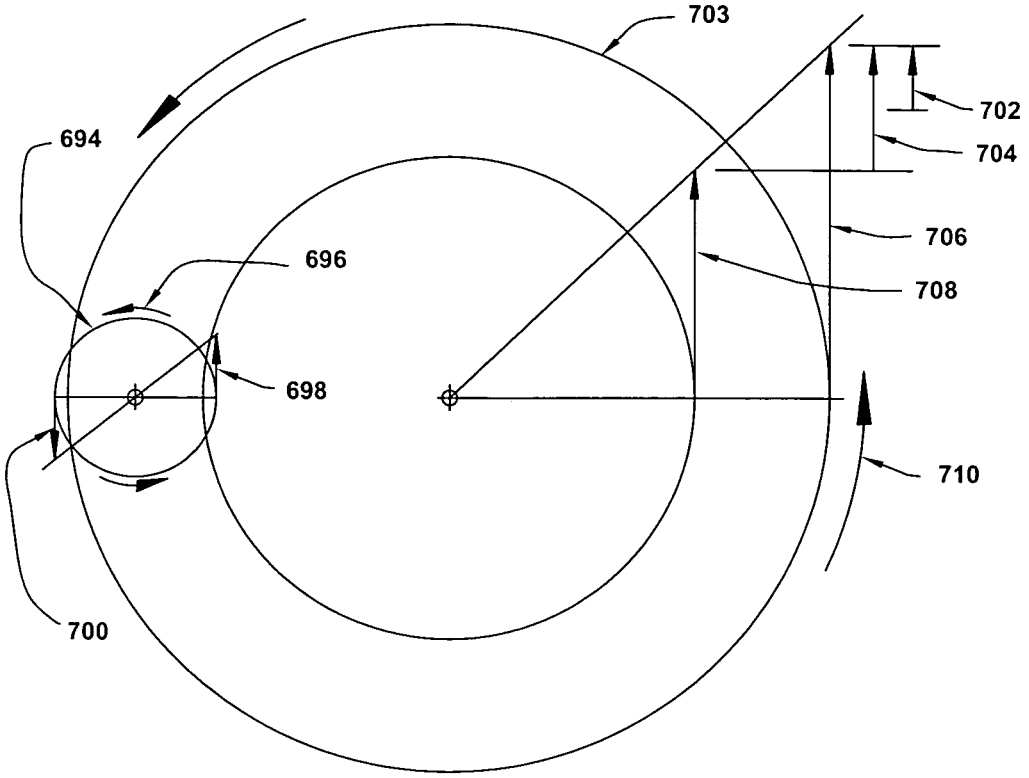
FIG. 56 is a top view of abrading speeds of a rotating workpiece on an annular platen.

FIG. 55 is a top view of a rotating workpiece on a fixed-abrasive CMP web polisher. The workpiece 686 rotates in a direction 692 about an axis 684 where the workpiece 686 has a maximum abrading speed 688 at the outer periphery 689 of the workpiece 686 and a minimum abrading speed 690 near the workpiece 686 center and an abrading speed of zero at the workpiece 686 rotation axis 684 location FIG. 56 is a top view of abrading speeds of a rotating workpiece on an annular platen. An abrasive covered annular platen 703 rotates in a direction 710 and a flat contacting workpiece 694 rotates in a direction 696. The workpiece 694 has a peripheral speed 698 at the inner periphery of the platen 703 annular area and a opposed-direction localized speed 700 at the outer periphery of the annular platen 703. The platen 703 has a peripheral speed 708 at the inner periphery of the platen 703 annular area and a larger same-direction localized speed 706 at the outer periphery of the annular platen 703. The difference between the platen 703 abrading speed 708 at the inner periphery of the platen 703 annular area and the larger same-direction localized speed 706 at the outer periphery of the annular platen 703 is 704 and one half of the platen 703 differential speed 704 is 702. Typically the rotation speed of the workpiece 694 is 10% of the rotation speed of the platen 703.

Figure 57:
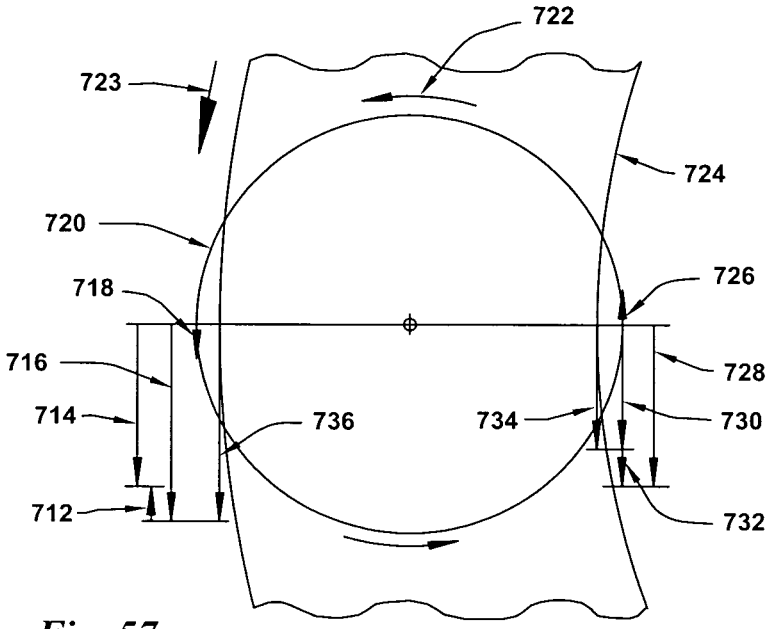
FIG. 57 is a top view of abrading speeds of a rotating workpiece on annular abrasive.

FIG. 57 is a top view of abrading speeds of a rotating workpiece on annular abrasive. An abrasive covered annular platen 724 rotates in a direction 723 and a flat contacting workpiece 720 rotates in a same-direction 722. The workpiece 720 has a peripheral speed 726 at the inner periphery of the platen 724 annular area and a opposed-direction localized speed 718 at the outer periphery of the annular platen 724. The platen 724 has a peripheral speed 734 at the inner periphery of the platen 724 annular area and a larger same-direction localized speed 714 at the outer periphery of the annular platen 724. The abrading speed vector 734 at the inner periphery of the platen 724 annular area is also shown for convenience as the vector 730 at the inner periphery of the platen 724 annular area. The small opposed-direction localized speed 732 of the workpiece 720 at the inner periphery of the annular platen 724 is added to the platen 724 vector 730 to produce a net abrading speed 728 at the inner periphery of the platen 724 annular area. Likewise, the abrading speed vector 736 at the outer periphery of the platen 724 annular area is also shown for convenience as the vector 716 at the outer periphery of the platen 724 annular area and the small same-direction localized speed 712 of the workpiece 720 at the outer periphery of the annular platen 724 is subtracted from the platen 724 vector 716 to produce a net abrading speed 714 at the outer periphery of the platen 724 annular area. The net abrading speed 714 at the outer periphery of the annular platen 724 is equal in magnitude to the net abrading speed 728 at the inner periphery of the annular platen 724 with the result that the abrading speed is the same at both the inner and outer peripheries of the platen 724. The technique of rotating the workpiece 720 in the same direction as the platen 724 equalizes the abrading speed, and workpiece material removal rate, across the radial-direction surface of the workpiece 720.

Figure 58:
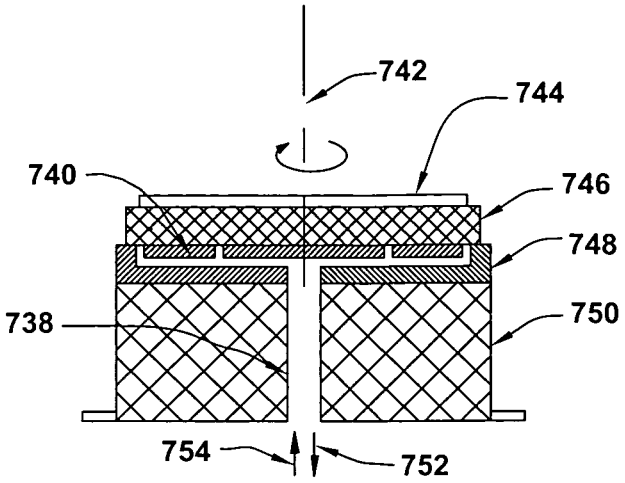
FIG. 58 is a cross section view of a workpiece spindle with vacuum carrier attachment.

FIG. 58 is a cross section view of a workpiece spindle with vacuum carrier attachment. A workpiece spindle 750 has a flat-surfaced rotary top 748 that rotates about an axis 742. A workpiece flat-surfaced carrier 746 is precisely uniform in thickness and both surfaces of the lapped carrier 746 are precisely co-planar to assure that workpieces 744 that are attached to the carrier 746 rotate with the top surface of the workpiece precisely co-planar with the workpiece spindle 750 top 748 surface. Vacuum 752 is applied to the spindle 750 top 748 through a spindle 750 center passageway 738 connected to spindle-top 747 passageways 740 to attach the workpiece carrier 746 to the rotating spindle 750 top 748. Air pressure 754 can also be applied to the spindle 750 top 748 through the spindle 750 center passageway 738 connected to spindle-top 748 passageways 740 to aid in separating the workpiece carrier 746 from the rotating spindle 750 top 748. The vacuum 752 and the air pressure 754 are supplied through a rotary union (not shown) that is attached to the spindle 750 hollow drive shaft (not shown).

Figure 59:
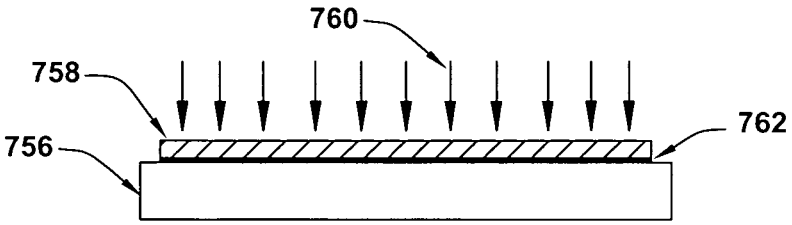
Fig. 59 Prior Art
FIG. 59 is a cross section view of a workpiece attached to a workpiece carrier.

FIG. 59 is a prior art cross section view of a workpiece attached to a workpiece carrier. A flat-surfaced workpiece 758 carrier plate 756 is coated with a film 762 comprising a liquid water or polymer or air and a uniform pressure 760 is applied to the upper flat surface of the workpiece 758 to force the workpiece 758 conformably against the flat surface of the carrier plate 756 to adhesively bond the workpiece 758 temporarily to the workpiece 758 carrier plate 756.

Figure 60:
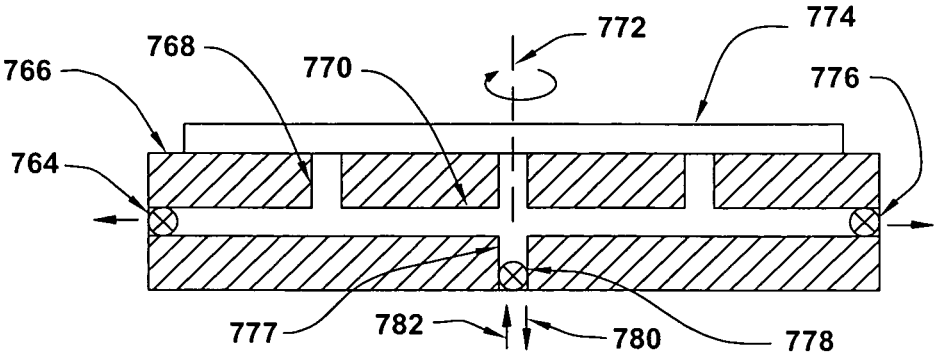
FIG. 60 is a cross section view of a workpiece vacuum-pressure workpiece carrier.

FIG. 60 is a cross section view of a workpiece vacuum-pressure workpiece carrier. A workpiece flat-surfaced carrier plate 766 is precisely uniform in thickness and both surfaces of the lapped carrier plate 766 are precisely co-planar to assure that workpieces 774 that are attached to the carrier plate 766 rotate with the top surface of the workpiece precisely co-planar with the workpiece spindle top surface (not shown). Vacuum 780 is supplied through a valve 778 controlled passageway 777 connected to passageways 768 and 770 to attach the workpiece 774 to the carrier plate 766. The carrier plate 766 rotates about an axis 772. Air pressure 782 can also be applied to the carrier plate 766 through the passageways 770, 768 and 777 to aid in separating the workpieces 774 from the carrier plate 766. Air pressure 782 or vacuum 780 can be supplied to the carrier plate 766 through valves 778, 776 or 764.

Figure 61:
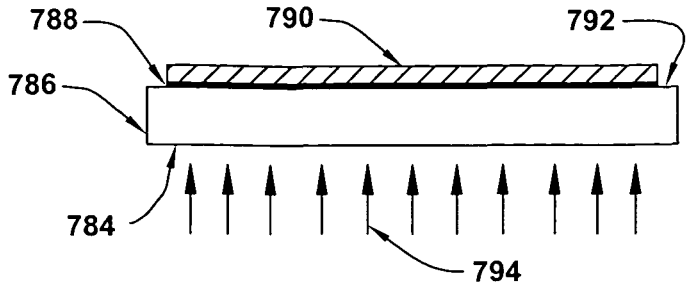
Fig. 61 Prior Art
FIG. 61 is a cross section view of a workpiece attached to a quartz workpiece carrier.

FIG. 61 is a prior art cross section view of a workpiece attached to a quartz workpiece carrier. A flat-surfaced workpiece 790 carrier plate 786 is coated with a liquid polymer film 788 to bond the workpiece 790 to the carrier plate 786 by activating the polymer film 788 with a light source 794. The top flat surface 792 of the carrier plate 786 is precisely co-planar with the bottom mounting surface 784 of the carrier plate 786.

Figure 62:
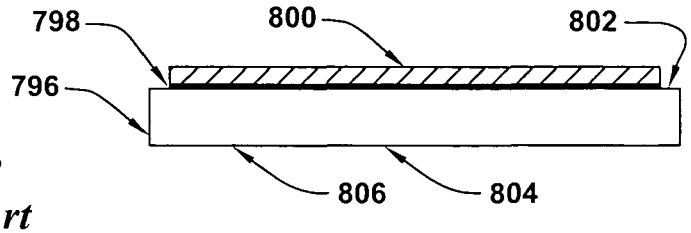
Fig. 62 Prior Art
FIG. 62 is a cross section view of a workpiece attached with wax to a workpiece carrier.

FIG. 62 is a prior art cross section view of a workpiece attached with wax to a workpiece carrier. A flat-surfaced workpiece 800 carrier plate 796 is coated with a wax film 798 to bond the workpiece 800 to the carrier plate 796. The top flat surface 802 of the carrier plate 796 is precisely co-planar with the bottom mounting surface 804 of the carrier plate 796.

Figure 63:
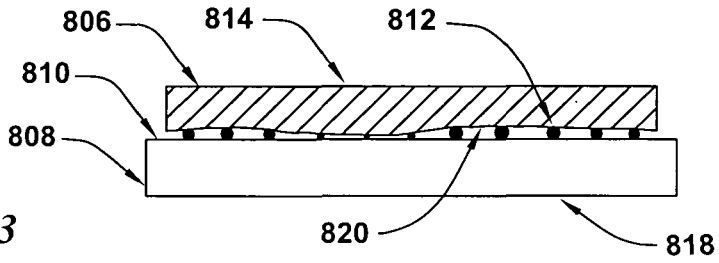
FIG. 63 is a cross section view of a workpiece attached with wax drops to a carrier plate.

FIG. 63 is a cross section view of a workpiece attached with wax drops to a carrier plate. A flat-surfaced workpiece 806 carrier plate 808 has drops of wax 812 that bond the workpiece 806 to the carrier plate 808 top flat surface 810. The top flat surface 810 of the lapped rigid carrier plate 808 is precisely co-planar with the bottom mounting surface 818 of the carrier plate 808. The non-flat surface 820 of the workpiece 806 is connected in a workpiece 806 stress-free condition to the top flat surface 810 of the carrier plate 808 by wax beads 812 having different sizes. The abraded workpiece 806 has a workpiece 806 precision-flat top surface 814 that is precisely co-planar with the carrier 808 bottom mounting surface 818.

Figure 64:
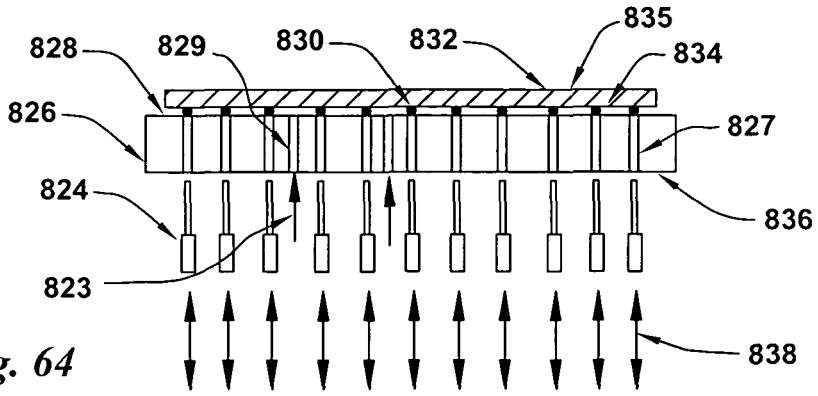
FIG. 64 is a cross section view of a workpiece wax drop injection to a carrier plate.

FIG. 64 is a cross section view of a workpiece wax drop injection to a carrier plate. A flat-surfaced workpiece 832 carrier plate 826 has drops of wax 830 that bond the workpiece 832 to the carrier plate 826 top flat surface 828. The top flat surface 828 of the lapped rigid carrier plate 826 is precisely co-planar with the bottom mounting surface 836 of the carrier plate 826. The bottom surface 834 of the workpiece 832 is attached in a workpiece 832 stress-free condition to the top flat surface 828 of the carrier plate 826 by wax beads 830. The abraded workpiece 832 has a workpiece 832 precision-flat top surface 835 that is precisely co-planar with the carrier 828 bottom mounting surface 836. Heated pins 824 translate 838 into pin holes 827 to deposit the heated wax beads 830 in the gaps between the workpiece 832 bottom surface 834 and the top surface 828 of the carrier plate 826. When the pins 824 are withdrawn, the molten wax 830 solidifies into wax beads 830 to adhesively bond the workpiece 832 to the carrier plate 826 top surface 828. After abrading the top surface 835 of the workpiece 832, the workpiece 832 is separated from the carrier 826 by contacting the wax beads 830 with the heated pins 824 to soften or melt the wax beads 830. To provide improved separation of the workpiece 832 from the carrier 826 air pressure 823 can be applied to the carrier 826 port holes 829 when the wax beads 830 are molten.

Figure 65:
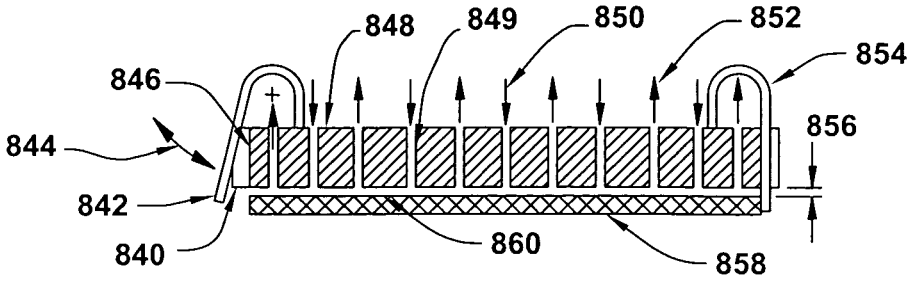
FIG. 65 is a cross section view of an air bearing non-contact workpiece carrier plate.

FIG. 65 is a cross section view of an air bearing non-contact workpiece carrier plate. A workpiece 858 is separated from a workpiece carrier plate 848 by a thin air film 860 having a thickness 856 that is created by a combination of pressurized air 850 and vacuum 852 that utilize passageways 849 that are adjacent to each other. The thickness 856 of the air film 860 can be adjusted by changing either by changing the vacuum 852 or the air pressure 850 or a combination of both. The workpiece 858 is positioned concentrically with the workpiece carrier plate 848 by polymer or metal flex springs 842 and 854. The free end of the flex spring 842 is shown flexed upward through an angle 844 while the opposite end of the flex spring 842 is attached to the body of the carrier plate 848. When fully relaxed, the spring 842 rests on a stop 846 that can be adjusted to match the size of the workpiece 858 to achieve centering the workpiece 858 concentrically with the carrier 848. The cylindrical-shaped flex spring 854 is shown in its relaxed position in point or line contact with the outer, typically unused or non-functional, periphery edge of the workpiece 858.

Figure 66:
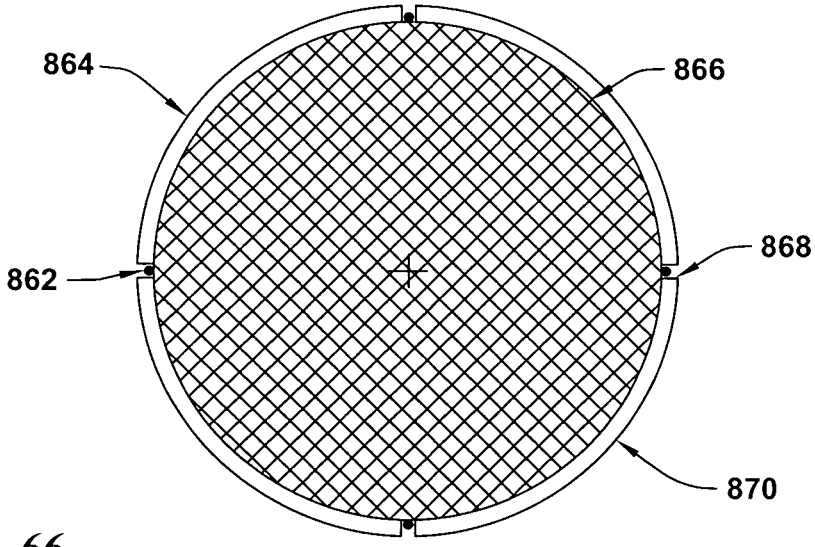
FIG. 66 is a top view of an air bearing non-contact workpiece carrier plate.

FIG. 66 is a top view of an air bearing non-contact workpiece carrier plate. A flat-surfaced workpiece 866 is concentrically centered on a flat-surfaced workpiece carrier plate 870 by cylindrical-shaped flex springs 862 that are positioned in notches 868 that extend inside the outer periphery 864 of the carrier plate 870.

Figure 67:
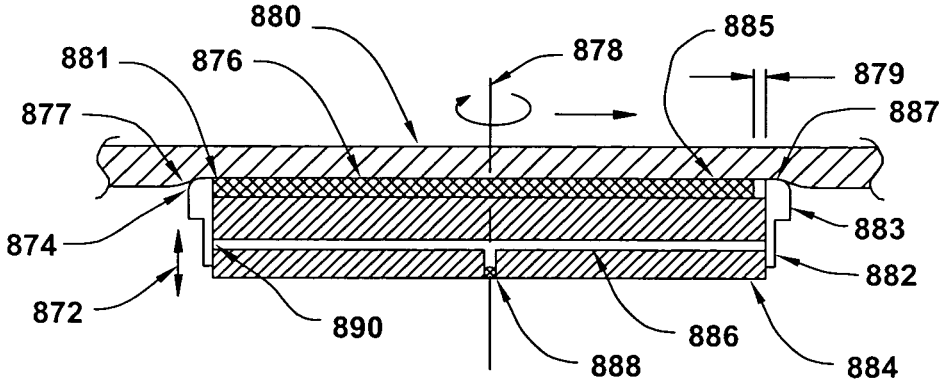
FIG. 67 is a cross section view of a CMP workpiece carrier with a sacrificial ring.

FIG. 67 is a cross section view of a CMP workpiece carrier with a sacrificial ring. A circular-shaped flat-surfaced carrier plate 884 has an attached flat-surfaced workpiece 876 that rotates about an axis 878 and that is in abrading contact with a resilient CMP pad 880 that moves in pressurized abrading contact across the surface 885 of the workpiece 876. A sacrificial annular ring 883 having a top rounded surface 874 is positioned with the ring 883 top surface 887 level with the top surface 885 of the workpiece 876. The sacrificial ring 883 is movable in the direction 872 and is held in this top-level position by vacuum that is introduced through the valve 888 into the passageways 886 where the vacuum applied at 890 deflects the annular ring 883 flex tabs 882 tightly against the circular peripheral body of the workpiece carrier plate 884. There is a space gap 879 that can range from a tight fit and a loose fit between the workpiece 876 and the sacrificial ring 883. When the CMP pad 880 translates across the leading edge of the workpiece 876, the resilient CMP pad 880 is distorted 877 when it is compressed as it encounters the protrusion of the rounded 874 portion of the sacrificial ring 883 and the pad 880 assumes a level-flat pad 880 surface as it encounters the leading edge 881 of the workpiece 876 and it retains this flat pad 880 configuration as the moving pad 880 translates over the full abraded top surface 885 of the workpiece 876.

Without the sacrificial ring 883, the moving pad 880 would distort as it encounters the leading edge 881 of the workpiece 876 with the result that the leading edge 881 outer periphery portion of the workpiece 876 would become excessively abraded with the result that the workpiece 876 would have an undesired non-flat abraded surface 885. At set-up, the sacrificial ring top surface 887 can be easily positioned level with the workpiece 876 top surface 885 by turning the assembly upside down where both the ring 883 top surface 887 and the workpiece 876 top surface 885 are in full-face contact with a precision-flat plate (not shown), after which vacuum is applied through the valve 888 to firmly attach the ring 883 to the body of the carrier 884 by deflecting the ring 883 flex band 882 against the body of the carrier 884. Both the ring 883 top surface 887 and the workpiece 876 top surface 885 are mutually abraded by the resilient CMP pad 880 but the wear of the ring 883 top surface 887 during one workpiece 876 CMP polishing operation is insignificant relative to the typical amount that the CMP pad 880 is compressed by abrading pressure. In addition, the sacrificial ring 883 can have a composite construction, where the upper wear surface 887 portion of the ring 883 is made of the same material as the workpiece 876 material to provide equal wear-down of both the workpiece 876 and the ring 883 surface 887. The composite sacrificial ring 883 can have a polymer flex-band 882 that will deflect easily when subjected to the vacuum force. Release of the sacrificial ring 883 from the carrier plate 884 is easily accomplished by opening the vacuum valve 888 which allows the sacrificial ring 883 to be used repetitively. The sacrificial ring 883 can have an off-set top or complex-geometry top (not shown) to accommodate workpieces 876 that are smaller than the diameter of the workpiece carrier plate 884 or multiple workpieces 876.

Figure 68:
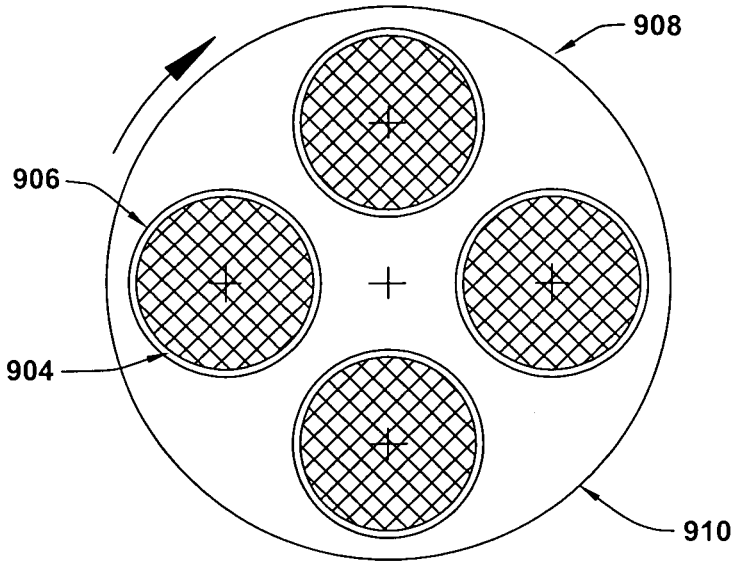
FIG. 68 is a top view of multiple workpieces on a spindle with sacrificial rings.

FIG. 68 is a top view of multiple workpieces on a spindle with sacrificial rings. A workpiece rotating air bearing spindle 910 that has a rotating top 908 also has multiple workpieces 904 that are contained in sacrificial annular bands 906.

Figure 69:
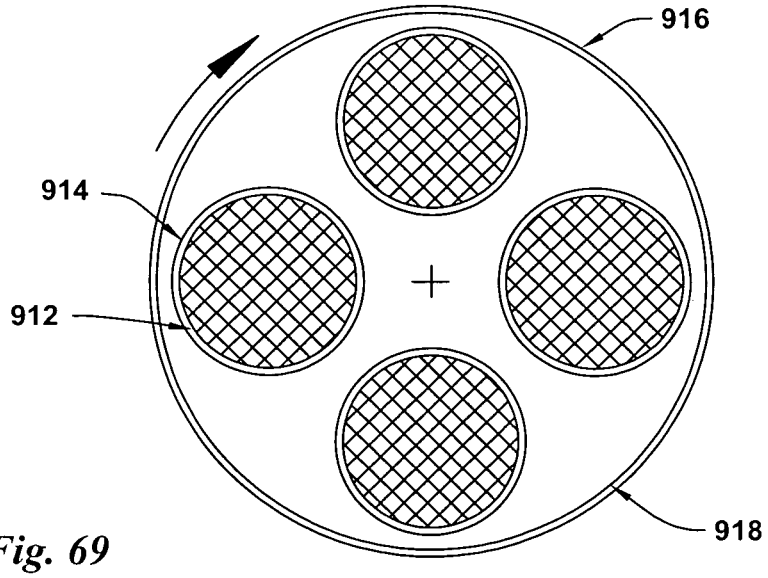
FIG. 69 is a top view of multiple workpieces on a spindle with a workholder plate.

FIG. 69 is a top view of multiple workpieces on a spindle with a workholder plate. A flat-surfaced workholder plate 918 is mounted in flat surface contact with the top rotating surface of an air bearing workpiece spindle 916 where multiple flat-surfaced workpieces 912 are positioned in the workholder pockets 914.

Figure 70:
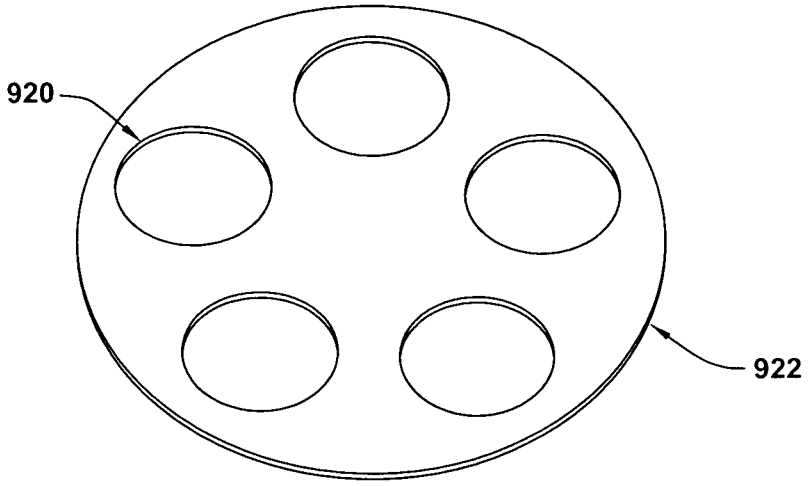
FIG. 70 is a top view of multiple workpieces workholder for an air bearing spindle.

FIG. 70 is a top view of multiple workpieces workholder for an air bearing spindle. A multiple workpiece workholder plate 922 is shown with multiple workpiece pockets 920.

Figure 71:
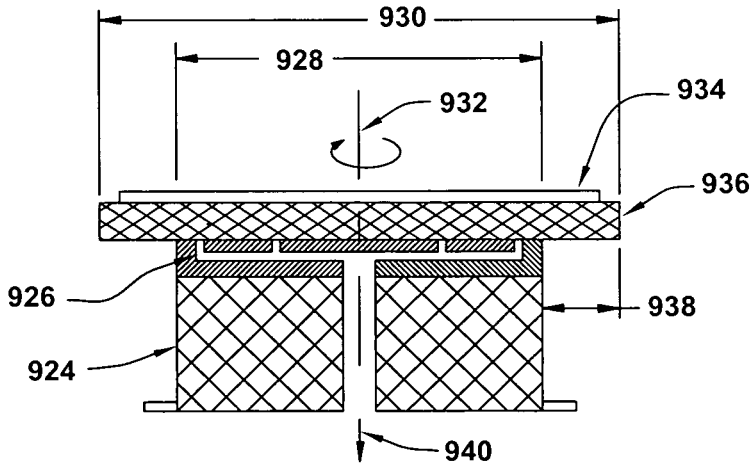
FIG. 71 is a cross section view of a spindle with an overhung workpiece carrier.

FIG. 71 is a cross section view of a spindle with an overhung workpiece carrier. A workpiece spindle 924 that has a flat-surfaced top 925 that rotates around an axis 932 has an attached workpiece carrier 936 that supports an attached flat-surfaced workpiece 934. The workpiece carrier 936 has a diameter 930 that exceeds the spindle top 925 diameter 928 where the workpiece carrier 936 overhangs the spindle top 925 by the distance 938. Vacuum 940 is routed through passageways 926 to attach the workpiece carrier 936 to the spindle top 925 where the workpiece carrier 936 and the workpiece 934 are both concentric with the spindle top 925.

Figure 72:
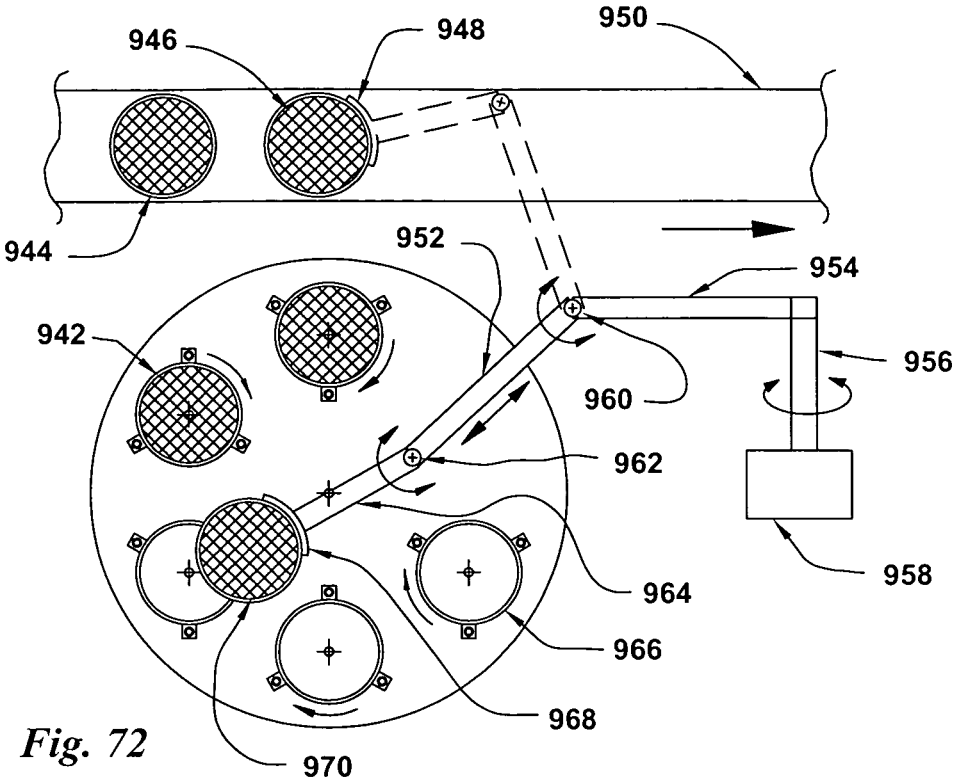
FIG. 72 is a top view of an automatic robotic workpiece loader for multiple spindles.

FIG. 72 is a top view of an automatic robotic workpiece loader for multiple spindles. An automated robotic device 958 has a rotatable shaft 956 that has an arm 954 to which is connected a pivot arm 952 that, in turn, supports another pivot arm 964. A workpiece carrier holder 968 attached to the pivot arm 964 holds a workpiece carrier 970 that contains a workpiece 942 where the robotic device 958 positions the workpiece 942 and carrier 970 on and concentric with the workpiece rotary spindle 966. Other workpieces 946 and carriers 944 are shown on a moving workpiece transfer belt 950 where they are picked up by the carrier holder 948. The workpieces 942 and 946 and workpiece carriers 970, 944 can also be temporarily stored in other devices comprising cassette storage devices (not shown). The workpieces 942, 946 and workpiece carriers 970, 944 can also be removed from the spindles 966 after the workpieces 970, 944 are abraded and the workpieces 942, 946 and workpiece carriers 970, 944 can then be placed in or on a moving belt (not shown) or a cassette device (not shown). The workpieces 942, 946 can also optionally be loaded directly on the spindles 966 without the use of the workpiece carriers 970, 944. Access for the robotic device 958 is provided in the open access area between two wide-spaced adjacent spindles 966.

Figure 73:
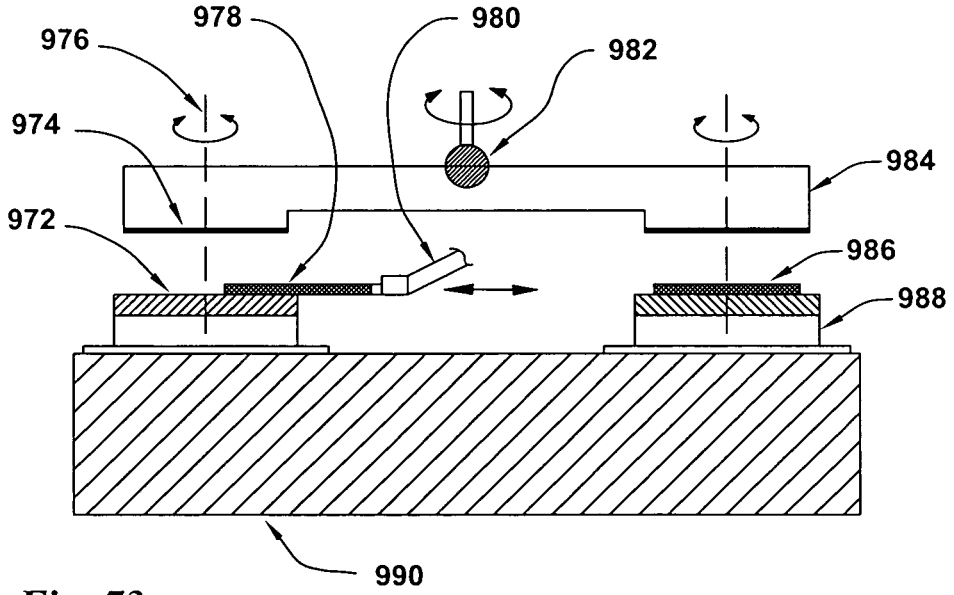
FIG. 73 is a side view of an automatic robotic workpiece loader for multiple spindles.

FIG. 73 is a side view of an automatic robotic workpiece loader for multiple spindles. An automated workpiece loader device 980 (partially shown) can be used to load workpieces 978, 986 onto spindles 988 that have spindle tops that have flat surfaces 972 and where the spindle tops rotate about the spindle axis 976. A floating platen 984 that is rotationally driven by a spherical-action device 982 has an annular abrasive surface 974 that contacts the equal-thickness workpieces 978 and 986 where the platen 984 is partially supported by abrading contact with the three independent three-point spindles 988 and the abrading pressure on the workpieces 978 and 986 is controlled by controlled force-loading of the spherical action device 982. The spindles 988 are supported by a granite machine base 990.

Figure 74:
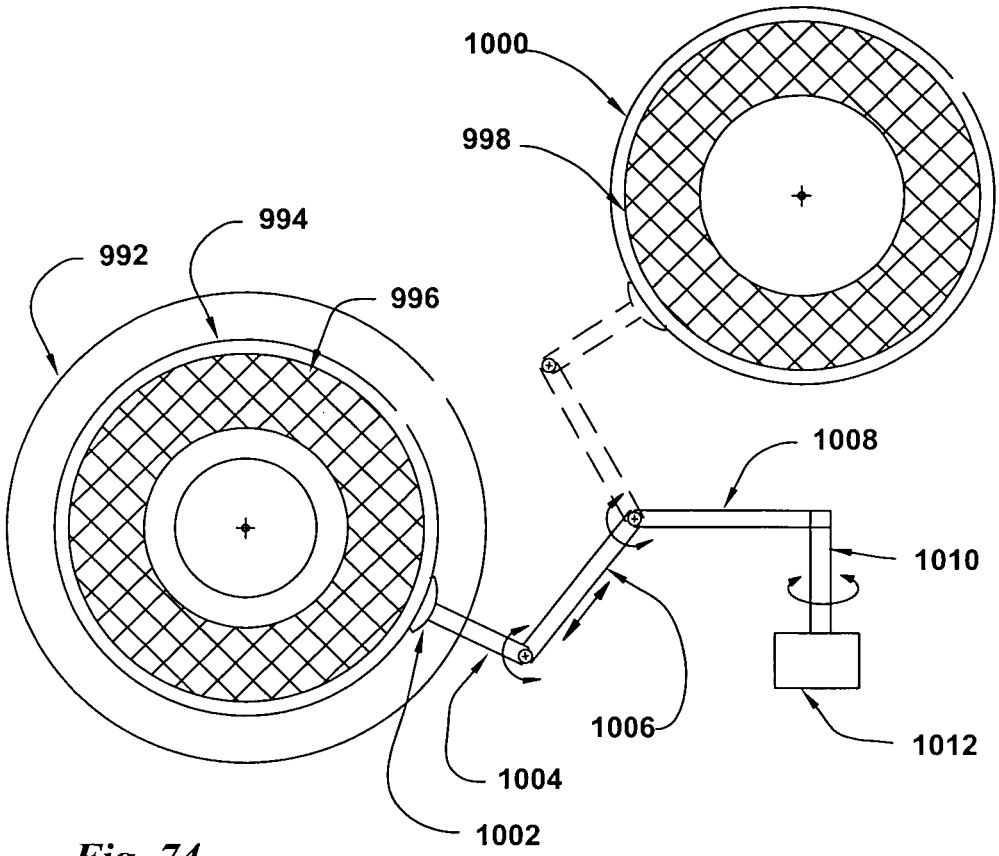
FIG. 74 is a top view of an automatic robotic abrasive disk loader for an upper platen.

FIG. 74 is a top view of an automatic robotic abrasive disk loader for an upper platen. An automated robotic device 1012 has a rotatable shaft 1010 that has an arm 1008 to which is connected a pivot arm 1006 that, in turn, supports another pivot arm 1004. An abrasive disk carrier holder 1002 attached to the pivot arm 1004 holds an abrasive disk carrier 994 that contains an abrasive disk 996 where the robotic device 1012 positions the abrasive disk 996 and disk carrier 994 on and concentric with the platen 992. Another abrasive disk 998 and abrasive disk carrier plate 1000 are shown in a remote location where the abrasive disk 998 can also be temporarily stored in other devices comprising cassette storage devices (not shown). Guide or stop devices (not shown) can be used to aid concentric alignment of the abrasive disk 996 and the platen 992 and the robotic device can position the abrasive disk 996 in flat conformal contact with the flat-surfaced platen 992 after which, vacuum (not shown) is applied to attach the disk 996 to the platen 992 flat abrading surface (not shown). Then the pivot arms 1004, 1006 and 1008 and the carrier holder 1002 and the disk carrier 994 are translated back to a location away from the platen 992.

Figure 75:
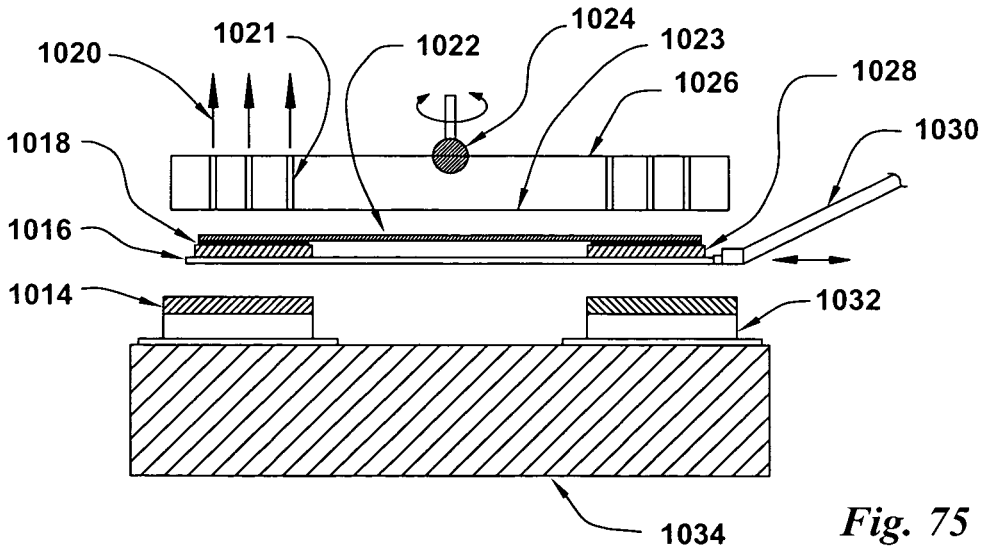
FIG. 75 is a side view of an automatic robotic abrasive disk loader for an upper platen.

FIG. 75 is a side view of an automatic robotic abrasive disk loader for an upper platen. An automated robotic device 1030 (partially shown) has a carrier holder plate 1016 that has an attached resilient annular disk support pad 1028 that supports an abrasive disk 1022 that has an abrasive layer 1018. The abrasive disk carrier holder 1016 that contains an abrasive disk 1022 is moved where the robotic device 1030 positions the abrasive disk 1022 and disk carrier 1016 on to and concentric with the platen 1026. The resilient layer pad 1028 on the carrier holder 1016 allows the back-disk-mounting side of the abrasive disk 1022 to be in flat conformal contact with the platen 1026 abrading surface 1023 before the vacuum 1020 is activated. The platen has vacuum 1020 that is applied through vacuum port holes 1021 to attach the abrasive disk 1022 to the abrading surface 1023 of the platen 1026. The floating platen 1026 is driven rotationally by a spherical action device 1024 to allow the floating platen 1026 abrading surface 1023 to be in flat contact with equal-thickness flat-surface workpieces (not shown) that are attached with flat surface contact to the flat top rotating component 1014 of three three-point spindles 1032 (one not shown) that are mounted on a granite base 1034. After the abrasive disk 1022 is attached to the platen 1026 the robotic device 1030 carrier holder 1016 is withdraw from the platen 1026 area.

Figure 76:
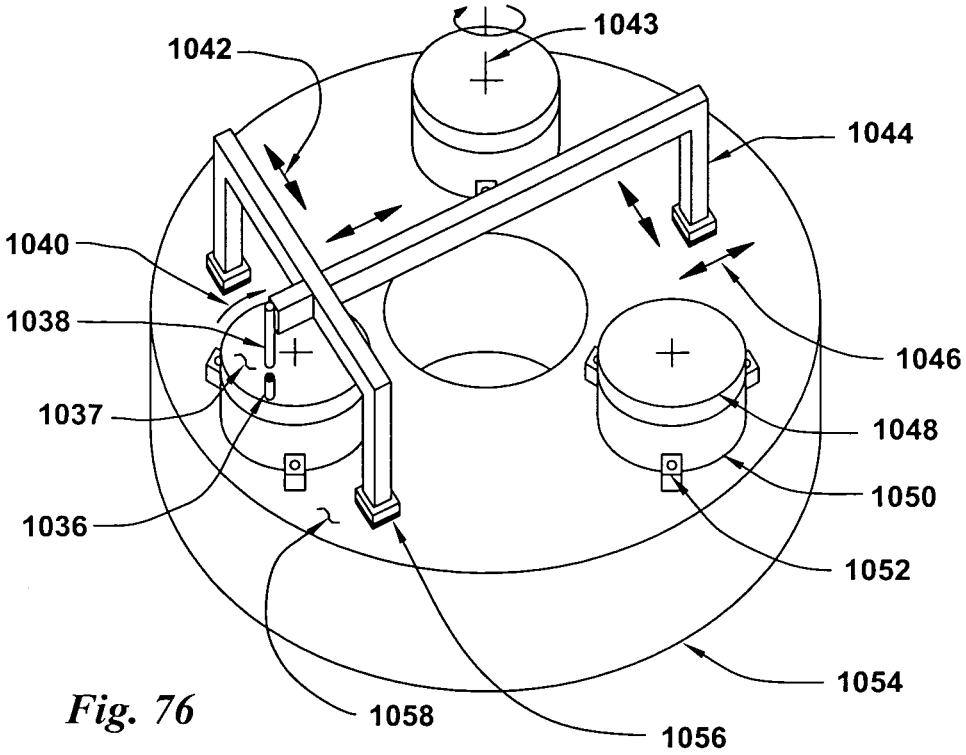
FIG. 76 is an isometric view of a gauging device used for alignment of three-point spindles.

FIG. 76 is an isometric view of a gauging device used for the alignment of three-point spindles on a precision-flat granite base. Three air bearing spindles 1050 having rotating spindle tops 1048 and that have three adjustable mounting legs 1052 are mounted on the top flat surface 1058 of an annular-shaped granite base 1054. A precision-distance gauge sensor 1038 comprising capacitance or eddy current gauges is attached to a movable frame 1044 that is supported by three frame 1044 three-point supporting air-pads 1056 that allow the frame 1044 and sensor 1038 to be moved freely in directions 1042 and 1046 along the precision-flat surface 1058 of the granite base 1054. The air bearing pads 1056 comprise pads that utilize controlled pressure air that acts against the weight of the sensor frame or the air bearing pads 1056 can be combination pads that have vacuum sections that act against the positive-pressure sections to precisely control the frame 1044 height from the granite base 1054 flat surface 1058 within 0.0001 inches or less. Because the frame 1044 is three-point mounted by the multiple pads 1056, any out-of-plane variation of the granite 1054 surface 1058 at the location of a individual pad 1056 is averaged-out and reduced in significance to the sensor measurement which results in a very accurate positioning and measurement readings of the sensor 1038. A sensor target 1036 is temporarily attached to the flat top surface 1037 of the spindle top 1048 and the spindle top 1048 is incrementally rotated to a rotational position aligned with an individual spindle leg 1052. Here, the gauge sensor 1038 measures the gap between the sensor 1038 and the sensor target 1036. This gap measurement can be used to accurately establish the height-position of that spindle top surface 1037 at the location of the corresponding adjustable-position spindle leg 1052 where the spindle top 1037 height is established relative to the precision-flat surface 1058 of the granite base 1054. Then the spindle top 1048 can be rotated to a location where the sensor target 1036 is aligned with the second of the three spindle legs 1052 and the gauge sensor 1038 can be moved to that location to provide data on the gap distance between the gauge 1038 and the target 1052 at that spindle leg location.

The gap distance between the gauge 1038 and the target 1052 at the second spindle leg location can be used as a reference to establish the spindle top 1037 height relative to the precision flat surface 1058 of the granite base 1054. The second spindle leg 1052 can be adjusted to a level-height of the top surface 1037 at the second spindle leg 1052 location so that it is equal to the spindle top 1037 height at the first spindle leg 1052 position relative to the precision flat surface 1058 of the granite base 1054. This spindle 1050 alignment procedure is repeated for the third spindle leg 1052 with the result that the spindle 1050 flat top surface 1037 is precisely co-planar with the precision-flat surface 1058 of the granite base 1054. This spindle 1050 alignment procedure aligns the spindle 1050 axis of rotation 1043 precisely perpendicular with the approximate-flat surface 1058 of the granite base 1054.

This spindle 1050 alignment procedure is repeated for the other two spindles 1050 where all three of the spindle top 1037 heights measured from the top surface 1037 of the spindle top 1048 to the to the precision-flat surface 1058 of the granite base 1054 are precisely equal. This procedure provides spindle 1050 flat top surfaces 1037 that are precisely co-planar with each other and also that are precisely co-planar with the precision-flat surface 1058 of the granite base 1054. Because the three spindles 1050 are equally spaced in a circle where the circle-center is located at the granite machine base 1054 surface 1058 center, the three spindle 1050 tops 1048 provide stable three-point support of a rotary platen (not shown) and the spindle top 1048 rotational axes 1043 are aligned with the radial-center of the annular abrasive band of the platen.

By using the frame 1044 to position the sensor 1038 in alignment with the spindles 1050, the spindle tops 1048 can be rotated at speed while the sensor 1038 determines the gap distance between the gauge 1038 and the target 1052 at that spindle location. Here, the spindle top 1048 alignment can be established by incrementally rotating the spindle top 1048 or by rotating the spindle top 1048 at a desired rotating speed to determine the out-of-flat characteristics of the rotating spindle operating at speed. Using the adjustable spindle legs 1052, all of the three spindles 1050 can be aligned where the top flat rotating surfaces of the spindle tops 1048 are precisely co-planar when the spindle 1050 tops 1048 are rotated at speeds typically used in the abrading operations. Capacitance and eddy current gauge sensors 1038 having subnanometer resolutions are available from Lion Precision, St Paul, Minn.

Figure 77:
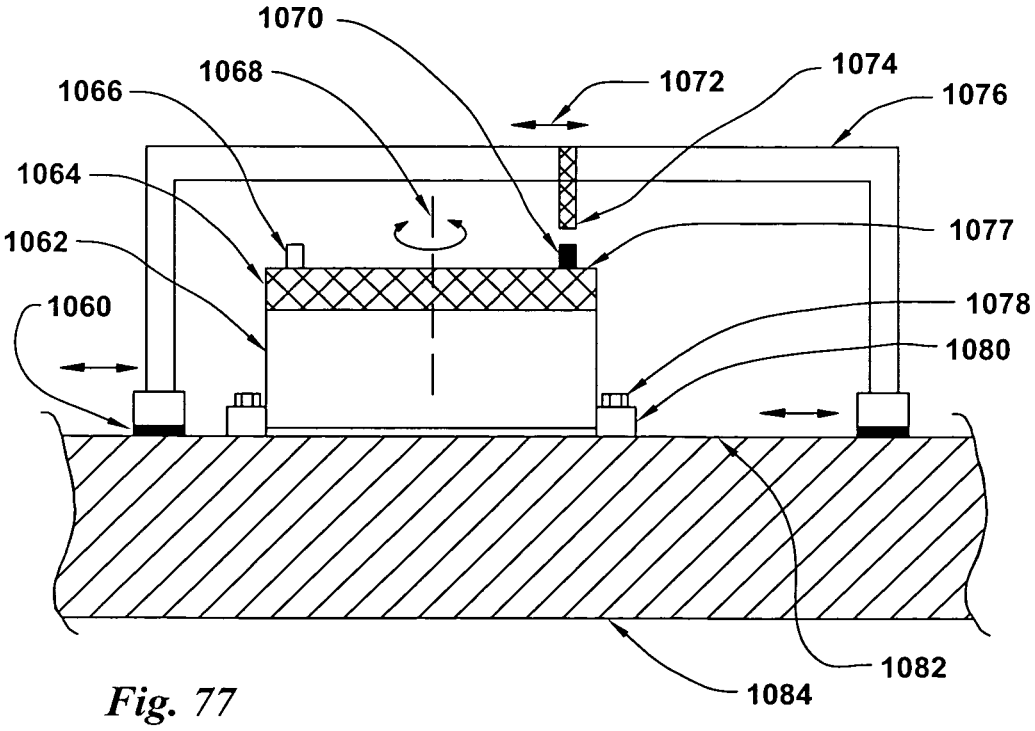
FIG. 77 is a side view of a gauging device used for alignment of three-point spindles.

FIG. 77 is a side view of a gauging device used for alignment of three-point spindles on a precision-flat granite base. An air bearing spindle 1062 having a rotating spindle top 1064 has three adjustable mounting legs 1080 that are mounted with fasteners 1078 to the top flat surface 1082 of a granite base 1084. A precision-distance gauge sensor 1074 comprising capacitance or eddy current gauges is attached to a movable frame 1076 that is supported by three frame 1076 three-point supporting air-pads 1060 that allow the frame 1076 and sensor 1074 to be moved freely in direction 1072 along the precision-flat surface 1082 of the granite base 1084. A sensor target 1070 is temporarily attached to the flat top surface 1077 of the spindle top 1064 and the spindle top 1064 is incrementally rotated to a rotational position where the sensor target 1070 is aligned with an individual spindle leg 1080. Here, the gauge sensor 1074 measures the gap between the sensor 1074 and the sensor target 1070. This gap measurement can be used to accurately establish the height-position of that spindle top surface 1077 at the location of the corresponding adjustable-position spindle leg 1080 where the spindle top 1077 height is established relative to the precision-flat surface 1082 of the granite base 1084. Then the spindle top 1064 can be rotated to a location where the sensor target 1066 is shown aligned with the second of the three spindle legs 1080 and the gauge sensor 1074 can be moved to that location to provide data on the gap distance between the gauge sensor 1074 and the target 1066 at that spindle leg 1080 location. The spindle top 1064 rotates about a spindle axis 1068.

Figure 78:
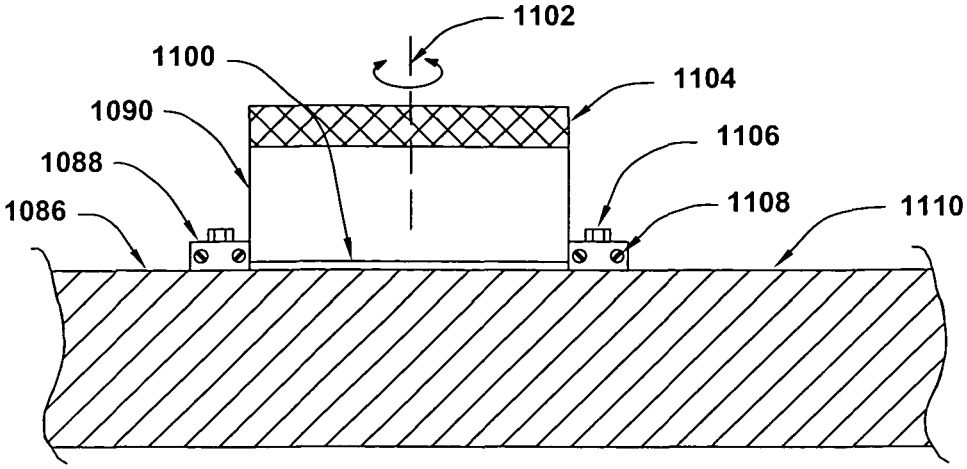
FIG. 78 is a cross section view of adjustable legs on a workpiece spindle.

FIG. 78 is a cross section view of adjustable legs on a workpiece spindle. A rotary workpiece spindle 1090 is attached to a granite base 1110 by fasteners 1106 that are used to bolt the spindle legs 1088 to the granite base 1110. The spindle 1090 has three equally spaced spindle legs 1088 that are attached to the bottom portion of the spindle 1090 where there is a space gap 1100 between the bottom of the spindle and the flat surface 1086 of the granite base 1110. The spindle 1090 has a rotary spindle top 1104 that rotates about a spindle axis 1102 and the three spindle legs are height-adjusted to align the spindle axis 1102 approximately perpendicular with the top surface 1086 of the approximately-flat granite base 1110. To adjust the height of the spindle leg 1088, transverse bolts 1108 are tightened to squeeze-adjust the spindle leg 1088 where the spindle leg 1088 distorts along the spindle axis 1102 thereby raising the portion of the spindle 1090 located adjacent to the transverse bolts 1108 squeeze-adjusted spindle leg 1088. After the three spindle legs 1088 are adjusted to provide the desired height of the top flat surface of the spindle top 1104 and provide the perpendicular alignment of the spindle axis 1102 with the top surface 1086 of the granite base 1110, the spindle hold-down attachment bolts 1106 are torque-controlled tightened to attach the spindle 1090 to the granite base 1110. The hold-down bolts 1106 can be loosened and the spindle 1090 removed and the spindle 1090 then brought back to the same spindle 1090 location and position on the granite base 1110 for re-mounting on the granite base 1110 without affecting the height of the spindle top 1104 or perpendicular alignment of the spindle axis 1102 because the controlled compressive force applied by the hold-down bolts 1106 does not substantially affect the desired size-height distortion of the spindle legs 1088 along the spindle rotation axis 1102. The height adjustments provided by this adjustable spindle leg 1088 can be extremely small, as little as 1 or 2 micrometers, which is adequate for precision alignment adjustments required for air bearing spindles 1050 that are typically used for the fixed-spindle floating-platen abrasive system (not shown). Also, these spindle leg 1088 height adjustments are dimensionally stable over long periods of time because the squeeze forces produced by the transverse bolts 1108 do not stress the spindle leg 1088 material past its elastic limit. Here, the spindle leg 1088 acts as a compression-spring where the spindle leg 1088 height can be reversibly changed by changing the force applied by the transverse bolts 1108 which is changed by changing the tightening-torque that is applied to these threaded transverse bolts 1108.

Figure 79:
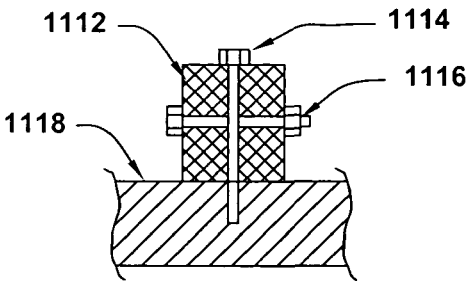
FIG. 79 is a cross section view of an adjustable spindle leg.

FIG. 79 is a cross section view of an adjustable spindle leg. A spindle leg 1112 has transverse tightening bolts 1116 that compress the spindle leg 1112 along the axis of the transverse bolts 1116. Spindle (not shown) hold-down bolts 1114 are threaded to engage threads (not shown) in the granite base 1118 but the compressive action applied on the spindle leg 1112 by the hold-down bolts 1114 along the axis of the hold-down bolt 1114 is carefully controlled in concert with the compressive action of the transverse bolts 1116 to provide the desired distortion of the spindle leg 1112 along the axis of the hold-down bolts 1114.

Figure 80:
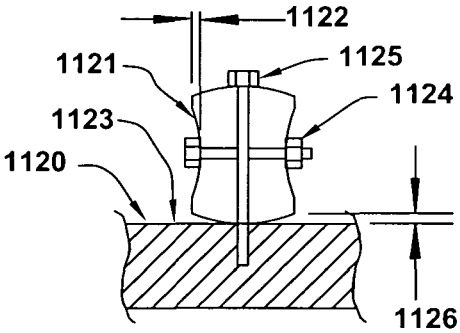
FIG. 80 is a cross section view of a compressed adjustable spindle leg.

FIG. 80 is a cross section view of a compressed adjustable spindle leg. A spindle leg 1121 has transverse tightening bolts 1124 that compress the spindle leg 1121 along the axis of the transverse bolts 1124 by a distortion amount 1122. Spindle (not shown) hold-down bolts 1125 are threaded to engage threads (not shown) in the granite base 1120 but the compressive action applied on the spindle leg 1121 by the hold-down bolts 1125 along the axis of the hold-down bolt 1125 is carefully controlled in concert with the compressive action of the transverse bolts 1124 to provide the desired distortion 1126 of the spindle leg 1112 along the axis of the hold-down bolts 1114. The transverse bolts 1124 create a transverse squeezing distortion 1122 that is present on the spindle leg 1121 and this transverse distortion 1122 produces the desired height distortion 1126 of the spindle leg 1121. When the spindle leg 1121 is distorted by the amount 1126, the spindle is raised away from the surface 1123 of the granite base 1120 by this distance amount 1126.

Figure 81:
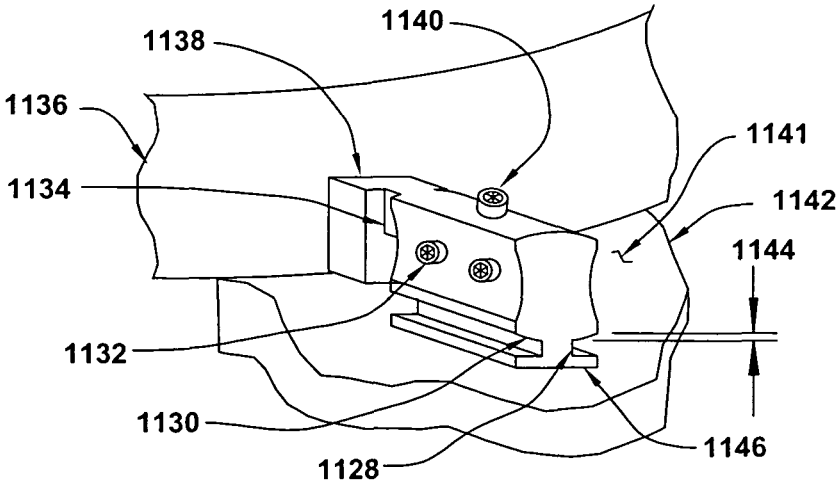
FIG. 81 is an isometric view of a compressed adjustable spindle leg.

FIG. 81 is an isometric view of a compressed adjustable spindle leg. A spindle leg 1138 has transverse tightening bolts 1132 that compress the spindle leg 1130 along the axis of the transverse bolts 1132. The spindle 1136 has attached spindle legs 1138 that have spindle hold-down bolts 1140 that are threaded to engage threads (not shown) in the granite base 1142. The compressive action applied on the spindle leg 1138 by the hold-down bolts 1140 along the axis of the hold-down bolt 1140 is carefully controlled in concert with the compressive action of the transverse bolts 1132 to provide the desired distortion 1144 of the spindle leg 1138 along the axis of the hold-down bolts 1140. The transverse bolts 1132 create a transverse squeezing distortion that is present on the spindle leg 1138 and this transverse distortion produces the desired height distortion 1144 of the spindle leg 1138. When the spindle leg 1138 is distorted by the amount 1144, the spindle 1136 is raised away from the surface 1141 of the granite base 1142 by this distance amount 1144. A spindle leg 1138 integral flat-base 1146 having a distortion-isolation wall 1128 provides flat-contact of the spindle leg 1138 with the flat surface 1141 of the granite base 1142. The distortion-curvature 1130 of the spindle leg 1138 is shown where the spindle leg 1138 leg-base 1146 remains flat where it contacts the granite base 1142 flat surface 1141. A narrow but stiff bridge section 1134 that is an integral portion of the spindle leg 1138 isolates the spindle leg 1138 distortion 1144 from the body of the spindle 1136.

Figure 82:
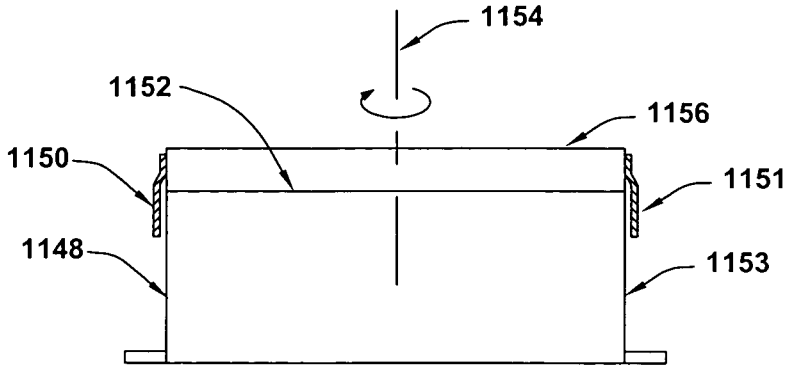
FIG. 82 is a cross section view of a workpiece spindle with a spindle top debris guard.

FIG. 82 is a cross section view of a workpiece spindle with a spindle top debris guard. A cylindrical workpiece spindle 1148 has a rotary top 1156 that rotates about a spindle axis 1154 where the spindle top 1156 has a circumferential separation line 1152 that separates the spindle top 1156 from the spindle 1148 base 1153. Where these spindles 1148 are used in abrading atmospheres, water mist, abrading debris and very small sized abrasive particles are present in the atmosphere surrounding the spindle 1148. To prevent entry of this debris, water moisture and abrasive particles in the spindle 1148 separation line 1152 area, a circumferential drip-shield 1150 is provided where the drip shield 1150 has a drip lip 1151 that extends below the separation line 1152. Unwanted debris material and water simply drips off the surface of the drip shield 1150. Build-up of debris matter on the drip shield 1150 is typically avoided because of the continued presence of abrasive coolant water that continually washes the surface of the drip shield 1150. When the workpiece spindles 1148 are used in abrading processes, often special chemical additives are added to the coolant water to enhance the abrading action on workpieces (not shown) in abrading procedures such as chemical mechanical planarization. Both the cylindrical spindle 1148 cylindrical drip shields 1150 and the spindles 1148 are constructed from materials that are resistant to materials comprising water coolants, chemical additives, abrading debris and abrasive particles.

Figure 83:
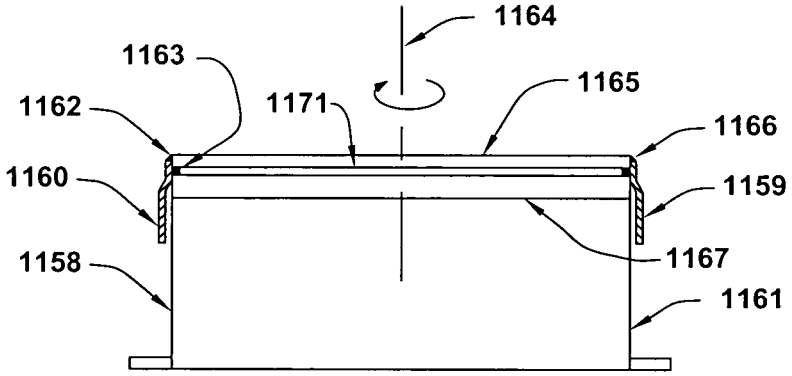
FIG. 83 is a cross section view of a workpiece spindle with a spindle O-ring debris guard.

FIG. 83 is a cross section view of a workpiece spindle with a spindle O-ring debris guard. A cylindrical workpiece spindle 1158 has a rotary top 1165 that rotates about a spindle axis 1164 where the spindle top 1165 has a circumferential separation line 1167 that separates the spindle top 1165 from the spindle 1148 base 1161. Where these spindles 1158 are used in abrading atmospheres, water mist, abrading debris and very small sized abrasive particles are present in the atmosphere surrounding the spindle 1158. To prevent entry of this debris, water moisture and abrasive particles in the spindle 1158 separation line 1167 area, a circumferential drip-shield 1160 is provided where the drip shield 1160 has a drip lip 1159 that extends below the separation line 1167. Unwanted debris material and water simply drips off the surface of the drip shield 1160. Build-up of debris matter on the drip shield 1160 is typically avoided because of the continued presence of abrasive coolant water that continually washes the surface of the drip shield 1160. When the workpiece spindles 1158 are used in abrading processes, often special chemical additives are added to the coolant water to enhance the abrading action on workpieces (not shown) in abrading procedures such as chemical mechanical planarization. Both the cylindrical spindle 1158 cylindrical drip shields 1160 and the spindles 1158 are constructed from materials that are resistant to materials comprising water coolants, chemical additives, abrading debris and abrasive particles. An O-ring 1163 is shown positioned in an O-ring groove 1171 that is a part of the spindle top 1165 and this O-ring 1163 acts as a seal to prevent water or debris from entering the top peripheral edge 1162 of the spindle top 1165. In addition, temporary sealant 1166 can be used to seal this same peripheral edge 1162 joint area.

Figure 84:
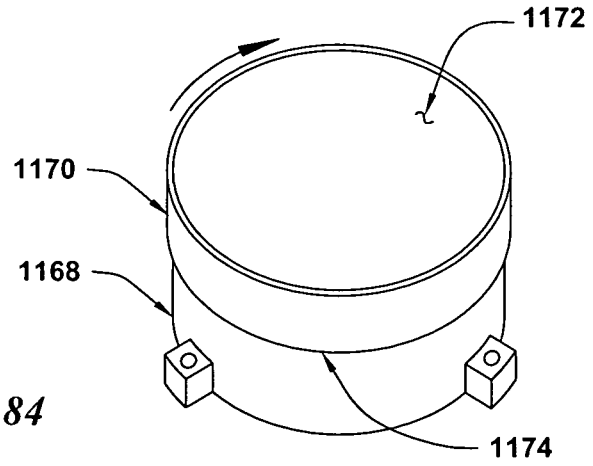
FIG. 84 is an isometric view of a workpiece spindle with a spindle top debris guard.

FIG. 84 is an isometric view of a workpiece spindle with a spindle top debris guard. A rotary workpiece spindle 1168 has a drip shield 1170 that extends around the periphery of the spindle 1168 flat-surfaced spindle top 1172 where the drip shield 1170 has a drip shield 1170 lower periphery edge 1174.

Figure 85:
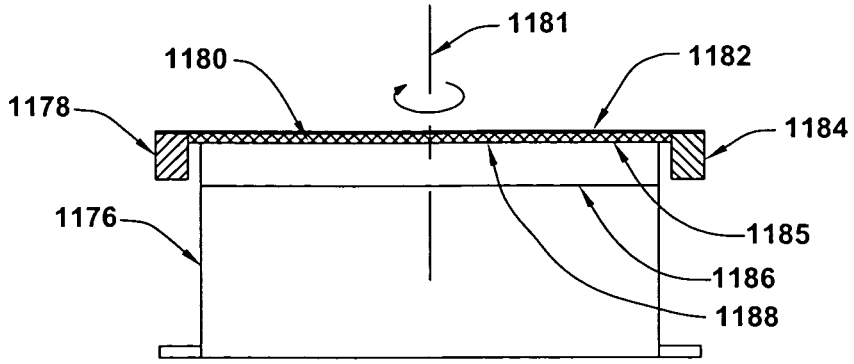
FIG. 85 is a cross section view of a workpiece spindle with an annular conditioning ring.

FIG. 85 is a cross section view of a workpiece spindle with a annular conditioning ring. A rotary workpiece spindle 1176 has a rotary spindle top 1186 that rotates about a spindle axis 1181 and the spindle top 1186 has a flat top surface 1185. A conditioning ring 1178 has an annular ring 1184 that is attached to a flat-surfaced conditioning ring support plate 1188 that is in flat contact with the flat top surface 1185 of the spindle top 1186. The annular ring 1184 has a top ring surface 1182 that is coated with abrasive 1180 where the abrasive 1180 can be in abrading contact with a platen (not shown) abrading surface or can be in abrading contact with an abrasive disk (not shown) that is attached to a flat platen surface where the abrasive disk abrading surface contacts the conditioning ring 1184 abrasive surface 1180. The conditioning ring 1178 is rotated in a selected rotation direction while the platen is rotated in a selected direction to abrade the flat annular abrading surface of the platen or the flat annular abrasive surface of the abrasive disk.

Figure 86:
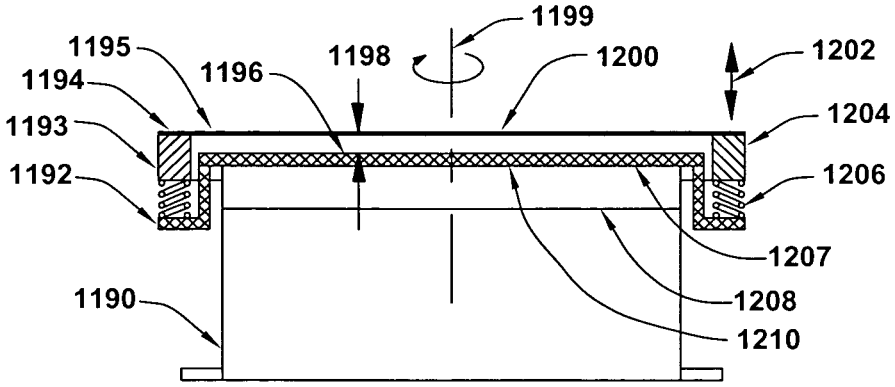
FIG. 86 is a cross section view of a spindle with a spring-type annular conditioning ring.

FIG. 86 is a cross section view of a spindle with a spring-type annular conditioning ring. A rotary workpiece spindle 1190 has a rotary spindle top 1208 that rotates about a spindle axis 1199 and the spindle top 1208 has a flat top surface 1207. A conditioning ring 1193 has an annular ring 1204 that is attached to compression springs 1206 that are supported by a annular ledge 1192 that is attached to a flat-surfaced conditioning ring support plate 1210 that is in flat contact with the flat top surface 1207 of the spindle top 1208. The conditioning ring 1193 annular portion 1204 has a top ring surface 1200 that is coated with abrasive 1195 where the abrasive 1195 can be in abrading contact with a platen (not shown) abrading surface or can be in abrading contact with an abrasive disk (not shown) that is attached to a flat platen surface where the abrasive disk abrading surface contacts the conditioning ring 1193 abrasive surface 1195. The conditioning ring 1193 is rotated in a selected rotation direction while the platen is rotated in a selected direction to abrade the flat annular abrading surface of the platen or the flat annular abrasive surface of the abrasive disk. A gap 1198 is maintained between the top surface 1196 of the support plate 1210 and the conditioning ring 1193 abrasive surface 1195 to allow the conditioning ring 1193 to travel friction-free in a vertical direction 1202. The abrading pressure applied by the conditioning ring 1193 to the platen abrading surface or platen abrasive disk is controlled by the deflection of the condition ring 1193 supporting springs 1206.

Figure 87:
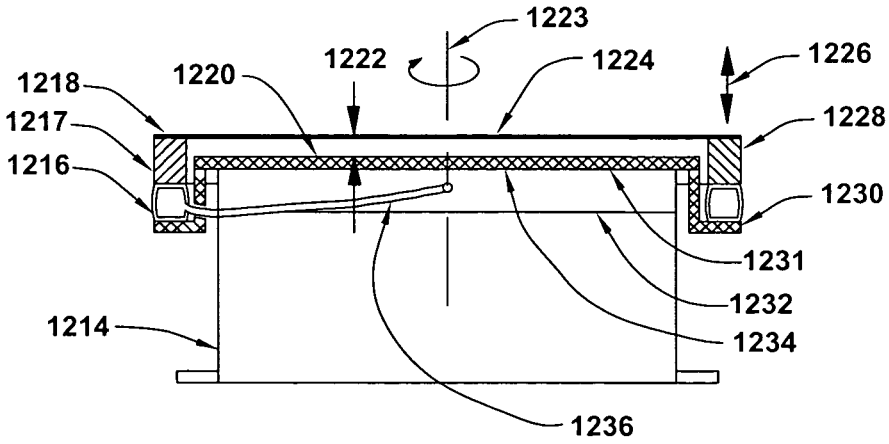
FIG. 87 is a cross section view of a spindle with a bladder-type annular conditioning ring.

FIG. 87 is a cross section view of a spindle with a bladder-type annular conditioning ring. A rotary workpiece spindle 1214 has a rotary spindle top 1232 that rotates about a spindle axis 1223 and the spindle top 1232 has a flat top surface 1231. A conditioning ring 1217 has an annular ring 1228 that is attached to an annular-shaped air bladder 1216 that is supported by a annular ledge 1230 that is attached to a flat-surfaced conditioning ring support plate 1234 that is in flat contact with the flat top surface 1231 of the spindle top 1232. The conditioning ring 1217 annular portion 1228 has a top ring surface 1224 that is coated with abrasive 1218 where the abrasive 1218 can be in abrading contact with a platen (not shown) abrading surface or can be in abrading contact with an abrasive disk (not shown) that is attached to a flat platen surface where the abrasive disk abrading surface contacts the conditioning ring 1217 abrasive surface 1218. The conditioning ring 1217 is rotated in a selected rotation direction while the platen is rotated in a selected direction to abrade the flat annular abrading surface of the platen or the flat annular abrasive surface of the abrasive disk. A gap 1222 is maintained between the top surface 1220 of the support plate 1234 and the conditioning ring 1217 abrasive surface 1218 to allow the conditioning ring 1217 to travel friction-free in a vertical direction 1226. The abrading pressure applied by the conditioning ring 1217 to the platen abrading surface or platen abrasive disk is controlled by the air pressure supplied to the annular air bladder 1217 that supports the conditioning ring 1217. A flexible air line 1236 supplies pressurized air to the bladder 1216 from the rotary spindle 1214 spindle top 1232 where the pressurized air is supplied by a rotary union (not shown) that is attached to the spindle top 1232 hollow rotary drive shaft (not shown).

Figure 88:
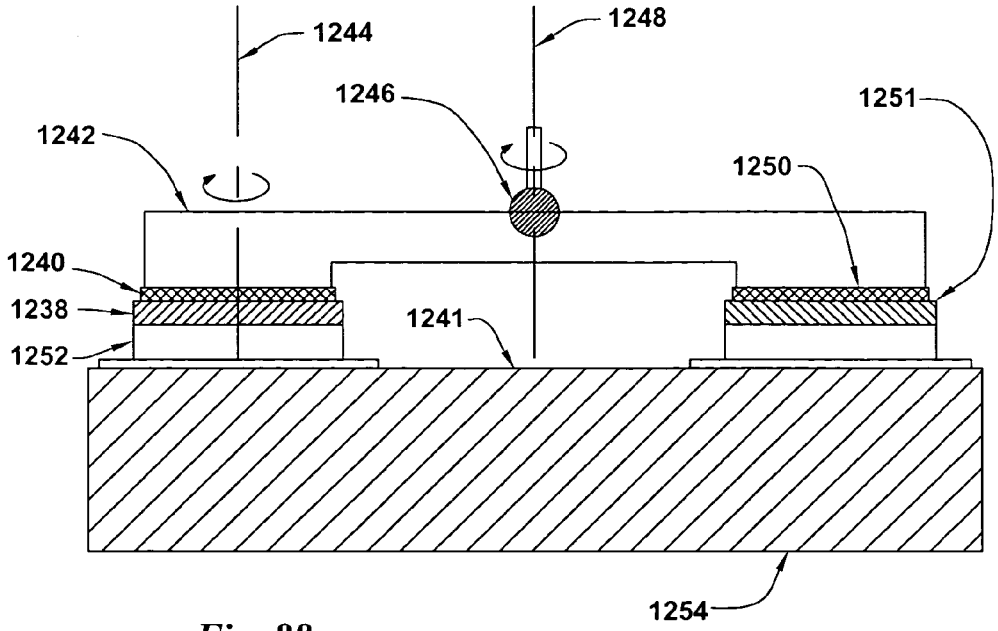
FIG. 88 is a cross section view of spindle abrasion of a platen abrading surface.

FIG. 88 is a cross section view of spindle abrasion of a platen abrading surface. A rotary platen 1242 that rotates about a platen axis 1248 is supported at the platen axis 1248 by a spherical action device 1246 that allows the free-floating platen 1242 to have spherical pivot action while the spherical action device 1246 restrains the platen 1242 in a platen annular abrading surface 1250 radial direction. The spherical action device 1246 can be moved in a direction along the platen axis 1248 to raise or lower the platen 1242 where the platen abrading surface 1250 is horizontal. The spherical action device 1246 also provides rotation of the platen 1242 about the platen 1242 rotation axis 1248. The platen rotation axis 1248 is centered between three fixed-position rotary spindles 1252 that have rotary tops 1238 where the three spindles (one not shown) 1252 have equal spaces between them and the spindles 1252 have spindle rotation axes 1244. The spindles 1252 are mounted on a granite machine base 1254 and the spindle axes of rotation 1244 are approximately perpendicular to the flat top surface 1241 of the granite base 1254. The platen 1242 has an annular flat abrading surface 1250 that is abraded by equal-thickness abrasive disks 1240 that are attached to the top flat surfaces 1251 of all three of the three-point fixed-position spindle 1252 spindle tops 1238 where the spindle tops 1238 rotate in selected directions and at selected rotational speeds while the abrading surface 1250 of the platen 1242 is rotated in selected directions and at selected rotational speeds during the abrading action. The abrading pressure between the abrading surface 1250 of the platen 1242 and the spindle top 1238 abrasive disks 1240 is controlled throughout the platen surface 1250 abrading action. The abrading disks 1240 are selected to have a disk 1240 diameter that is larger than the radial width of the annular abrading surface 1250 of the platen 1242 to assure that the rotating abrasive disk 1240 extends over both the inner and outer peripheries of the platen 1242 annular abrading surface 1250. The annular abrading surface 1250 of the platen 1242 is a bare non-abrasive surface. This bare-surfaced annular abrading surface 1250 of the platen 1242 can be coated with an abrasive slurry mixture (not shown) or abrasive disk articles (not shown) can be attached to this platen 1242 abrading surface 1250.

Figure 89:
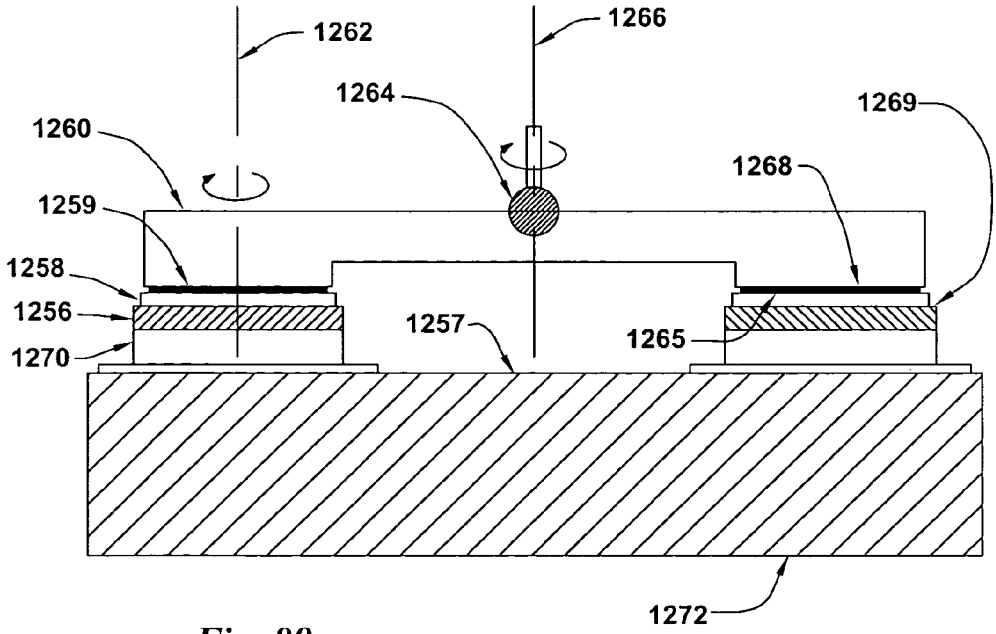
FIG. 89 is a cross section view of spindle abrasion of an abrasive disk attached to a platen.

FIG. 89 is a cross section view of spindle abrasion of an abrasive disk attached to a platen. A rotary platen 1260 that rotates about a platen axis 1266 is supported at the platen axis 1266 by a spherical action device 1264 that allows the free-floating platen 1260 to have spherical pivot action while the spherical action device 1264 restrains the platen 1260 in a platen annular abrading surface 1268 radial direction. The spherical action device 1264 can be moved in a direction along the platen axis 1266 to raise or lower the platen 1260 where the platen abrading surface 1268 is horizontal. The spherical action device 1264 also provides rotation of the platen 1260 about the platen 1260 rotation axis 1266. The platen rotation axis 1266 is centered between three fixed-position rotary spindles 1270 that have rotary tops 1256 where the three spindles (one not shown) 1270 have equal spaces between them and the spindles 1270 have spindle rotation axes 1262. The spindles 1270 are mounted on a granite machine base 1272 top surface 1257 and the spindle axes of rotation 1262 are approximately perpendicular to the approximately-flat top surface 1257 of the granite base 1272. The platen 1260 has an annular flat abrading surface 1268 to which is attached the abrasive disk 1259 having an annular abrading surface 1265 that is abraded by equal-thickness abrasive disks 1258 that are attached to the top flat surfaces 1269 of all three of the three-point fixed-position spindle 1270 spindle tops 1256 where the spindle tops 1256 rotate in selected directions and at selected rotational speeds while the abrading surface 1268 of the platen 1260 is rotated in selected directions and at selected rotational speeds during the abrasive disk 1259 abrading surface 1265 abrading action. The abrading pressure between the abrasive disk 1259 abrading surface 1265 and the spindle top 1256 abrasive disks 1258 is controlled throughout the abrasive disk 1259 abrading surface 1265 abrading action. The spindle top 1256 abrading disks 1258 are selected to have a disk 1258 diameter that is larger than the radial width of the platen 1260 abrasive disk 1259 annular abrading surface 1265 to assure that the rotating abrasive spindle disks 1258 extend over both the inner and outer peripheries of the platen 1260 abrasive disk 1259 annular abrading surface 1265.

Fixed workpieces spindles mounted on the top surface of a machine base can all be driven by a driven wire which rotates the top portion of the station spindles. The three-point workpiece spindles, or even more spindles in a group, can be driven by a continuous wire loop. Spindle tilting forces on the spindle are avoided by selective routing of the wire where it contacts the spindle rotary tops. The wire loop is wrapped around the top rotary portion of the fixed spindles in a spindle-top wire groove that surrounds the circular spindle top outer periphery. The wrapped drive wire enters and exits the spindle top periphery in a straight plane that is tangent to the peripheral surface of the spindle top. Because of this planar alignment of the drive wire with the spindle top periphery, the drive wire provides rotational torque to the spindle top but other forces that would tend to tilt the spindle top are minimized by this planar alignment of the entry and exit of the looped wire relative to the spindle top. There is substantial traction of the small diameter wire as it is wrapped around the spindle top periphery and also substantial traction of the wire at the wire motor drive as the wire is also wrapped around the motor drive wire pulley.

A cultch is provided at the drive motor to limit the wire tension to prevent wire breaks and stretching of the wire. The wires are continuous loops formed by butt welding the two opposed ends of the wire using induction heating and compressed forcing of the two heated wire ends together. The butt weld joint is then ground down and polished to a uniform wire diameter size along the butt welded section of wire. The fatigue life of this butt joint construction provides substantial wire-use life to the continuous loop as it is routed at high speeds around the spindle tops and the wire idlers. This butt weld joint is similar to the butt welds used for continuous loops of metal saw blades that are constructed from high-strength blade material. Small diameter high-strength wire material is readily available for replacement purposes.

The torque applied to the spindles can be monitored using the motor control systems to ascertain the completion-condition of the workpieces mounted to the spindle tops as the stiction-force between the workpieces and the abrasive increase as the workpieces become progressively flatter and smoother due to the abrading action.

Wire tension can be controlled using a air cylinder that urges an idler mounted on a pivot arm into a span of wire where the idler acts at a near-right angle to the wire in the wire span. Another device mounted on the pivot arm, or another pivot arm, can be used to sense if the wire breaks and it can be used to initiate a emergency-stop shut down of the system in a wire-break event. A wire-condition sensor can be used to continuously monitor the condition of the wire as it travels past the stationary sensor system. Changes in the wire diameter can be sensed along with wire surface defects to provide knowledge of the optimal time to change the wire loop on a preventative maintenance basis. An air jet can be used to clean abrading debris or water from the wire to insure accurate wire diameter measurements by the sensor.

This spindle wire drive system can be used on the upper surface of a machine base to act as a direct drive for the individual spindle tops or the wire drive system can be mounted on the bottom of the machine base and used to drive the spindle shaft drive pulleys.

Figure 90:
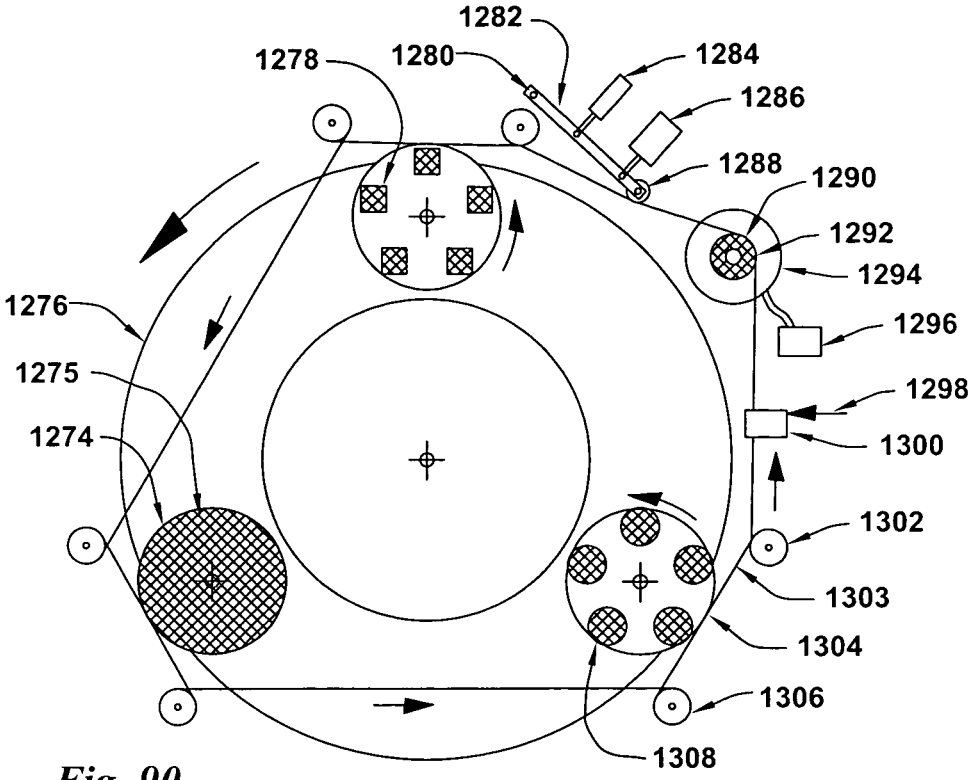
FIG. 90 is a top view of three-point workpiece spindles driven by a continuous wire loop.

FIG. 90 is a top view of three-point workpiece spindles where all three spindles are driven by a continuous wire loop. Spindles 1275 are mounted on a machine base 1276 where the spindles 1275 contain workpieces 1274, 1278 and 1308 that are contacted by a abrasive coated rotary platen (not shown). A drive wire 1303 is wrapped around a motor 1294 wire pulley 1292 that is attached to a torque-controlled clutch 1290 where the clutch 1290 limits the motor 1294 induced tension in the wire 1303. Wire 1303 tension is controlled by either the motor 1294 or by an air cylinder 1284 that acts upon a pivot arm 1282 that has a arm 1282 end-attached wire idler 1288 that contacts the wire 1303. A pivot arm 1282 motion sensor 1286 is used to detect sudden motions of the pivot arm 1282 that occurs in the event of wire 1303 breakage. The wire 1303 is routed through a wire condition sensor 1300 to determine the size of the wire 1303 and to sense defects of the wire 1303 surface as the wire 1303 moves through the sensor 1300. An air jet 1298 cleans the wire 1303 from abrading debris and water prior to the wire 1303 surface being measured by the sensor 1300.

The wire 1303 is routed around the circumference of the spindle 1275 tops with the use of wire 1303 idlers 1302 and 1306 that route the wire 1303 in a common plane into and out of the spindle 1275 tops and at a wire 1303 common contact point 1304 that is located at the outer periphery of the spindle 1275 rotary tops. The motor 1294 has a motor current sensor 1296 that indicates the torque being applied to the motor 1294 which represents the stiction (workpiece completion condition state) between the workpieces 1274,1278 and 1308 and the abrasive surface (not shown).

Figure 91:
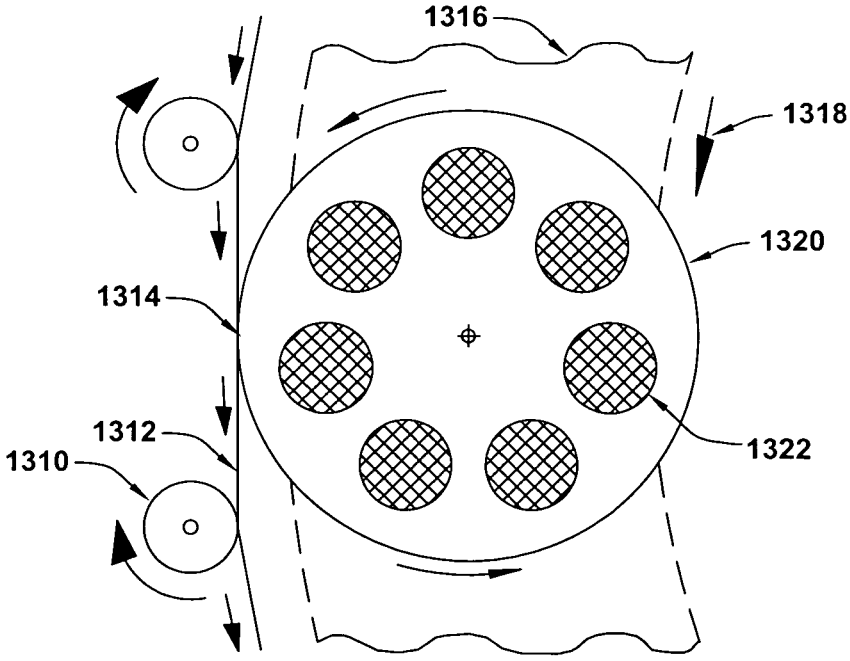
FIG. 91 is a top view of a single workpiece spindle driven by a continuous wire loop.

FIG. 91 is a top view of a single workpiece spindle driven by a continuous wire loop. A spindle 1320 is mounted on a machine base (not shown) where the spindle 1320 contains workpieces 1322 that are contacted by an abrasive coated rotary platen 1316 (shown as a dashed outline). A drive wire 1312 is routed around the circumference of the spindle 1320 top with the use of wire 1312 idlers 1310 that route the wire 1312 in a common plane into and out of the spindle 1320 tops and at a wire 1312 common contact point 1314 that is located at the outer periphery of the spindle 1320 rotary top. The platen abrasive 1316 travels in a rotary direction 1318.

Figure 92:
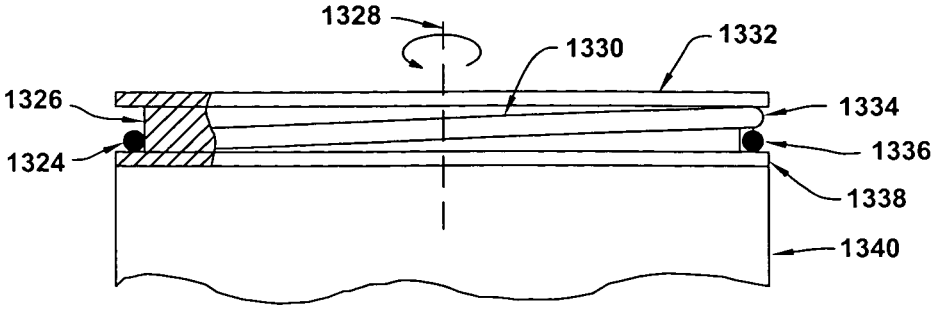
FIG. 92 is a side view of a single workpiece spindle driven by a continuous wire loop.

FIG. 92 is a side view of a single workpiece spindle rotary top driven by a continuous wire loop. A spindle 1332 rotary top 1338 that rotates about an axis 1328 is attached to a stationary spindle body 1340 that is attached to a machine base (not shown). The spindle top 1338 has a recessed wire groove 1326 that contains a wrapped drive wire 1334 that is also shown at the spindle top 1338 recessed wire groove 1326 entry and exit positions as 1324 and 1336. The drive wire 1334 is shown at an angled incline position 1330 as the wire 1334 is wrapped around the spindle top 1338 wire groove 1326.

Figure 93:
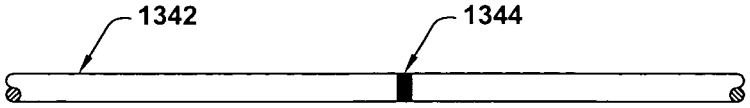
FIG. 93 is a side view of a butt welded section of a continuous wire loop.

FIG. 93 is a side view of a butt welded section of a continuous wire loop. A round wire 1342 has a butt weld joint 1344.

Figure 94:
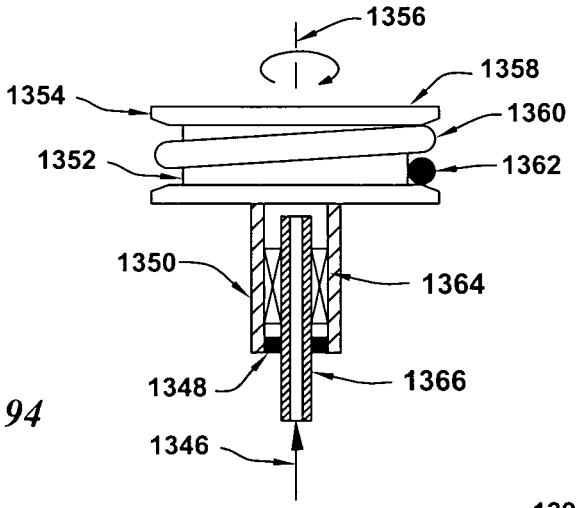
FIG. 94 is a cross section view of an air purged wire loop wire-wrapped idler pulley.

FIG. 94 is a cross section view of an air purged wire loop wire-wrapped idler pulley. A wire idler 1358 rotates about an axis 1356 where the idler 1358 has a diameter 1354 and the idler 1358 has a wire groove 1352. A round drive wire 1360 is wrapped around the idler 1358 groove 1352 to allow two layers of the wire 1360 to travel in the groove 1352 as shown by the two wire 1360 and wire 1362 views. The idler 1358 has a hollow shaft 1350 that contains an idler bearing 1364 that supports a stationary hollow idler shaft 1366 that allows entry of pressurized air 1346 which acts to purges the idler 1358 and prevent entry of abrasive debris into the idler 1358 device. An idler shaft 1366 seal 1348 contacts both the shaft 1366 and the idler shaft 1350 to prevent entry of abrasive debris into the idler 1358 device.

Figure 95:
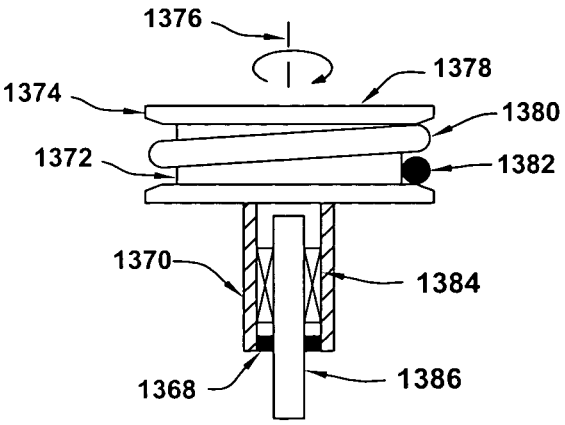
FIG. 95 is a cross section view of a wire loop wire-wrapped idler pulley.

FIG. 95 is a cross section view of a wire loop wire-wrapped idler pulley. A wire idler 1378 rotates about an axis 1376 where the idler 1378 has a diameter 1374 and the idler 1378 has a wire groove 1372. A round drive wire 1380 is wrapped around the idler 1378 groove 1372 to allow two layers of the wire 1380 to travel in the groove 1372 as shown by the two wire 1380 and wire 1382 views. The idler 1378 has a hollow shaft 1370 that contains an idler bearing 1384 that supports a stationary solid idler shaft 1386 where an idler shaft 1386 seal 1368 contacts both the shaft 1386 and the idler shaft 1370 to prevent entry of abrasive debris into the idler 1378 device.

Figure 96:
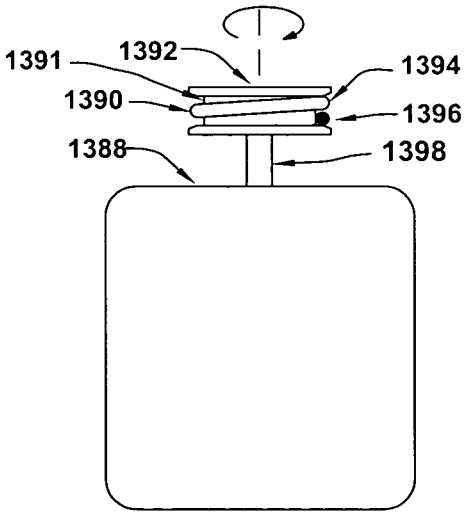
FIG. 96 is a side view of a drive motor with a wire-wrapped wire drive pulley.

FIG. 96 is a side view of a drive motor with a wire-wrapped wire drive pulley. A drive motor 1388 has a rotatable motor shaft 1398 which has an attached wire pulley 1392 where a round drive wire 1394 is wrapped around the pulley 1392 pulley groove 1391 to allow two layers of the wire 1394 to travel in the groove 1391 as shown by the two wire 1394 and wire 1396 views and the wire 1390 view.

Figure 97:
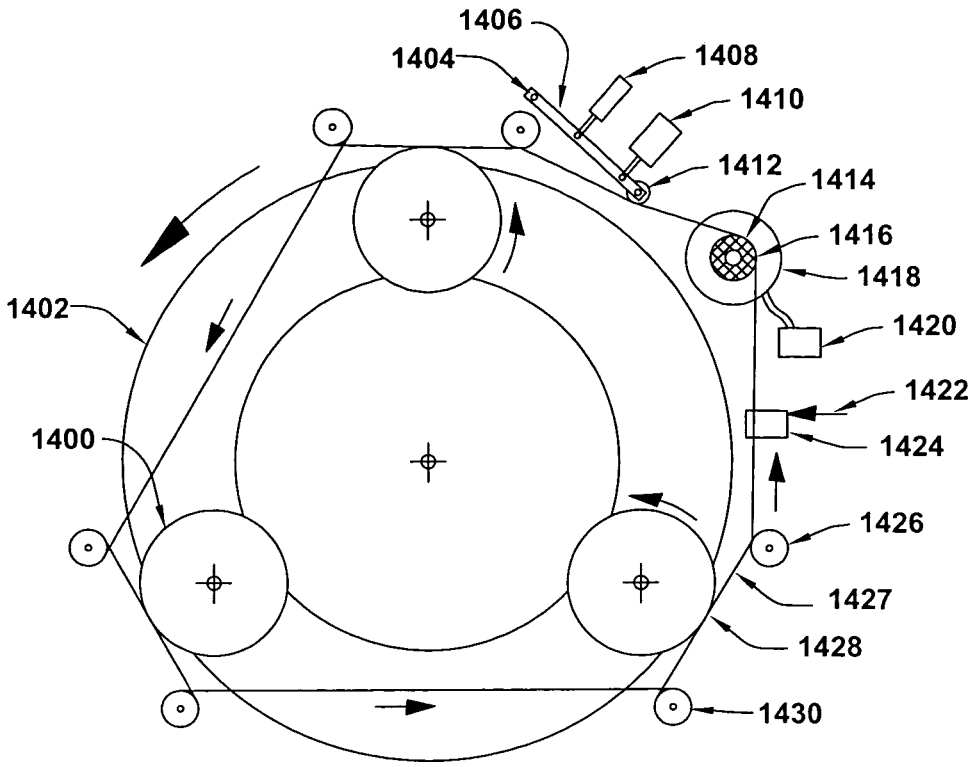
FIG. 97 is a bottom view of a workpiece spindle pulleys driven by a continuous wire loop.

FIG. 97 is a bottom view of three-point workpiece spindles where all three rotating spindle top drive shaft pulleys are driven by a continuous wire loop. Spindles pulleys 1400 are mounted on a machine base 1402 where the spindle pulleys 1400 drive spindle tops (not shown) that have attached workpieces (not shown) that are contacted by an abrasive coated rotary platen (not shown). A drive wire 1427 is wrapped around a motor 1418 wire pulley 1416 that is attached to a torque-controlled clutch 1414 where the clutch 1414 limits the motor 1418 induced tension in the wire 1427. Wire 1427 tension is controlled by either the motor 1418 or by an air cylinder 1408 that acts upon a pivot arm 1406 that has an arm 1406 end-attached wire idler 1412 that contacts the wire 1427. A pivot arm 1406 motion sensor 1410 is used to detect sudden motions of the pivot arm 1406 that occurs in the event of wire 1427 breakage. The wire 1427 is routed through a wire condition sensor 1424 to determine the size of the wire 1427 and to sense defects of the wire 1427 surface as the wire 1427 moves through the sensor 1424. An air jet 1422 cleans the wire 1427 from abrading debris and water prior to the wire 1427 surface being measured by the sensor 1424.

The wire 1427 is routed around the circumference of the spindle pulleys 1400 with the use of wire 1427 idlers 1426 and 1430 that route the wire 1427 in a common plane into and out of the spindle pulleys 1400 and at a wire 1427 common contact point 1428 that is located at the outer periphery of the spindle pulleys 1400. The motor 1418 has a motor current sensor 1420 that indicates the torque being applied to the motor 1418 which represents the stiction (workpiece completion condition state) between the workpieces and the abrasive surface (not shown).

Figure 98:
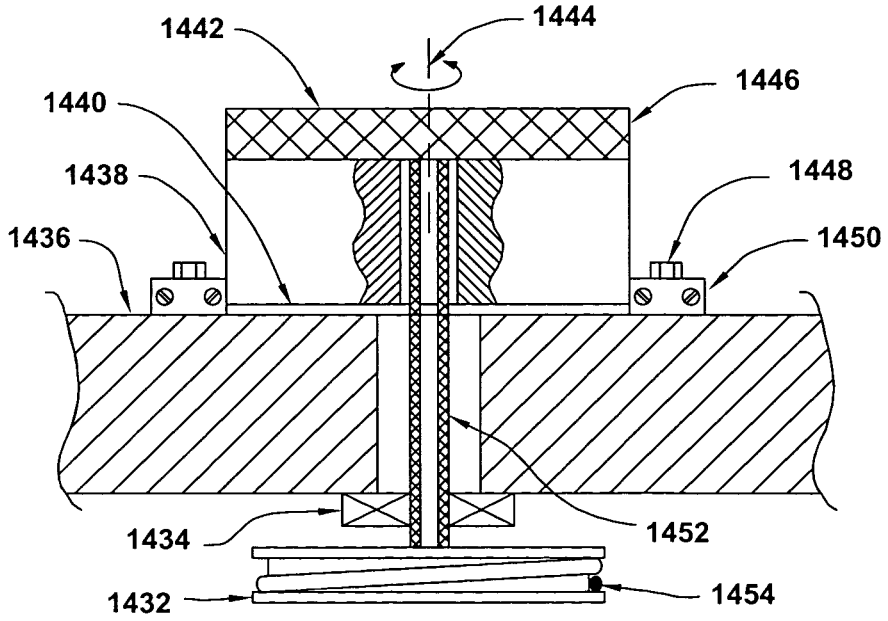
FIG. 98 is a cross section view of a workpiece spindle pulley driven by a wire loop.

FIG. 98 is a cross section view of a workpiece spindle top that is driven by a continuous wire loop. A spindle 1438 having a spindle-top 1446 has a flat surface 1442 where the spindle-top 1446 is rotated about a spindle axis 1444. The spindle 1438 is mounted on a machine base 1436 by fasteners 1448 that attach spindle support legs 1450 that are attached to the spindle 1438 body to the machine base 1436. The spindle-top 1446 is driven by a shaft 1452 that is supported by a bearing 1434 that is attached to the machine base 1436. A spindle-top 1446 drive-wire 1454 is shown wrapped around a drive pulley 1432 that is attached to the spindle-top 1446 hollow drive shaft 1452.

Figure 99:
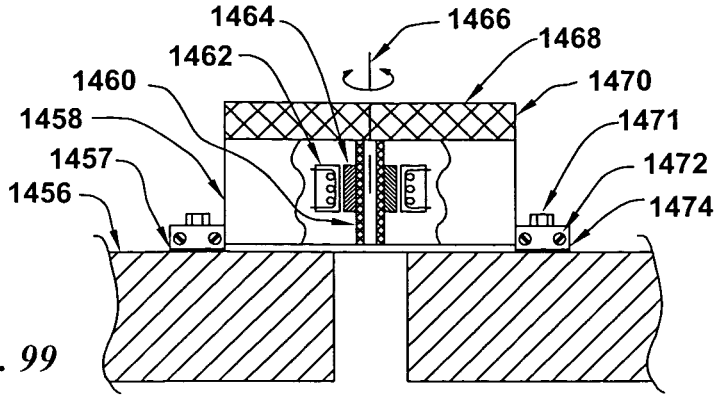
FIG. 99 is a cross section view of a workpiece spindle driven by an internal motor.

FIG. 99 is a cross section view of a workpiece spindle driven by an internal motor. A spindle 1458 having a spindle-top 1470 has a flat surface 1468 where the spindle-top 1470 is rotated about a spindle axis 1466. The spindle 1458 is mounted on a machine base 1456 by fasteners 1471 that attach spindle support legs 1474 that are attached to the spindle 1458 body to the machine base 1456. The spindle support legs 1474 are individually height-adjusted by squeeze-fasteners 1472 and with the use of shims 1457. The spindle-top 1470 is driven by a hollow shaft 1460 that is driven by a motor armature 1464 that is driven by an internal motor winding 1462.

Figure 100:
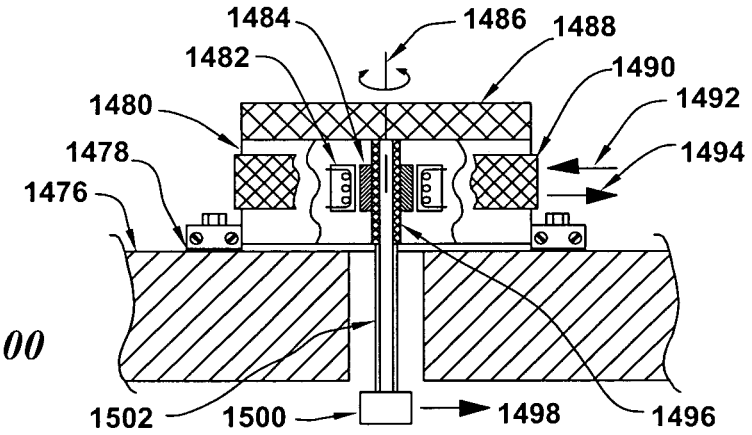
FIG. 100 is a cross section view of a workpiece spindle driven by a cooled internal motor.

FIG. 100 is a cross section view of a workpiece spindle driven by a cooled internal motor. A spindle 1480 has a flat-surfaced rotary spindle-top 1488 where the spindle-top 1488 is rotated about a spindle axis 1486. The spindle 1480 is mounted on a machine base 1476 by fasteners that attach spindle support legs 1478 that are attached to the spindle 1480 body to the machine base 1476. The spindle-top 1488 is driven by a hollow shaft 1496 that is driven by a motor armature 1484 that is driven by an internal motor winding 1482. The spindle-top 1488 hollow drive shaft 1496 has an attached hollow shaft 1502 that has an attached to a stationary rotary union 1500 that is coupled to a vacuum source 1498 that supplies vacuum to the spindle-top 1488. A water jacket 1490 is shown wrapped around the spindle 1480 body where the water jacket 1490 has temperature-controlled coolant water 1492 that enters the water jacket 1490 and exits the water jacket as exit water 1494 where the water 1492 cools the spindle 1480 to remove the heat generated by the motor windings 1482 to prevent thermal distortion of the spindle 1480 and thermal displacement of the spindle-top 1488.

Figure 101:
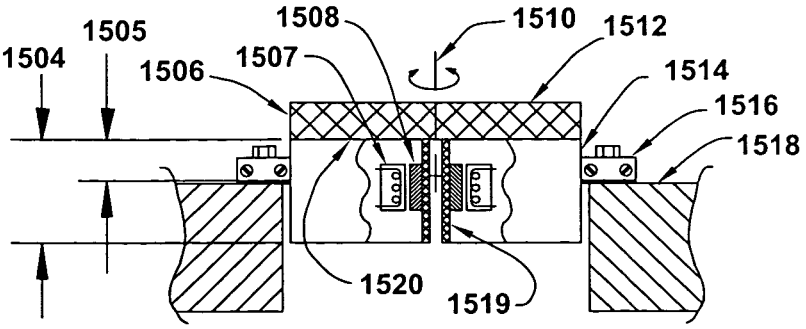
FIG. 101 is a cross section view of a recessed workpiece spindle driven by an internal motor.

FIG. 101 is a cross section view of a recessed workpiece air bearing spindle driven by an internal motor. A rotary workpiece spindle 1514 is mounted on a machine base 1518 with spindle legs 1516 that are attached to the spindle 1514 body. The spindle 1514 has a flat-surfaced spindle-top 1512 that rotates about a spindle axis 1510. The spindle-top 1512 has a hollow spindle shaft 1519 that is driven by an internal motor armature 1508 that is driven by an electrical motor winding 1507. The spindle 1514 is recessed into the machine base 1518 because the spindle 1514 support legs 1516 are attached to the spindle 1514 body near the top of the spindle 1514. Here, the separation-line 1520 between the spindle-top 1512 and the spindle 1514 body is a close distance 1505 from the spindle 1514 mounting surface of the machine base 1518. Because the distance 1505 is short, heat from the motor winding 1507 that tends to thermally expand the length of the spindle 1514 is minimized and the there is little thermally-induced vertical movement of the spindle-top 1512 due to the motor heat. Also, the pressurized air that is supplied to the air bearing spindle 1514 expands as it travels through the spindle 1514 which lowers the temperature of the spindle air. This cool spindle air exits the spindle body at the separation line 1520 where it cools the spindle 1514 internally and at the interface between the spindle-top 1512 and the spindle 1514 which reduces the thermal-expansion effects from the heat generated by the electrical internal motor windings 1507. Thermal growth in the length 1504 of the spindles 1514 tends to be equal for all three spindles 1514 used in the fixed-spindle floating platen abrading systems (not shown). Any spindle 1514 thermal distortion effects are uniform across all of the system spindles 1514 and there is little affect on the abrading process because the floating abrasive platen simply contacts all of these same-expanded spindles 1514 in a three-point contact stance. When the spindles 1514 are mounted where the bottom of the spindle 1514 extends below the machine base 1518 the effect of the thermal growth of the spindles 1514 along the spindle length is diminished.

This uniform thermal expansion and contraction of air bearing spindles occurs on all of the air bearing spindles mounted on all of the granite machine bases when each of individual spindles are mounted with the same methods on the bases. The spindles can be mounted on spindle legs attached to the bottom of the spindles or the spindles can be mounted to legs that are attached to the upper portion of the spindle bodies and the length expansion or shrinkage of all of the spindles will be the same. This insures that precision abrading can be achieved with these fixed-spindle floating-platen abrading systems.

Figure 102:
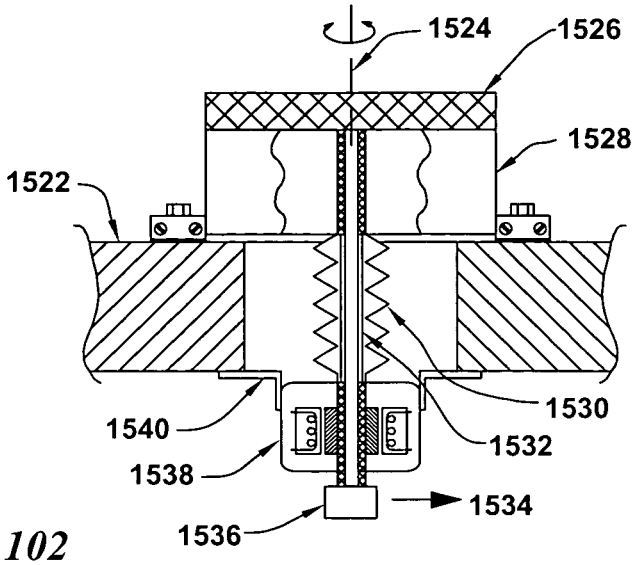
FIG. 102 is a cross section view of a workpiece spindle driven by an external motor.

FIG. 102 is a cross section view of a workpiece spindle driven by an external motor. A spindle 1528 having a flat-surfaced spindle-top 1526 that rotates about a spindle axis 1524 is mounted to a machine base 1522. An external motor 1538 drives the spindle-top 1526 with a bellows-type drive coupler 1530 that allows slight misalignments between the motor 1538 rotation axis and the spindle-top 1526 axis of rotation 1524. The bellows-type coupler 1530 provides stiff torsional load capabilities for accelerating or decelerating the spindle-top 1526. A rotary union device 1536 supplies vacuum 1534 to the spindle-top 1527 through a flexible tube 1532. The motor 1538 is attached to the machine base 1522 with motor brackets 1540.

Figure 103:
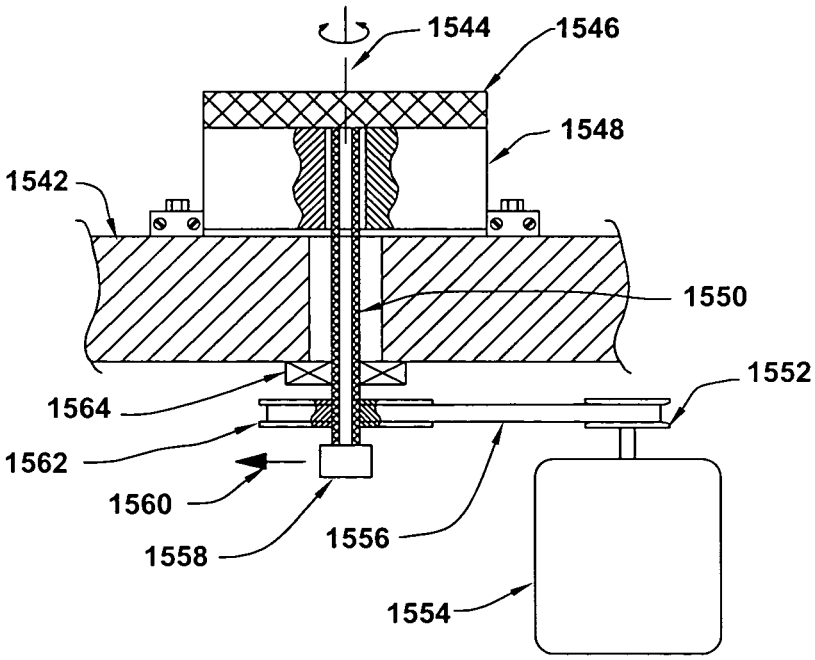
FIG. 103 is a cross section view of a workpiece spindle belt-driven by an external motor.

FIG. 103 is a cross section view of a workpiece spindle belt-driven by an external motor. A spindle 1548 having a flat-surfaced spindle-top 1546 that rotates about a spindle axis 1544 is mounted to a machine base 1542. An external motor 1554 drives the spindle-top 1546 with a hollow drive shaft 1550 that is supported by a bearing 1564 that is attached to the machine base 1542. The drive shaft 1550 has a drive pulley 1562 that is driven by a drive-belt 1556 that is driven by a motor pulley 1552 that is attached to a drive motor 1554. A rotary union device 1558 supplies vacuum 1560 to the spindle-top 1546 through the hollow drive shaft 1550.

Figure 104:
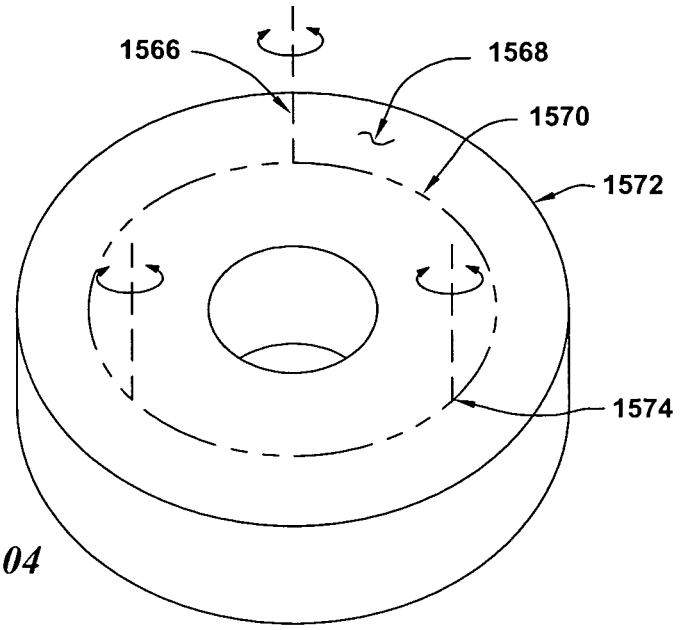
FIG. 104 is an isometric view of spindle rotation axes intersecting a spindle-circle.

FIG. 104 is an isometric view of spindle rotation axes intersecting a spindle-circle. A granite machine base 1572 has a spindle-circle 1570 that is coincident with the machine base 1572 surface 1568. Three equally-spaced spindles (not shown) have axes of rotation 1566 that intersect the spindle-circle 1570.

Figure 105:
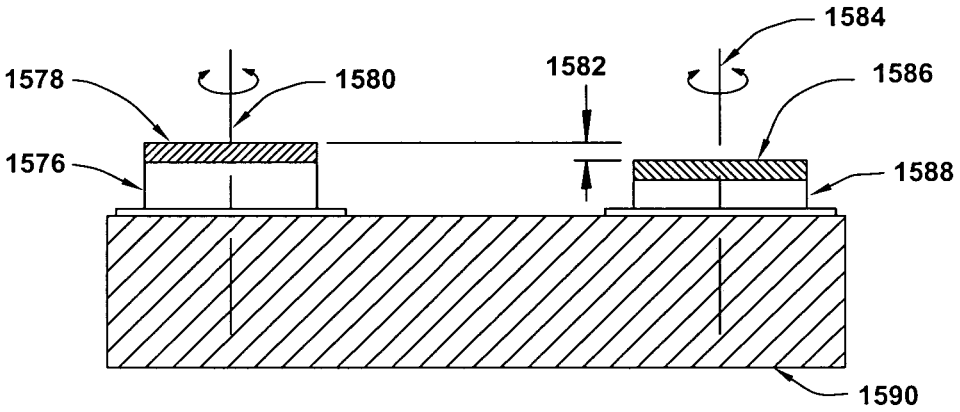
FIG. 105 is a cross section view of non-planar spindles on a machine base.

FIG. 105 is a cross section view of non-planar spindles on a machine base. Two rotary spindles 1576 and 1588 are attached to a machine base 1590 where the spindle 1576 has a rotary spindle-top 1578 that has an axis of rotation 1580 and the spindle 1588 has a flat surfaced spindle-top 1586 that has an axis of rotation 1584. The spindle 1576 spindle-top 1578 has elevation difference of 1582 with the spindle 1588 spindle-top 1586. A planar abrasive surface of an abrasive platen (not shown) would not be in flat contact with the two spindle-tops 1578 and 1586 because of the elevation difference 1582.

Figure 106:
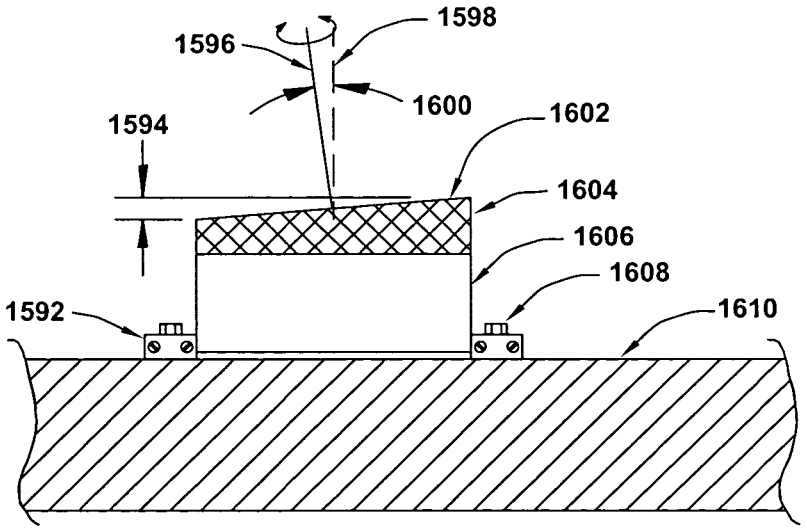
FIG. 106 is a cross section view of an angled spindle-top spindle on a machine base.

FIG. 106 is a cross section view of an angled spindle-top spindle on a machine base. A workpiece spindle 1606 that has a rotary spindle-top 1604 that has a rotary axis 1596 that has an angle 1600 with a vertical axis 1598 results in a angled spindle-top 1604 surface 1602 that has a elevation error distance 1594 across the width of the spindle-top 1604 surface 1602 that would prevent flat-surfaced abrading with a flat-surfaced platen (not shown) that is in three-point contact with a set of three spindles (two not shown). The spindle 1606 is attached at spindle 1606 spindle legs 1592 to the machine base 1610 with fasteners 1608.

FIG. 107 is an isometric view of fixed-abrasive coated raised islands on a flexible annular abrasive disk that has an open disk center. Abrasive particle 1616 coated raised islands 1618 are attached to an abrasive disk 1614 backing 1620 where the annular backing 1620 has an abrasive disk 1614 inner periphery 1612. The backing 1620 has a backing thickness 1622 that is thick enough to provide sufficient structural strength and support of the annular abrasive disk 1614 whereby the disk 1614 can be handled without damage to the disk 1614 and where the disk 1614 can be mounted to the flat annular surface of an abrading platen (not shown) where the disk 1614 can be successfully attached to the platen abrasive disk 1614 mounting surface with a vacuum attachment system (not shown).

FIG. 108 is an isometric view of a flexible fixed-abrasive coated raised island annular abrasive disk. Abrasive particle coated raised islands 1624 are attached to an abrasive disk 1628 backing 1630 and where the annular abrasive disk 1628 has an open center and also has an annular inner radius 1626.

FIG. 109 is an isometric view of a flexible annular fixed-abrasive coated abrasive disk having a thick layer of solid abrasive material attached to the annular abrasive disk backing. A continuous flat-surfaced annular band of a thick layer of solid abrasive material 1636 is attached to the flexible backing 1634 of an abrasive disk 1632 that can be attached with vacuum or by other mechanical attachment devices (not shown) to a flat-surfaced rotary platen (not shown). The annular abrasive material 1636 has inner radius abrasive periphery 1640 and the abrasive disk 1632 backing 1634 has an inner radius disk periphery 1638.

Figure 110:
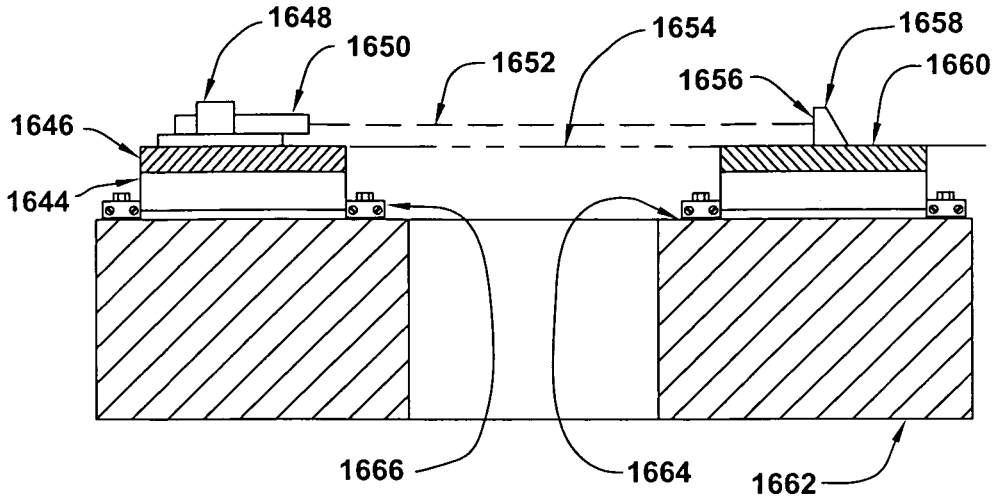
FIG. 110 is a cross section view of laser and target and spindles on a machine base.

FIG. 110 is a cross section view of laser and target and spindles on a machine base. Two rotary spindles 1644 having rotary spindle-tops 1646 are attached to a machine base 1662 where the spindles 1644 have adjustable spindle legs 1666 that allow the spindles 1644 to be mounted to the base 1662 surface 1664. A laser device 1648 mounted on a spindle 1644 flat surface 1660 has a laser tube 1650 that emits a laser beam 1652 that is impinged on a array sensor target 1656 that is part of the laser target 1658 that is mounted on another spindle 1644 surface 1660. The laser beam 1652 is parallel to the spindle-top 1646 surface plane 1654 that is common to the flat surfaces 1660 of the spindle-tops 1646. The laser 1648 and the laser target 1658 are used to co-planar align the surfaces 1660 of the spindles 1644.

Figure 111:
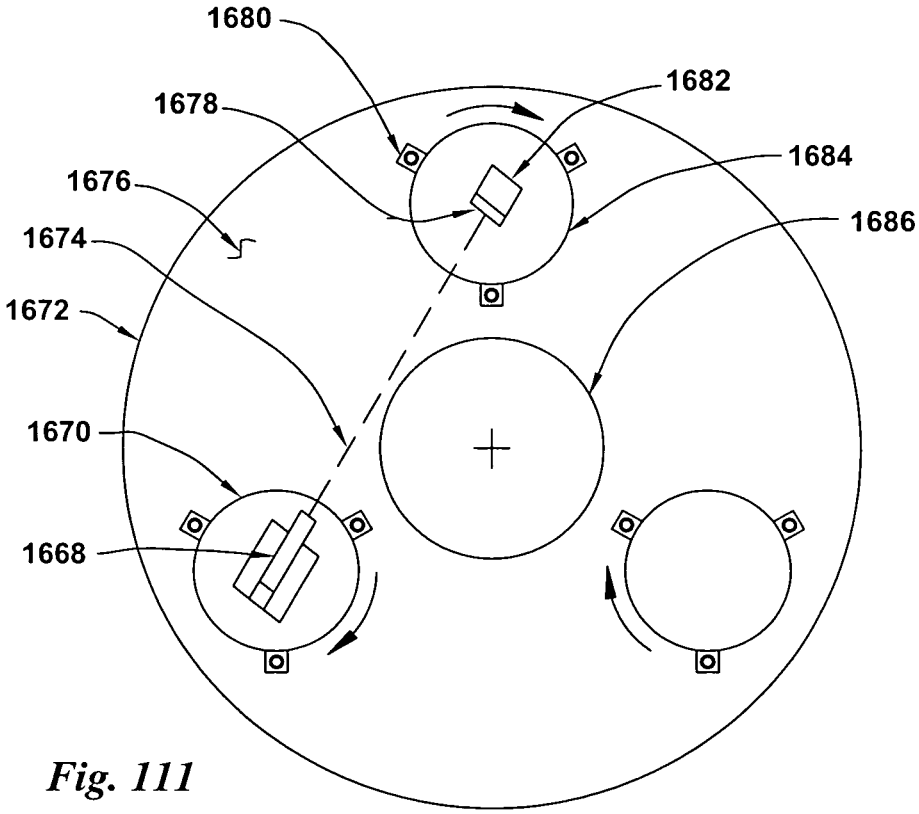
FIG. 111 is a top view of laser and target and spindles on a machine base.

FIG. 111 is a top view of a laser and a laser target and spindles on a machine base. Three rotary spindles 1670 having rotary spindle-tops 1684 are attached to a machine base 1672 where the spindles 1670 have adjustable spindle legs 1680 that allow the spindles 1670 to be mounted to the base 1672 surface 1676. A laser device 1668 mounted on a spindle-top 1684 emits a laser beam 1674 that is impinged on an array sensor target 1678 that is mounted on another spindle-top 1684. The machine base 1672 is shown with a cut-out center hole 1686. The laser 1668 and the laser target 1678 are used to co-planar align the spindle-tops 1684.

Figure 112:
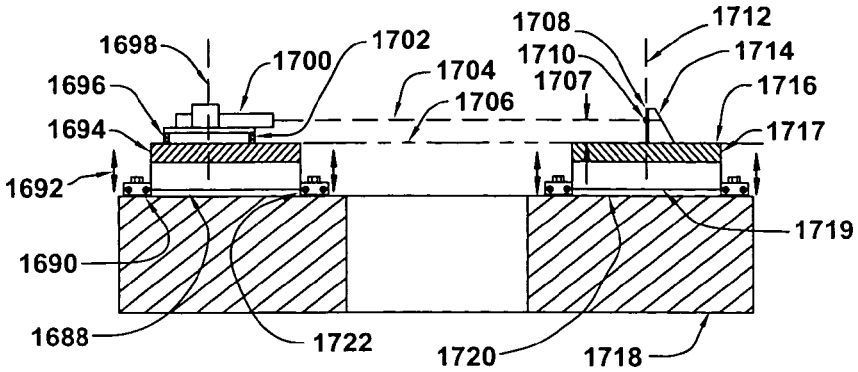
FIG. 112 is a cross section view of laser and target and spindles on a machine base.

FIG. 112 is a cross section view of laser and target and spindles on a machine base. Two rotary spindles 1694 having flat-surfaced 1716 rotary spindle-tops 1717 are attached to a machine base 1718 where the spindles 1694 have adjustable spindle legs 1722 that allow the spindles 1694 to be mounted to the base 1718 surface 1688 where the individual spindle legs 1722 are elevation-height 1692 adjusted with shims 1690 and leg 1722 adjustments. A laser device 1700 is mounted on a spindle-top 1694 flat surface 1716 by three-point laser device support legs 1696 where the laser 1700 emits a laser beam 1704 that is impinged on a array sensor target 1708 that has a target point 1710 that is located a distance 1707 above the top surface 1716 of the spindle-top 1717 that has the attached laser target 1708. The laser beam 1704 is shown parallel to the spindle-top 1717 surface plane 1706 that is common to the flat surfaces 1716 of the spindle-tops 1717. The laser 1700 and the laser target 1708 are used to co-planar align the top flat surfaces 1716 of the spindle-tops 1717. There is a space gap 1720 between the base surface 1688 and the bottom surface 1719 of the spindle 1694 that allows the spindle legs 1722 to be height adjusted. The spindle-tops 1717 rotate about the axes 1698 and 1712 and these axes 1698 and 1712 are precisely perpendicular to their respective spindle tops 1717.

Figure 113:
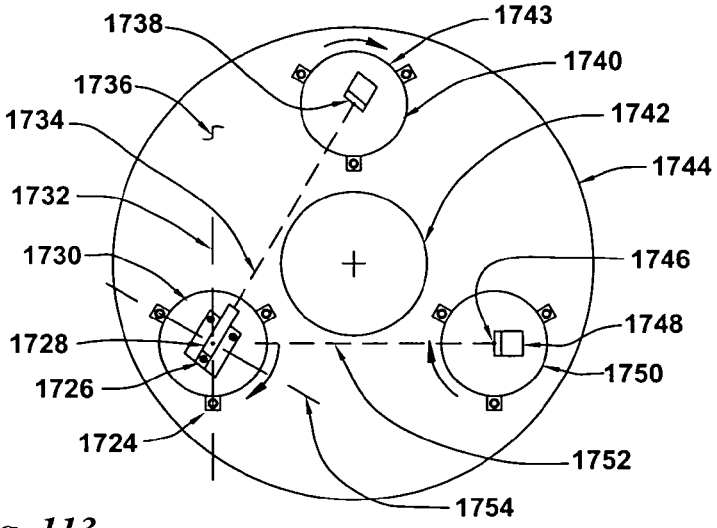
FIG. 113 is a top view of laser and target and spindles on a machine base.

FIG. 113 is a top view of a laser and a laser target and spindles on a machine base. Three rotary spindles 1730, 1740 and 1750 having rotary spindle-tops 1743 are attached to a machine base 1744 where the spindles 1730, 1740 and 1750 have adjustable spindle legs 1724 that allow the spindles 1730, 1740 and 1750 to be mounted to the base 1744 surface 1736. A laser device 1728 has three-point supports 1726 is mounted on a spindle-top 1730 emits a laser beam 1734 that is impinged on an array sensor target 1738 that is mounted on another spindle 1740 spindle-top 1743. The laser device 1728 can also be rotated on the spindle-top 1730 and emit a laser beam 1752 that is impinged on an array sensor target 1746 that is mounted on another spindle 1750 spindle-top 1743. The machine base 1744 is shown with a cut-out center hole 1742. The laser 1728 and the laser target 1738 are used to co-planar align the spindles 1730, 1740 and 1750 spindle-tops 1743. The spindle 1730 can be tilt-adjusted about a tilt axis 1754 that is perpendicular to the laser beam 1734 and the spindle 1730 can be tilt-adjusted about a tilt axis 1732 that is perpendicular to the laser beam 1752.

Figure 114:
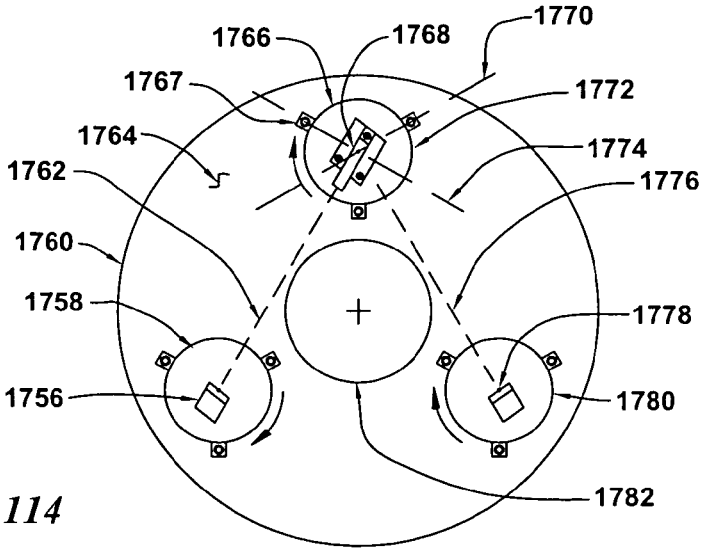
FIG. 114 is a top view of laser and target and spindles on a machine base.

FIG. 114 is a top view of a laser and a laser target and spindles on a machine base. In a second laser alignment step, three rotary spindles 1758, 1766 and 1780 having rotary spindle-tops 1772 are attached to a machine base 1760 where the spindles 1758, 1766 and 1780 have adjustable spindle legs 1767 that allow the spindles 1758, 1766 and 1780 to be mounted to the base 1760 surface 1764. A laser device 1768 mounted on a spindle 1766 spindle-top 1772 emits a laser beam 1762 that is impinged on an array sensor target 1756 that is mounted on another spindle 1758 spindle-top 1772. The laser device 1768 can also be rotated on the spindle-top 1766 and emit a laser beam 1776 that is impinged on an array sensor target 1778 that is mounted on another spindle 1780 spindle-top 1772. The machine base 1760 is shown with a cut-out center hole 1782. The laser 1768 and the laser target 1756 are used to co-planar align the spindles 1758, 1766 and 1780 spindle-tops 1772. The spindle 1766 can be tilt-adjusted about a tilt axis 1774 that is perpendicular to the laser beam 1762 and the spindle 1766 can be tilt-adjusted about a tilt axis 1770 that is perpendicular to the laser beam 1776.

Figure 115:
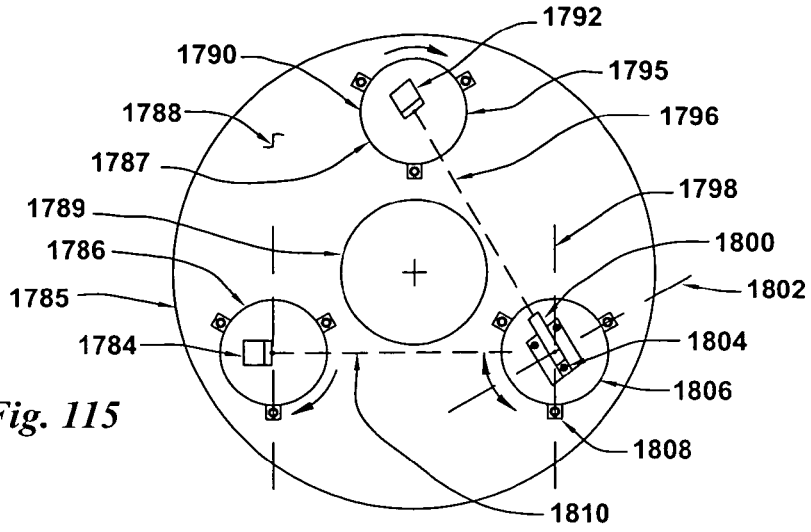
FIG. 115 is a top view of laser and target and spindles on a machine base.

FIG. 115 is a top view of a laser and a laser target and spindles on a machine base. In a third laser alignment step, three rotary spindles 1786, 1790 and 1806 having rotary spindle-tops 1795 are attached to a machine base 1785 where the spindles 1786, 1790 and 1806 have adjustable spindle legs 1808 that allow the spindles 1786, 1790 and 1806 to be mounted to the base 1785 surface 1788. A laser device 1800 having three point supports 1804 is mounted on a spindle 1806 spindle-top 1795 and emits a laser beam 1810 that is impinged on an array sensor target 1784 that is mounted on another spindle 1786 spindle-top 1795. The laser device 1800 can also be rotated on the spindle-top 1806 and emit a laser beam 1796 that is impinged on an array sensor target 1792 that is mounted on another spindle 1790 spindle-top 1795. The machine base 1785 is shown with a cut-out center hole 1789. The laser 1800 and the laser target 1784 are used to co-planar align the spindles 1786, 1790 and 1806 spindle-tops 1795. The spindle 1806 can be tilt-adjusted about a tilt axis 1798 that is perpendicular to the laser beam 1810 and the spindle 1806 can be tilt-adjusted about a tilt axis 1802 that is perpendicular to the laser beam 1796.

Figure 116:
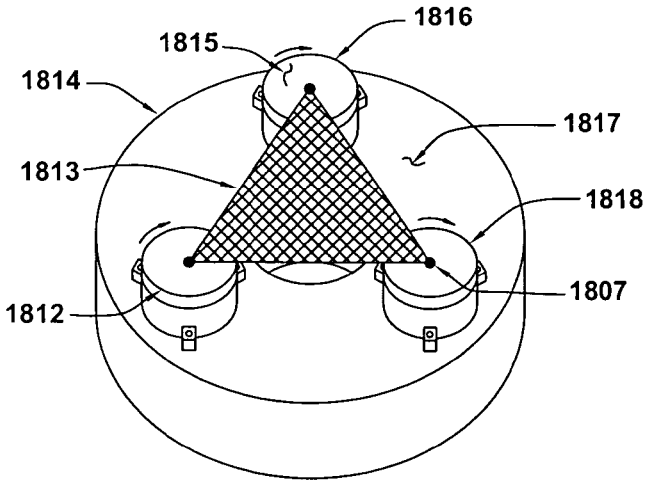
FIG. 116 is a top view of three-point spindles coplanar alignment.

FIG. 116 is an isometric view of three-point spindles that have a spindle-common plane where the spindles are mounted on a machine base. Three spindles 1818 having rotary spindle-tops 1812 that have spindle-top 1812 rotational center points 1807 where all of the spindle-tops 1812 flat surfaces 1815 are co-planar as represented by a planar surface 1813. The spindles 1818 are mounted on a machine base 1814.

Figure 116A:
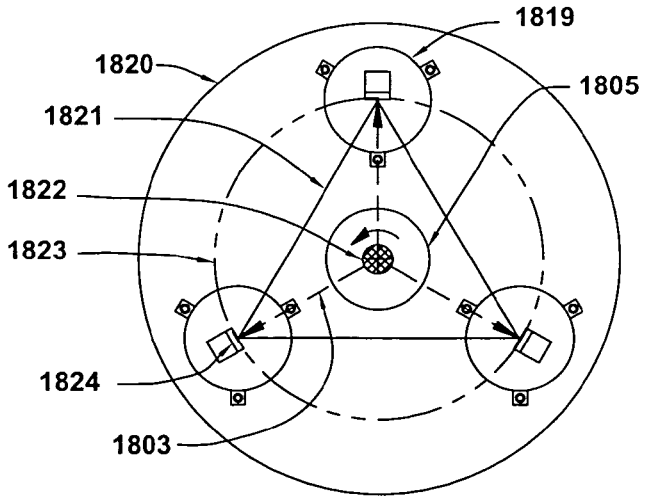
FIG. 116A is a top view of three-point spindles co-planar aligned by a planar-beam laser device.

FIG. 116A is a top view of three-point spindles co-planar aligned by a planar-beam laser device. Three-point spindles 1819 are mounted on a machine base 1820 where a rotary laser device 1805 having a rotary laser head 1822 that sweeps a laser beam 1803 in a laser plane circle 1823. The rotary laser 1805 is mounted on the machine base 1820 at a central position between the three spindles 1819 to minimize the laser beam 1803 distance between the rotary laser head 1822 and the laser targets 1824 that are mounted on the spindles 1819 top flat surfaces. The spindle 1819 top surfaces are aligned to be co-planar with the use of the rotary-beam laser device 1805 to form a spindle-top alignment plane 1821

Figure 117:
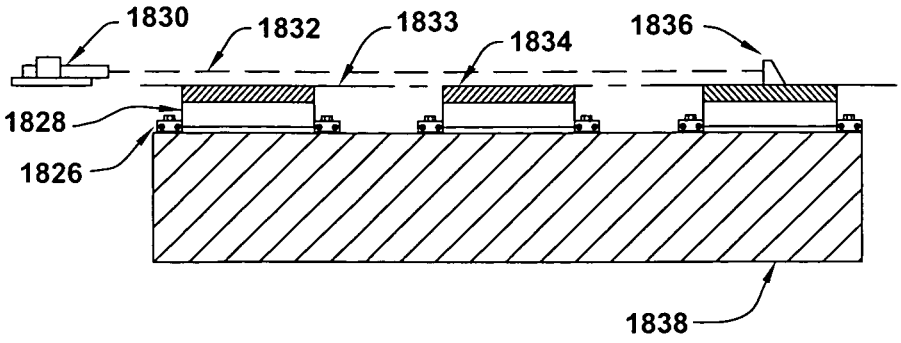
FIG. 117 is a cross section view of a remote position laser and target and spindles on a machine base.

FIG. 117 is a cross section view of a remote-position laser and target and spindles on a machine base. Three spindles 1828 that have flat-surfaced spindle-tops 1834 are attached with spindle legs 1826 to a machine base 1838. The spindles-tops 1834 are in a common plane 1833. A laser device 1830 that is mounted remotely from the spindles 1828 emits a laser beam 1832 that impinges on a laser target 1836 that is mounted to a spindle-top 1834 where the laser beam 1832 is parallel to the spindle-tops 1834 common plane 1833.

Figure 118:
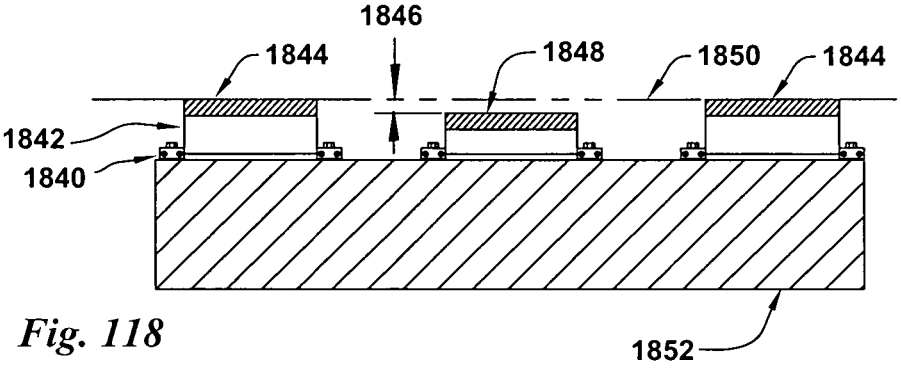
FIG. 118 is a cross section view of multiple non-planar spindles on a machine base.

FIG. 118 is a cross section view of multiple non-planar spindles on a machine base. Three spindles 1842 that have flat-surfaced spindle-tops 1844 and 1848 are attached with spindle legs 1840 to a machine base 1852. Two of the he spindles-tops 1844 are in a common plane 1850 but a third spindle 1842 has a off-set distance 1846 from its spindle-top 1848 and the spindle-top 1844 common plane 1850.

Figure 119:
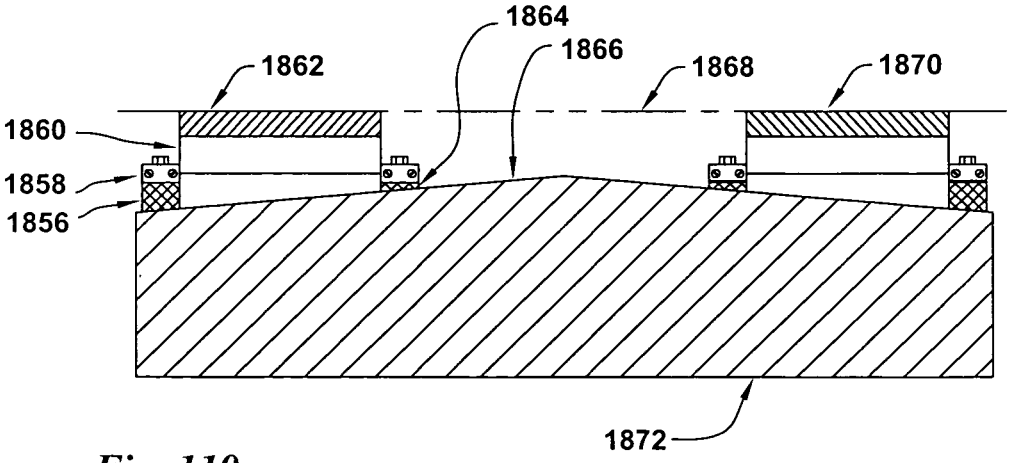

FIG. 119 is a cross section view of co-planar spindles mounted on an angled machine base. Two spindles 1860 that have flat-surfaced spindle-tops 1862 and 1870 are attached with spindle legs 1858 and spindle leg 1858 spacers 1856 and 1864 to a machine base 1872 that has a machine base 1872 angled surface 1866. The two spindles-tops 1862 and 1870 are in a common plane 1868.

Figure 120:
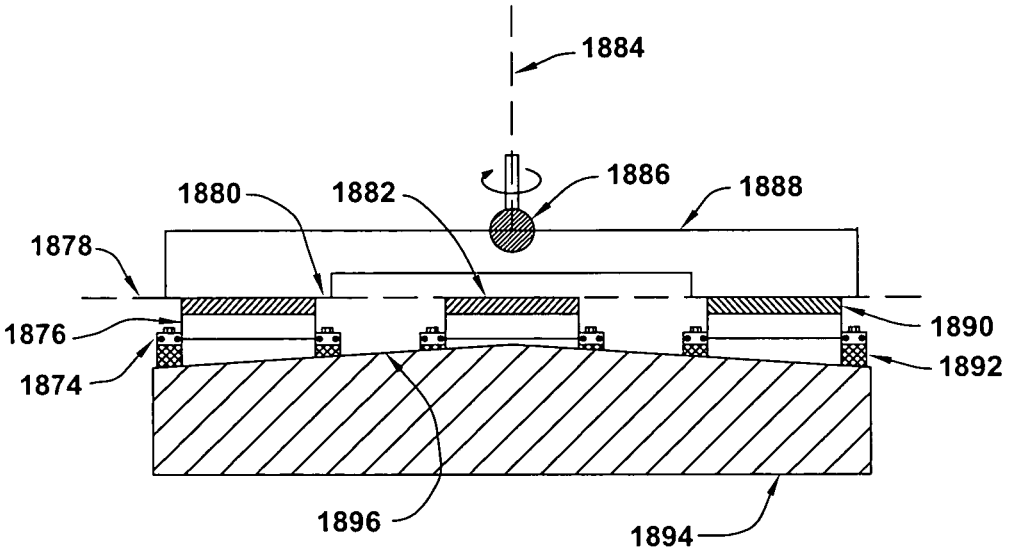

FIG. 120 is a cross section view of a floating platen and spindles on a angled machine base. Three spindles 1876 having spindle legs 1874 are mounted on a machine base 1894 that has an angled top surface 1896 by height-adjusting the spindle legs 1874 and with use of spindle leg 1874 spacers 1892 when all three spindles 1876 spindle-top 1890 flat surfaces 1882 are co-planar and lie in a common plane 1878. A floating platen 1888 has a spherical-rotation platen support device 1886 that allows the platen 1888 to rotate about a platen rotation axis 1884 and where the spherical platen support device 1886 allows the flat annular surface 1880 of the platen 1888 to be in conformal contact with the all three co-planar spindle tops 1890 flat surfaces 1882. Also, the platen 1888 spherical-action support device 1886 restrains the platen 1888 in a platen 1888 annular surface 1880 radial direction while the platen 1888 rotates about the platen 1888 rotation axis 1884.

Figure 121:
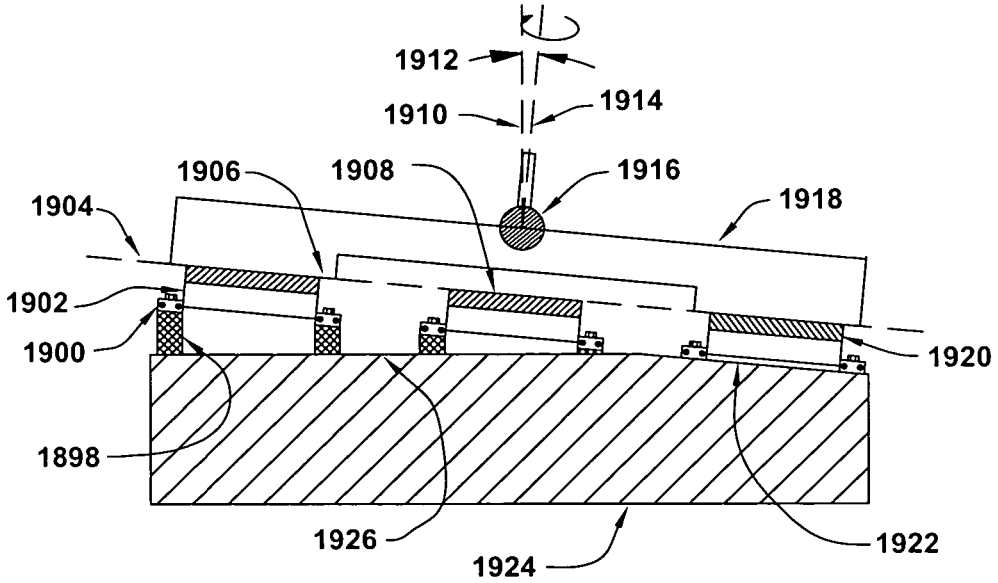

FIG. 121 is a cross section view of a floating platen and spindles on an angled machine base. Three spindles 1902 having spindle legs 1900 are mounted on a machine base 1924 that has an angled top surface 1926 by height-adjusting the spindle legs 1900 and with use of spindle leg 1900 spacers 1898 when all three spindles 1902 spindle-top 1920 flat surfaces 1908 are co-planar and lie in a common plane 1904. A floating platen 1918 has a spherical-rotation platen support device 1916 that allows the platen 1918 to rotate about a platen rotation axis 1914 and where the spherical platen support device 1916 allows the flat annular surface 1906 of the platen 1918 to be in conformal contact with the all three co-planar spindle tops 1920 flat surfaces 1908. Also, the platen 1918 spherical-action support device 1916 restrains the platen 1918 in a platen 1918 annular surface 1906 radial direction while the platen 1918 rotates about the platen 1918 rotation axis 1914. The platen 1918 annular flat surface 1906 is tilted from the horizontal as represented by the tilt angle 1912 between the platen 1918 rotation axis 1914 and a vertical axis 1910.

Figure 122:
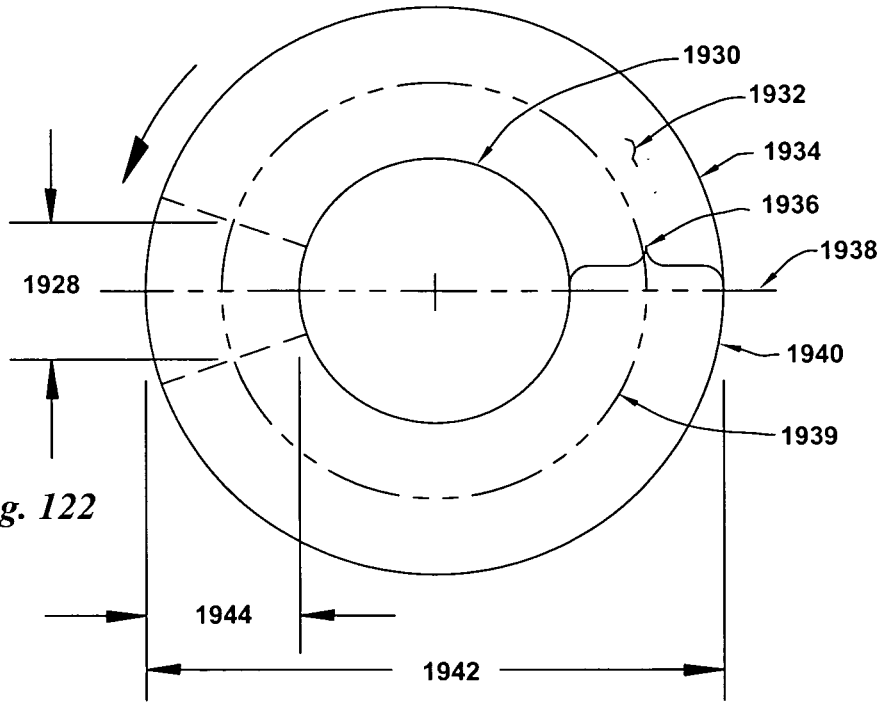

FIG. 122 is a top view of an arc segment of a platen abrading surface. A platen 1934 having a flat annular abrading surface 1932 has a abrading surface 1932 radial width 1944 where a annular abrading surface 1932 has a circumferential centerline 1939. The annular abrading surface 1932 has an outer radius 1940 and an inner radius 1930 and a diameter 1942. Radial platen 1934 out-of-plane deviation measurements are made in the region 1936 along the platen 1934 annular abrading surface 1932 radial line 1938. Circumferential platen 1934 out-of-plane deviation measurements are made along the platen 1934 circumference in the region along the platen 1934 annular abrading surface 1932 circumference in an area having a circumferential length 1928.

Figure 123:
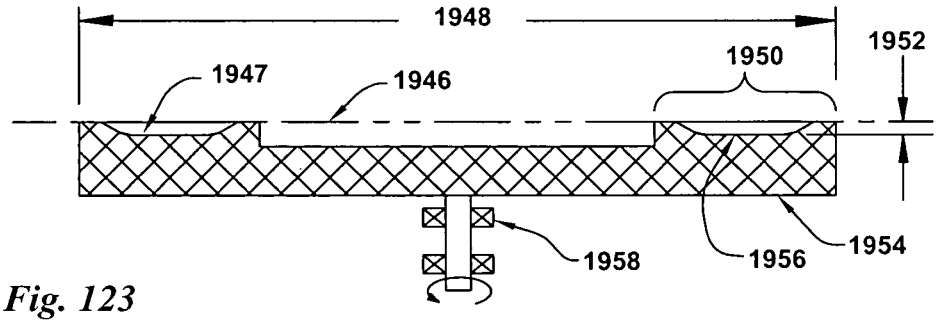

FIG. 123 is a cross section view of a non-planar platen surface. A platen 1954 has a non-flat annular abrading surface 1947 that has a diameter 1948. Radial platen 1954 out-of-plane deviation measurements are made in the region 1950 along the platen 1954 annular abrading surface 1947 radial line 1946. The non-flat surface deviations 1956 have a depth of 1952. The rotatable platen 1954 is supported by platen bearings 1958.

Figure 124:
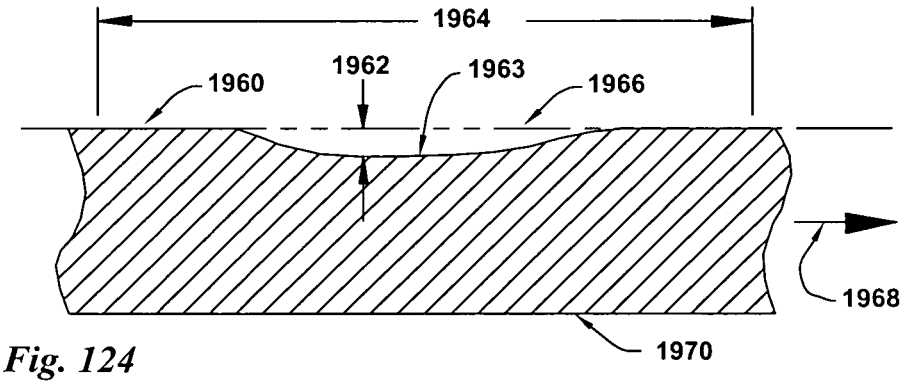

FIG. 124 is a cross section view of a segment of a non-planar platen surface. A circumferential section of a platen 1970 rotates in a direction 1968 has an out-of-plane flatness deviation 1963 that has a depth 1962 from the platen 1970 flat surface 1960 plane 1966.

Figure 125:
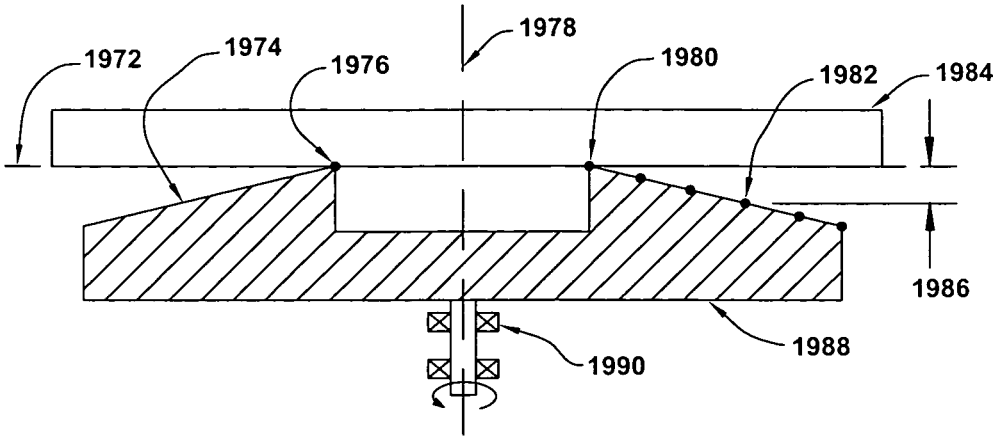

FIG. 125 is a cross section view of a non-flat radial segment of a platen surface. A platen 1988 has an angled non-planar abrading surface 1974 that deviates from the platen 1988 planar surface 1972. Deviation of measurement points 1982 that lie on a radial section of the platen 1988 have deviation distances 1986 as measured from the plane 1972. Here, a precision straight-edge member 1984 s shown contacting the platen 1988 at the inner radii points 1976 and 1980 on the platen 1988 annular surface 1974 and the measurement point 1982 deviation distances 1986 are shown relative to the bottom surface of the straight-edge member 1984. The platen 1988 is supported by bearings 1990.

Figure 126:
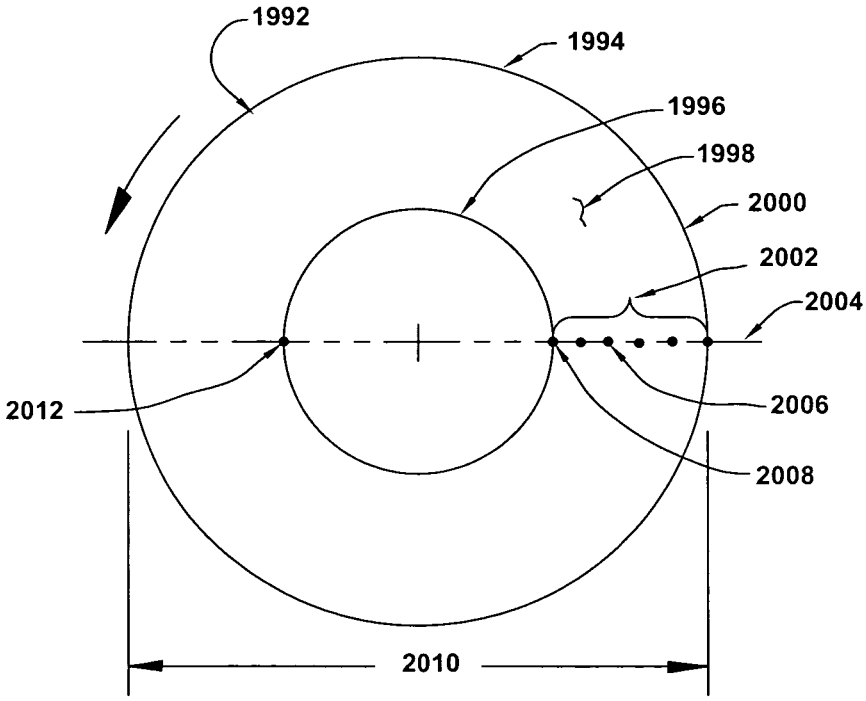

FIG. 126 is a top view of a non-flat radial segment of a platen surface. A platen 1992 has an angled non-planar abrading surface 1998 that deviates from the platen 1992 planar surface where the platen 1992 abrading surface 1998 has an inner diameter 1996 and an outer diameter 2000. The platen 1992 has a diameter size 2010. Radial deviation measurement points 2006 lie on a radial section of the platen 1992 in the region 2002 along a straight radial line 2004 that contacts the platen 1992 at the inner radii points 2012 and 2008.

HIGH SPEED LAPPING MACHINES

A. Lapper Machine Configuration

A preferred configuration of a high speed lapper machine is one having a stable massive granite base and that has a large diameter platen that remains precisely flat over long periods of time and at all speeds of operation. Air bearings are used to support the platen to provide precision platen flatness accuracy at reasonable machine costs. Also, air bearings are used to support the workpiece holder spindle to provide precise friction free control of the abrading contact pressure over the different phases of the lapping operation. Abrading force control and mechanism weight counterbalance is provided by friction free air bearing pressure cylinders that are supplied by electronically controlled air pressure.

The upper portion of the lapper machine is an independent structure unit that allows the workpiece holder axis to be adjusted perpendicular to the plane of the abrasive. This upper machine portion also provides X-Y translation of the workpiece holder to traverse the workpiece surface across the full annular surface of the abrasive during a lapping operation. This traversing action provides even wear across the surface of the workpiece and also the abrasive. Multiple workpiece stations positioned around the circumference of the platen allow a number of workpiece to be processed at the same time. Force and position sensors, including precision capacitive sensors, are used to sense and control the lapper machine devices and determine the state of completion or surface finish characteristics or the workpieces as they are processed. Drive motors allow the speed of the workpiece rotation and the speed of the platen to be changed continuously during a lapping procedure.

Programmable controllers are used to automate the abrading operation of the lapper for each workpiece. Vacuum is supplied to the platens for installation and removal of the different raised island abrasive disks. Water is supplied for use as an abrading coolant. The platen is surrounded by a retaining wall that collects spent coolant water and the abrading debris is separated from the waste water for collection and disposal. The coolant water also continuously washes the abrasive disks which simplifies the repetitive reuse of disks.

B. Lapper Machine Platens

1. Precision-Flat Platen Surface

The platens must have surfaces that are and remain precisely flat at all operating speeds to allow the interchange of abrasive disks having different abrasive particle sizes. The peripheral abrading speed of these platens exceeds 10,000 surface feet per minute. To attain these abrading speeds, small diameter platens must rotate at very high speeds but large diameter platens can rotate slower. Vacuum port holes located at the outer annular periphery of the platens allow the flexible raised island abrasive disks to be quickly attached to the platen surfaces.

2. Types of Platen Spindle Assemblies a. Small Platen Commercial Spindles

Platen vacuum disk attachment interface plates can be mounted on the top flat surfaces of commercially available rotary spindles. These spindles are unitary closed-frame devices. Most roller bearing spindles have limited rotational speeds because of the heat generated by the pre-loaded bearings that support the spindle shaft. Small diameter platens must have high rotational speeds for high speed flat lapping. To reach 10,000 SFM speeds a 12 inch diameter platen must operate at 3,200 rpm. Air bearing spindles can operate at high rotational speeds but have significant load force limitations. They are particularly sensitive to over-hanging forces which significantly limits the size of the vacuum interface plates that are mounted on them. Nominally very small abrading contact forces are imposed on a platen during high speed lapping. However, occasional large platen load forces can be experienced in the event where a thin abrasive disk becomes torn and is wedged between the workpiece holder and the high-inertia moving platen.

b. Large Platen Air Bearing Spindles

Platen assemblies used for large diameter abrasive disks have a unique open-frame construction. The horizontal platen assembly is supported at the outer periphery by air bearing pads that control the platen planar surface motion only in a vertical direction perpendicular to the platen surface. A simple platen-center axial needle bearing can be used to control only the radial position of the platen. The needle bearing also allows free platen assembly axial motion in the direction perpendicular to the platen surface. In this way, the air bearing pads provide very precision vertical control of the platen planar surface as they are not constrained axially by the needle bearing. Precision control of the platen radial motion is not required for high speed flat lapping so inexpensive needle bearings are sufficient for the application.

The air bearing platen assembly is constructed of materials that are free from residual stresses to provide a low inertia rigid structure that is dimensionally stable over long periods of time. The platen assembly uses a three-point support to maximize the platen dimensional stability independent of the lapper machine base support frame. Three equal spaced air bearing pads are positioned around the periphery of the platen structure to support the platen assembly. These air bearing pads have large surface areas that contact a smooth annular rail that is attached to the bottom of the platen assembly. These large contact areas allow each air bearing pad to sustain large loading forces without the occurrence of any damage to the pads or to the platen assembly. In addition, the structural rigidity of the composite platen assembly distributes localized load forces to adjacent air pads in the event of an abrasive disk tearing and jamming-up as the platen rotates.

Single or multiple workpiece lapping stations are located directly above the platen assembly air bearing pads. If desired, extra air bearing support pads and work stations can also be positioned between the three primary three-point support pads.

C. Granite Machine Bases

1. Selection of Granite Base Material

Granite is dimensionally a very stable structural material and has sufficient mass to attenuate machine vibrations. It can be formed into many different shapes and can be fitted with fasteners that can be used to mount lapping machine members. Also, water passageways can be drilled to provide temperature control of portions of the granite base to minimize thermal distortion of the base. In addition, granite bases can be machined to provide precision flat surfaces that are very stable with time. Here, a granite base is typically has a three-point support during the surface machining operation.

2. Shape of Granite Bases

A variety of granite base shapes can be used to optimize the function of the lapper machine. These include rectangular, triangular and donut shapes.

3. Support of Granite Bases

When a granite base is used, the same three-point support that was used to machine the base is retained in the lapper machine to minimize base surface distortions due to the weight of the granite base.

4. Platen Assembly Support

The platen assembly also has a tree-point support to minimize distort of the platen assembly over time. Even if some distortion of the granite base occurs, the platen will still retain its precision-flat planar operation when it is supported at these three points. In addition, the primary support for the workpiece holder assembly is supported at the same three points as the platen assembly. This assures that any localized dimensional change in the base is simultaneously transmitted to both the platen support and the workpiece holder assembly. Here they both will move together and retain their relative alignment. This is important when using a rigid workpiece spindle assembly. However, in the more common case where the workpiece holder has a floating spherical motion, this mutual alignment is not so important.

D. Gauges Determine Workpiece Completion

As workpieces become more flat and smooth, the stiction forces between the workpieces and the abrasive become larger. These large stiction forces also act on the workpiece holder devices and on the workpiece holder spindle mechanisms. Here, the stiction forces tend to bend or deflect certain of the lapper machine component parts away from other adjacent parts. This increases the nominal gap between the adjacent parts. Because all of the machine components have known linear or non-linear spring constant characteristics, larger stiction forces result in predictable larger deflections and larger gaps. A measurement of the gap distance change can provide an accurate indication of the magnitude of the stiction forces. In turn, the magnitude of the stiction force is a predictable measure of the state of completion of the lapping procedure. This knowledge allows the lapping procedure to be terminated when the procedure is completed.

Capacitance gauges and eddy current gap distance sensing gauges can be used to dynamically determine the state of completion of a workpiece as it is being subjected to high speed lapping. Also, force or deflection sensing gages such as strain gages can be used to sense the magnitude of the stiction forces.

E. Rotary Platen Accuracy

In order to provide ultra flat raised island abrasive surfaces for high speed flat lapping the rotary platens that the abrasive disks are mounted on must also be precisely flat. These platens must be flat over the full circumference of the annular abrasive and they must remain flat at all operating speeds. In addition the platens must remain flat over the full time that the lapper machine is operated on a daily or monthly basis. Special care is exercised in the design of the lapper machine and with the use of operating process procedures to assure that this platen flatness accuracy is held to the required specifications, especially with large diameter platens. Typically the platen abrading surface flatness must be held to less than 0.0001 inches on platens that can have platen diameters that exceed 3 feet where the surface speed of the platen exceeds 100 mph. Traditional roller bearings that can provide these platen flatness accuracies are not operated at these high rotational speeds. However, air bearings can be used to support the abrasive disk platen with the required precision flatness at these high speeds. Here, the structural distortions of the platen assembly due to thermal contraction from the cooling effects of the expanding air bearing pressurized air can be avoided by using a special thermally isolated annular air bearing support rail.

A wide size range of abrasive disk diameters or abrasive disk annular radial widths can be used with a given sized platen. The outer diameter of the platen simply has to be larger than the largest diameter of the abrasive disks.

F. Very Large Sized Platens

Platens having 144 inch diameters, used for the very large raised island disks, can also be built using air bearings that support the outer periphery of the platen directly underneath the annular band of abrasive. The platen structure is fabricated from stress-free materials, such as cast aluminum plate, that are structural-adhesive bonded together to provide stable platens that remain flat over long periods of time. It is only necessary to lap the structure lower air bearing rail surface and the top outer annular surface of the platen where the annular band of abrasive is located. The bottom rail surface can be lapped by a number of different well established lapping processes. This same lower rail surface can be used to lap the top platen surface. Here, a simple air bearing pad mechanism supports a platen-surface lapping device, or grinder, while the mechanism is rotated tangentially around the flat-lapped air bearing rail. These very large platens and lapper machines can be manufactured by numerous special machine companies.

G. Progressive Use of Finer Abrasive Particles

Abrasive disks are typically used in sets of three abrasive particles sizes. The first disk has coarse sized particles to remove the large out-of-plane defects and establish the nominal flatness of a workpiece. The second disk has medium sized particles to further refine the flatness and develop a smoother surface. The third disk has very fine particles to polish the workpiece where the surface is both precisely flat and very smooth.

To provide an even more smoothly polished workpiece than do the spaced abrasive beads, a fourth disk can be used that has a continuous layer of very fine abrasive particles coated on the island tops. The abrasive is a mixture of abrasive particles and an adhesive that is flat-coated on the surface of the raised islands.

H. Abrasive Disk Flatness-Initialization Procedure

A new unused abrasive disk will always conform to the surface of a platen. A platen that has flatness variations will result in an abrasive surface that replicates these non-flat surface variations. However, the top abrading surface of the new abrasive disk will develop a precision planar surface after abrading contact with a workpiece as the platen rotates. Any thickness variations in the abrasive disk and any localized platen out-of-plane flatness variations will be removed during this lapping initialization process. Once an abrasive disk-flatness is initialized with a given platen, that disk can be removed and be reinstalled at a later time at the same tangential position on that platen to instantly provide a disk abrasive planar surface attribute. The flatness variation of a "initialized" disk abrasive surface is substantially less than the prescribed 0.0001 inch flatness variation tolerance that is established for the platen surface and for the 0.0001 inch thickness variation tolerance for the abrasive disk.

I. Vacuum Attachment of Disks to the Platens

Abrasive disks must be repetitively attached and removed from the lapping machine platens to complete the high speed flat lapping of workpieces. The abrasive disks are flexible and the disk backings have flat mounting surfaces that can provide a vacuum seal when the disks are mounted with vacuum to a flat platen surface.

The vacuum disk attachment system provides huge forces that bond the thin flexible raised island abrasive disks to the robust flat surfaced platens. These bonding forces are so large because all of the vacuum force of 10, or more, psig is applied to each square inch of surface area of an abrasive disk. At a modest 10 psig vacuum, a small sized 12 inch diameter abrasive disk having a surface area of 113 inches squared, results in a disk attachment bonding force of 1,130 lbs. With a perfect vacuum of 14.7 psig the disk hold-down bonding force is 1,661 lbs.

These large disk attachment forces assure that the abrasive disks are in full conformal contact with the precision-flat platen surface. Here, the top flat planar surface of the abrasive disk assumes the precision flatness of the platen. The abrasive surface is simply off-set fro the platen by the precision thickness of the disk. Use of vacuum to attach precision thickness raised island abrasive disks to the precision flat platens results in an planar abrasive surface that is precisely flat and therefore, capable of high speed flat lapping.

Each platen-mounted raised island abrasive disk is rigid in a direction perpendicular to the disk surface. As a result, the typical small contact abrading forces applied to the disk have little effect on distorting the thickness of the disk. The abrading contact forces acting in a direction perpendicular to the abrasive surface are intentionally small because of the extraordinary cut rates of the abrasive particles at the high speeds used in high speed flat lapping. Friction forces in a direction parallel to the abrasive surface, due to the contact abrading forces, are correspondingly small. Also, the raised islands prevent large stiction-type disk shearing forces (from the coolant water) to act parallel to the flat surface of the moving disks. These small disk surface liquid shearing forces and friction forces have little effect on the disk because the disk is bonded to the structurally stiff platen by the huge vacuum disk attachment forces.

Platen surfaces have patterns of vacuum port holes that extend under the abrasive annular portion of an abrasive disk to assure that the disk is firmly attached to the platen surface. Use of the vacuum disk attachment system assures that each disk is in full conformal contact with the platen flat surface. Also, each individual disk can be marked so that it can be remounted in the exact same tangential position on the platen by using the vacuum attachment system. Here, a disk that is "worn-in" to the flatness variation of a given platen will recapture that registered platen position and will not have to be "worn-in" again upon reinstallation.

When an abrasive disk is partially worn down, the top surface of the abrasive wears-in to assume a true planar flatness even when there are very small out-of-plane defects in the platen surface. After usage, this disk can be removed to be temporarily replaced by a disk having different sized abrasive particles. However, before the disk is removed from a platen, the disk and the platen are marked at a mutual tangential location. Then when the original disk is re-mounted on the same platen, the marking on the disk is tangentially aligned with the marking on the platen. This assures that the disk is positioned at the same original location on the platen to reestablish the true planar surface of the disk abrasive without having to re-wear in the abrasive disk.

Coolant water acts as a continuous flushing agent to keep each disk and the platen clean during an abrading procedure. This allows clean abrasive disks to be quickly removed from a platen by interrupting the platen vacuum for future use. Another disk can be quickly installed and attached to the platen by simply re-applying the vacuum to the platen.

J. Filter Collection of Abrading Debris

Coolant water is supplied on a continuous basis during a lapping operation. This water flushes out grinding debris from the workpiece surface where the water and debris is thrown off the platen by centrifugal force. This water is routed to a filter to conveniently collect the debris for disposal. The filtered water can be recycled.

K. Lapper Machine Process Operations

Because the high speed lapping operation removes workpiece material so rapidly, the lapping machine platen speed is typically started and ended at very low rotational speeds and at low abrading contact pressures. Here, the rate of material removal is directly proportional to both the contact pressure and the localized abrading surface speed. Faster speeds and higher pressures increase the material removal rates. The removal rate is diminished as the pressure decreases and as the abrading speed decreases. Typical abrading speeds are in excess of 10,000 surface feet per minute (about 3,000 rpm for a 12 inch diameter disk).

Typical abrading contact pressures are less than 1 lb per square inch. Reducing the abrading pressures and surface speeds at the beginning of an abrading process allows the workpiece to be initially flattened where the highest portions of a workpiece are removed. Then higher speeds and pressures are applied to maximize the material removal across the full flat surface of a workpiece. Finally, the speeds and pressures are reduced at the end of the operation to assure that the workpiece surface finish is abraded uniformly. During the lapping procedure, the workpiece is rotated while the workpiece is in contact with the moving abrasive. The rotational speed of the workpiece can also be adjusted during the abrading procedure to optimize the uniformity of the workpiece flatness and surface finish.

L. Flatness Accuracy of Abrading System Components

To provide precision-flat and smoothly-polished workpieces surfaces at high abrading speeds when using the fixed-spindle floating-platen abrading system, all of the system components that are actively used in the abrading process must have precision-flat surfaces and these components must also be precisely aligned relative to each other. These precision-flat surfaces and precision alignments must be maintained at all abrading speeds and all process speeds and under all processing conditions. It is not sufficient that the components only have the required precision flatness characteristics and alignments in a static at-rest state; they must retain them when they are subjected to dynamic conditions including events such as the occurrence of abrading forces. This performance criterion requires that the system have components that are robust and that are not substantially affected by the continual presence of water-wetted abrasive particles in the system abrading environment. In addition, the abrasive disks used in the lapping or abrading process must have an abrasive disk thickness that is uniform over the full abrading surface of the disk.

Using stationary-position air bearing spindles having rotating flat top surfaces in the fixed-spindle floating-platen abrading system offers a number of significant advantages. These spindles have large 12 inch diameters that can easily hold large workpieces such as 300 mm semiconductor wafers; they have extraordinary-flat spindle-top flat surfaces that provide the desired flat lapping accuracy; they are extremely stiff which enables them to resist spindle-top deflections due to abrading forces; they can be operated at very high speeds for high speed lapping while retaining excellent dynamic flatness; they have extremely low rotational friction which allows accurate measurement of the abrading torque that is applied to individual spindles to ascertain the abrading state of completion of workpieces; and they are inherently self-cleaning due to the internal pressurized air which allows them to be operated without contamination in the water-mist abrasive-particle abrading environment present in high speed flat lapping. The flatness accuracy provided by the precision stationary-position air bearing rotary spindle flat top surfaces to support flat-surfaced workpieces is decidedly superior to the flatness of the moving workpiece supporting surfaces that is provided by conventional abrading systems, including slurry lapping and micro-grinding (flat-honing).

It is critical that all three of the individual spindle-top flat-surfaces to be precisely flat to provide supporting surfaces that the flat-surfaced workpieces can conform to without localized distortion of these workpieces that are often quite thin and even flexible. It is also important that all three of the air-bearing spindles are near-equal separated from each other to provide stable three-point support of the rotating floating platen. In addition, it is critical that all three of the spindle-tops planar flat surfaces are precisely aligned in a common plane to allow the precision-flat platen abrading surface to be in conformal flat-contact with all three of the spindles tops, or with the workpieces that are attached to the spindle-tops.

In addition, great care must be exercised to prevent thermal effects from distorting portions of the abrading system relative to other portions where these distortions cause misalignment of the critical abrading system components. One common source of this type of thermal distortion is friction heat that is generated by the abrading process. Another common source is heat that is generated by electrical components such as electric motors that drive the spindles or the platen. The effects of these heating (or cooling) effects tend to influence the system structural stability over a period of time. It is necessary that the abrading system perform as-desired when first started up and remain so over long periods of production operations.

Often these thermal-effects are concentrated at localized areas and they set up temperature gradients across structural elements of the system. Due to the coefficient of thermal expansion, portions of the uneven-temperature structural components or other abrading machine components grow or shrink in size relative to other portions of the components. Structural stresses are often generated by these temperature gradients that magnify the localized distortions of critical components of the abrading system. These distortions can result in the loss of the planar flatness of individual system machine components or result in distortions of the mutual planar alignment of component elements such as the spindle-top flat surfaces. Localized cooling effects from sources such as air bearings can also generate unwanted misalignments of critical abrading system components. These abrading system heat sources and cooling effects have been individually recognized and accounted for in the elementary design of the fixed-spindle floating-platen abrading system. The overall extreme simplicity of the fixed-spindle floating-platen abrading system minimizes thermal-effect distortions of the system which allows precision lapping to be successfully performed throughout typical production operation sequences.

The platen abrasive disks typically have annular bands of fixed-abrasive coated rigid raised-island structures. There is insignificant elastic distortion of the individual raised islands or of the whole thickness of the raised island abrasive disks when they are subjected to typical abrading pressures. These abrasive disks must also be precisely uniform in thickness across the full annular abrading surface of the disk to assure that full-surface abrading takes place over the full flat surface of the workpieces located on the tops of each of the three spindles.

To be successfully used for high speed lapping, the overall thickness of the abrasive disks, measured from the top surface of the exposed abrasive to the bottom mounting surface of the disk backing must be uniform across the full disk-abrasive surface with a standard deviation in thickness of less than 0.0001 inches. The top flat surfaces of the islands are coated with a very thin coating of abrasive. The abrasive coating typically consists of a monolayer of 0.002 inch diameter beads that contain very small 3 micron (0.0001 inch) or sub-micron diamond abrasive particles. The 3 micron particles have a size of 100 millionths of an inch which is also approximately equal to 10 helium lightbands of flatness. Raised island abrasive disks are attached with vacuum to ultra-flat platens that rotate at very high abrading surface speeds, often in excess of 10,000 SFM (100 mph).

Most conventional platen abrasive surfaces have original-condition flatness tolerances of approximately 0.0001 inches (100 millionths) that typically wear down into a non-flat condition during abrading operations to approximately 0.0006 inches before they are reconditioned to re-establish the original flatness variation of 0.0001 inches. By comparison, the typical flatness of a precision air bearing spindle is less than 5 millionths of an inch. The rotary air bearing spindle-tops experience extremely low deflections due to abrading forces because of their very high stiffness.

There are two distinctly different components of the planar flatness of the abrading surface of a rotating platen. One component is the circumferential flatness of the platen. The other component is the radial flatness of the platen. In addition, it is important to establish the planar flatness of the abrading-surface of the platen to which is attached the precision-thickness abrasive disks. Because the abrasive disks are attached to the platen abrading-surface, these disks protect the platen abrading surface from abrasive wear. However, the abrasive that is attached to the abrasive disks do experience continuous wear during abrading actions. This abrasive wear of the abrasive surface generates a non-flat abrasive surface that will prevent the creation of precision-flat lapped workpieces. When the platen abrasive planar surface becomes excessively worn, it must be re-conditioned to again provide the capability for precision-flat lapping.

Radial platen abrasive surface wear-down is due to the abrading speed differential that exists across the radius of a rotating platen. Here the wear rate, of both the workpieces and the platen annular abrasive, is directly proportional to the localized abrading speed. Because the outer radius of a rotating platen annular abrasive travels faster than the inner radius, the wear-down rates are substantially higher at the platen outer radius than at the platen inner radius. This radial wear-down is an on-going process and its effects must be corrected periodically. Radial wear of the abrading surfaces occurs for all rotary-platen systems including slurry lapping and micro-grinding (flat-honing).

When there is extra-wear of a platen abrading-surface or the platen abrasive surface, the radial-worn surface assumes a shallow-angle cone-shape. The amount radial wear must be accurately measured to determine the localized deviation of the surface from straight-edge surface to ascertain the necessity of corrective measures and also, to determine the success of these corrective measures. These out-of-plane radial-surface measurements are not made relative to the full planar platen abrasive surface but rather to individual radial straight-line segments of the platen planar abrasive surface. Measurements taken at one straight-line location is typically duplicated at other circumferential locations because the platen abrasive wear-down has a common cause of speed differential across the radial width of the platen abrasive. Cone-shapes, reverse-cone-shapes, valleys and raised portions all tend to extend uniformly around the circumference of the platen abrading surface. Also, the abrasive surface reconditioning methods are devoted primarily to correcting the radial deviation of the platen abrasive and only secondarily, to correcting the circumferential surface variations of the platen abrasive surface. To reestablish the radial flatness of a platen annular abrading surface, conditioning ring type abrasive surfaces are placed in pressure-contact with the platen abrasive and both the conditioning ring and the platen are rotated. The speeds, abrading pressures and directions of rotation are all selected to correct the defined deficiencies of the platen abrasive surface. This conditioning-ring corrective action is very effect in reducing the radial out-of-plane deficiencies of the platen abrasive.

The process of measuring these radial platen abrading surface variations is described here. A straight-edge device, or its electronic equivalent, is placed across the full diameter of the platen annular abrading surface where the straight-edge device also intersects the platen center of rotation. The straight-edge line contacts the platen abrading annular surface at two contact-points that are positioned opposed from each other across the platen rotational center. There is a straight-edge line located at the surface of the straight-edge device that contacts the platen abrading annular surface where the straight edge line is centered on the longitudal surface of the straight-edge device. Measurement points are then selected where they are located in a measuring-line segment that conforms to the platen abrading surface wherein the measuring-line intersects the platen center of rotation. The measuring-line extends radially along the annular bandwidth from the abrading surface annular band inner radius to the abrading surface annular band outer radius. One straight-edge line platen contact-point is located on the portion of the annular platen abrading surface that is diagonal across the platen rotational center from the measuring-line segment. The other straight-edge line platen contact-point is located on the portion of the annular platen abrading surface that is on the measuring-line segment. The distances of the individual measuring-points from the straight-edge line are then determined and the standard deviation of the individual measuring-points from the straight-edge line is determined. It is preferred that the standard deviation is less than 0.001 inches and more preferred that the standard deviation is less than 0.0002 inches and even more preferred that the standard deviation is less than 0.0001 inches. The platens must also have flat planar surfaces where points on the abrading surface of a platen have a standard deviation of less than 0.002 inches from the plane of the abrading surface and it is preferred that the standard deviation is less than 0.001 inches and more preferred that the standard deviation is less than 0.0002 inches and even more preferred that the standard deviation is less than 0.0001 inches.

M. Co-Planar Alignment of Spindle-Top Flat Surfaces

To provide precision-flat and smoothly-polished workpieces surfaces at high abrading speeds it is necessary that each of the individual rotary workpiece spindles used in the fixed-spindle floating platen abrading system have flat-surfaced spindle-tops that are precisely flat and also that the spindle-tops rotate about a spindle axis that is precisely perpendicular to the respective spindle-top flat surface. Select air bearing spindles typically have spindle-tops that are flat within 5 millionths of and inch when measured as the spindle top rotates which is an indication that the spindle-top axis of rotation is precisely perpendicular to the spindle-top flat surface. It is desired that the spindle-top flat surface has a standard deviation from the plane of the spindle-top flat surface of less than 0.0001 inches (100 millionths of an inch). Here the flatness accuracy capabilities of the select air bearing spindles far exceed the accuracy requirements required for successful high speed flat lapping.

Not only do the spindle-tops need to be precisely flat, these fixed-position spindles must be aligned where their flat surfaces are precisely co-planar with each other. To form a three-point support of the flat-surfaced floating-abrasive platen, the three primary spindles are placed in circle on the flat horizontal flat surface of a rigid and dimensionally stable machine base. The rotational axes of all of the spindles intersect this circle which is equal in diameter and concentric with the circumferential center-line of the platen abrading surface. By spacing the three spindles an equal distance from each other on this circle, the resultant positioning forms a three-point support of the rotational platen where the platen is stable as it rests on these three spindles. More spindles can be added to the primary three spindles to provide more workstations on an abrading machine. However, all of the spindles, including the three primary spindles, must have spindle-top flat surfaces that are all precisely co-planar with each other.

The plane formed by these co-planar spindles does not have to be precisely parallel with the machine base horizontal flat surface that the spindles are attached to. Here, the planar floating platen abrading surface is three-point supported by these spindles and the rotating platen can successfully perform the abrading action on flat-surfaced workpieces that are attached to the spindles even if the platen planar abrading surface is at a slight angle to the machine base flat surface. The mutual co-planar alignment of the individual spindle-top flat surfaces is not dependent on the flatness accuracy of the machine base. Also, the spindles do not need to have precision equal heights to successfully align the spindle-tops to be precisely co-planar. Instead, each individual spindle is supported by three equally-spaced legs that are positioned around the perimeter of the spindle where the legs form a three-point support of the spindle. More than three support legs can be attached to the spindles but the extra legs tend to make spindle alignment adjustments more difficult than with a spindle that has three equally-spaced support legs.

There are various process procedures that can be used to align all of the spindles-tops in a common plane. In one procedure, a "point-and-shoot" laser device is used to co-planar align all three spindle-tops to a reference plane that passes through spindle-top surface points located at the spindle axis of rotation where these points lie on the surface of all three spindle-tops. This type of laser has a single narrow laser beam and it is mounted on one of the spindle top surfaces and a laser beam readout target is placed on another of the three spindle-top surfaces. The combination laser-readout devices are calibrated prior to use on the spindle-tops with a precision flat surface plate to establish the location of the specific sensor pixels on the digital target sensor array that are at the same elevation as the laser beam. Also, the laser device is aligned with the spindle top it is mounted on where the laser beam is precisely parallel with the spindle-top flat surface.

The spindle that the laser is mounted upon can be adjusted until the laser beam intersects the receptor readout device selected pixels when the laser receptor is positioned at the center of rotation of the target spindle. To direct the laser beam to the target sensor the laser can be rotated on the spindle-top to direct the laser beam at the target sensor or the spindle-top can be rotated to accomplish this. Then the laser spindle is tilt-adjusted to where the height-selected array sensors are activated by the laser beam. When this alignment is completed, the planar surface of the laser spindle-top is tilt-angle aligned with a point on the surface of the target spindle where this point is located at the rotational center of the target spindle. The laser is then rotated on the spindle-top until it is directed at the target sensor that has been moved to the center of the third spindle spindle-top. The third spindle is then height adjusted and tilt-angle adjusted where the laser beam activates the height-selected array sensors on the laser target Then the "point-and-shoot" laser and targets can be re-directed where the laser targets are sequentially moved across the width and depth of the target spindle-top to align the target spindle to be co-planar with the laser spindle-top surface. This procedure is repeated by moving the laser device sequentially to all three spindle-tops to mutually align all three spindle-tops in a common plane. These laser-target array devices are very accurate and the roll, pitch and yaw (X,Y,Z axes) adjustments can be made with these or other types of alignments procedure steps. In another procedure, the laser device can be positioned at a site remote from the three spindles and the three spindle-tops can be co-planar aligned relative to this remote site.

A more desirable procedure is to use a laser device that has a rotating laser-beam head that provide a precision plane of laser light that is directed at target array sensors positioned on all three spindle-tops. A single target sensor can be moved from spindle to spindle or multiple sensors can be used where each spindle has its own sensor. First the alignment procedure establishes a common reference plane that passes through center-points on all three spindle-top flat surfaces. Then the target sensors are sequentially moved across the width and depth positions on the target spindle-tops to complete the co-planar alignment of all three spindles. This alignment procedure is done in steps where a coarse co-planar alignment is completed, then a fine adjustment is completed and then an ultra-fine adjustment is completed. This type of rotating-beam laser provides very precision co-planar alignment with the aid of software laser measurement data programs. Here, the laser device can be mounted on a select spindle head or the laser device can be positioned at a remote site that is close to all the spindles. An excellent remote site for the rotary laser device is at the center of the machine base, nested between all three (or more) spindles. The co-planar alignment accuracy is a function of the sensor target distance from the rotating laser head.

A L-740 Ultra Precision Leveling Laser System can be provided by Hamar Laser of Danbury, Conn. which has a flatness alignment capability of 30 millionths of an inch per foot of distance between the rotating laser head and the laser target. This accuracy is approximately three times better than the 0.0001 inch (100 millionths of an inch) co-planar spindle-top flat rotating surface alignment required for sucessful high speed flat lapping for a medium-sized abrading system. The alignment process is quick and also can be performed periodically to confirm the coplanar alignment of the spindles. This laser system can also be used to verify the flatness of the platen precision-flat abrading surface and can be used to verify the flatness of the abrasive surface of the abrasive disk attached to the platen.

This fixed-spindle floating-platen abrading system must be precisely aligned to provide successful high speed flat lapping of flat surfaced workpieces. Once the precision co-planar alignment of the spindles is made, it is critical that this precision alignment is maintained over long periods of time. To accomplish this, the rigid machine bases that support the spindles must be rigid and dimensionally stable over these long periods of time and during extended abrading process procedures. The bases must be resistant to material creep-type dimensional changes due to internal stress in the machine base material and they must not deflect or reactively move when they are subjected to steady-state or dynamic abrading forces. Also, the dimensional stability of the machine base must not be affected by heat generated by the machine components such as motors or heat generated by abrading friction or affected by cooling effects from air bearing devices. The preferred machine base is granite or epoxy-granite. The machine bases must be large enough and heavy enough to provide this dimensional stability for the spindles that are mounted on them. Air bearing spindles that have the desired 12 inch diameter spindle-top sizes and the required flatness accuracy are typically quite heavy. They weigh between 100 and 150 lbs each. It is also desirable to provide constant temperature control of the granite bases with the use of heat transfer fluid coolant passageways within the body of the machine base body.

The floating platens must also be rigid and dimensionally stable to provide abrading surfaces that remain precisely flat over long periods of time. It is important that they be light in weight and structurally stiff enough that they do not deform when subjected to substantial abrading forces. Controlled abrading forces that are imposed on the workpieces are applied by the spherical-action platen support device that is located at the center of rotation of the platen. Because very low abrading forces are typically applied to the workpieces during high speed abrading, it is necessary to very accurately control these applied abrading forces. The imposed abrading forces are the net difference between the weight of the platen structure and the force and the applied force of the platen support device. If a platen structure is very heavy, it is difficult to precisely control the accuracy of the imposed abrading forces on the workpieces. However, the platens and platen structures can be constructed from stress-free aluminum materials that are adhesively bonded together to provide a lightweight, stiff and dimensionally stable platen apparatus. The abrading surfaces of the aluminum platen can be hard-coat anodized to provide an extremely hard wear surface. Often, zero-friction air bearing platen support devices are used to improve accurate control of the imposed abrading forces. Strain gauges are also used to determine the net workpiece abrading force by subtracting the weight of the platen structure from the platen support device applied force.

There are many abrading machines that have groups of workpiece rotating spindle heads that are mounted on a support frame that is lowered to allow abrading contact of multiple workpieces with a horizontal abrasive covered rotating platen. These upper-type workpiece spindles are all lowered together as a group to contact the abrasive surface. However, each of the spindles float-free from the other spindles to allow individual abrading-force control of each spindle where the spindles move along their spindle rotating axes.

Converting these free-floating upper spindles into a system where heavy 100 lb spindles are rigidly mounted to a common frame that could be free-floating to allow uniform contact of all of the workpieces with the rigid abrasive platen would not be practical. The supporting frame would be extremely heavy in order to provide a rigid and dimensionally stable base for the rigid spindles. Controlling the abrading forces on the workpieces would be very difficult with this heavy spindle-support frame. Providing a frame that would remain dimensionally stable and accurate over long periods of time would result in a complex frame that would be difficult to construct and would be expensive. Material creep dimensional changes and thermal-stress dimension issues would require sophisticated engineering considerations for the floating upper spindle frame system as compared to this simple-construction system that uses a granite base that supports three heavy air bearing workpiece spindles that have the required flatness accuracy for successful flat lapping of workpieces. Furthermore, there would be operator safety issues where this heavy but free-floating frame is suspended above the horizontal abrasive covered platen. Loading and removal of individual workpieces would also be difficult as these individual workpieces would have to be presented to the upper spindle flat surfaces without line-of-sight visual access to the workpieces. Precision co-planar alignment of the spindle-tops to within the 0.0001 inches that is required for successful precision flat lapping or precision abrading of workpieces would be extremely difficult when all of the spindles are mounted to a floating spindle-frame support apparatus.

Fixed-Spindle Floating-Platen System

A three-point fixed-spindle floating-platen abrading machine assembly apparatus is described that has the flowing features may have:

a) three equal height rotary spindles having circular rotatable flat-surfaced spindle-tops that each have a spindle-top axis of rotation at a center of the rotatable flat-surfaced spindle top;

b) an abrading machine base having a horizontal, flat top surface and a machine base spindle-circle where the spindle-circle is coincident with the machine base top surface;

c) wherein the three rotary spindles are located with near-equal spaces between each of them and the spindle-tops' axes of rotation intersect the machine base spindle-circle and the spindles are attached to the machine base top surface at those spindle-circle locations by mechanical fasteners at the respective at least three spindle-support mounting legs that are near-equal spaced around the outer periphery of the spindles to form at least three-point supports of the spindles;

d) wherein the three spindle-top flat surfaces are co-planar with each other;

e) wherein the spindle-tops' axes of rotation are perpendicular to the spindle-tops' flat surfaces;

f) a floating, rotatable abrading platen having a flat annular abrading surface with an abrasive band radial width and where the platen is supported by and rotationally driven about a platen rotation axis located at a rotational center of the platen by a spherical-action rotation device located at the rotational center of the platen and the spherical-action rotation device restrains the platen in a radial direction relative to the platen axis of rotation and the platen axis of rotation is concentric with the machine base spindle-circle;

g) wherein the spherical-action rotation device allows spherical motion of the floating platen about the platen rotation axis where the platen abrading surface is nominally horizontal;

h) and wherein the platen can be moved vertically along the platen rotation axis by the spherical-action platen rotation device to allow the platen abrading surface to contact the spindle-top flat surfaces of the three spindles wherein the three spaced spindles provide three-point support of the platen;

i) and wherein the total force from the platen abrading contact that is applied to the three spindle-top flat surfaces by contact of the spindle-tops with the platen is controlled through the spherical-action platen rotation device to allow the total platen abrading contact force to be evenly distributed to the three individual spindle-tops;

j) flexible abrasive disk articles having annular bands of abrasive coated surfaces wherein the radial width of the platen annular abrading surface is at least equal to the radial width of the abrasive disk annular abrading band of abrasives where each flexible abrasive disk is attached in flat conformal contact with the platen abrading surface by disk attachment techniques such that the attached abrasive disks are concentric with the platen abrading surface;

k) wherein equal-thickness workpieces having parallel or near-parallel opposed flat surfaces are attached in flat-surfaced contact with the flat surfaces of the spindle-tops and the platen is vertically moveable to allow the abrasive surface of the abrasive disk that is attached to the platen abrading surface to contact the top surfaces of the workpieces such that the total platen abrading contact force is evenly distributed to the workpieces attached to each of the three equally-spaced spindle-tops;

l) wherein the three spindle-tops having the attached workpieces can be rotated about the spindle axes and the platen can be rotated about the platen rotation axis to single-side abrade the workpieces wherein the abrasive surface of the flexible abrasive disk that is attached to the moving platen abrading surface is in force-controlled abrading pressure with the workpieces.

Also, the three-point fixed-spindle floating-platen abrading machine assembly apparatus may have spindle-tops that have flat-surfaced spindle-top devices comprising workpieces, workpiece carriers, abrasive-type conditioning rings and abrasive-type abrasive disks and where the spindle-top devices on the three spindle tops are attached to the three spindle tops by attachment technologies selected from the group consisting of vacuum attachment, mechanical attachment and adhesive attachment techniques and wherein the attached spindle-top devices or groups of workpieces are concentric with the spindle-tops. In addition, the machine base can be granite and the spindles can be air bearing spindles.

Further, the workpiece spindles can have adjustable-height at least three-point support legs where the at least three support legs are attached to a supporting surface of each spindle and the spindle support legs are positioned around the periphery of the spindle body with near-equal space distances between the support legs to form an at least three-point support of the workpiece spindle and where each spindle-top flat surface can be aligned to be co-planar with the two other spindle-top flat surfaces by adjusting the elevation-height of the at least three support legs and where mechanical fasteners attach each of the at least three-point spindle legs to the machine base top surface thereby attaching the workpiece spindle to the machine base.

In addition, the platen flexible abrasive disk articles can be selected from the group consisting of: flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, chemical-mechanical planarization resilient disk pads that are suitable for use with liquid abrasive slurries, flat-surfaced metal or polymer disks that are suitable for use with liquid abrasive slurries, chemical-mechanical planarization resilient disk pads having nap covers, shallow-island chemical-mechanical planarization abrasive disks, shallow-island abrasive disks with resilient backing layers having a vacuum-seal polymer backing layer, and flat-surfaced slurry abrasive plate disks.

Auxiliary workpiece spindles in excess of the three workpiece spindles which are primary workpiece spindles can be attached to the machine base precision-flat surface where the more than three auxiliary workpiece spindles are each positioned between sets of two adjacent primary three-point near-equally spaced workpiece spindles, the auxiliary spindle-top having centers of rotation that are positioned on the machine base spindle-circle and the top surfaces of the spindle-tops of the auxiliary spindles are co-planar with the top surfaces of the spindle-tops of the primary spindles A three-point fixed-spindle floating-platen abrading machine assembly apparatus can be configured to abrade the flat-surfaced spindle-tops with a structure comprising:

a) the three spindle-top flat surfaces are co-planar with each other;

b) flexible abrasive disk articles having annular bands of abrasive coated surfaces having the radial width of the platen annular abrading surface at least equal to the radial width of the abrasive disk annular abrading band of abrasives and a selected flexible abrasive disk is attached in flat conformal contact with the platen abrading surface by disk attachment techniques comprising vacuum disk attachment techniques, mechanical disk attachment techniques and adhesive disk attachment techniques where the attached abrasive disk is concentric with the platen abrading surface;

c) and wherein the platen can be moved vertically along the platen rotation axis by the spherical-action platen rotation device to allow the abrasive surface of the abrasive disk that is attached to the platen abrading surface to contact the top surfaces of the spindle-tops where the total platen abrading contact force is evenly distributed to the three equally-spaced spindle-tops;

d) providing that the three spindle-tops rotated about their respective spindle axes and the platen is rotated about the platen rotation axis to abrade the spindle-tops while the moving platen abrading surface is in force-controlled abrading pressure with the spindle-tops where the abrading pressure is equal for all three spindle-tops Also, the three-point fixed-spindle floating-platen abrading machine assembly apparatus may have a process of abrading flat-surfaced workpieces using a three-point fixed-spindle floating-platen abrading machine assembly apparatus comprising:

a) providing three primary rotary spindles having circular-shaped rotatable flat-surfaced spindle-tops that have a spindle-top axis of rotation at the center of the rotatable flat-surfaced spindle top;

b) providing an abrading machine base having a horizontal flat top surface and a spindle-circle where the spindle-circle is located at the approximate center of the machine base flat top surface and the spindle-circle is coincident with the machine base top surface;

c) wherein the three rotary spindles are located with near-equal spaces between each of them and the spindle-tops axes of rotation intersect the machine base spindle-circle and the spindles are attached to the machine base top surface at those spindle-circle locations by mechanical fasteners at the respective at least three spindle-support mounting legs that are near-equal spaced around the outer periphery of the spindles to form at least three-point supports of the spindles;

d) wherein the three spindle-top flat surfaces are precisely co-planar with each other;

e) wherein the spindle-tops' axes of rotation are perpendicular to the spindle-tops' flat surfaces;

f) providing a floating rotatable abrading platen having a precision-flat annular abrading surface having an abrasive band radial width and where the platen is supported by and rotationally driven about a platen rotation axis located at the rotational center of the platen by a spherical-action rotation device located at the rotational center of the platen and the spherical-action rotation device restrains the platen in a radial direction relative to the platen axis of rotation and the platen axis of rotation is concentric with the machine base spindle-circle;

g) wherein the spherical-action rotation device allows spherical motion of the floating platen about the platen rotation axis where the platen abrading surface is nominally horizontal;

h) providing that the total platen abrading contact force that is applied to the three spindle-top flat surfaces by contact of the spindle-tops with the platen is controlled through the spherical-action platen rotation device to allow the total platen abrading contact force to be evenly distributed to the three individual spindle-tops;

i) wherein flexible abrasive disk articles having annular bands of abrasive coated surfaces where the radial width of the platen annular abrading surface is at least equal to the radial width of the abrasive disk annular abrading band of abrasives where a selected flexible abrasive disk is attached in flat conformal contact with the platen abrading surface by disk attachment techniques comprising vacuum disk attachment techniques, mechanical disk attachment techniques and adhesive disk attachment techniques where the attached abrasive disk is concentric with the platen abrading surface;

j) wherein equal-thickness workpieces having parallel or near-parallel opposed flat surfaces are attached in flat-surfaced contact with the flat surfaces of the spindle-tops and the platen is moved vertically to allow the abrasive surface of the abrasive disk that is attached to the platen abrading surface to contact the top surfaces of the workpieces where the total platen abrading contact force is evenly distributed to the workpieces attached to each of the three equally-spaced spindle-tops;

k) the three spindle-tops having the attached workpieces are rotated about the spindle axes and the platen is rotated about the platen rotation axis to single-side abrade the workpieces wherein the abrasive surface of the flexible abrasive disk that is attached to the moving platen abrading surface is in force-controlled abrading pressure with the workpieces wherein the abrading force is evenly distributed to the workpieces attached to each of the three equally-spaced spindle-tops.

The abrading machine apparatus also has the capability where the elevation-heights of the at least three spindle-housing support mounting legs are individually adjusted where the at least three spindles' respective spindle-top planar flat surfaces are aligned in a spindle-top-common-plane wherein the variations in the distance of points on the surface of a respective spindle-top flat surface from the spindle-top-common-plane have a standard deviation that is less than 0.002 inches.

In addition, the abrading apparatus can have a process of abrading an abrading surface of a floating platen on a three-point fixed-spindle floating-platen abrading machine to recondition or reestablish the planar flatness of the platen abrading surface comprising:

a) providing three primary rotary spindles that each have a rotatable flat-surfaced spindle-top that have a spindle-top axis of rotation at the center of the rotatable flat-surfaced spindle top;

b) providing an abrading machine base having a horizontal flat top surface and a spindle-circle where the spindle-circle is coincident with the machine base top surface;

c) providing that the three rotary spindles are located with near-equal spaces between each of them and the spindle-tops' axes of rotation intersect the machine base spindle-circle and the spindles are attached to the machine base top surface at those spindle-circle locations by mechanical fasteners at the respective at least three spindle-support mounting legs that are near-equal spaced around the outer periphery of the spindles to form at least three-point supports of the spindles;

d) wherein the three spindle-top flat surfaces are co-planar with each other;

e) wherein the spindle-tops' axes of rotation are perpendicular to the spindle-tops' flat surfaces;

f) providing a floating rotatable abrading platen having a flat annular abrading surface with an abrasive band radial width and where the platen is supported by and rotationally driven about a platen rotation axis located at the rotational center of the platen by a spherical-action rotation device located at the rotational center of the platen and the spherical-action rotation device restrains the platen in a radial direction relative to the platen axis of rotation and the platen axis of rotation is concentric with the machine base spindle-circle;

g) providing flexible abrasive flexible abrasive disk articles having annular bands of abrasive coated surfaces where the radial width of the platen annular abrading surface is at least equal to the radial width of the abrasive disk annular abrading band of abrasives where a selected flexible abrasive disk can be attached in flat conformal contact with the platen abrading surface by disk attachment techniques comprising vacuum disk attachment techniques, mechanical disk attachment techniques and adhesive disk attachment techniques where the attached abrasive disks are concentric with the platen abrading surface;

h) wherein the spherical-action rotation device allows spherical motion of the floating platen about the platen rotation axis where the platen abrading surface is nominally horizontal;

i) attaching abrasive-type spindle-top devices concentric to the spindle-tops;

j) moving the platen vertically along the platen rotation axis by the spherical-action platen rotation device to allow the platen abrading surface to contact the spindle-top flat surfaces of the three spindles wherein the three spaced spindles provide three-point support of the platen where the total platen abrading contact force is evenly distributed to the abrasive-type spindle-top devices attached to the three equally-spaced spindle-tops;

k) controlling through the spherical-action platen rotation device the total platen abrading contact force that is applied to the three spindle-top flat surfaces by contact of the abrasive-type spindle-top devices with the platen abrading surface;

l) rotating the three spindle-tops having the attached abrasive-type spindle-top devices about the spindle axes and rotating the platen about the platen rotation axis to abrade the abrading-surface of the platen with the abrasive-type spindle-top devices while the moving platen abrading surface is in force-controlled abrading pressure with the spindle-top abrasive-type spindle-top devices abrading surfaces.

Also, the platen abrading surface process includes where the abrading surface of the floating platen is abraded to recondition or reestablish planar flatness of the platen abrading surface using conditioning rings where circular-shaped conditioning rings having an abrasive coated annular band that has a band diameter that is larger than the radial width of the annular abrading-surface of the platen wherein the conditioning rings are attached to the three spindle-tops where the conditioning ring annular abrasive surfaces have equal heights above each spindle-top wherein the three spindle-tops having the attached conditioning rings are rotated about the spindle axes and rotating the platen about the platen rotation axis while the rotating platen moving abrading surface is in force-controlled abrading pressure with the spindle-top conditioning ring abrading surfaces.

In addition, the platen abrading surface process includes where the abrading surface of an abrasive disk that is attached to the abrading surface of the floating platen of a fixed-spindle floating platen abrading machine is abraded to recondition or reestablish the planar flatness of the abrading surface of the abrasive disk comprising:

a) attaching the flexible abrasive disk articles having annular bands of abrasive coated surfaces in flat conformal contact with the platen abrading surface by at least one step selected from the group consisting of vacuum disk attachment, mechanical disk attachment, and adhesive disk attachment where the attached abrasive disk article is attached concentric with the platen abrading surface;

b) moving the platen vertically along the platen rotation axis by the spherical-action platen rotation device to allow the abrading surface of the abrasive disk that is attached to the abrading surface of the platen to contact the abrasive surface of the abrasive-type spindle-top devices that are attached to the spindle-top flat surfaces of the three spindles wherein the three spaced spindles provide three-point support of the platen where the total platen abrading contact force is evenly distributed to the abrasive-type spindle-top devices attached to the three equally-spaced spindle-tops;

c) providing that the total platen abrading contact force that is applied to the abrading surface of the abrasive disk article that is attached to the flat abrading surface of the platen at the three spindle-top flat surfaces by contact of the abrasive-type spindle-top devices with the abrading surface of the abrasive disk article that is attached to the flat platen abrading surface is controlled through the spherical-action platen rotation device;

d) rotating the three spindle-tops having the attached abrasive-type spindle-top devices about the spindle axes and rotating the platen about the platen rotation axis to abrade the abrading surface of the abrasive disk that is attached to the abrading-surface of the platen with the spindle-top abrasive-type spindle-top devices while the moving abrading surface of the abrasive disk that is attached to the platen abrading surface is in force-controlled abrading pressure with the abrasive-type spindle-top devices abrading surfaces.

Furthermore, the platen abrading surface process includes where the abrading surface of an abrasive disk that is attached to the abrading surface of the floating platen is abraded to recondition or reestablish the planar flatness of the abrading surface of the abrasive disk using conditioning rings where circular-shaped conditioning rings having an abrasive coated annular band that has a band diameter that is larger than the radial width of the annular abrading-surface of the platen-attached abrasive disk wherein the conditioning rings are attached to the three spindle-tops where the conditioning ring annular abrasive surfaces have equal heights above each spindle-top wherein the three spindle-tops having the attached conditioning rings are rotated about the spindle axes and the platen is rotated about the platen rotation axis to abrade the abrading surface of the abrasive disk that is attached to the abrading-surface of the platen while the moving platen abrading surface of the platen-attached abrasive disk is in force-controlled abrading pressure with the spindle-top conditioning ring abrading surfaces.

An automated robotic workpiece loading apparatus can be attached to the abrading machine apparatus that can selectively install and remove workpieces for a three-point fixed-spindle floating-platen abrading machine apparatus comprising:

a) three rotary spindles having circular-shaped rotatable flat-surfaced spindle-tops that have a spindle-top axis of rotation at the center of the circular-shaped rotatable flat-surfaced spindle top;

b) an abrading machine base having a horizontal precision-flat top surface and a spindle-circle where the spindle-circle is located on the machine base top surface and the spindle-circle is coincident with the machine base top surface;

c) wherein the three rotary spindles are located with equal spaces between each of them and the spindle-tops axes of rotation intersect the machine base spindle-circle and the spindles are attached to the machine base top surface at those spindle-circle locations by mechanical fasteners at the respective at least three spindle-support mounting legs that are near-equal spaced around the outer periphery of the spindles to form at least three-point supports of the spindles;

d) wherein the spindle-top flat surfaces are precisely co-planar with each other;

e) wherein the spindle-tops' axes of rotation are perpendicular to the spindle-tops' flat surfaces;

f) a floating rotatable abrading platen having a precision-flat annular abrading surface where the platen is supported by and rotationally driven about a platen rotation axis located at the rotational center of the platen by a spherical-action rotation device located at the rotational center of the platen and the spherical-action rotation device restrains the platen in a radial direction relative to the platen axis of rotation;

g) wherein the spherical-action rotation device allows spherical motion of the platen about the platen rotation axis where the platen abrading surface is nominally horizontal;

h) and wherein the platen can be moved vertically along the platen rotation axis by the spherical-action rotation device to allow the platen abrading surface to contact the spindle-top flat surfaces of the three spindles wherein the three spaced spindles provide three-point support of the platen;

i) and wherein the total contact force that is applied to the three spindle-top flat surfaces by contact of the spindle-tops with the platen is controlled through the spherical-action rotation device to allow the total contact force to be evenly distributed to the three individual spindle-tops;

j) wherein equal-thickness workpieces having parallel or near-parallel opposed flat surfaces are attached in flat-surfaced contact with the flat surfaces of the spindle-tops and the platen is moved vertically to allow the platen abrading surface to contact the top surfaces of the workpiece where the total contact force is evenly distributed to the workpieces attached to the three spindle-tops;

k) wherein the spindle-tops having the attached workpieces can be rotated about the spindle axes and the platen can be rotated about the platen rotation axis to single-side abrade the workpieces while the platen abrading surface is in force-controlled abrading pressure with the workpieces.

l) an automated robotic device that can sequentially transport and install selected flat workpieces or flat workpiece carrier devices on the top flat surface on all three spindle-top flat surfaces by picking selected individual workpieces or workpiece carrier devices from a corresponding workpiece or workpiece carrier storage device and can transport it to a select spindle spindle-top where it is positioned concentrically with the rotational center of the rotatable spindle-top wherein the workpiece or workpiece carrier is attached to the spindle-top with vacuum for abrading action on the workpieces by the abrading machine apparatus; and the same automated robotic device sequentially can remove selected flat workpieces or flat workpiece carrier devices from the top flat surface on all three spindle-top flat surfaces by picking the individual workpieces or workpiece carriers from a selected spindle-top and transporting them to a corresponding workpiece or workpiece carrier storage device for storage.

A process of using the automated robotic workpiece loading apparatus is described where workpieces are selectively installed and removed from a three-point fixed-spindle floating-platen abrading machine apparatus comprising:

a) and moving the platen vertically along the platen rotation axis by the spherical-action rotation device to allow the platen abrading surface to contact the spindle-top flat surfaces of the three spindles wherein the three spaced spindles provide three-point support of the platen;

b) wherein the total contact force that is applied to the three spindle-top flat surfaces by contact of the spindle-tops with the platen is controlled through the spherical-action rotation device to allow the total contact force to be evenly distributed to the three individual spindle-tops;

c) providing equal-thickness workpieces having parallel opposed flat surfaces that are attached in flat-surfaced contact with the flat surfaces of the spindle-tops and the platen is moved vertically to allow the platen abrading surface to contact the top surfaces of the workpiece where the total contact force is evenly distributed to the workpieces attached to the three spindle-tops;

d) wherein the spindle-tops having the attached workpieces are rotated about the spindle axes and the platen is rotated about the platen rotation axis to single-side abrade the workpieces while the platen abrading surface is in force-controlled abrading pressure with the workpieces;

e) providing an automated robotic device that sequentially transports and installs selected flat workpieces or flat workpiece carrier devices on the top flat surface on all three spindle-top flat surfaces by picking selected individual workpieces or workpiece carrier devices from a corresponding workpiece or workpiece carrier storage device and transporting it to a select spindle spindle-top where it is positioned concentrically with the rotational center of the rotatable spindle-top wherein the workpiece or workpiece carrier is attached to the spindle-top with vacuum for abrading action on the workpieces by the abrading machine apparatus; and the same automated robotic device sequentially can remove selected flat workpieces or flat workpiece carrier devices from the top flat surface on all three spindle-top flat surfaces by picking the individual workpieces or workpiece carriers from a selected spindle-top and transporting them to a corresponding workpiece or workpiece carrier storage device for storage.

The automated robotic workpiece loading apparatus can also selectively install and remove abrasive disks to and from a platen of a three-point fixed-spindle floating-platen abrading machine assembly comprising:

a) providing three rotary spindles having circular-shaped rotatable flat-surfaced spindle-tops that have a spindle-top axis of rotation at the center of the circular-shaped rotatable flat-surfaced spindle top;

b) providing an abrading machine base having a horizontal precision-flat top surface and a spindle-circle where the spindle-circle is located at the approximate center of the machine base top surface and the spindle-circle is coincident with the machine base top surface;

c) wherein the three rotary spindles are located with equal spaces between each of them and the spindle-tops axes of rotation intersect the machine base spindle-circle and the spindles are attached to the machine base top surface at those spindle-circle locations by mechanical fasteners at the respective at least three spindle-support mounting legs that are near-equal spaced around the outer periphery of the spindles to form at least three-point supports of the spindles;

d) wherein the spindle-top flat surfaces are precisely coplanar with each other;

e) providing a floating rotatable abrading platen having a precision-flat annular abrading surface where the platen is supported by and rotationally driven about a platen rotation axis located at the rotational center of the platen by a spherical-action rotation device located at the rotational center of the platen and the spherical-action rotation device restrains the platen in a radial direction relative to the platen axis of rotation;

f) wherein the spherical-action rotation device allows spherical motion of the platen about the platen rotation axis where the platen abrading surface is nominally horizontal;

g) and wherein the platen can be moved vertically along the platen rotation axis by the spherical-action rotation device to allow the platen abrading surface to contact the spindle-top flat surfaces of the three spindles wherein the three spaced spindles provide three-point support of the platen;

h) providing that the total contact force that is applied to the three spindle-top flat surfaces by contact of the spindle-tops with the platen is controlled through the spherical-action rotation device to allow the total contact force to be evenly distributed to the three individual spindle-tops;

i) wherein equal-thickness workpieces having parallel or near-parallel opposed flat surfaces are attached in flat-surfaced contact with the flat surfaces of the spindle-tops and the platen is moved vertically to allow the platen abrading surface to contact the top surfaces of the workpiece where the total contact force is evenly distributed to the workpieces attached to the three spindle-tops;

j) wherein the spindle-tops having the attached workpieces can be rotated about the spindle axes and the platen can be rotated about the platen rotation axis to single-side abrade the workpieces while the platen abrading surface is in force-controlled abrading pressure with the workpieces;

k) wherein the automated robotic device sequentially can install selected abrasive disks comprising flexible abrasive disks, flexible raised-island abrasive disks, flexible abrasive disks having attached solid abrasive pellets, chemical mechanical planarization resilient disk pads, shallow-island abrasive disks, flat-surfaced slurry abrasive plate disks and non-abrasive cloth or other material pads wherein a selected abrasive disk is attached to the platen flat-surfaced abrading by picking a selected individual abrasive disk from a corresponding abrasive disk storage device and transporting it to the platen abrading surface where it is positioned concentrically with the rotational center of the platen and the flexible abrasive disk is pressed conformably against the abrading surface of the platen wherein the abrasive disk is attached to the platen abrading surface with vacuum for abrading action on the workpieces by the abrading machine apparatus; and the same automated robotic device sequentially removes selected abrasive disk from the flat abrading surface of the platen by picking the abrasive disk from the platen after the abrasive disk attachment vacuum is released and transporting the abrasive disk to an abrasive disk device for storage.

The automated robotic workpiece loading apparatus that can selectively install and remove abrasive disks to and from a platen has a robotic disk carrier apparatus that has a flat-surfaced thin circular-shaped abrasive disk carrier plate and the abrasive disk is loosely attached to the disk carrier plate prior to transport of the disk carrier plate by the robotic apparatus. Also, the abrasive disk carrier plate has a circular-shaped resilient flat-surfaced pad that is attached concentrically to the flat-surfaced carrier plate where the resilient pad has a circumference approximately equal to the circumference of the disk carrier plate and where the abrasive disk is placed in flat contact with the resilient pad and the abrasive disk is loosely attached to the disk carrier plate resilient pad prior to transport of the disk carrier plate by the robotic apparatus.

A process of using the automated robotic workpiece loading apparatus is described where an automated robotic device selectively installs and removes abrasive disks to and from a platen of a three-point fixed-spindle floating-platen abrading machine assembly apparatus comprising: an automated robotic device sequentially installing selected abrasive disks on the platen flat abrading-surface by picking a selected individual abrasive disk from a corresponding abrasive disk storage device and transporting it to the platen abrading-surface; positioning the selected individual abrasive disk concentrically with the rotational center of the platen; attaching the abrasive disk to the platen abrading-surface with vacuum for abrading action on the workpieces by the abrading machine apparatus; and the same automated robotic device sequentially removing a selected abrasive disk from the flat abrading-surface of the platen by picking the abrasive disk from the platen after the abrasive disk attachment vacuum is released and transporting the abrasive disk to an abrasive disk storage device or an abrasive disk storage area.

What is claimed:

1. An at least three-point, fixed-spindle floating-platen abrading machine comprising:

a) at least three rotary spindles having circular rotatable flat-surfaced spindle-tops that each have a spindle-top axis of rotation at the center of a respective rotatable flat-surfaced spindle-top for a respective rotary spindles;

b) an abrading machine base having a horizontal nominally-flat top surface and a spindle-circle where the spindle-circle is coincident with the machine base nominally-flat top surface;

c) wherein the at least three rotary spindles are located with near-equal spacing between the at least three of the rotary spindles and that the at least three spindle-tops' axes of rotation intersect the machine base spindle-circle and the at least three rotary spindles are mechanically attached to the machine base nominally-flat top surface at those respective at least three rotary spindles' spindle-circle locations by respective at least three rotary spindle-support mounting legs that are near-equally spaced around the outer periphery of the rotary spindles to form at least three-point support of the at least three rotary spindles;

d) wherein the at least three spindle-tops' flat surfaces are aligned to be co-planar with each other;

e) wherein the at least three spindle-tops' axes of rotation are perpendicular to the respective spindle-tops' flat surfaces;

f) a floating, rotatable abrading platen having a precision-flat annular abrading-surface that has an annular abrading-surface radial width and an annular abrading-surface inner radius and an annular abrading-surface outer radius and where the abrading platen is supported by and is rotationally driven about an abrading platen rotation axis located at a rotational center of the abrading platen by a spherical-action rotation device located at the rotational center of the abrading platen and where the abrading platen spherical-action rotation device restrains the abrading platen in a radial direction relative to the abrading platen axis of rotation and where the abrading platen axis of rotation is concentric with the machine base spindle-circle;

g) wherein the abrading platen spherical-action rotation device allows spherical motion of the abrading platen about the abrading platen rotational center where the precision-flat annular abrading-surface of the abrading platen that is supported by the abrading platen spherical-action rotation device is nominally horizontal; and h) flexible abrasive disk articles having annular bands of abrasive coated surfaces that have an abrasive coated surface annular band radial width and an abrasive coated surface annular band inner radius and an abrasive coated surface annular band outer radius where a selected flexible abrasive disk is attached in flat conformal contact with an abrading platen precision-flat annular abrading-surface such that the attached abrasive disk is concentric with the abrading platen precision-flat annular abrading-surface wherein the abrading platen precision-flat annular abrading-surface radial width is at least equal to the radial width of the attached flexible abrasive disk abrasive coated annular abrading band and wherein the abrading platen precision-flat annular abrading-surface provides conformal support of the full-abrasive-surface of the flexible abrasive disk abrasive coated surface annular band where the abrading platen precision-flat annular abrading-surface inner radius is less than an inner radius of the attached flexible abrasive disk abrasive coated surface annular band and where an abrading platen precision-flat annular abrading-surface outer radius is greater than the outer radius of the attached flexible abrasive disk abrasive coated surface annular band;

i) wherein each flexible abrasive disk is attached in flat conformal contact with the abrading platen precision-flat annular abrading-surface by disk attachment techniques selected from the group consisting of vacuum disk attachment techniques, mechanical disk attachment techniques and adhesive disk attachment techniques;

j) wherein equal-thickness workpieces having parallel or near-parallel opposed flat workplace top surfaces and flat workpiece bottom surfaces are attached in flat-surfaced contact with the flat surfaces of the respective at least three spindle-tops where the workpiece bottom surfaces contact the flat surfaces of the respective at least three spindle-tops;

k) wherein the abrading platen can be moved vertically along the abrading platen rotation axis by the abrading platen spherical-action rotation device to allow the abrasive surface of the flexible abrasive disk that is attached to the abrading platen precision-flat annular abrading-surface to contact the top surfaces of the workpieces that are attached to the flat surfaces of the respective at least three spindle-tops wherein the at least three rotary spindles provide at least three-point support of the abrading platen; and l) wherein total abrading platen abrading contact force applied to workpieces that are attached to the respective at least three spindle-top flat surfaces by contact of the abrasive surface of the flexible abrasive disk that is attached to the abrading platen precision-flat annular abrading-surface with the top surfaces of the workpieces that are attached to the flat surfaces of the respective at least three spindle-tops is controlled through the abrading platen spherical-action abrading platen rotation device to allow the total abrading platen abrading contact force to be evenly distributed to the workpieces attached to the respective at least three spindle-tops;

m) wherein the at least three spindle-tops having the attached equal-thickness workpieces can be rotated about the respective spindle-tops' rotation axes and the abrading platen having the attached flexible abrasive disk can be rotated about the abrading platen rotation axis to single-side abrade the equal-thickness workpieces that are attached to the flat surfaces of the at least three spindle-tops while the moving abrasive surface of the flexible abrasive disk that is attached to the moving abrading platen precision-flat annular abrading-surface is in force-controlled abrading contact with the top surfaces of the equal-thickness workpieces that are attached to the respective at least three spindle-tops and where the abrading platen precision-flat annular abrading-surface assumes a co-planar alignment with the precisely co-planar flat surfaces of the respective at least three spindle-tops.

2. The machine of claim 1 wherein at least one flat-surfaced circular device is selected from the group consisting of workpiece carriers, abrasive conditioning rings and abrasive disks is attached to the flat surfaces of the at least three spindle-tops where the selected flat-surfaced circular devices are attached to the at least three spindle-tops by attachment systems selected from the group consisting of vacuum attachment, mechanical attachment and adhesive attachment and wherein the attached flat-surfaced circular devices are concentric with the respective spindle-tops.

3. The machine of claim 1 wherein the machine base structural material is selected from the group consisting of granite and epoxy-granite and wherein the machine base structural material is temperature controlled by a temperature-controlled fluid that circulates in fluid passageways internal to the machine base structural materials.

4. The machine of claim 1 wherein the at least three rotary spindles are air bearing rotary spindles.

5. The machine of claim 1 where the at least three rotary spindles have at least three-point support legs with adjustable height on each of the at least three-point support legs and where the at least three support legs are attached to a supporting surface of each rotary spindle and the at least three support legs are positioned around the periphery of the rotary spindle body with near-equal distances between the support legs to form an at least three-point support of the rotary spindle and where each spindle-top flat surface can be aligned to be precisely co-planar with the other spindle-tops' flat surfaces by adjusting the height of the at least three rotary spindle support legs and where mechanical fasteners attach each of the at least three-point rotary spindle support legs to the machine base top surface thereby attaching the at least three rotary spindles to the machine base.

6. The machine of claim 1 wherein the abrading platen flexible abrasive disk articles are selected from the group consisting of: flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, and flexible flat-surfaced metal or polymer disks.

7. The machine of claim 1 where auxiliary rotary spindles in excess of the at least three rotary spindles which are primary rotary spindles are attached to the machine base flat surface and where the auxiliary rotary spindles are each positioned between adjacent primary rotary spindles, and where the auxiliary rotary spindles have circular rotatable flat-surfaced spindle-tops that each have spindle-top axis of rotation at a center of their respective auxiliary rotary spindle spindle-top and where the respective auxiliary rotary spindle spindle-tops' axes of rotation intersect the machine base spindle-circle and where the top surfaces of the rotary spindle respective spindle-tops of the auxiliary rotary spindles are precisely co-planar with the precisely co-planar top surfaces of the spindle-tops of the at least three primary rotary spindles.

8. A process of abrading flat-surfaced workpieces using an at least three-point fixed-spindle floating-platen abrading machine comprising:

a) providing at least three rotary spindles having circular rotatable flat-surfaced spindle-tops that each have a spindle-top axis of rotation at a center of respective rotatable flat-surfaced spindle-tops;

b) providing an abrading machine base having a horizontal nominally-flat top surface and a spindle-circle where the spindle-circle is coincident with the abrading machine base nominally-flat top surface;

c) providing that the at least three rotary spindles with near-equal spaces between three of the rotary spindles and that the at least three spindle-tops' axes of rotation intersect the abrading machine base spindle-circle and the at least three rotary spindles are mechanically attached to the abrading machine base nominally-flat top surface at respective at least three rotary spindles' spindle-circle locations by respective at least three spindle-support mounting legs that are near-equal spaced around the outer periphery of the at least three rotary spindles to form at least three-point support of the at least three rotary spindles;

d) providing the at least three spindle-tops' flat surfaces aligned precisely co-planar with each other;

e) providing the at least three spindle-tops' axes of rotation perpendicular to the respective spindle-tops' flat surfaces;

f) providing a floating, rotatable abrading platen having a precision-flat annular abrading-surface that has an annular abrading-surface radial width and an annular abrading-surface inner radius and an annular abrading-surface outer radius and where the abrading platen is supported by and is rotationally driven about an abrading platen rotation axis located at a rotational center of the abrading platen by a spherical-action rotation device located at the rotational center of the abrading platen and where the abrading platen spherical-action rotation device restrains the rotatable abrading platen in a radial direction relative to the abrading platen axis of rotation and where the abrading platen axis of rotation is concentric with the machine base spindle-circle;

g) wherein the abrading platen spherical-action rotation device allows spherical motion of the abrading platen about the abrading platen rotational center where the precision-flat annular abrading-surface of the abrading platen that is supported by the abrading platen spherical-action rotation device is nominally horizontal; and h) providing flexible abrasive disk articles having annular bands of abrasive coated surfaces that have an abrasive coated surface annular band radial width and an abrasive coated surface annular band inner radius and an abrasive coated surface annular band outer radius, attaching a selected flexible abrasive disk in flat conformal contact with an abrading platen precision-flat annular abrading-surface such that the attached abrasive disk is concentric with the abrading platen precision-flat annular abrading-surface wherein an abrading platen precision-flat annular abrading-surface radial width is at least equal to the radial width of the attached flexible abrasive disk abrasive coated annular abrading band and wherein the abrading platen precision-flat annular abrading-surface provides conformal support of the full-abrasive-surface of the flexible abrasive disk abrasive coated surface annular band where the abrading platen precision-flat annular abrading-surface inner radius is less than the inner radius of the attached flexible abrasive disk abrasive coated surface annular band and where the abrading platen precision-flat annular abrading-surface outer radius is greater than the outer radius of the attached flexible abrasive disk abrasive coated surface annular band;

i) wherein each flexible abrasive disk is attached in flat conformal contact with the abrading platen precision-flat annular abrading-surface by disk attachment techniques comprising vacuum disk attachment techniques, mechanical disk attachment techniques and adhesive disk attachment techniques;

j) wherein equal-thickness workpieces having parallel or near-parallel opposed flat workpiece top surfaces and flat workpiece bottom surfaces are attached in flat-surfaced contact with the flat surfaces of a respective at least three spindle-tops where the workpiece bottom surfaces contact the flat surfaces of the respective at least three spindle-tops;

k) wherein the abrading platen is moved vertically along the abrading platen rotation axis by the abrading platen spherical-action rotation device to allow the abrasive surface of the flexible abrasive disk that is attached to the abrading platen precision-flat annular abrading-surface to contact the top surfaces of the workpieces that are attached to the flat surfaces of the respective at least three spindle-tops wherein the at least three rotary spindles provide at least three-point support of the abrading platen; and l) wherein a total abrading platen abrading contact force is applied to workpieces that are attached to the respective at least three spindle-top flat surfaces by contact of the abrasive surface of the flexible abrasive disk that is attached to the abrading platen precision-flat annular abrading-surface with the top surfaces of the workpieces that are attached to the flat surfaces of the respective at least three spindle-tops is controlled through the abrading platen spherical-action abrading platen rotation device to allow the total abrading platen abrading contact force to be evenly distributed to the workpieces attached to the respective at least three spindle-tops;

m) providing that the at least three spindle-tops having the attached equal-thickness workpieces are rotated about the respective spindle-tops' rotation axes and the abrading platen having the attached flexible abrasive disk is rotated about the abrading platen rotation axis to single-side abrade the equal-thickness workpieces that are attached to the flat surfaces of the at least three spindle-tops while the moving abrasive surface of the flexible abrasive disk that is attached to the moving abrading platen precision-flat annular abrading-surface is in force-controlled abrading contact with the top surfaces of the equal-thickness workpieces that are attached to the respective at least three spindle-tops and where the abrading platen precision-flat annular abrading-surface assumes a co-planar alignment with the precisely co-planar flat surfaces of the respective at least three spindle-tops.

9. The process of claim 8 where flat-surfaced equal-thickness workpieces having top and bottom surfaces are provided where a workpiece top surface is a first workpiece surface and a workpiece bottom surface is a second workpiece surface and where the flat-surfaced equal-thickness workpieces are attached to the at least three spindle-tops, and the first workpiece surfaces are abraded by the flexible abrasive disk article that is attached to the abrading platen precision-flat annular abrading-surface when the second workpiece surfaces are attached to the at least three spindle-tops, and after the first workpiece surface is abraded, the flat-surfaced equal-thickness workpieces are removed from the at least three spindle-tops and the flat-surfaced equal-thickness workpieces are re-attached to the at least three spindle-tops where the abraded first workpiece surfaces are attached to the spindle-tops and the second workpiece surfaces are abraded by the flexible abrasive disk article that is attached to the abrading platen precision-flat annular abrading-surface workpiece.

10. The process of claim 8 wherein the abrading platen flexible abrasive disk articles are selected from the group consisting of: flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, and flexible flat-surfaced metal or polymer disks.

11. The process of claim 8 where the at least three rotary spindles have at least three-point support legs with adjustable height on each of the at least three-point support legs and where the at least three support legs are attached to a supporting surface of each rotary spindle and the at least three support legs are positioned around the periphery of the rotary spindle body with near-equal distances between the support legs to form an at least three-point support of the rotary spindle and where each spindle-top flat surface can be aligned to be precisely co-planar with the other spindle-tops' flat surfaces by adjusting the height of the at least three rotary spindle support legs and where mechanical fasteners attach each of the at least three-point rotary spindle support legs to the machine base top surface thereby attaching the at least three rotary spindles to the machine base.

12. The process of claim 8 where auxiliary rotary spindles in excess of the at least three rotary spindles which are primary rotary spindles are attached to the machine base flat surface and where the auxiliary rotary spindles are each positioned between adjacent primary rotary spindles, and where the auxiliary rotary spindles have circular rotatable flat-surfaced spindle-tops that each have spindle-top axis of rotation at a center of their respective auxiliary rotary spindle spindle-top and where the respective auxiliary rotary spindle spindle-tops' axes of rotation intersect the machine base spindle-circle and where the top surfaces of the rotary spindle respective spindle-tops of the auxiliary rotary spindles are precisely co-planar with the precisely co-planar top surfaces of the spindle-tops of the at least three primary rotary spindles.

13. A process of abrading the top flat surfaces of rotary spindles using an at least three-point fixed-spindle floating-platen abrading machine comprising:

a) providing at least three rotary spindles having circular rotatable flat-surfaced spindle-tops that each have a spindle-top axis of rotation at a center of the respective rotatable flat-surfaced spindle-top;

b) providing an abrading machine base having a horizontal nominally-flat top surface and a spindle-circle where the spindle-circle is coincident with the machine base nominally-flat top surface;

c) providing the at least three rotary spindles at near-equal spacing between the at least three of the rotary spindles and providing the at least three spindle-tops' axes of rotation to intersect the machine base spindle-circle and providing the at least three rotary spindles mechanically attached to the machine base nominally-flat top surface at respective at least three rotary spindles' spindle-circle locations by respective at least three rotary spindle-support mounting legs that are near-equal spaced around the outer periphery of the rotary spindles to form at least three-point support of the at least three rotary spindles;

d) providing that the at least three spindle-tops' flat surfaces as aligned co-planar with each other;

e) providing the at least three spindle-tops' axes of rotation perpendicular to the respective spindle-tops' flat surfaces;

f) providing a floating, rotatable abrading platen having a precision-flat annular abrading-surface that has an annular abrading-surface radial width and an annular abrading-surface inner radius and an annular abrading-surface outer radius and where the abrading platen is supported by and is rotationally driven about an abrading platen rotation axis located at a rotational center of the abrading platen by a spherical-action rotation device located at the rotational center of the abrading platen and where the abrading platen spherical-action rotation device restrains the abrading platen in a radial direction relative to the abrading platen axis of rotation and where the abrading platen axis of rotation is concentric with the machine base spindle-circle;

g) wherein the abrading platen spherical-action rotation device allows spherical motion of the abrading platen about the abrading platen rotational center where the precision-flat annular abrading-surface of the abrading platen that is supported by the abrading platen spherical-action rotation device is nominally horizontal; and h) providing flexible abrasive disk articles having annular bands of abrasive coated surfaces that have an abrasive coated surface annular band radial width and an abrasive coated surface annular band inner radius and an abrasive coated surface annular band outer radius where a selected flexible abrasive disk is attached in flat conformal contact with an abrading platen precision-flat annular abrading-surface such that the attached abrasive disk is concentric with the abrading platen precision-flat annular abrading-surface wherein the abrading platen precision-flat annular abrading-surface radial width is at least equal to the radial width of the attached flexible abrasive disk abrasive coated annular abrading band and wherein the abrading platen precision-flat annular abrading-surface provides conformal support of the full-abrasive-surface of the flexible abrasive disk abrasive coated surface annular band where the abrading platen precision-flat annular abrading-surface inner radius is less than the inner radius of the attached flexible abrasive disk abrasive coated surface annular band and where the abrading platen precision-flat annular abrading-surface outer radius is greater than the outer radius of the attached flexible abrasive disk abrasive coated surface annular band;

i) attaching a selected flexible abrasive disk in flat conformal contact with the abrading platen precision-flat annular abrading-surface by disk attachment system selected from the group consisting of vacuum disk attachment, mechanical disk attachment and adhesive disk attachment;

j) vertically moving the abrading platen along the abrading platen rotation axis by the abrading platen spherical-action rotation device to allow the abrasive surface of the flexible abrasive disk that is attached to the abrading platen precision-flat annular abrading-surface to contact the co-planar flat surfaces of the at least three spindle-tops wherein the at least three rotary spindles provide at least three-point support of the abrading platen;

k) applying a total abrading platen abrading contact force to the at least three spindle-tops' flat surfaces by contact of the abrasive surface of the flexible abrasive disk that is attached to the abrading platen precision-flat annular abrading-surface with the flat surfaces of the at least three spindle-tops is controlled through the abrading platen spherical-action abrading platen rotation device to allow the total abrading platen abrading contact force to be evenly distributed to the respective at least three spindle-tops; and l) rotating the at least three spindle-tops about their respective spindle-tops' rotation axes and rotating the abrading platen having the attached flexible abrasive disk about the abrading platen rotation axis to abrade the co-planar flat surfaces of the at least three spindle-tops while the moving abrasive surface of the flexible abrasive disk that is attached to the moving abrading platen precision-flat annular abrading-surface is in force-controlled abrading contact with the co-planar flat surfaces of the at least three spindle-tops and where the abrading platen precision-flat annular abrading-surface assumes a co-planar alignment with the precisely co-planar flat surfaces of respective at least three spindle-tops.

14. The process of claim 13 where the at least three rotary spindles have at least three-point support legs with adjustable height on each of the at least three-point support legs and where the at least three support legs are attached to a supporting surface of each rotary spindle and the at least three support legs are positioned around the periphery of the rotary spindle body with near-equal distances between the support legs to form an at least three-point support of the rotary spindle and where each spindle-top flat surface can be aligned to be precisely co-planar with the other spindle-tops' flat surfaces by adjusting the height of the at least three rotary spindle support legs and where mechanical fasteners attach each of the at least three-point rotary spindle support legs to the machine base top surface thereby attaching the at least three rotary spindles to the machine base.

15. A process of abrading a non-precision-flat annular abrading-surface of a floating, rotatable abrading platen on an at least three-point fixed-spindle floating-platen abrading machine to recondition or reestablish the planar precision-flatness of the abrading platen annular abrading-surface comprising:

a) providing at least three rotary spindles having circular rotatable flat-surfaced spindle-tops that each have a spindle-top axis of rotation at a center of a respective rotatable flat-surfaced spindle-top;

b) providing an abrading machine base having a horizontal nominally-flat top surface and a spindle-circle where the spindle-circle is coincident with the machine base nominally-flat top surface;

c) providing the at least three rotary spindles with near-equal spaces between three of the at least three rotary spindles and causing the at least three spindle-tops' axes of rotation to intersect the machine base spindle-circle, mechanically attaching the at least three rotary spindles to the machine base nominally-flat top surface at the respective at least three rotary spindles' spindle-circle locations by respective at least three rotary spindle-support mounting legs that are near-equally spaced around the outer periphery of the rotary spindles to form an at least three-point support of the at least three rotary spindles;

d) aligning the at least three spindle-tops' flat surfaces to be precisely co-planar with each other;

e) providing the at least three spindle-tops' axes of rotation as perpendicular to the respective spindle-tops' flat surfaces;

f) providing a floating, rotatable abrading platen having a non-precision-flat annular abrading-surface that has an annular abrading-surface radial width and an annular abrading-surface inner radius and an annular abrading-surface outer radius and the abrading platen is supported by and is rotationally driven about an abrading platen rotation axis located at a rotational center of the abrading platen by a spherical-action rotation device located at a rotational center of the abrading platen and where the abrading platen spherical-action rotation device restrains the abrading platen in a radial direction relative to the abrading platen axis of rotation and where the abrading platen axis of rotation is concentric with the machine base spindle-circle;

g) wherein the abrading platen spherical-action rotation device allows spherical motion of the abrading platen about the abrading platen rotational center where the non-precision-flat annular abrading-surface of the abrading platen that is supported by the abrading platen spherical-action rotation device is nominally horizontal; and h) attaching abrasive disk components having abrasive surfaces concentric to the circular flat surfaces of at least three spindle-tops wherein the spindle-top abrasive disk components have abrasive disk component outer diameters that are larger than the radial width of the non-precision-flat annular abrading-surface of the abrading platen wherein outer diameter portions of the spindle-top disk-type abrasive components extend radially over both the abrading platen non-precision-flat annular abrading-surface inner annular radius and the abrading platen non-precision-flat annular abrading-surface outer annular radius;

i) moving the abrading platen vertically along the abrading platen rotation axis by the abrading platen spherical-action rotation device to allow the abrading platen non-precision-flat annular abrading-surface to contact the abrasive surfaces of the spindle-top abrasive disk components wherein the at least three rotary spindles having the attached disk-type abrasive components provide at least three-point support of the abrading platen; and j) applying a total abrading platen abrading contact force to the abrasive surface of the abrasive disk components that are attached to the at least three spindle-top flat surfaces by contact of the non-precision-flat annular abrading-surface of the abrading platen with the abrasive surfaces of the abrasive disk components that are attached to the flat surfaces of the respective at least three spindle-tops is controlled through the abrading platen spherical-action rotation device to allow the total abrading platen abrading contact force to be evenly distributed to respective at least three rotary spindles' abrasive disk components;

k) rotating the at least three spindle-tops having the attached abrasive disk components about the respective spindle-tops' rotation axes of rotation and rotating the abrading platen having the non-precision-flat annular abrading-surface about the abrading platen rotation axis to abrade the non-precision-flat annular abrading-surface of the abrading platen with the spindle-top disk-type abrasive components while the moving abrading platen non-precision-flat annular abrading-surface is in force-controlled abrading contact with the abrasive surfaces of the spindle-top abrasive disk components and where the non-precision-flat annular abrading-surface of the abrading platen develops a precision-flat annular abrading-surface due to the at least three spindle-tops abrasive disk components' abrading action on the abrading platen abrading-surface and where the abrading platen precision-flat annular abrading-surface assumes a co-planar alignment with the precisely co-planar flat surfaces of the at least three spindle-tops.

16. The process of claim 15 where the non-precision-flat annular abrading-surface of the abrading platen is abraded to recondition or reestablish planar precision-flatness of the non-precision-flat annular abrading platen annular abrading-surface using abrasive conditioning ring spindle-top abrasive components, the process comprising:

a) attaching abrasive conditioning ring abrasive components concentric to the circular flat surfaces of the at least three spindle-tops where the spindle-top abrasive conditioning rings have an abrasive coated annular flat surface that has an abrasive conditioning ring abrasive coated annular outer diameter that is larger than the radial width of the annular abrading-surface of the abrading platen and wherein outer diameter portions of the abrasive conditioning rings' annular abrasive flat surface extend radially over both the abrading platen non-precision-flat annular abrading-surface inner annular radius and the abrading platen non-precision-flat annular abrading-surface outer annular radius; and b) attaching the abrasive conditioning rings to the at least three spindle-tops where the abrasive conditioning ring annular abrasive flat surfaces have equal-heights above each respective spindle-top;

c) moving the abrading platen vertically along the abrading platen rotation axis by the abrading platen spherical-action rotation device to allow the abrading platen non-precision-flat annular abrading-surface to contact the abrasive flat surfaces of the spindle-top abrasive conditioning rings wherein the at least three rotary spindles having the attached spindle-top abrasive conditioning rings provide at least three-point support of the abrading platen;

d) applying a total abrading platen abrading contact force to the abrasive flat surfaces of the conditioning rings that are attached to the at least three spindle-top flat surfaces by controlling contact of the non-precision-flat annular abrading-surface of the abrading platen with the abrasive flat surfaces of the abrasive conditioning rings through the abrading platen spherical-action rotation device to allow the total abrading platen abrading contact force to be evenly distributed to the respective at least three rotary spindles' abrasive conditioning rings; and e) rotating the at least three spindle-tops having the attached abrasive conditioning rings about the respective at least three spindle-tops axes of rotation and rotating the abrading platen about the abrading platen rotation axis to abrade the non-precision-flat annular abrading-surface of the abrading platen with the abrasive conditioning rings' abrasive flat surfaces while the moving abrading platen non-precision-flat annular abrading-surface is in force-controlled abrading contact with the abrasive conditioning rings' abrasive flat surfaces and where the non-precision-flat annular abrading-surface of the abrading platen develops a precision-flat annular abrading-surface due to the at least three spindle-tops' abrasive conditioning rings abrasive flat surfaces abrading action on the abrading platen abrading-surface and where the abrading platen precision-flat annular abrading-surface assumes a co-planar alignment with the precisely co-planar flat surfaces of the at least three spindle-tops.

17. A process of abrading a non-precision-flat annular abrasive surface of an abrasive disk that is attached to a precision-flat annular abrading-surface of a floating, rotatable abrading platen on an at least three-point fixed-spindle floating-platen abrading machine to recondition or reestablish the planar precision-flatness of the flat annular abrasive surface of the abrasive disk, the process comprising:

a) providing at least three rotary spindles having circular rotatable flat-surfaced spindle-tops that each have a spindle-top axis of rotation at a center of respective rotatable flat-surfaced spindle-tops;

b) providing an abrading machine base having a horizontal nominally-flat top surface and a spindle-circle where the spindle-circle is coincident with the machine base nominally-flat top surface;

c) providing the at least three rotary spindles with near-equal spacing between three of the at least three rotary spindles and providing that the at least three spindle-tops' axes of rotation intersect the machine base spindle-circle and the at least three rotary spindles are mechanically attached to the machine base nominally-flat top surface at the respective at least three rotary spindles' spindle-circle locations by respective at least three rotary spindle-support mounting legs that are near-equally spaced around the outer periphery of the rotary spindles to form at least three-point support of the at least three rotary spindles;

d) providing alignment to the at least three spindle-tops' flat surfaces to be precisely co-planar with each other;

e) providing the at least three spindle-tops' axes of rotation as perpendicular to the respective spindle-tops' flat surfaces;

f) providing a floating, rotatable abrading platen having a precision-flat annular abrading-surface that has an annular abrading-surface radial width and an annular abrading-surface, inner radius and an annular abrading-surface outer radius and where the abrading platen is supported by and is rotationally driven about an abrading platen rotation axis located at a rotational center of the abrading platen by a spherical-action rotation device located at the rotational center of the abrading platen and where the abrading platen spherical-action rotation device restrains the abrading platen in a radial direction relative to the abrading platen axis of rotation and where the abrading platen axis of rotation is concentric with the machine base spindle-circle;

g) wherein the abrading platen spherical-action rotation device allows spherical motion of the abrading platen about the abrading platen rotational center where the precision-flat annular abrading-surface of the abrading platen that is supported by the abrading platen spherical-action rotation device is nominally horizontal; and h) providing flexible abrasive disk articles having non-precision-flat annular abrasive surfaces that have an abrasive surface annular radial width and an abrasive surface annular inner radius and an abrasive surface annular outer radius, and attaching a flexible abrasive disk in flat conformal contact with an abrading platen precision-flat annular abrading-surface such that the attached abrasive disk is concentric with the abrading platen precision-flat annular abrading-surface wherein the abrading platen precision-flat annular abrading-surface radial width is at least equal to the radial width of the attached flexible abrasive disk non-precision-flat annular abrasive surface and wherein the abrading platen precision-flat annular abrading-surface provides conformal support of the full-abrasive-surface of the flexible abrasive disk non-precision-flat annular abrasive surface where the abrading platen precision-flat annular abrading-surface inner radius is less than the inner radius of the attached flexible abrasive disk non-precision-flat annular abrasive surface and where the abrading platen precision-flat annular abrading-surface outer radius is greater than the outer radius of the attached flexible abrasive disk non-precision-flat annular abrasive surface;

i) attaching each flexible abrasive disk in flat conformal contact with the abrading platen precision-flat annular abrading-surface by disk attachment systems selected from the group consisting of vacuum disk attachment, mechanical disk attachment and adhesive disk attachment;

j) attaching abrasive disk components having abrasive surfaces concentric to the circular flat surfaces of at least three spindle-tops wherein the spindle-top abrasive disk components have abrasive disk component outer diameters that are larger than the radial width of the non-precision-flat annular abrasive surface of the flexible disk that is attached to the abrading platen precision-flat annular abrading-surface wherein outer diameter portions of the spindle-top abrasive disk components extend radially over both the abrasive disk's non-precision-flat annular abrasive surface inner radius and the abrasive disk's non-precision-flat annular abrasive surface outer radius;

k) moving the abrading platen vertically along the abrading platen rotation axis by the abrading platen spherical-action rotation device to allow the flexible abrasive disk non-precision-flat annular abrasive surface to contact the abrasive surfaces of the spindle-top disk-type abrasive components wherein the at least three rotary spindles having the attached spindle-top disk-type abrasive components provide at least three-point support of the abrading platen;

l) applying a total abrading platen abrading contact force to the abrasive surface of the spindle-top disk-type abrasive components by contact of the flexible abrasive disk non-precision-flat annular abrasive surface with the abrasive surfaces of the disk-type abrasive components that are attached to the flat surfaces of the respective at least three spindle-tops that is controlled through the abrading platen spherical-action abrading platen rotation device to allow the total abrading platen abrading contact force to be evenly distributed to the respective at least three rotary spindles' spindle-top disk-type abrasive components; and m) rotating the at least three spindle-tops having the attached disk-type abrasive components about the respective spindle-tops' rotation axes of rotation and rotating the abrading platen having the attached flexible abrasive disk with the non-precision-flat annular abrasive surface about the abrading platen rotation axis to abrade the non-precision-flat annular abrasive surface of the flexible abrasive disk with the spindle-top disk-type abrasive components while the moving non-precision-flat annular abrasive surface of the flexible abrasive disk that is attached to the moving abrading platen is in force-controlled abrading contact with the abrasive surfaces of the spindle-top disk-type abrasive components and where the non-precision-flat annular abrasive surface of the flexible abrasive disk develops a precision-flat annular abrasive surface due to the at least three spindle-tops disk-type abrasive components' abrading action on the flexible abrasive disk annular abrasive surface and where the abrading platen precision-flat annular abrading-surface assumes a co-planar alignment with the precisely co-planar flat surfaces of the at least three spindle-tops.

18. The process of claim 17 where the non-precision-flat abrasive disk annular abrasive surface of an abrasive disk that is attached to a precision-flat annular abrading platen abrading-surface is abraded to recondition or reestablish planar precision-flatness of the annular abrasive surface of the non-precision-flat abrasive disk using abrasive conditioning rings types of abrasive components comprising:

a) attaching abrasive conditioning ring abrasive components concentric to the circular flat surfaces of at least three spindle-tops where the spindle-top abrasive conditioning rings have an abrasive coated annular flat surface that has an abrasive conditioning ring abrasive coated annular outer diameter that is larger than the radial width of the abrasive disk non-precision-flat annular abrasive surface and wherein outer diameter portions of the abrasive conditioning rings' annular abrasive flat surface extend radially over both the abrasive disk non-precision-flat annular abrasive surface inner annular radius and the abrasive disk non-precision-flat annular abrasive surface outer annular radius; and b) attaching the abrasive conditioning rings to the at least three spindle-tops where the abrasive conditioning ring annular abrasive flat surfaces have equal-heights above each respective spindle-top;

c) moving the abrading platen vertically along the abrading platen rotation axis by the abrading platen spherical-action rotation device to allow the flexible abrasive disk non-precision-flat annular abrasive surface to contact the abrasive flat surfaces of the spindle-top abrasive conditioning rings wherein the at least three rotary spindles having the attached spindle-top abrasive conditioning rings provide at least three-point support of the abrading platen;

d) applying a total abrading platen abrading contact force to the abrasive flat surface of the abrasive conditioning rings abrasive components that are attached to the at least three spindle-top flat surfaces by contact of the non-precision-flat annular abrasive surface of the flexible abrasive disk with the abrasive flat surfaces of the abrasive conditioning rings is controlled through the abrading platen spherical-action rotation device to allow the total abrading platen abrading contact force to be evenly distributed to the respective at least three rotary spindles' abrasive conditioning rings; and e) rotating the at least three spindle-tops having the attached abrasive conditioning rings about the respective at least three spindle-tops axes of rotation and rotating the abrading platen about the abrading platen rotation axis to abrade the non-precision-flat annular abrasive surface of the flexible abrasive disk with the abrasive conditioning rings' abrasive flat surfaces while the moving non-precision-flat annular abrasive surface of the abrasive disk that is attached to the moving abrading platen is in force-controlled abrading contact with the abrasive conditioning rings abrasive flat surfaces and where the non-precision-flat abrasive disk annular abrasive surface develops a precision-flat annular abrasive surface due to the at least three spindle-tops' abrasive conditioning rings abrasive flat surfaces abrading action on the flexible abrasive disk annular abrasive surface and where the abrading platen precision-flat annular abrading-surface assumes a co-planar alignment with the precisely co-planar flat surfaces of the at least three spindle-tops.

19. The process of claim 17 where the at least three rotary spindles have at least three-point support legs with adjustable height on each of the at least three-point support legs and where the at least three support legs are attached to a supporting surface of each rotary spindle and the at least three support legs are positioned around the periphery of the rotary spindle body with near-equal distances between the support legs to form an at least three-point support of the rotary spindle and where each spindle-top flat surface can be aligned to be precisely co-planar with the other spindle-tops' flat surfaces by adjusting the height of the at least three rotary spindle support legs and where mechanical fasteners attach each of the at least three-point rotary spindle support legs to the machine base top surface thereby attaching the at least three rotary spindles to the machine base.

20. The process of claim 17 wherein the abrading platen flexible abrasive disk articles are selected from the group consisting of: flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, and flexible flat-surfaced metal or polymer disks.

* * * * *